US012479613B2

(12) United States Patent
Hamano et al.

(10) Patent No.: US 12,479,613 B2
(45) Date of Patent: Nov. 25, 2025

(54) BINDING FACILITY, WIRE FEEDING MECHANISM AND BINDING MACHINE

(71) Applicant: MAX CO., LTD., Tokyo (JP)

(72) Inventors: Terufumi Hamano, Tokyo (JP); Kenichi Arai, Tokyo (JP); Yousei Nodaguchi, Tokyo (JP); Shigeki Shindou, Tokyo (JP)

(73) Assignee: Max Co., Ltd., Tokyo (JP)

( * ) Notice: Subject to any disclaimer, the term of this patent is extended or adjusted under 35 U.S.C. 154(b) by 642 days.

(21) Appl. No.: 17/493,537

(22) Filed: Oct. 4, 2021

(65) Prior Publication Data

US 2022/0106067 A1 Apr. 7, 2022

(30) Foreign Application Priority Data

| | | |
|---|---|---|
| Oct. 5, 2020 | (JP) | 2020-168577 |
| Oct. 5, 2020 | (JP) | 2020-168578 |
| Feb. 19, 2021 | (JP) | 2021-025686 |
| Jun. 2, 2021 | (JP) | 2021-093025 |

(51) Int. Cl.
*B65B 13/04* (2006.01)
*B65B 13/18* (2006.01)

(52) U.S. Cl.
CPC ..... *B65B 13/04* (2013.01); *B65B 13/186* (2013.01)

(58) Field of Classification Search
CPC ..... B65B 13/04; B65B 13/06; B65B 13/184; B65B 13/186; B65B 13/20; B65B 27/10; E04G 21/123
See application file for complete search history.

(56) References Cited

U.S. PATENT DOCUMENTS

| | | | | |
|---|---|---|---|---|
| 5,682,927 | A | 11/1997 | Takahashi et al. | |
| 5,826,629 | A | 10/1998 | West | |
| 6,502,373 | B1 * | 1/2003 | Tipton | B65B 13/20 53/529 |
| 2005/0211111 | A1 * | 9/2005 | Ropers | B65B 59/04 100/29 |
| 2008/0006341 | A1 | 1/2008 | Kusakari et al. | |
| 2009/0223388 | A1 * | 9/2009 | Doyle | B65B 13/06 100/1 |
| 2014/0306054 | A1 * | 10/2014 | Termanas | B65B 13/18 242/615.3 |

(Continued)

FOREIGN PATENT DOCUMENTS

| | | | |
|---|---|---|---|
| CN | 2652552 | Y | 11/2004 |
| CN | 107165418 | A | 9/2017 |

(Continued)

OTHER PUBLICATIONS

English translation of CN 107165418 A (6 pages), retrieved in Nov. 2024. (Year: 2024).*

(Continued)

*Primary Examiner* — Jimmy T Nguyen
(74) *Attorney, Agent, or Firm* — Banner & Witcoff, Ltd.

(57) ABSTRACT

A binding facility includes: a binding mechanism configured to bind a binding target with a plurality of wires; a reel accommodation part in which a plurality of reels each having one wire wound thereon are accommodated; and a wire feeding mechanism configured to feed each wire from the plurality of reels accommodated in the reel accommodation part to the binding mechanism.

7 Claims, 72 Drawing Sheets

(56) References Cited

U.S. PATENT DOCUMENTS

| | | | | |
|---|---|---|---|---|
| 2015/0272009 | A1* | 10/2015 | Adams | A01F 15/0825 100/17 |
| 2017/0218631 | A1 | 8/2017 | Matsuno | |
| 2018/0187431 | A1 | 7/2018 | Itagaki et al. | |
| 2019/0292799 | A1 | 9/2019 | Itagaki et al. | |
| 2020/0139657 | A1* | 5/2020 | Termanas | B65B 57/10 |
| 2020/0149279 | A1 | 5/2020 | Matsuno | |
| 2020/0290109 | A1 | 9/2020 | Yoshida et al. | |
| 2021/0387246 | A1 | 12/2021 | Kasahara et al. | |
| 2023/0166319 | A1 | 6/2023 | Yoshida et al. | |

FOREIGN PATENT DOCUMENTS

| | | | | |
|---|---|---|---|---|
| EP | 3327223 | A1 | 5/2018 | |
| EP | 3427882 | A1 | 1/2019 | |
| EP | 3696344 | A1 * | 8/2020 | B21F 15/04 |
| JP | S51-100897 | A | 9/1976 | |
| JP | H08-034405 | A | 2/1996 | |
| JP | 2006-193979 | A | 7/2006 | |
| JP | 2009-275487 | A | 11/2009 | |
| JP | 2013-035052 | A | 2/2013 | |
| JP | 2017-132003 | A | 8/2017 | |
| JP | 2018-109299 | A | 7/2018 | |
| JP | 2020-147298 | A | 9/2020 | |
| WO | 95-005313 | A1 | 2/1995 | |
| WO | 2000-036249 | A1 | 6/2000 | |

OTHER PUBLICATIONS

Extended European Search Report for EP Application No. 21200703.3 dated Mar. 3, 2022. (8pp).

Jul. 23, 2024—(JP) Office Action—App 2021-025686.

Apr. 23, 2024—(EP) Office Action—EP App 21200703.3.

* cited by examiner

BINDING FACILITY, WIRE FEEDING MECHANISM AND BINDING MACHINE

CROSS-REFERENCE TO RELATED APPLICATIONS

This application is based upon and claims the benefit of priority from prior Japanese patent application No. 2020-168577, filed on Oct. 5, 2020, Japanese patent application No. 2020-168578, filed on Oct. 5, 2020, Japanese patent application No. 2021-025686, filed on Feb. 19, 2021, and Japanese patent application No. 2021-093025, filed on Jun. 2, 2021, the entire contents of which are incorporated herein by reference.

TECHNICAL FIELD

The present invention relates to a binding facility configured to bind a binding target such as a reinforcing bar with a wire, a wire feeding mechanism configured to feed a wire, and a binding machine.

BACKGROUND ART

For concrete buildings, reinforcing bars are used so as to improve strength. The reinforcing bars are bound with wires so that the reinforcing bars do not deviate from predetermined positions during concrete placement.

In the related art, suggested is a binding machine referred to as a reinforcing bar binding machine that an operator holds and uses with a hand and is configured to wind a wire on two or more reinforcing bars and to twist the wire wound on the reinforcing bars, thereby binding the two or more reinforcing bars with the wire (for example, refer to JP-A-H08-34405).

In addition, suggested is a technology that is applied to a facility apparatus where a reinforcing bar binding machine is installed and used (for example, refer to JP-A-2013-35052).

There are various types of methods of binding reinforcing bars by a reinforcing bar binding machine. However, in the facility apparatus and a wire feeding mechanism, it is not possible to feed the wire in an appropriate method, according to the binding method in the reinforcing bar binding machine.

An object of the present invention is to provide a binding facility capable of feeding a wire by an appropriate method and a wire feeding mechanism configured to feed a wire.

Further, in the facility apparatus where the reinforcing bar binding machine is used, the reinforcing bar binding machine is moved to a binding-possible position and is retreated from the binding-possible position by movement in an upper and lower direction or the like with respect to the reinforcing bar that is a binding target. In response to such movement of the reinforcing bar binding machine, it is necessary to be able to guide a wire to a wire feeding unit provided to the reinforcing bar binding machine.

Another object of the present invention is to provide a binding facility capable of guiding a wire to a binding mechanism of a reinforcing bar binding machine and the like.

Furthermore, in a configuration where the binding machine is applied to the facility apparatus, since the reinforcing bars are bound from below, the binding machine is always used upward oriented. For this reason, foreign matters attached on the reinforcing bars, shavings generated as a result of wires rubbing, and foreign matters such as carelessly cut wires are likely to enter the binding machine. In addition, also in a case of a binding machine that is held and used with a hand, foreign matters generated inside the binding machine, such as shavings generated as a result of wires rubbing and carelessly cut wires, are contained. The foreign matters accumulated in the binding machine may cause a malfunction.

Another object of the present invention is to provide a binding facility and a binding machine capable of discharging foreign matters inside the binding machine to an outside.

SUMMARY

According to an aspect of the invention, there is provided a binding facility comprising: a binding mechanism configured to bind a binding target with a plurality of wires; a reel accommodation part in which a plurality of reels each having one wire wound thereon are accommodated; and a wire feeding mechanism configured to feed each wire from the plurality of reels accommodated in the reel accommodation part to the binding mechanism.

According to an aspect of the invention, there is also provided a binding facility comprising: a binding mechanism configured to bind a binding target with a wire; a wire pullback mechanism configured to feed the wire fed in a first direction and wound around the binding target by the binding mechanism in a second direction opposite to the first direction to wind the wire on the binding target; a reel accommodation part in which a reel having the wire wound thereon is accommodated; and a wire feeding mechanism configured to feed the wire from the reel accommodated in the reel accommodation part to the binding mechanism, wherein the wire feeding mechanism includes a wire pullout mechanism configured to pull out the wire from the reel, and wherein the wire pullout mechanism is provided between the wire pullback mechanism and the reel.

According to an aspect of the invention, there is further provided a wire feeding mechanism comprising: a wire pullout mechanism configured to pull out a wire from a reel on which the wire is wound, wherein the wire pullout mechanism is configured to pull out the wire from the reel, according to a surplus of the wire on a feeding path of the wire pulled out from the reel.

DESCRIPTION OF EMBODIMENTS

Hereinafter, embodiments of the binding facility and the wire feeding mechanism of the invention and the reinforcing bar binding machine as embodiments of the binding machine of the invention will be described with reference to the drawings.

<Configuration Example of Binding Facility of First Embodiment>

Figure 1A:
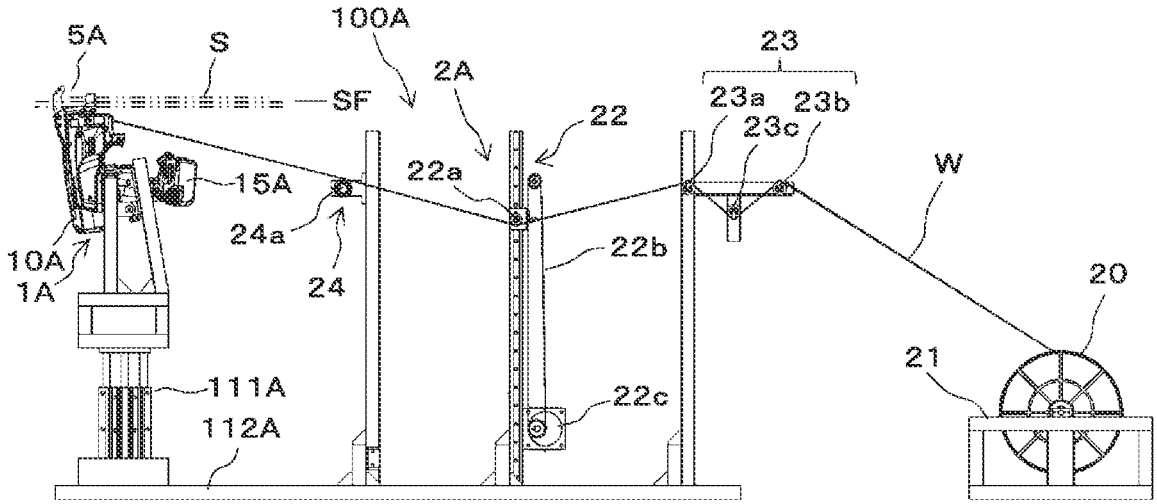
FIG. 1A is a side view showing an example of a binding facility according to a first embodiment.
Figure 1B:
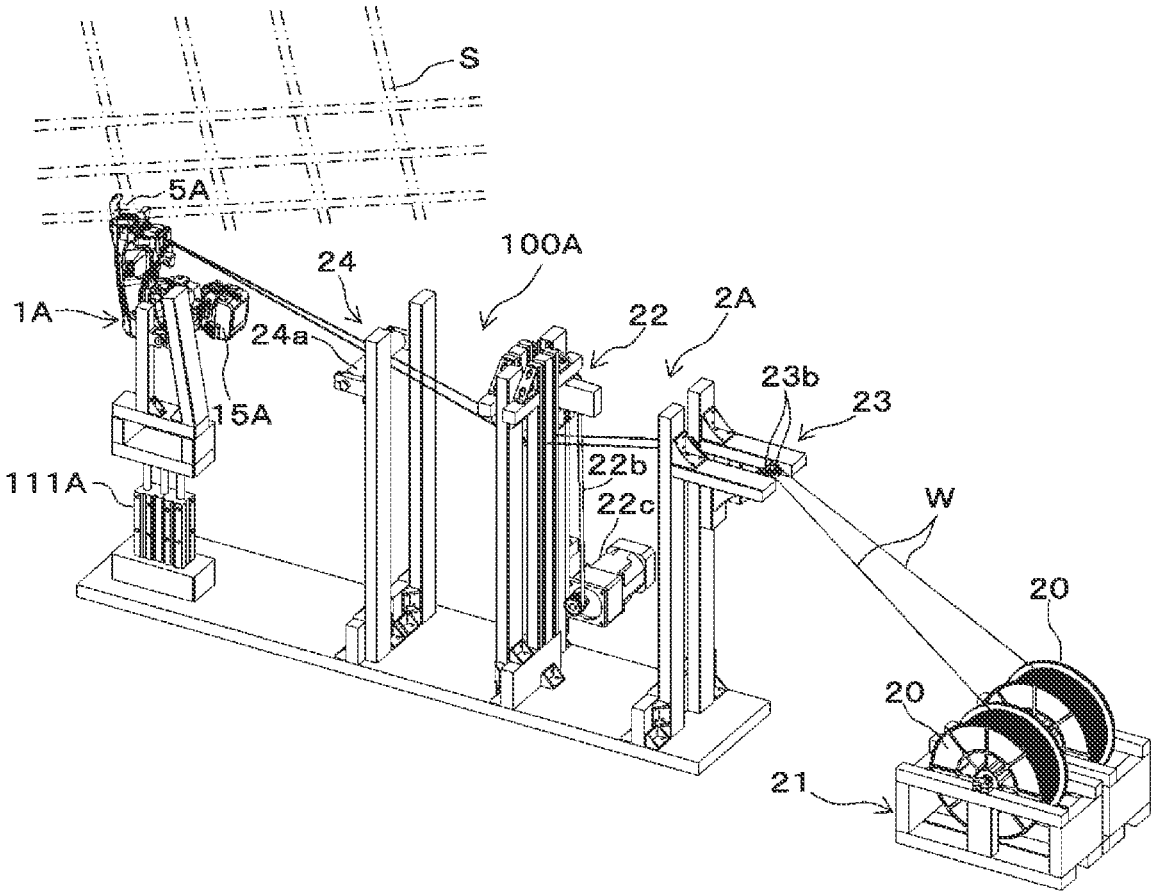
FIG. 1B is a perspective view showing the example of the binding facility according to the first embodiment.
Figure 1C:
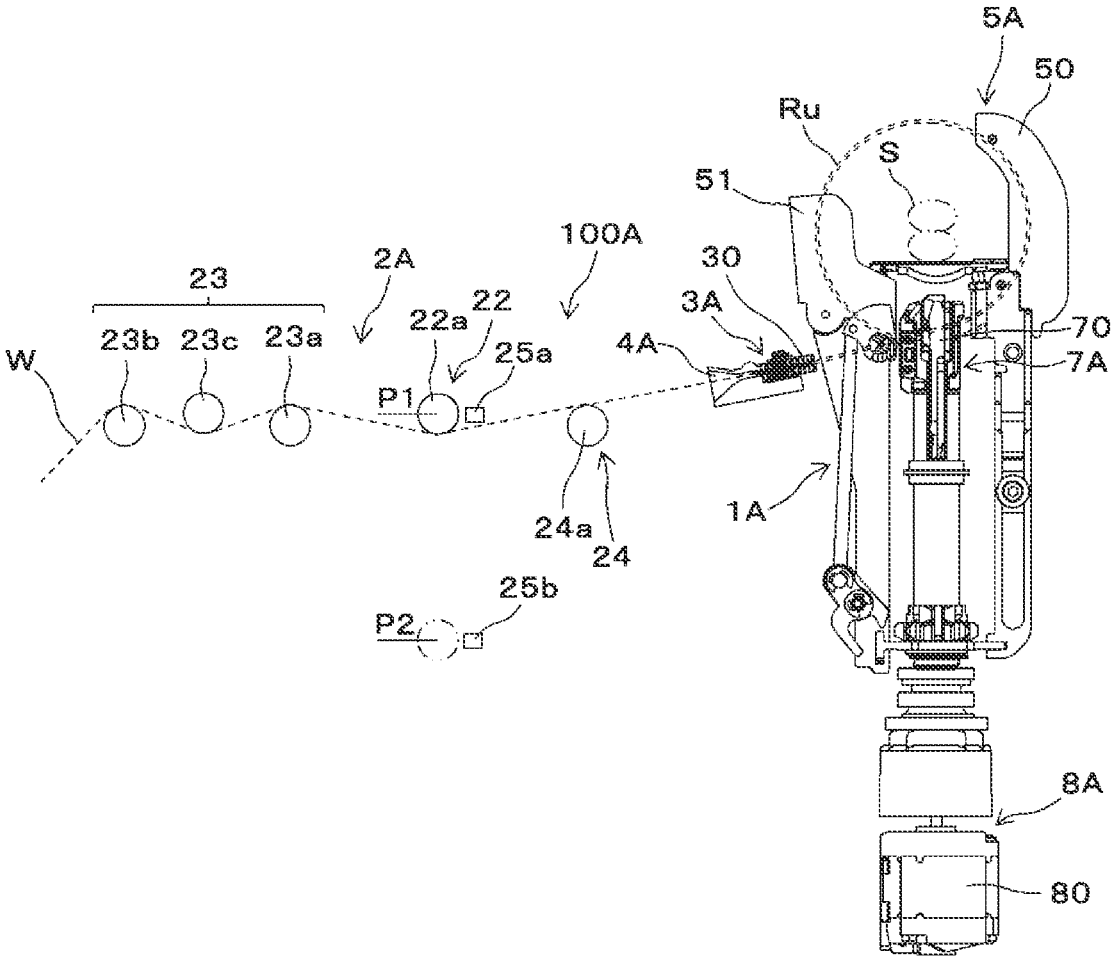
FIG. 1C is a side view of main parts showing the example of the binding facility according to the first embodiment.
Figure 1D:
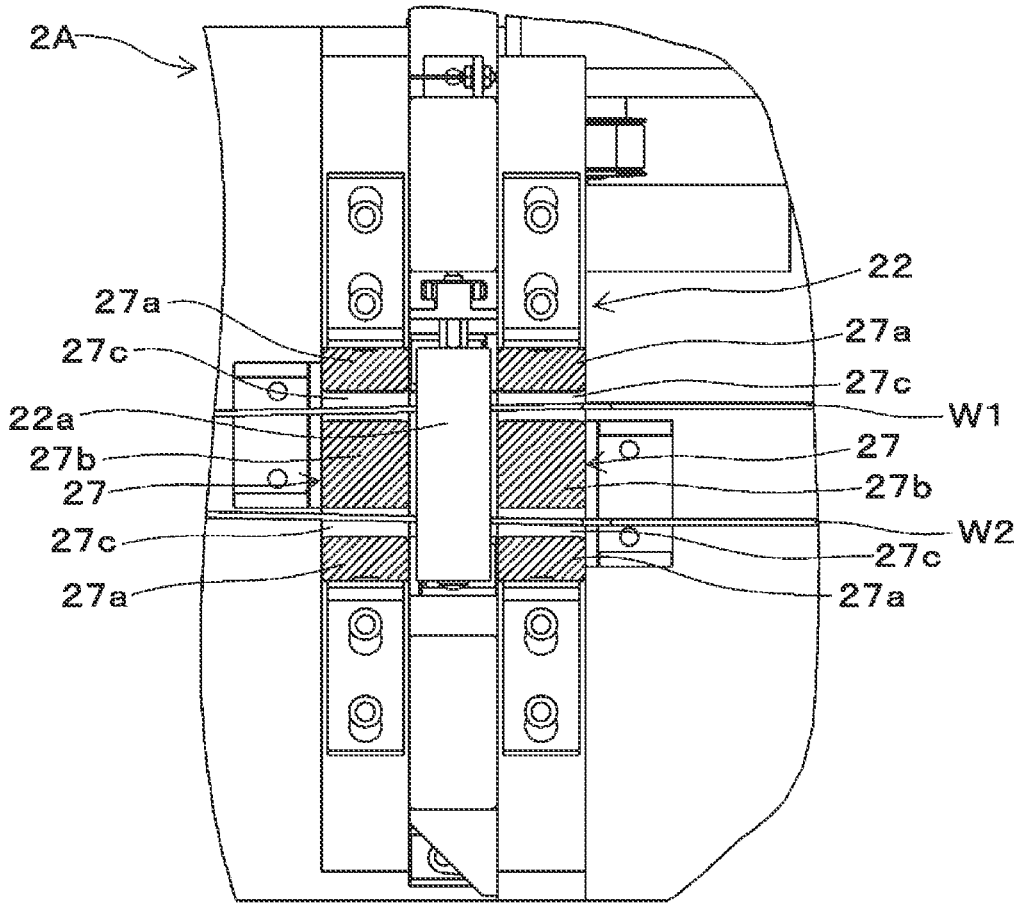
FIG. 1D is a plan sectional view of main parts showing the example of the binding facility according to the first embodiment.
Figure 1E:
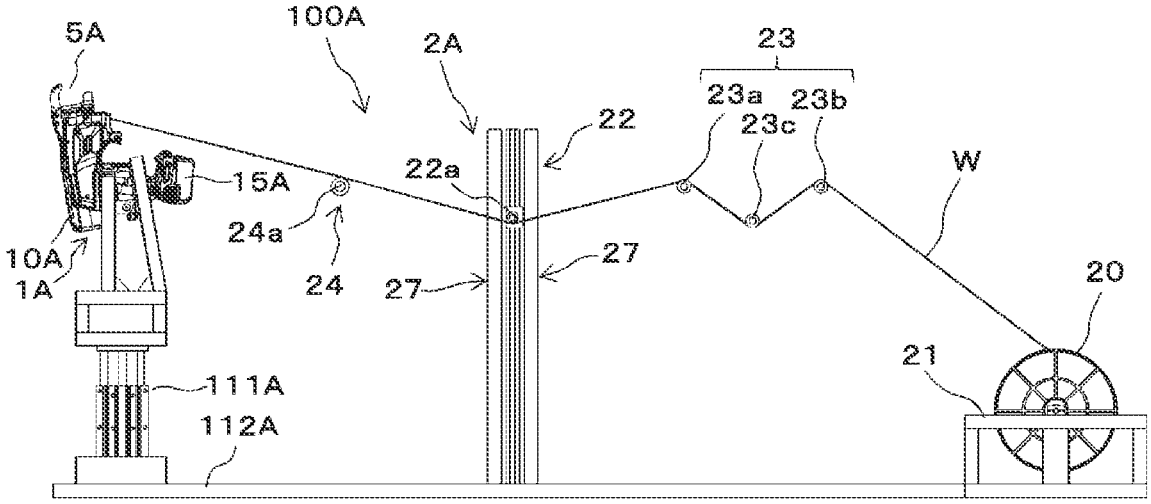
FIG. 1E is a side view of main parts showing the example of the binding facility according to the first embodiment.

FIG. 1A is a side view showing an example of a binding facility according to a first embodiment, FIG. 1B is a perspective view showing the example of the binding facility according to the first embodiment, FIG. 1C is a side view of main parts showing the example of the binding facility according to the first embodiment, FIG. 1D is a plan sectional view of main parts showing the example of the binding facility according to the first embodiment, and FIG. 1E is a side view of main parts showing the example of the binding facility according to the first embodiment.

A binding facility 100A of the first embodiment includes a reinforcing bar binding machine 1A configured to bind reinforcing bars S, which are a binding target, with a wire W, and a wire feeding mechanism 2A configured to feed the wire W to the reinforcing bar binding machine 1A. The reinforcing bar binding machine 1A is attached to an elevation mechanism 111A and supported on a base part 112A so as to be able to move (move up and down) in an upper and lower direction, which is a direction intersecting with an arrangement surface SF of the reinforcing bars S. Thereby, the reinforcing bar binding machine 1A is configured to be movable with respect to the wire feeding mechanism 2A supported on the base part 112A.

Figure 2:
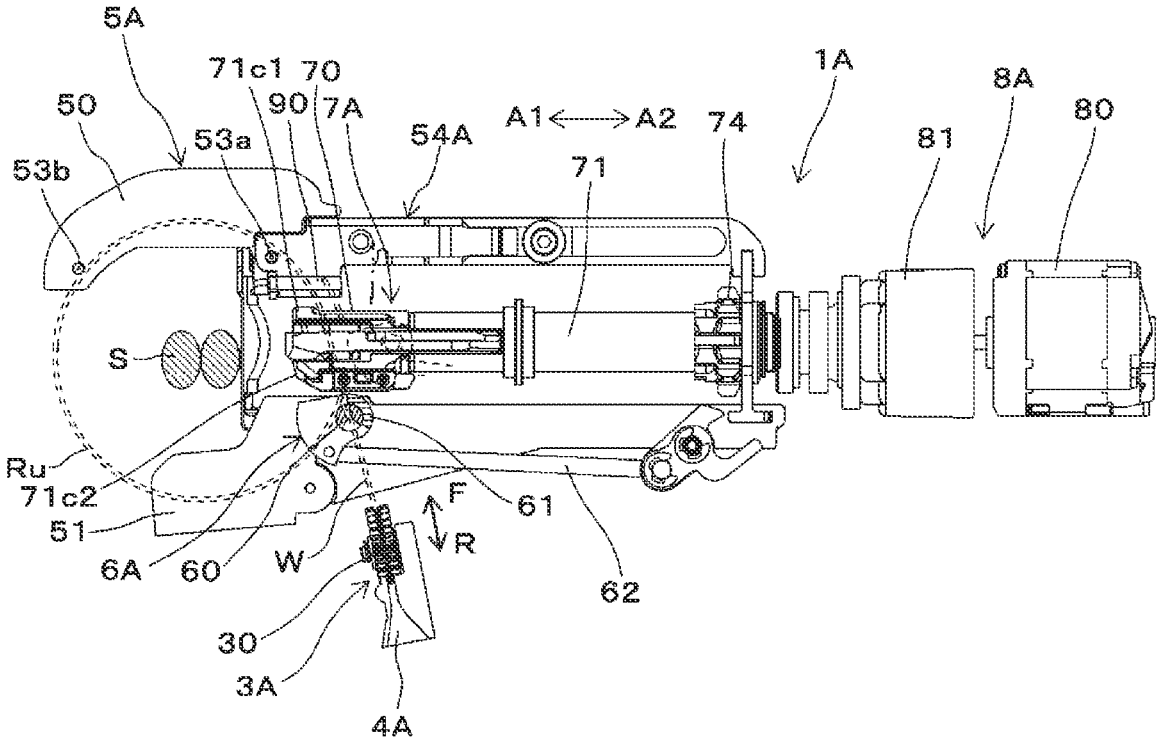
FIG. 2 is a side view showing an example of a reinforcing bar binding machine according to the first embodiment.

FIG. 2 is a side view showing an example of the reinforcing bar binding machine according to the first embodiment. The reinforcing bar binding machine 1A is an example of the binding mechanism, and is configured to feed the wire W in a forward direction denoted with an arrow F, to wind the wire around the two intersecting reinforcing bars S, to feed the wire W wound around the reinforcing bars S in a reverse direction denoted with an arrow R, to wind the wire on the reinforcing bars S, and to twist the wire W, thereby binding the reinforcing bars S with the wire W.

In order to implement the above functions, the reinforcing bar binding machine 1A includes a wire feeding unit 3A configured to feed the wire W in the forward direction and the reverse direction, and a wire guide 4A configured to guide the wire W that is fed by the wire feeding unit 3A. The reinforcing bar binding machine 1A also includes a curl forming unit 5A configured to form a path along which the wire W fed by the wire feeding unit 3A is to be wound around the reinforcing bars S, and a cutting unit 6A configured to cut the wire W wound on the reinforcing bars S. The reinforcing bar binding machine 1A also includes a binding unit 7A configured to twist the wire W wound on the reinforcing bars S, and a drive unit 8A configured to drive the binding unit 7A.

The wire feeding unit 3A includes a pair of feeding gears 30 (a first feeding gear 30L and a second feeding gear 30R) as a feeding member, configured to sandwich and feed one wire or a plurality of wires W aligned in parallel. In the wire feeding unit 3A, a rotating operation of a feeding motor (which will be described later) is transmitted to rotate the feeding gears 30. Thereby, the wire feeding unit 3A is configured to feed the wire W sandwiched between the pair of feeding gears 30 along an extension direction of the wire W. In a configuration where a plurality of, for example, two wires W are fed, the two wires W are fed aligned in parallel.

The wire guide 4A is provided in a predetermined position on an upstream side of the wire feeding unit 3A with respect to a feeding direction of feeding the wire W in the forward direction. In a configuration where the two wires W are fed, the wire guide 4A is configured to regulate radial orientation of the two wires W, to align the two introduced wires W in parallel and to guide the same between the pair of feeding gears 30 (the first feeding gear 30L and the second feeding gear 30R).

A downstream side opening of the wire guide 4A with respect to the feeding direction of the wire W that is fed in the forward direction has a shape of regulating the radial orientation of the wire W. On the other hand, an upstream side opening with respect to the feeding direction of the wire W that is fed in the forward direction has a larger opening area, as compared to the downstream side opening. For example, the wire guide 4A is constituted by a tapered opening whose opening area is largest on an introduction side for the wire W, which is fed from the wire feeding mechanism 2A shown in FIGS. 1A to 1C, and is reduced from the introduction side. Thereby, even when a height and an orientation of the reinforcing bar binding machine 1A are changed, the wire W that is fed by the wire feeding mechanism 2A can be guided between the pair of feeding gears 30.

The curl forming unit 5A includes a curl guide 50 configured to curl the wire W that is fed by the wire feeding unit 3A, and an induction guide 51 configured to guide the wire W curled by the curl guide 50 to the binding unit 7A. In the reinforcing bar binding machine 1A, a feeding path of the wire W that is fed by the wire feeding unit 3A is regulated by the curl forming unit 5A, so that a locus of the wire W becomes a loop Ru as shown with a broken line in FIG. 2 and the wire W is thus wound around the reinforcing bars S.

The curl forming unit 5A has guide members 53*a* and 53*b* configured to guide the wire W that is fed in the forward direction, and to curl the wire W. The guide member 53*a* is provided on a side of the curl guide 50 on which the wire W fed by the wire feeding unit 3A are introduced, and is arranged on a radially inner side of the loop Ru that is formed by the wire W. The guide member 53*b* is provided on a side of the curl guide 50 on which the wire W fed by the wire feeding unit 3A are discharged, and is arranged on a radially outer side of the loop Ru that is formed by the wire W.

The curl forming unit 5A includes a guide member moving mechanism 54A configured to retreat the guide member 53*a*. The guide member moving mechanism 54A is configured to retreat the guide member 53*a* in conjunction with an operation of the binding unit 7A after the wire W is wound on the reinforcing bars S.

The cutting unit 6A includes a fixed blade part 60, a movable blade part 61 configured to cut the wire W in cooperation with the fixed blade part 60, and a transmission mechanism 62 configured to transmit an operation of the binding unit 7A to the movable blade part 61. The cutting unit 6A is configured to cut the wire W by a rotating operation of the movable blade part 61 about the fixed blade part 60, which is a fulcrum shaft. The transmission mechanism 62 is configured to transmit an operation of the binding unit 7A to the movable blade part 61 via a movable member 83 and to rotate the movable blade part 61 in conjunction with the operation of the binding unit 7A, thereby cutting the wire W.

The binding unit 7A includes a wire engaging body 70 to which the wire W is engaged. A detailed embodiment of the binding unit 7A will be described later. The drive unit 8A includes a motor 80, and a decelerator 81 configured to perform deceleration and amplification of torque.

In a case where the reinforcing bar binding machine 1A has such a form that an operator holds and uses with a hand, the reinforcing bar binding machine 1A includes a main body 10A and a handle part 11A, and a battery 15A is detachably attached to the handle part 11A.

Figure 3A:
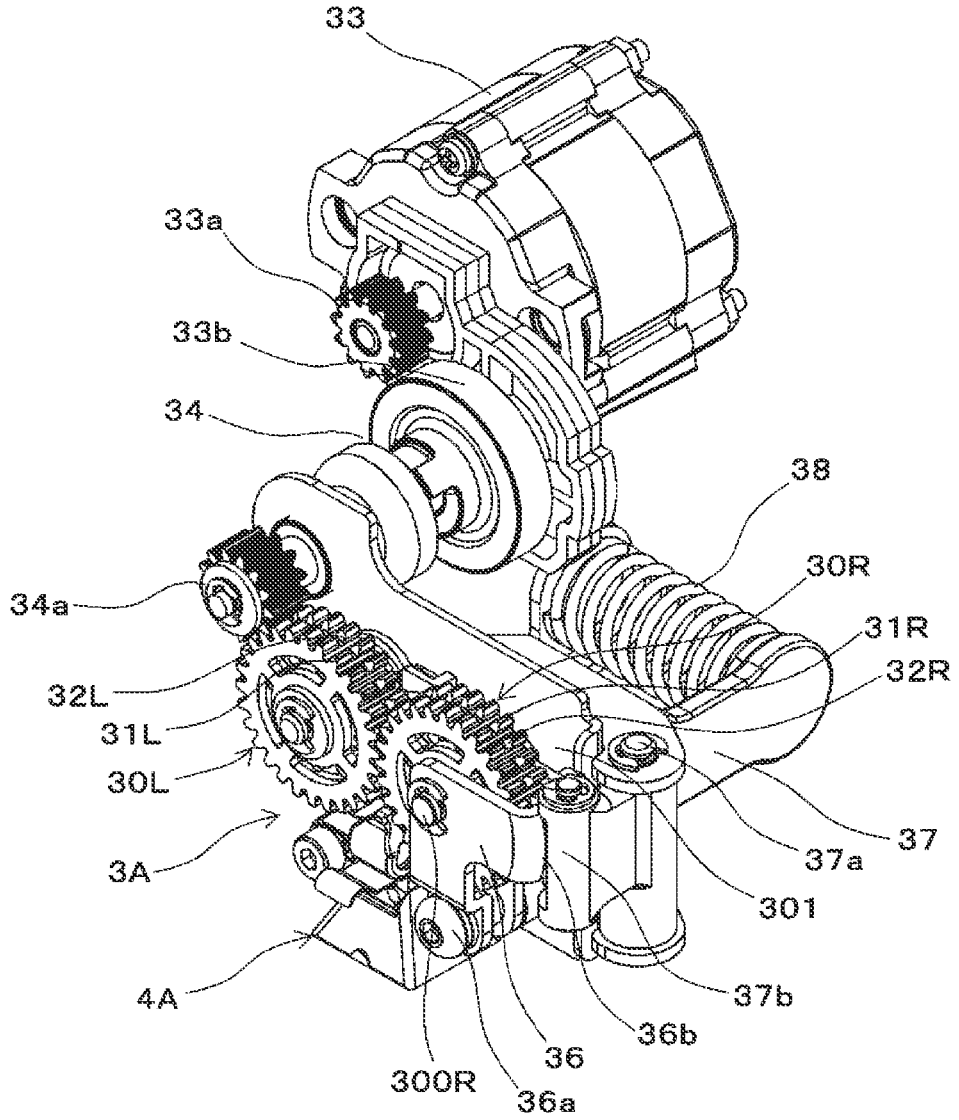
FIG. 3A is a perspective view showing an example of a wire feeding unit.

FIG. 3A is a perspective view showing an example of the wire feeding unit. Subsequently, a configuration of the wire feeding unit 3A is described with reference to each drawing.

The first feeding gear 30L, which constitutes one of the pair of feeding gears 30, has tooth portions 31L configured to transmit a drive force. In the present example, the tooth portions 31L have a shape constituting a spur gear, and are formed over an entire circumference of an outer periphery of the first feeding gear 30L. The first feeding gear 30L also has groove portions 32L in which the wire W is introduced. In the present example, the groove portions 32L are each constituted by a concave portion whose sectional shape is a substantial V-shape, and are formed along a circumferential direction over the entire circumference of the outer periphery of the first feeding gear 30L.

The second feeding gear 30R, which constitutes the other of the pair of feeding gears 30, has tooth portions 31R configured to transmit a drive force. In the present example, the tooth portions 31R have a shape constituting a spur gear, and are formed over an entire circumference of an outer periphery of the second feeding gear 30R. The second feeding gear 30R also has groove portions 32R in which the wire W is introduced. In the present example, the groove portions 32R are each constituted by a concave portion whose sectional shape is a substantial V-shape, and are formed along a circumferential direction over the entire circumference of the outer periphery of the second feeding gear 30R.

In the wire feeding unit 3A, the groove portions 32L of the first feeding gear 30L and the groove portions 32R of the second feeding gear 30R are made to face each other, so that the first feeding gear 30L and the second feeding gear 30R are provided with the feeding path of the wire W being interposed therebetween.

In the wire feeding unit 3A, the tooth portions 31L of the first feeding gear 30L and the tooth portions 31R of the second feeding gear 30R are in mesh with each other in a state where the wire W is sandwiched between the groove portions 32L of the first feeding gear 30L and the groove portions 32R of the second feeding gear 30R. Thereby, the drive force resulting from rotation is transmitted between the first feeding gear 30L and the second feeding gear 30R.

The wire feeding unit 3A includes a feeding motor 33 configured to one of the first feeding gear 30L and the second feeding gear 30R, in the present example, the first feeding gear 30L, and a drive force transmission mechanism 34 configured to transmit a drive force of the feeding motor 33 to the first feeding gear 30L.

The drive force transmission mechanism 34 has a small gear 33*a* attached to a shaft of the feeding motor 33, and a large gear 33*b* in mesh with the small gear 33*a*. The drive force transmission mechanism 34 also has a feeding small gear 34*a* which the drive force is transmitted thereto from the large gear 33*b* and is in mesh with the first feeding gear 30L. The small gear 33*a*, the large gear 33*b* and the feeding small gear 34*a* are each constituted by a spur gear.

The first feeding gear 30L is configured to rotate as a rotating operation of the feeding motor 33 is transmitted thereto via the drive force transmission mechanism 34. The rotating operation of the first feeding gear 30L is transmitted to the second feeding gear 30R by engagement between the tooth portions 31L and the tooth portions 31R, so that the second feeding gear 30R is caused to rotate by the first feeding gear 30L.

Thereby, the wire feeding unit 3A is configured to feed the wire W sandwiched between the first feeding gear 30L and the second feeding gear 30R along the extension direction of the wire W. In a configuration where the two wires W are fed, the two wires W are fed aligned in parallel by a friction force generated between the groove portions 32L of the first feeding gear 30L and one wire W, a friction force generated between the groove portions 32R of the second feeding gear 30R and the other wire W and a friction force generated between one wire W and the other wire W.

The wire feeding unit 3A is configured so that the rotation directions of the first feeding gear 30L and the second feeding gear 30R are switched and the feeding direction of the wire W is switched between forward and reverse directions by switching the rotation direction of the feeding motor 33 between forward and reverse directions.

The wire feeding unit 3A is configured so that the first feeding gear 30L and the second feeding gear 30R come close to each other to press against each other, so as to sandwich the wire W between the first feeding gear 30L and the second feeding gear 30R. Specifically, the wire feeding unit 3A is configured so that the first feeding gear 30L and the second feeding gear 30R can be displaced in directions of contacting/separating with respect to each other, so as to sandwich the wire W between the first feeding gear 30L and the second feeding gear 30R and to load the wire W between the first feeding gear 30L and the second feeding gear 30R. In the present example, the drive force of the feeding motor 33 is received from the first feeding gear 30L, and the second feeding gear 30R to which the drive force of the feeding motor 33 is not directly transmitted is configured to be displaced with respect to the first feeding gear 30L.

Therefore, the wire feeding unit 3A has a first displacement member 36 configured to displace the second feeding gear 30R toward and away from the first feeding gear 30L. The wire feeding unit 3A also has a second displacement member 37 configured to displace the first displacement member 36. The first displacement member 36 and the second displacement member 37 are configured to displace one or both of the pair of feeding gears 30 toward and away from each other. In the present example, as described above, the second feeding gear 30R is configured to be displaced toward and away from the first feeding gear 30L.

The second feeding gear 30R is rotatably supported on one end portion-side of the first displacement member 36 by a shaft 300R. The other end portion of the first displacement member 36 is rotatably supported to a support member 301 of the wire feeding unit 3A by a shaft 36*a* as a fulcrum.

The shaft 36*a* of the first displacement member 36, which is a fulcrum of the rotating operation, is oriented in parallel to the shaft 300R of the second feeding gear 30R. Thereby, the first displacement member 36 is configured to be displaced by a rotating operation about the shaft 36*a* as a fulcrum, thereby causing the second feeding gear 30R to contact/separate with respect to the first feeding gear 30L.

The first displacement member 36 is provided on one end portion-side with a to-be-pressed portion 36*b* that is pressed from the second displacement member 37. The to-be-pressed portion 36*b* is provided on a side of a part at which the shaft 300R of the second feeding gear 30R is supported.

The second displacement member 37 is supported by the support member 301 of the wire feeding unit 3A so as to be rotatable about a shaft 37*a* as a fulcrum. The second displacement member 37 also has a pressing portion 37*b* for pressing against the to-be-pressed portion 36*b* of the first displacement member 36 on one end portion-side that sandwiches the shaft 37*a*.

The second displacement member 37 is configured to be displaced by a rotating operation about the shaft 37*a* as a fulcrum, thereby causing the pressing portion 37*b* to press against the to-be-pressed portion 36*b* of the first displacement member 36 and releasing the pressing of the pressing portion 37*b* against the to-be-pressed portion 36*b*.

The wire feeding unit 3A has a spring 38 for pressing the second feeding gear 30R against the first feeding gear 30L. The spring 38 is constituted by a compression coil spring, for example, and presses against the other end portion-side that sandwiches the shaft 37*a* of the second displacement member 37.

The second displacement member 37 is pressed by the spring 38 and is thus configured to be displaced by the rotating operation about the shaft 37*a* as a fulcrum, thereby causing the pressing portion 37*b* to press against the to-be-pressed portion 36*b* of the first displacement member 36. When the pressing portion 37*b* of the second displacement member 37 presses against the to-be-pressed portion 36*b* of the first displacement member 36, the first displacement member 36 is displaced by the rotating operation about the shaft 36*a* as a fulcrum. Thereby, the second feeding gear 30R is pressed toward the first feeding gear 30L by the force of the spring 38.

When the wire W is loaded between the first feeding gear 30L and the second feeding gear 30R, the wire W is sandwiched between the groove portions 32L of the first feeding gear 30L and the groove portions 32R of the second feeding gear 30R.

In a state where the wire W is sandwiched between the groove portions 32L of the first feeding gear 30L and the groove portions 32R of the second feeding gear 30R, the tooth portions 31L of the first feeding gear 30L and the tooth portions 31R of the second feeding gear 30R mesh with each other.

Figure 3B:
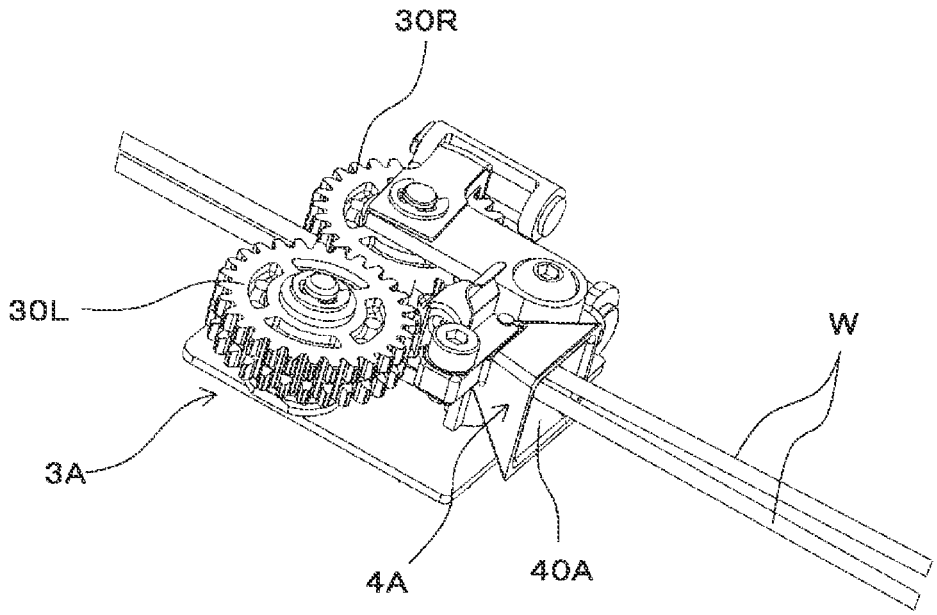
FIG. 3B is a perspective view showing an example of the wire feeding unit and a wire guide.
Figure 3C:
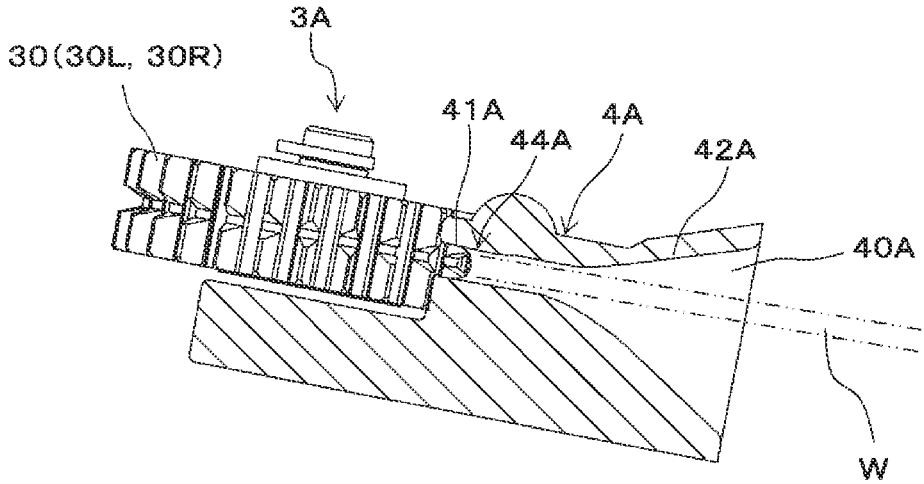
FIG. 3C is a side sectional view showing the example of the wire feeding unit and the wire guide.
Figure 3D:
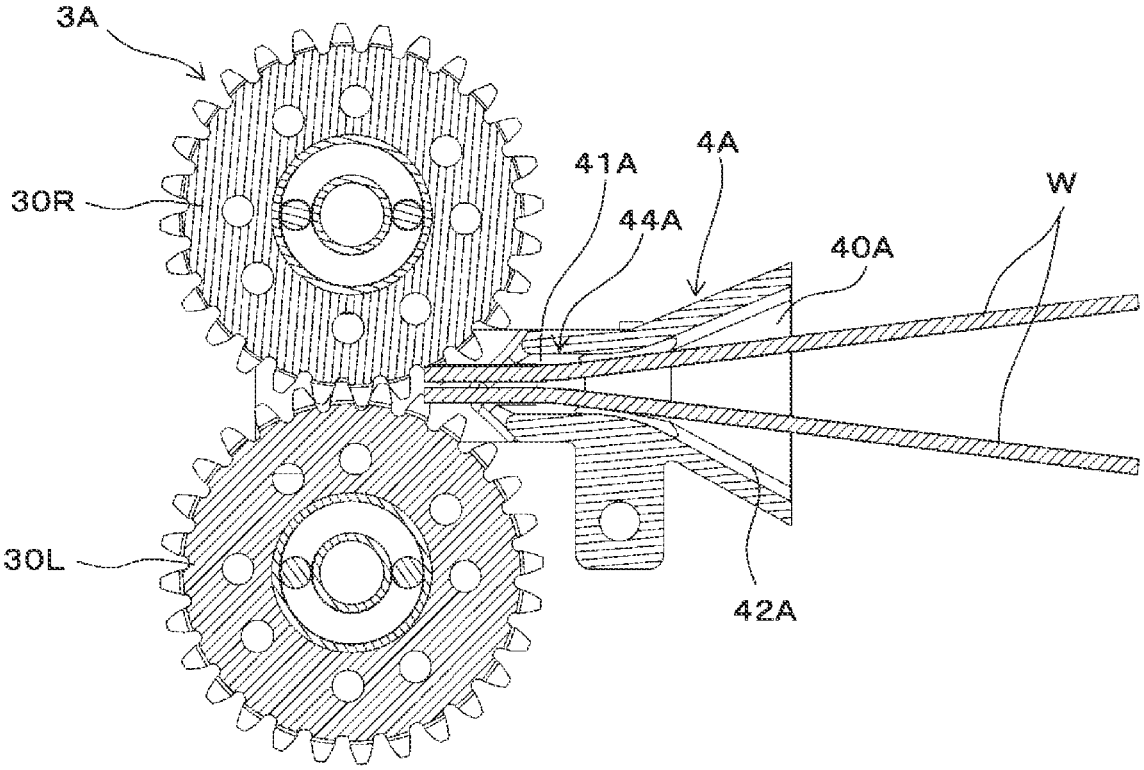
FIG. 3D is a plan sectional view showing the example of the wire feeding unit and the wire guide.
Figure 3E:
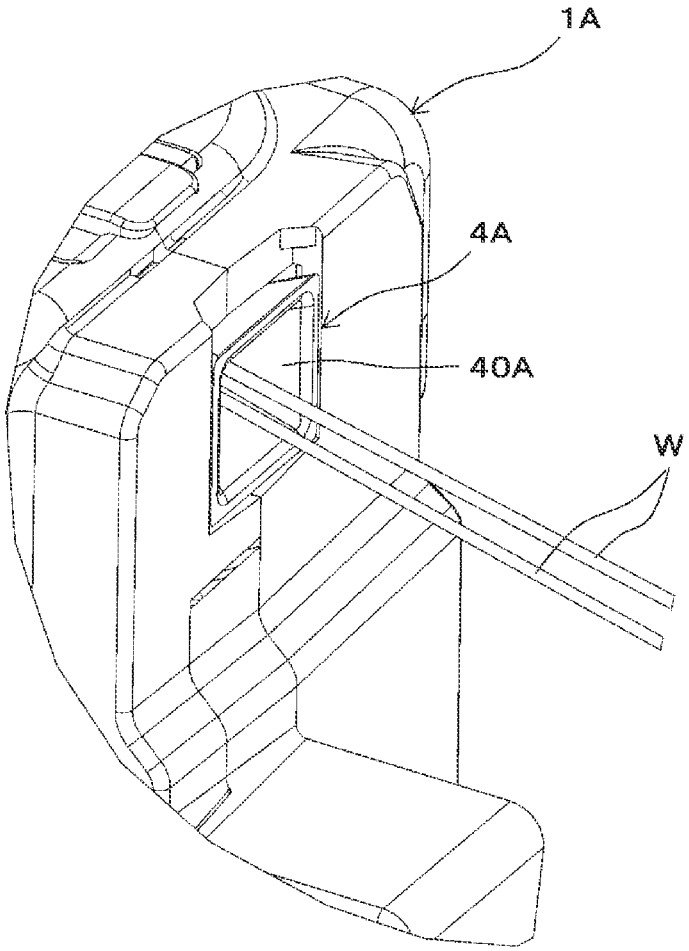
FIG. 3E is a perspective view showing the example of the wire feeding unit.

FIG. 3B is a perspective view showing an example of the wire feeding unit and the wire guide, FIG. 3C is a side sectional view showing the example of the wire feeding unit and the wire guide, FIG. 3D is a plan sectional view showing the example of the wire feeding unit and the wire guide, and FIG. 3E is a perspective view showing the example of the wire guide. Subsequently, a configuration of the wire guide 4A configured to guide the wire W to the wire feeding unit 3A is described.

The wire guide 4A is configured so that an upstream side opening 40A with respect to the feeding direction of the wire W that is fed in the forward direction has a larger opening area, as compared to a downstream side opening 41A. In the present example, the wire guide 4A is constituted by a tapered opening where an opening area of the upstream side opening 40A, which is an introduction side for the wire W that is fed from the wire feeding mechanism 2A, is largest and the opening area is reduced from the introduction side, and a guide surface 42A configured to guide the wire W is constituted by a tapered inclined surface. The upstream side opening 40A of the wire guide 4A has a quadrangular, circular or the like shape.

In addition, the wire guide 4A has a wire position regulation part 44A configured to regulate a position of the wire W along axial directions of rotations of the pair of feeding gears 30 (the first feeding gear 30L and the second feeding gear 30R) of the wire feeding unit 3A and to suppress the wire W from coming off from the wire feeding unit 3A. The wire position regulation part 44A is constituted by providing an opening, through which the wire W passes, while aligning a position thereof along the axial directions of rotations of the first feeding gear 30L and the second feeding gear 30R with respect to the groove portions 32L of the first feeding gear 30L and the groove portions 32R of the second feeding gear 30R. In the present example, the wire guide 4A has the wire position regulation part 44A that is constituted by a downstream side opening 41A facing the pair of feeding gears 30 (the first feeding gear 30L and the second feeding gear 30R) of the wire feeding unit 3A with respect to the feeding direction of the wire W that is fed in the forward direction. The wire position regulation part 44A has such a shape that the opening 41A facing the pair of feeding gears 30 regulates a radial orientation of the wire W. In a configuration where the reinforcing bars S are bound with the two wires W, the wire guide 4A has an elliptical shape, a rectangular shape or the like where a length in a length direction of the downstream side opening 41A along the facing direction of the first feeding gear 30L and the second feeding gear 30R is about equal to or greater than a length of a diameter of two wires and a length in a width direction orthogonal to the length direction is about equal to or greater than a length of a diameter of one wire. Thereby, the radial orientation of the two wires W passing through the wire guide 4A is guided to an orientation along the facing direction of the first feeding gear 30L and the second feeding gear 30R by the downstream side opening 41A of the wire guide 4A, which constitutes the wire position regulation part 44A. In addition, the positions of the wires W along the axial directions of rotations of the first feeding gear 30L and the second feeding gear 30R are regulated by the downstream side opening 41A of the wire guide 4A, which constitutes the wire position regulation part 44A. Thereby, the two wires W passing through the wire guide 4A are suppressed from moving and coming off from the groove portions 32L of the first feeding gear 30L and the groove portions 32R of the second feeding gear 30R along the axial directions of rotations of the first feeding gear 30L and the second feeding gear 30R. Note that, as shown in FIGS. 3C and 3D, the wire guide 4A may have such a configuration where the downstream side opening 41A facing the pair of feeding gears 30 of the wire feeding unit 3A has a tapered shape whose opening area increases toward a downstream side end face by chamfering of the end face, or the like, as long as it can regulate the radial orientation of the two wires W passing through the wire guide 4A and the positions along the axial directions of rotations of the first feeding gear 30L and the second feeding gear 30R.

Figure 3F:
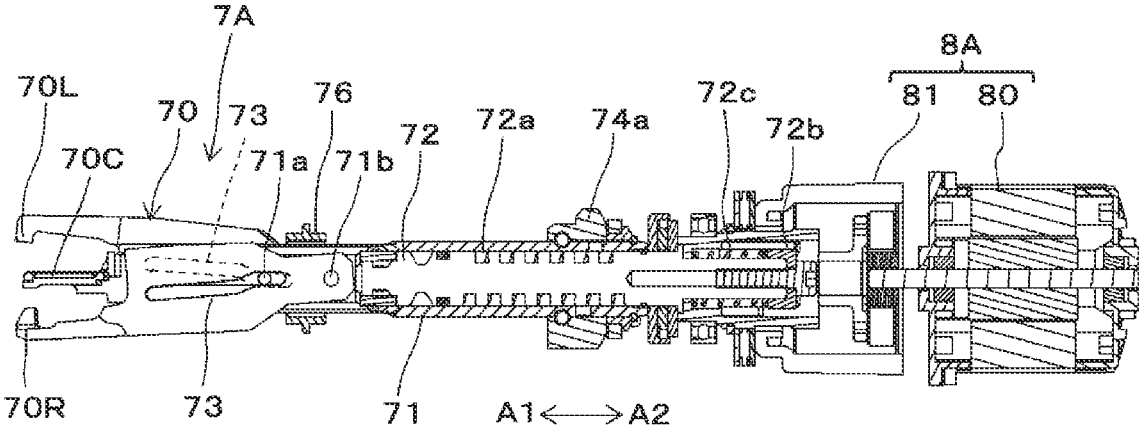
FIG. 3F is a sectional plan view showing an example of a binding unit.
Figure 3G:
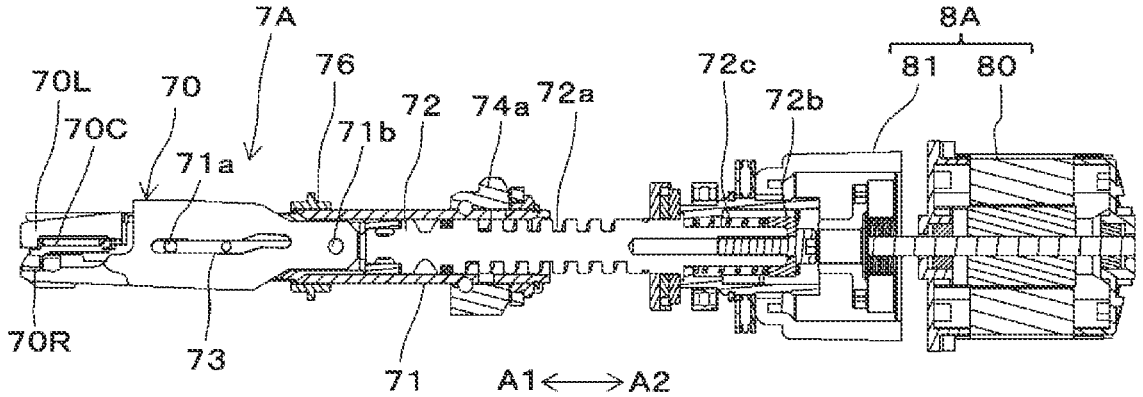
FIG. 3G is a sectional plan view showing the example of the binding unit.

FIGS. 3F and 3G are sectional plan views showing an example of the binding unit. Subsequently, a configuration of the binding unit is described with reference to each drawing.

The binding unit 7A includes a wire engaging body 70 to which the wire W is engaged, and a rotary shaft 72 for actuating the wire engaging body 70. The binding unit 7A and the drive unit 8A are configured so that the rotary shaft 72 and the motor 80 are connected via the decelerator 81 and the rotary shaft 72 is driven via the decelerator 81 by the motor 80.

The wire engaging body 70 has a center hook 70C connected to the rotary shaft 72, a first side hook 70R and a second side hook 70L configured to open and close with respect to the center hook 70C, and a sleeve 71 configured to actuate the first side hook 70R and the second side hook 70L and to form the wire W into a desired shape.

The center hook 70C is connected to a tip end of the rotary shaft 72, which is one end portion along an axial direction of the rotary shaft 72, via a configuration that can rotate with respect to the rotary shaft 72 and move integrally with the rotary shaft 72 in the axial direction.

The wire engaging body 70 is configured to open/close in directions in which the tip end-side of the first side hook 70R contacts and separates with respect to the center hook 70C by a rotating operation about a shaft 71*b* as a fulcrum. The wire engaging body 70 is also configured to open/close in directions in which the tip end-side of the second side hook 70L contacts and separates with respect to the center hook 70C.

The sleeve 71 has a convex portion (not shown) protruding from an inner peripheral surface of a space in which the rotary shaft 72 is inserted, and the convex portion enters a groove portion of a feeding screw 72*a* formed along the axial direction on an outer periphery of the rotary shaft 72. When the rotary shaft 72 rotates, the sleeve 71 moves in a front and rear direction along the axial direction of the rotary shaft 72 according to a rotation direction of the rotary shaft 72 by an action of the convex portion (not shown) and the feeding screw 72*a* of the rotary shaft 72. The sleeve 71 is also configured to rotate integrally with the rotary shaft 72.

The sleeve 71 has an opening/closing pin 71*a* configured to open/close the first side hook 70R and the second side hook 70L.

The opening/closing pin 71*a* is inserted into opening/closing guide holes 73 formed in the first side hook 70R and the second side hook 70L. The opening/closing guide hole 73 has a shape of extending in a moving direction of the sleeve 71 and converting linear motion of the opening/closing pin 71*a* configured to move in conjunction with the sleeve 71 into an opening/closing operation by rotations of the first side hook 70R and the second side hook 70L about the shaft 71*b* as a fulcrum.

The wire engaging body 70 is configured so that, when the sleeve 71 is moved in a backward direction denoted with an arrow A2, the first side hook 70R and the second side hook 70L move away from the center hook 70C by the rotating operations about the shaft 71*b* as a fulcrum, due to a locus of the opening/closing pin 71*a* and the shape of the opening/closing guide holes 73.

Thereby, the first side hook 70R and the second side hook 70L are opened with respect to the center hook 70C, so that a feeding path through which the wire W is to pass is formed between the first side hook 70R and the center hook 70C and between the second side hook 70L and the center hook 70C.

In a state where the first side hook 70R and the second side hook 70L are opened with respect to the center hook 70C, the wire W that is fed by the wire feeding unit 3A passes between the center hook 70C and the first side hook 70R. The wire W passing between the center hook 70C and the first side hook 70R is guided to the curl forming unit 5A. Then, the wire curled by the curl forming unit 5A and guided to the binding unit 7A passes between the center hook 70C and the second side hook 70L.

The wire engaging body 70 is configured so that, when the sleeve 71 is moved in the forward direction denoted with an arrow A1, the first side hook 70R and the second side hook 70L move toward the center hook 70C by the rotating operations about the shaft 71*b* as a fulcrum, due to the locus of the opening/closing pin 71*a* and the shape of the opening/closing guide holes 73. Thereby, the first side hook 70R and the second side hook 70L are closed with respect to the center hook 70C.

When the first side hook 70R is closed with respect to the center hook 70C, the wire W sandwiched between the first side hook 70R and the center hook 70C is engaged in such an aspect that the wire can move between the first side hook 70R and the center hook 70C. Also, when the second side hook 70L is closed with respect to the center hook 70C, the wire W sandwiched between the second side hook 70L and the center hook 70C is engaged in such an aspect that the wire cannot come off between the second side hook 70L and the center hook 70C.

The sleeve 71 has a bending portion 71*c*1 configured to push and bend a tip end-side (one end portion) of the wire W in a predetermined direction to form the wire W into a predetermined shape, and a bending portion 71*c*2 configured to push and bend a terminal end-side (the other end portion) of the wire W cut by the cutting unit 6A in a predetermined direction to form the wire W into a predetermined shape.

The sleeve 71 is configured to move in the forward direction denoted with the arrow A1, thereby pushing and bending the tip end-side of the wire W engaged by the center hook 70C and the second side hook 70L toward the reinforcing bars S by the bending portion 71*c*1. Also, the sleeve 71 is configured to move in the forward direction denoted with the arrow A1, thereby pushing and bending the terminal end-side of the wire W engaged by the center hook 70C and the first side hook 70R and cut by the cutting unit 6A toward the reinforcing bars S by the bending portion 71*c*2.

The binding unit 7A includes a rotation regulation part 74 configured to regulate rotations of the wire engaging body 70 and the sleeve 71 interlocking with the rotating operation of the rotary shaft 72. In the binding unit 7A, the rotation regulation part 74 is configured to regulate rotation of the sleeve 71 interlocking with rotation of the rotary shaft 72, according to a position of the sleeve 71 along an axial position of the rotary shaft 72, so that the sleeve 71 is moved in the front and rear direction by the rotating operation of the rotary shaft 72. Also, when the rotation regulation on the sleeve 71 by the rotation regulation part 74 is released, the sleeve 71 is rotated in conjunction with the rotation of the rotary shaft 72.

Subsequently, the wire feeding mechanism 2A is described with reference to each drawing. The wire feeding mechanism 2A includes a wire pullout mechanism 22 configured to feed the wire W between the reinforcing bar binding machine 1A and a reel 20, a first wire guiding part 23 configured to guide the wire W between the reel 20 and the wire pullout mechanism 22, and a second wire guiding part 24 configured to guide the wire W between the reinforcing bar binding machine 1A and the wire pullout mechanism 22.

The binding facility 100A includes a reel accommodation part 21 in which the reel 20 having the wire W wound thereon is accommodated. In the reel accommodation part 21, the reel 20 on which the wire W is wound so as to be able to be pulled out are rotatably and detachably accommodated. For the wire W, a wire made of a plastically deformable metal wire, a wire having a metal wire covered with a resin, a twisted wire or the like is used. The reel 20 is configured so that one wire W is wound on a hub part (not shown) and can be pulled out from the reel 20.

In the present example, in order to bind the reinforcing bars S with the two wires W in the reinforcing bar binding machine 1A, the reel accommodation part 21 is configured so that the two reels 20 are accommodated side by side along an axial direction in a state where shafts of rotation are horizontally oriented with respect to a vertical direction. The reel accommodation part 21 is configured independently of the wire feeding mechanism 2A supported on the base part 112A, and the reinforcing bar binding machine 1A supported on the base part 112A by the elevation mechanism 111A is configured to be movable with respect to the reel accommodation part 21.

The wire pullout mechanism 22 of the wire feeding mechanism 2A has a pullout roller 22*a* configured to pull the wires W between the first wire guiding part 23 and the second wire guiding part 24, and a drive unit 22*b* configured to move a position of the pullout roller 22*a* to a direction intersecting with the wires W between the first wire guiding part 23 and the second wire guiding part 24. The pullout roller 22*a* is in contact with the wires W between the first wire guiding part 23 and the second wire guiding part 24 and is configured to move in the direction intersecting with the wires W between the first wire guiding part 23 and the second wire guiding part 24 between an upper limit position P1 as a first position that is a standby position and a lower limit position P2 as a second position in which the pullout roller pulls the wires W.

Thereby, the pullout roller 22*a* is moved from the upper limit position to the lower limit position, so that the wire pullout mechanism 22 applies a force by which the wires W between the reel 20 and the first wire guiding part 23 and the wires W between the reinforcing bar binding machine 1A and the second wire guiding part 24 are pulled between the first wire guiding part 23 and the second wire guiding part 24.

The first wire guiding part 23 has rollers 23*a*, 23*b* and 23*c* as an example of the wire guiding member provided on an upstream side of the wire pullout mechanism 22 with respect to the feeding direction of the wires W that are fed from the reel 20 accommodated in the reel accommodation part 21 to the reinforcing bar binding machine 1A. The first wire guiding part 23 is configured to guide the path, along which the wires W pulled out from the reels 20 accommodated in the reel accommodation part 21 are fed, toward the roller 23*a* by the roller 23*b* and to guide the path toward the second wire guiding part 24 by the roller 23*a*. Note that, the rollers 23*a*, 23*b* and 23*c* are respectively independently configured to correspond to the two wires W. However, the two wires W may also be guided by the common rollers 23*a*, 23*b* and 23*c*. In addition, the two wires W may also be guided by one roller.

The second wire guiding part 24 has a roller 24*a* as an example of the wire guiding member on a downstream side of the wire pullout mechanism 22. The second wire guiding part 24 is configured to guide the path, along which the wires W are fed, toward the reinforcing bar binding machine 1A by the roller 24*a*.

The rollers 23*a* and 23*b* of the first wire guiding part 23 and the roller 24*a* of the second wire guiding part 24 are provided at substantially the same heights in the vertical direction, and are in contact with the wires W from the lower side. The rollers 23*a* and 23*b* of the first wire guiding part 23 and the roller 24*a* of the second wire guiding part 24 are supported by shafts in a direction intersecting with the vertical direction. The rollers 23*a* and 23*b* of the first wire guiding part 23 and the roller 24*a* of the second wire guiding part 24 are, for example, rotatably supported by the shafts, and the rollers 23*a* and 23*b* of the first wire guiding part 23 and the roller 24*a* of the second wire guiding part 24 are caused to rotate by feeding of the wires W. Note that, the wire guiding member is not limited to the roller configured to rotate, and may also be a non-rotating cylindrical or columnar member. The non-rotating member is not limited to the cylindrical shape and the columnar shape and may also be a member whose sliding surface for the wires W is a curved or flat surface.

The first wire guiding part 23 has a load applying unit configured to apply a first load in the feeding direction of the wires W. The load applying unit is implemented by a configuration where a predetermined load is applied in the rotating directions of the rollers 23*a* and 23*b*, a configuration where a contact length (angle) between the rollers 23*a* and 23*b* and the wires W is made different from that of the roller 24*a* of the second wire guiding part 24, and the like. The configuration where a contact length (angle) between the rollers 23*a* and 23*b* and the wires W is made different from that of the roller 24*a* of the second wire guiding part 24 is implemented by making diameters of the rollers different, bending the feeding path of the wires W and changing the contact angle (length) of the wires W, and the like.

The second wire guiding part 24 has a load applying unit configured to apply a second load in the feeding direction of the wires W. The load applying unit is implemented by a configuration where a predetermined load is applied in the rotating direction of the roller 24*a*, a configuration where a contact length (angle) between the roller 24*a* and the wires W is made different from that of the rollers 23*a* and 23*b* of the first wire guiding part 23, and the like. The configuration where a contact length (angle) between the roller 24*a* and the wires W is made different from that of the rollers 23*a* and 23*b* of the first wire guiding part 23 is implemented by making diameters of the rollers different, bending the feeding path of the wires W and changing the contact angle (length) of the wires W, and the like.

In the present example, as the load applying unit, the roller 23*c* is provided between the roller 23*a* and the roller 23*b* of the first wire guiding part 23. The roller 23*c* is in contact with the wires W from the upper side and bends the feeding path of the wires W, thereby increasing the contact angle (length) between the rollers 23*a* and 23*b* and the wires W with respect to the roller 24*a* of the second wire guiding part 24. Thereby, the load, which is applied to the wires W that are guided by the first wire guiding part 23, becomes greater than the load, which is applied to the wires W that are guided by the second wire guiding part 24, so that the first load becomes greater than the second load.

In the wire pullout mechanism 22, the pullout roller 22*a* located in the upper limit position P1 is in contact with the wires W between the roller 23*a* of the first wire guiding part 23 and the roller 24*a* of the second wire guiding part 24, from the upper side that is an opposite side to a side on which the rollers 23*a* and 24*a* are in contact with the wire. In the wire pullout mechanism 22, the pullout roller 22*a* is configured to move from the upper limit position P1 to the lower limit position P2 in a direction intersecting with the wires W between the roller 23*a* of the first wire guiding part 23 and the roller 24*a* of the second wire guiding part 24.

Thereby, the wires W between the roller 23*a* of the first wire guiding part 23 and the roller 24*a* of the second wire guiding part 24 are pulled downward by the pullout roller 22*a*. Then, the wires W between the reinforcing bar binding machine 1A and the second wire guiding part 24 and the wires W between the first wire guiding part 23 and the reels 20 accommodated in the reel accommodation part 21 are fed between the roller 23*a* of the first wire guiding part 23 and the roller 24*a* of the second wire guiding part 24.

At this time, it is switched whether the wires W on the first wire guiding part 23-side are fed or the wires W on the second wire guiding part 24-side are fed, depending on the magnitudes of the load applied to the wires W that are guided by the first wire guiding part 23 and the load applied to the wires W that are guided by the second wire guiding part 24.

The wire feeding mechanism 2A includes an upper limit detection sensor 25*a* configured to detect that the pullout roller 22*a* is located in the upper limit position P1, and a lower limit detection sensor 25*b* configured to detect that the pullout roller 22*a* is located in the lower limit position P2.

The wire feeding mechanism 2A includes guide parts 27 each configured to regulate a position of each wire W along the direction in which the two wires W are aligned in parallel, with a predetermined range along the moving direction of the pullout roller 22*a*.

The guide parts 27 are provided between the wire pullout mechanism 22 and the first wire guiding part 23 and between the wire pullout mechanism 22 and the second wire guiding part 24. In the present example, as shown in FIGS. 1B, 1D and 1E, the guide part is provided near the wire pullout mechanism 22 between the wire pullout mechanism 22 and the first wire guiding part 23. In addition, the guide part is provided near the wire pullout mechanism 22 between the wire pullout mechanism 22 and the second wire guiding part 24. That is, the guide parts 27 are provided before and after the pullout roller 22*a* along the feeding direction of the wires W.

The guide parts 27 are provided on outer sides along the direction in which the plurality of wires W are aligned in parallel, with respect to the wire W on the outermost side of the plurality of wires W aligned in parallel, and are configured to regulate moving of the wires W toward the outer side of the feeding path. In addition, the guide parts 27 are provided between the plurality of wires W aligned in parallel to separate the feeding paths of the wires W. In the present example, the guide parts 27 each have first guide portions 27*a* each provided on an outer side of each wire W with respect to the direction in which the two wires W (W1, W2) are aligned in parallel, and a second guide portion 27*b* provided between the two wires W.

The first guide portion 27*a* extends from the base part 112A along the moving direction of the pullout roller 22*a*, and the second guide portion 27*b* extends from the base part 112A along the moving direction of the pullout roller 22*a*.

The guide part 27 has one first guide portion 27*a* that is provided on one side of the second guide portion 27*b* along the direction, in which the two wires W are aligned in parallel, and faces the second guide part with a gap extending along the moving direction of the pullout roller 22*a* and enabling at least one wire W to pass therethrough. The guide part 27 is formed with a guiding portion 27*c* by the gap between the one first guide portion 27*a* and the second guide portion 27*b*.

In addition, the guide part 27 has the other first guide portion 27*a* that is provided on the other side of the second guide portion 27*b* along the direction, in which the two wires W are aligned in parallel, and faces the second guide part with a gap extending along the moving direction of the pullout roller 22*a* and enabling at least one wire W to pass therethrough. The guide part 27 is formed with a guiding portion 27*c* by the gap between the other first guide portion 27*a* and the second guide portion 27*b*.

Thereby, the guide parts 27 are configured to suppress each wire W from moving in the direction, in which the two wires W are aligned in parallel, before and after the pullout roller 22*a* along the feeding direction of the wires W, within a moving range of the pullout roller 22*a* from the upper limit position to the lower limit position.

Figure 4:
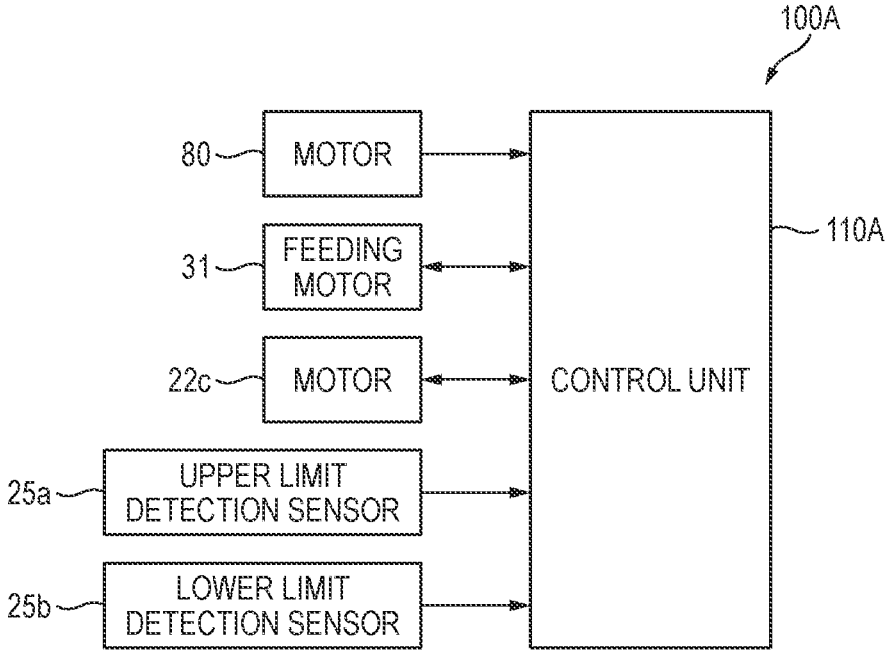
FIG. 4 is a block diagram showing an example of a control function of the binding facility.

FIG. 4 is a block diagram showing an example of a control function of the binding facility. In the binding facility 100A, a control unit 110A is configured to control a motor 80 and a feeding motor 31 of the reinforcing bar binding machine 1A. The control unit 110A is configured to control a position of the sleeve 71 and to perform an operation of engaging the wires W with the wire engaging body 70, an operation of cutting the wires W with the cutting unit 6A and an operation of twisting the wires W with the wire engaging body 70 by controlling a rotation amount of the motor 80.

In addition, the control unit 110A is configured to control forward and reverse rotations of the feeding motor 31, thereby feeding the wires W in the forward direction to perform an operation of winding the wires W around the reinforcing bars S and feeding the wires W in the reverse direction to perform an operation of winding the wires W on the reinforcing bars S.

Further, the control unit 110A is configured to control a motor 22*c* of the drive unit 22*b* of the wire feeding mechanism 2A. The control unit 110A is configured to control forward and reverse rotations of the motor 22*c*, based on the position of the pullout roller 22*a* detected by the upper limit detection sensor 25*a* and the lower limit detection sensor 25*b*, thereby moving down or up the pullout roller 22*a*.

<Operation Example of Binding Facility of First Embodiment>

Figure 5:
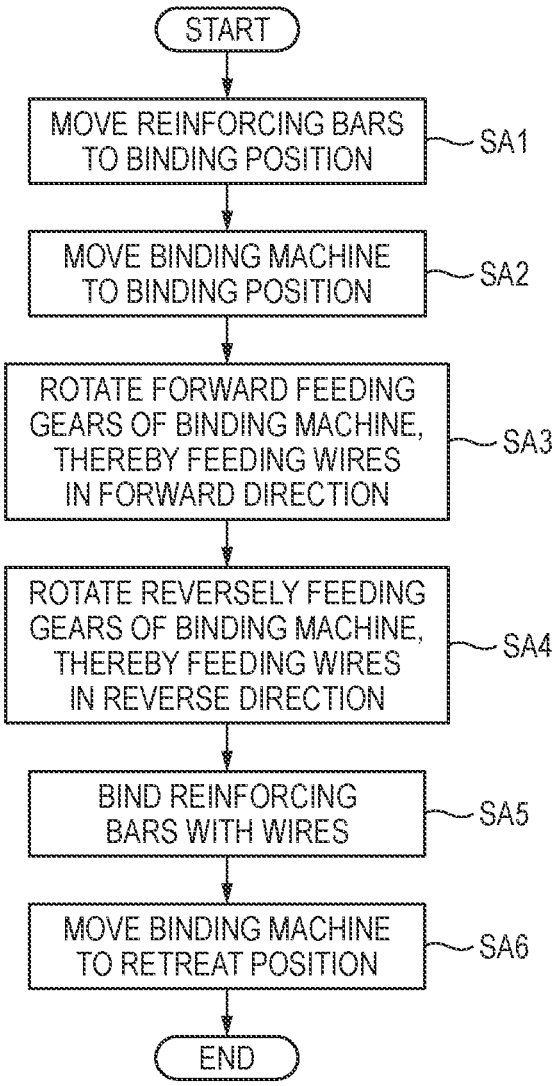
FIG. 5 is a flowchart showing an example of an operation of binding reinforcing bars with the reinforcing bar binding machine in the binding facility.
Figure 6A:
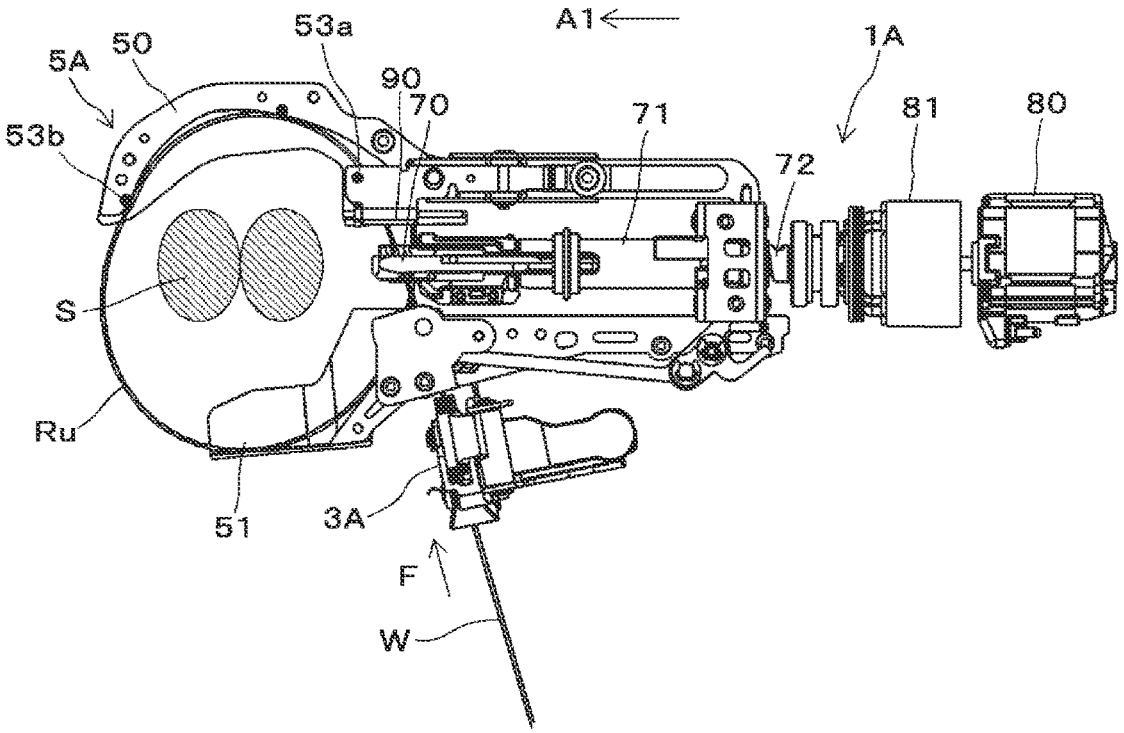
FIG. 6A is an operation illustration view showing an example of the operation of binding reinforcing bars with the reinforcing bar binding machine in the binding facility.
Figure 6B:
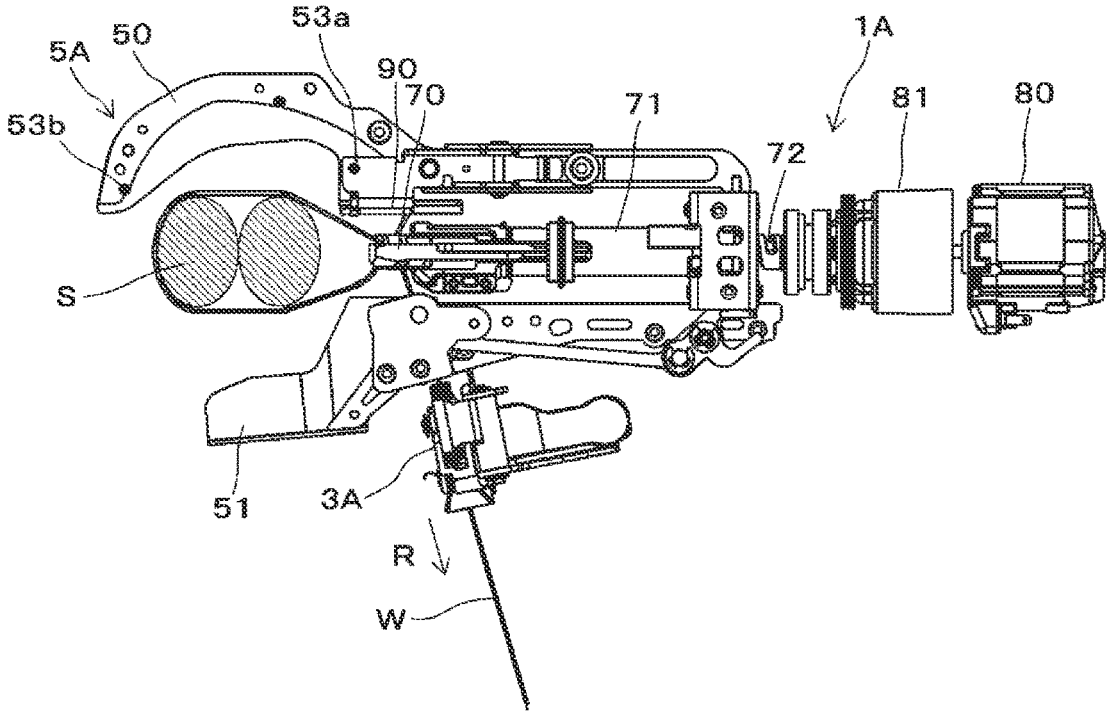
FIG. 6B is an operation illustration view showing the example of the operation of binding reinforcing bars with the reinforcing bar binding machine in the binding facility.

FIG. 5 is a flowchart showing an example of an operation of binding reinforcing bars with the reinforcing bar binding machine in the binding facility, and FIGS. 6A and 6B are operation illustration views showing an example of the operation of binding reinforcing bars with the reinforcing bar binding machine in the binding facility. Subsequently, the operation of binding the reinforcing bars S with the wires W by the reinforcing bar binding machine 1A is described with reference to each drawing.

In step SA1 of FIG. 5, the binding facility 100A moves the reinforcing bars S so that a binding target place at which the reinforcing bars S intersect becomes a position facing the curl forming unit 5A of the reinforcing bar binding machine 1A, and in step SA2, moves the reinforcing bar binding machine 1A so that the binding target place of the reinforcing bars S enters between the curl guide 50 and the induction guide 51 of the curl forming unit 5A.

When the control unit 110A receives a signal for binding the reinforcing bars S, the control unit 110A drives the feeding motor 31 in the forward rotation direction to feed the wires W in the forward direction denoted with an arrow F by the wire feeding unit 3A, in step SA3. In the reinforcing bar binding machine 1A, the two wires W are fed aligned in parallel in an axial direction of a loop Rn formed by the wires W.

The wires W that are fed in the forward direction pass between the center hook 70C and the first side hook 70R, and are fed to the curl guide 50 of the curl forming unit 5A. The wires W pass through the curl guide 50 and are thus curled to be wound around the reinforcing bars S by the guide members 53*a* and 53*b*.

The wires W curled by the curl guide 50 are guided to the induction guide 51 and are further fed in the forward direction by the wire feeding unit 3A, so that the wires are guided between the center hook 70C and the second side hook 70L by the induction guide 51. Then, the wires W are fed until the tip ends are butted against a feeding regulation part 90. The feeding path of the wires W that are fed by the wire feeding unit 3A is regulated by the curl forming unit 5A, so that a locus of the wires W becomes a loop Ru as shown with a broken line in FIG. 6A and the wires W are thus wound around the reinforcing bars S. When the wires W are fed to a position in which the tip ends thereof are butted against the feeding regulation part 90, the control unit 110A stops the drive of the feeding motor 31.

After stopping the feeding of the wires W in the forward direction, the control unit 110A drives the motor 80 in the forward rotation direction. In an operation area where the rotation regulation part 74 regulates the rotation of the sleeve 71 interlocking with the rotation of the rotary shaft 72, the rotating operation of the rotary shaft 72 is converted into linear movement, so that the sleeve 71 is moved in the forward direction denoted with the arrow A1.

When the sleeve 71 is moved in the forward direction, the opening/closing pin 71*a* passes through the opening/closing guide holes 73. Thereby, as shown in FIG. 3C, the first side hook 70R is moved toward the center hook 70C by the rotating operation about the shaft 71*b* as a fulcrum. When the first side hook 70R is closed with respect to the center hook 70C, the wires W sandwiched between the first side hook 70R and the center hook 70C are engaged in such an aspect that the wires can move between the first side hook 70R and the center hook 70C.

In addition, the second side hook 70L is moved toward the center hook 70C by the rotating operation about the shaft 71*b* as a fulcrum. When the second side hook 70L is closed with respect to the center hook 70C, the wires W sandwiched between the second side hook 70L and the center hook 70C are engaged in such an aspect that the wires cannot come off between the second side hook 70L and the center hook 70C.

After advancing the sleeve 71 to an end point position of the operation area where the wires W are engaged by the closing operation of the first side hook 70R and the second side hook 70L, the control unit 110A temporarily stops the rotation of the motor 80, and in step SA4, drives the feeding motor 31 in the reverse rotation direction. Thereby, the pair of feeding gears 30 is reversely rotated.

Therefore, the wires W sandwiched between the pair of feeding gears 30 are fed in the reverse direction denoted with the arrow R.

The wires W wound around the reinforcing bars S and engaged by the wire engaging body 70 are engaged in such an aspect that portions on the tip ends-side sandwiched between the second side hook 70L and the center hook 70C cannot come off between the second side hook 70L and the center hook 70C. Also, the wires W engaged by the wire engaging body 70 are engaged in such an aspect that portions sandwiched between the first side hook 70R and the center hook 70C can move between the first side hook 70R and the center hook 70C in a circumferential direction of the loop Ru along the feeding path of the wires W.

Thereby, the wires W wound around the reinforcing bars S are wound on the reinforcing bars S by the operation of feeding the wires W in the reverse direction denoted with the arrow R, as shown in FIG. 6B. In the operation of feeding the wires W in the reverse direction by the reinforcing bar binding machine 1A, the wires W are not fed in the reverse direction in the wire feeding mechanism 2A. For this reason, in the operation of feeding the wires W in the reverse direction by the reinforcing bar binding machine 1A, the wires W are loosened between the reinforcing bar binding machine 1A and the second wire guiding part 24.

When the wires W are pulled back to a position in which the wires W are wound on the reinforcing bars S, the control unit 110A stops the drive of the feeding motor 31 in the reverse rotation direction and then drives the motor 80 in the forward rotation direction, thereby moving the sleeve 71 in the forward direction denoted with the arrow A1. The operation of moving the sleeve 71 in the forward direction is transmitted to the cutting unit 6A, so that the movable blade part 61 is rotated and the wires W engaged by the first side hook 70R and the center hook 70C are cut by the operation of the fixed blade part 60 and the movable blade part 61.

When the wires W are cut, the bending portions 71*c*1 and 71*c*2 are moved in a direction of contacting the reinforcing bars S. Thereby, the tip ends-side of the wires W engaged by the center hook 70C and the second side hook 70L are pressed toward the reinforcing bars S and bent toward the reinforcing bars S in the engaging position as a fulcrum by the bending portion 71*c*1. The sleeve 71 is further moved in the forward direction, so that the wires W engaged between the second side hook 70L and the center hook 70C are maintained sandwiched by the bending portion 71*c*1.

Also, the terminal ends-side of the wires W engaged by the center hook 70C and the first side hook 70R and cut by the cutting unit 6A are pressed toward the reinforcing bars S and bent toward the reinforcing bars S in the engaging position as a fulcrum by the bending portion 71*c*2. The sleeve 71 is further moved in the forward direction, so that the wires W engaged between the first side hook 70R and the center hook 70C are maintained sandwiched by the bending portion 71*c*2.

After the tip ends-side and the terminal ends-side of the wires W are bent toward the reinforcing bars S, the motor 80 is further driven in the forward rotation direction, so that the sleeve 71 is further moved in the forward direction. When the sleeve 71 is moved to a predetermined position and reaches the operation area where the wires W engaged by the wire engaging body 70 are twisted, the rotation regulation on the sleeve 71 by the rotation regulation part 74 is released, and the sleeve 71 is rotated in conjunction with the rotation of the rotary shaft 72.

Thereby, the motor 80 is further driven in the forward rotation direction, so that the wire engaging body 70 is rotated in conjunction with the rotary shaft 72, thereby twisting the wires W to bind the reinforcing bars S with wires Wd, in step SA5.

When the control unit 110A detects a load applied to the motor 80 and detects that the load applied to the motor becomes a predetermined value, for example, a maximum value, the control unit 110A stops the rotation of the motor 80 in the forward direction at a predetermined timing.

After stopping the rotation of the motor 80 in the forward direction, the control unit 110A reversely rotates the motor 80, thereby moving the sleeve 71 in the backward direction to a position in which the first side hook 70R is opened with respect to the center hook 70C and the second side hook 70L is opened with respect to the center hook 70C, and returning the wire engaging body 70 to the standby position. When the wires W binding the reinforcing bars S come off from the wire engaging body 70, the control unit 110A moves the reinforcing bar binding machine 1A to the standby position, in step SA6.

Figure 7:
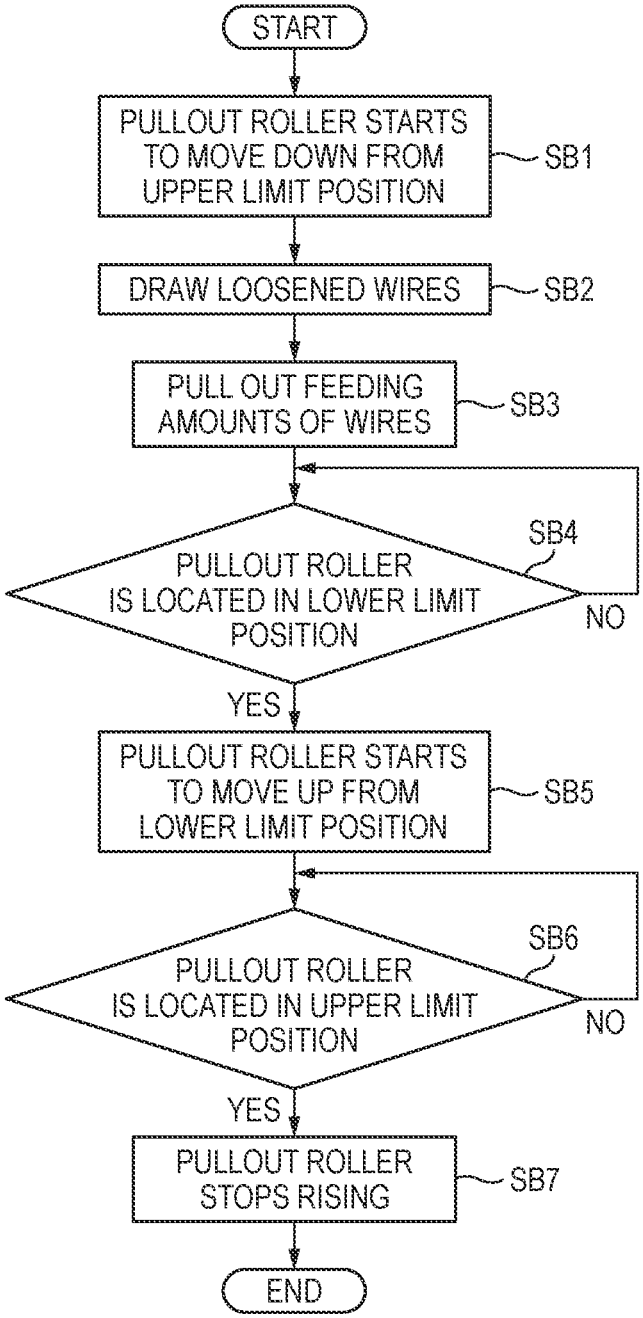
FIG. 7 is a flowchart showing an example of an operation of feeding wires with a wire feeding apparatus.

FIG. 7 is a flowchart showing an example of the operation of feeding wires with the wire feeding apparatus, and FIGS. 8A to 8E are operation illustration views showing an example of the operation of feeding the wires with the wire feeding apparatus. Subsequently, the operation of feeding the wires with the wire feeding mechanism 2A is described.

After the wires W are fed in the reverse direction in step SA4 in the binding operation in the above-described reinforcing bar binding machine 1A until the wires W are fed in the forward direction in step SA3 in a next binding operation, the wire feeding mechanism 2A performs an operation of pulling out predetermined amounts of the wires W from the reels 20.

In step SB1 of FIG. 7, the control unit 110A controls the drive unit 22*b* to rotate the motor 22*c* in the forward direction, thereby moving down the pullout roller 22*a* from the upper limit position P1 in a direction denoted with an arrow Do. In the wire pullout mechanism 22, the pullout roller 22*a* moves down from the upper limit position P1 to the lower limit position P2 along the direction intersecting with the wires W between the roller 23*a* of the first wire guiding part 23 and the roller 24*a* of the second wire guiding part 24.

When the pullout roller 22*a* starts to move down from the upper limit position P1, the wires W between the roller 23*a* of the first wire guiding part 23 and the roller 24*a* of the second wire guiding part 24 are pulled downward, so that the wires W between the reels 20 and the first wire guiding part 23 and the wires W between the reinforcing bar binding machine 1A and the second wire guiding part 24 are pulled between the first wire guiding part 23 and the second wire guiding part 24. Therefore, the wires W between the reinforcing bar binding machine 1A and the second wire guiding part 24 and the wires W between the first wire guiding part 23 and the reels 20 accommodated in the reel accommodation part 21 are fed between the roller 23*a* of the first wire guiding part 23 and the roller 24*a* of the second wire guiding part 24.

As described above, the load, which is applied to the wires W that are guided by the first wire guiding part 23, is set greater than the load, which is applied to the wires W that are guided by the second wire guiding part 24, so that the first load becomes greater than the second load.

Figure 8A:
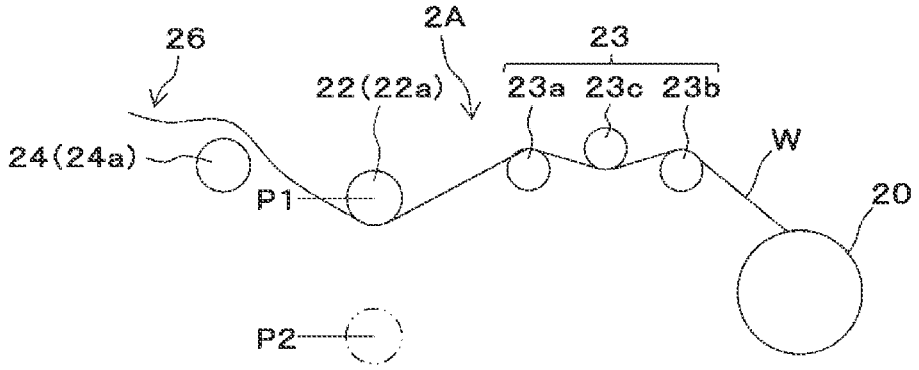
FIG. 8A is an operation illustration view showing an example of the operation of feeding the wires with the wire feeding apparatus.

In addition, in the reinforcing bar binding machine 1A, in the operation of binding the reinforcing bars S with the wires W, the wires W are fed in the reverse direction, so that the wires W are wound on the reinforcing bars S. In the operation of feeding the wires W in the reverse direction by the reinforcing bar binding machine 1A, the wires W are not fed in the reverse direction in the wire feeding mechanism 2A. For this reason, in the operation of feeding the wires W in the reverse direction by the reinforcing bar binding machine 1A, the wires W are loosened between the reinforcing bar binding machine 1A and the second wire guiding part 24, as shown in FIG. 8A.

Figure 8B:
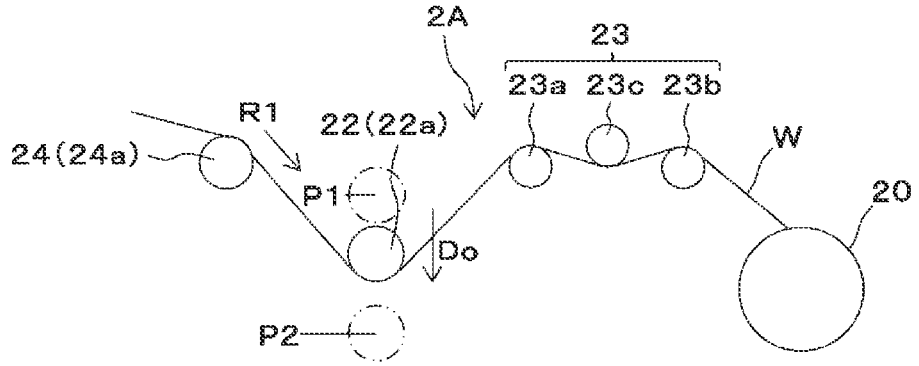
FIG. 8B is an operation illustration view showing the example of the operation of feeding the wires with the wire feeding apparatus.

Thereby, in the operation of pulling the wires W with the pullout roller 22*a* of the wire pullout mechanism 22, as shown in step SB2 of FIG. 7 and in FIG. 8B, since the first load is greater than the second load, a surplus of the wires W loosened between the reinforcing bar binding machine 1A and the second wire guiding part 24 is first drawn between the roller 23*a* of the first wire guiding part 23 and the roller 24*a* of the second wire guiding part 24, as shown with an arrow R1.

When the surplus of the wires W between the reinforcing bar binding machine 1A and the second wire guiding part 24 is fed to eliminate the loosening of the wires W, since the pair of feeding gears 30 of the wire feeding unit 3A is in the stationary state and does not rotate, the wires W cannot be fed on the feeding path 26 of the wires W between the reinforcing bar binding machine 1A and the second wire guiding part 24. Thereby, the feeding gears 30 become a load, so that the tension applied to the wires W between the reinforcing bar binding machine 1A and the second wire guiding part 24 increases. As a result, the load by the feeding gears 30 is added to the second load, so that a sum of the second load and the load of the feeding gears becomes greater than the first load.

Figure 8C:
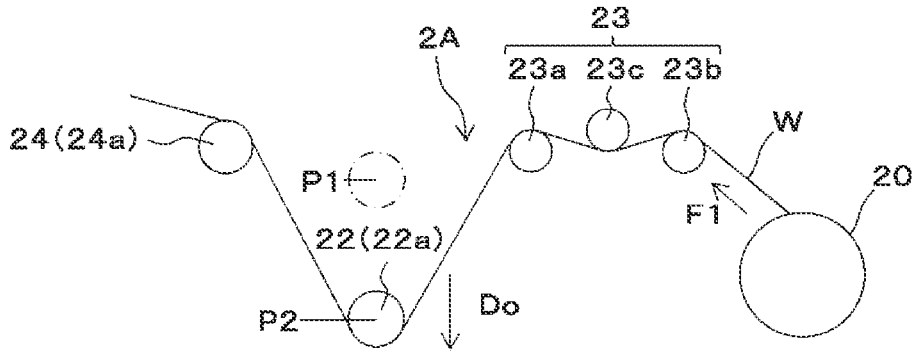
FIG. 8C is an operation illustration view showing the example of the operation of feeding the wires with the wire feeding apparatus.

When the sum of the second load and the load of the feeding gears becomes greater than the first load, as shown in step SB3 of FIG. 7 and with the arrow F1 in FIG. 8C, the wires W are pulled out from the reels 20 accommodated in the reel accommodation part 21 and are fed between the roller 23*a* of the first wire guiding part 23 and the roller 24*a* of the second wire guiding part 24. A moving amount of the pullout roller 22*a* is set so that amounts of the wires W required to eliminate the loosening of the wires W on the feeding path 26 of the wires W between the reinforcing bar binding machine 1A and the second wire guiding part 24 and to bind the reinforcing bars S by the reinforcing bar binding machine 1A can be pulled out from the reels 20 when the pullout roller 22*a* is moved to the lower limit position.

Figure 8D:
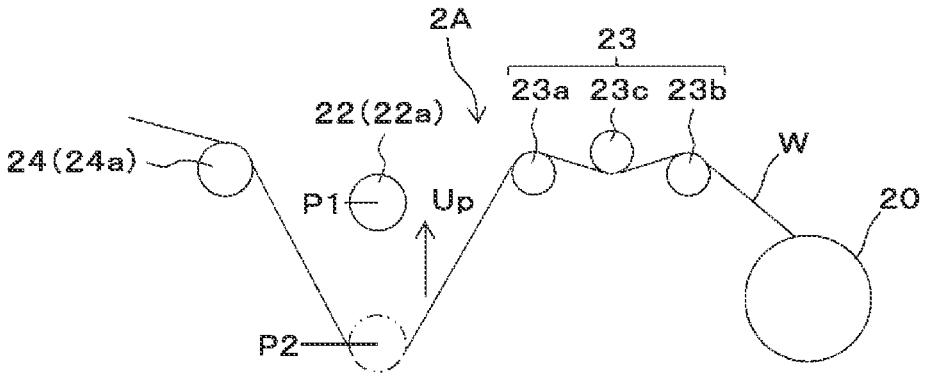
FIG. 8D is an operation illustration view showing the example of the operation of feeding the wires with the wire feeding apparatus.

In step SB4 of FIG. 7, when the lower limit detection sensor 25*b* detects that the pullout roller 22*a* is moved to the lower limit position, the control unit 110A switches the rotation direction of the motor 22*c* from the forward rotation to the reverse rotation, thereby moving up the pullout roller 22*a* in a direction denoted with an arrow Up, as shown in step SB5 of FIG. 7 and in FIG. 8D. In step SB6 of FIG. 7, when the upper limit detection sensor 25*a* detects that the pullout roller 22*a* is moved to the upper limit position, the control unit 110A stops the rotation of the motor 22*c*, in step SB7. Thereby, the amounts of the wires W required to bind the reinforcing bars S by the reinforcing bar binding machine 1A become in a loosened state between the roller 23*a* of the first wire guiding part 23 and the roller 24*a* of the second wire guiding part 24.

Figure 8E:
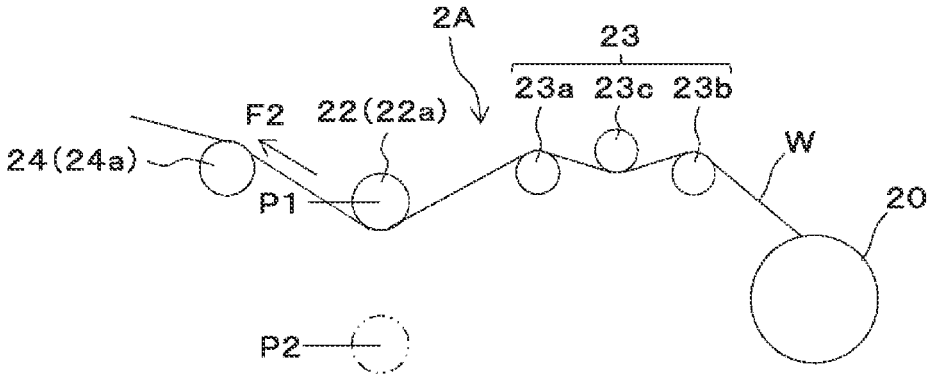
FIG. 8E is an operation illustration view showing the example of the operation of feeding the wires with the wire feeding apparatus.

In a next binding operation that is executed by the reinforcing bar binding machine 1A, the wires W loosened between the roller 23*a* of the first wire guiding part 23 and the roller 24*a* of the second wire guiding part 24 are fed in a direction denoted with an arrow F2 by the operation of feeding the wires W in the forward direction in step SA3, as shown in FIG. 8E.

In this way, it is switched whether the wires W on the first wire guiding part 23-side are fed or the wires W on the second wire guiding part 24-side are fed, depending on the magnitudes of the load applied to the wires W that are guided by the first wire guiding part 23 and the load applied to the wires W that are guided by the second wire guiding part 24.

Thereby, the loosening of the wires W occurring on the feeding path 26 of the wires W between the reinforcing bar binding machine 1A and the second wire guiding part 24 in the operation of feeding the wires W in the reverse direction by the reinforcing bar binding machine 1A so as to wind the wires W on the reinforcing bars S can be eliminated by the operation of pulling out the wires W with the wire pullout mechanism 22. In addition, in the operation of pulling out the wires W with the wire pullout mechanism 22, the amounts of the wires W required to bind the reinforcing bars S by the reinforcing bar binding machine 1A can be pulled out from the reels 20.

As described above, when the pullout roller 22*a* is moved to the lower limit position and is then moved to the upper limit position, the amounts of the wires W required to bind the reinforcing bars S by the reinforcing bar binding machine 1A become in a loosened state between the roller 23*a* of the first wire guiding part 23 and the roller 24*a* of the second wire guiding part 24.

The wires W wound on the reels 20 are so-called curled, so that when the wires become in a loosened state, one wire W loosened between the first wire guiding part 23 and the second wire guiding part 24 may be entangled due to being twisted or the like. In addition, the two wires W loosened between the first wire guiding part 23 and the second wire guiding part 24 may be moved toward each other, so that the two wires W may be entangled due to being twisted or the like.

Further, the two wires W loosened between the first wire guiding part 23 and the second wire guiding part 24 may be moved away from each other. In a form where a plurality of binding facilities 100A are used aligned, the two wires W may be moved toward each other between the adjacent binding facilities 100A, twisted or the like, so that the two wires W may be entangled between the adjacent binding facilities 100A.

Regarding this, the wire feeding mechanism 2A includes the guide parts 27 each configured to regulate the position of each wire W along the direction, in which the two wires W are aligned in parallel, with the predetermined range along the moving direction of the pullout roller 22*a*.

The guide parts 27 are respectively provided on the first wire guiding part 23-side and the second wire guiding part 24-side of the pullout roller 22*a* along the feeding direction of the wires W.

The guide part 27 has the first guide portions 27*a* that extend along the moving direction of the pullout roller 22*a*, are provided on both sides of the second guide portion 27*b* extending along the moving direction of the pullout roller 22*a* and face the second guide portion via the guiding portions 27*c* extending along the moving direction of the pullout roller 22*a*.

The surplus of the wires W between the reinforcing bar binding machine 1A and the second wire guiding part 24 is absorbed and the wires W are pulled out from the reels 20. Therefore, as described above, in the operation where the pullout roller 22*a* is moved to the lower limit position, one wire W1 of the two wires W are guided along the guiding portion 27*c* between the second guide portion 27*b* and one first guide portion 27*a* and the other wire W2 of the two wires W are guided along the guiding portion 27*c* between the second guide portion 27*b* and the other first guide portion 27*a*.

The pullout roller 22*a* is moved to the lower limit position and is then moved to the upper limit position, so that the two wires W are loosened downward along the moving direction of the pullout roller 22*a* between the first wire guiding part 23 and the second wire guiding part 24. As for the two wires W loosened between the first wire guiding part 23 and the second wire guiding part 24, one wire W1 of the two wires W passes through the guiding portion 27*c* between the second guide portion 27*b* and one first guide portion 27*a*, and the other wire W2 of the two wires W passes through the guiding portion 27*c* between the second guide portion 27*b* and the other first guide portion 27*a*.

Thereby, the two wires W loosened between the first wire guiding part 23 and the second wire guiding part 24 are suppressed from moving in the direction in which the wires are aligned in parallel. Therefore, one wire loosened between the first wire guiding part 23 and the second wire guiding part 24 is suppressed from being entangled due to being twisted or the like. In addition, the two wires W loosened between the first wire guiding part 23 and the second wire guiding part 24 are suppressed from moving toward each other and being entangled due to being twisted or the like.

Further, the two wires W loosened between the first wire guiding part 23 and the second wire guiding part 24 are suppressed from moving away from each other and being entangled between the adjacent binding facilities 100A.

In the next binding operation that is executed by the reinforcing bar binding machine 1A, the wires W loosened between the first wire guiding part 23 and the second wire guiding part 24 are moved in a direction denoted with an arrow F2 by the operation of feeding the wires W in the forward direction, as shown in FIG. 8E. Thereby, the loosening of the wires W between the first wire guiding part 23 and the second wire guiding part 24 is eliminated.

In the operation where the loosening of the wires W between the first wire guiding part 23 and the second wire guiding part 24 is eliminated, a lower end of a loosened portion of one wire W1 of the two wires W are guided along the guiding portion 27*c* between the second guide portion 27*b* and one first guide portion 27*a*, so that the one wire W1 is moved upward along the moving direction of the pullout roller 22*a*. In addition, a lower end of a loosened portion of the other wire W2 of the two wires W are guided along the guiding portion 27*c* between the second guide portion 27*b* and the other first guide portion 27*a*, so that the other wire W2 is moved upward along the moving direction of the pullout roller 22*a*.

Thereby, also in the operation where the loosening of the wires W between the first wire guiding part 23 and the second wire guiding part 24 is eliminated, the two wires W between the first wire guiding part 23 and the second wire guiding part 24 are suppressed from moving in the direction in which the wires are aligned in parallel. Therefore, one wire loosened between the first wire guiding part 23 and the second wire guiding part 24 is suppressed from being entangled due to being twisted or the like. In addition, the two wires W loosened between the first wire guiding part 23 and the second wire guiding part 24 are suppressed from moving toward each other and being entangled due to being twisted or the like.

Further, the two wires W loosened between the first wire guiding part 23 and the second wire guiding part 24 are suppressed from moving away from each other and being entangled between the adjacent binding facilities 100A.

Figure 8F:
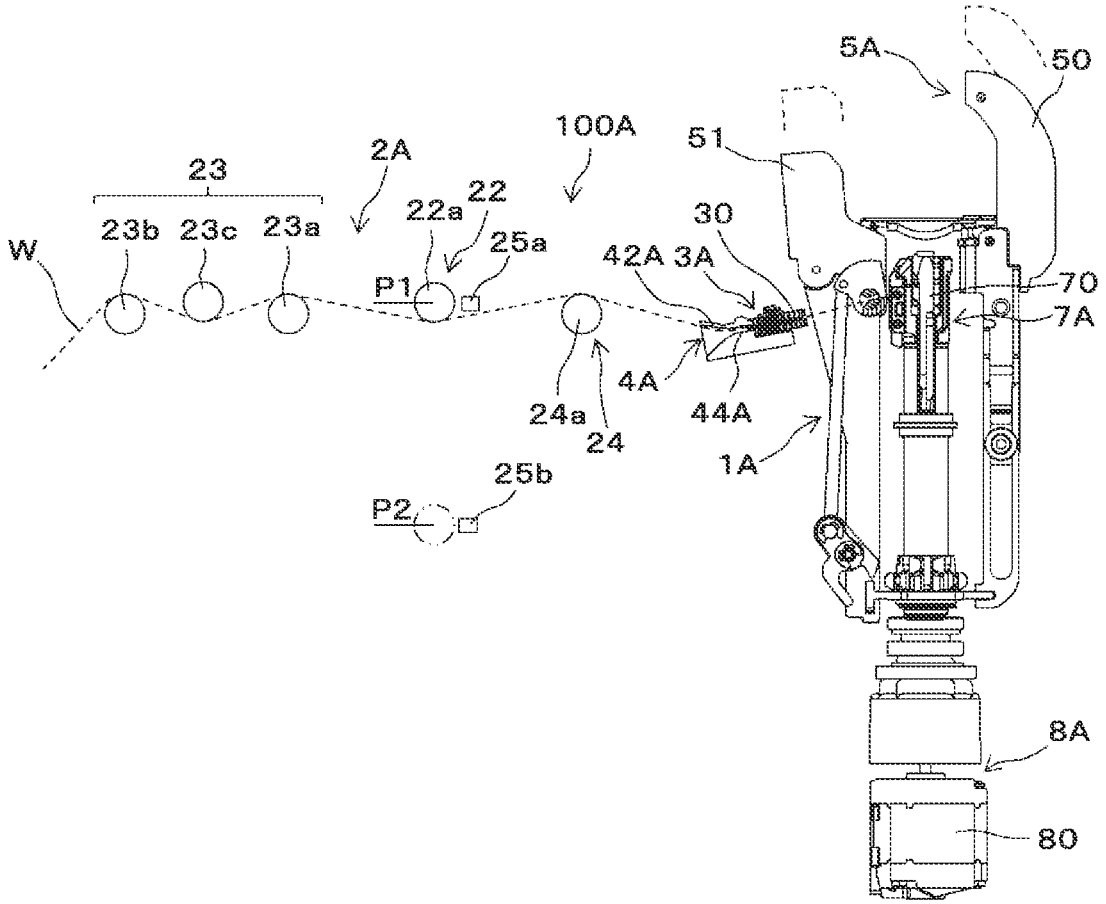
FIG. 8F is a side view of main parts showing an operation of guiding the wires with the wire guide.

FIG. 8F is a side view of main parts showing the operation of guiding the wires with the wire guide. Subsequently, the operation of guiding the wires W to the wire feeding unit 3A with the wire guide 4A between the reinforcing bar binding machine 1A and the wire feeding mechanism 2A is described.

The wire guide 4A is configured so that the upstream side opening 40A with respect to the feeding direction of the wire W that is fed in the forward direction has a larger opening area, as compared to the downstream side opening 41A. In the present example, the wire guide 4A is constituted by the tapered opening whose opening area is largest on an introduction side for the wire W, which is fed from the wire feeding mechanism 2A, and is reduced from the introduction side.

Thereby, when the elevation mechanism 111A is driven to change a height and an orientation of the reinforcing bar binding machine 1A, so that the reinforcing bar binding machine 1A is moved with respect to the wire feeding mechanism 2A, the wire W can be moved in the radial direction intersecting with the feeding direction of the wire W, within the upstream side opening 40A in which the wire W fed from the wire feeding mechanism 2A is introduced.

On the other hand, the wire position regulation part 44A of the wire guide 4A is constituted by the downstream side opening 41A with respect to the forward direction of the wire W that is fed in the forward direction. The wire position regulation part 44A has the opening 41A facing the pair of feeding gears 30, which is provided aligning the position along the axial directions of rotations of the first feeding gear 30L and the second feeding gear 30R with respect to the groove portions 32L of the first feeding gear 30L and the groove portions 32R of the second feeding gear 30R. In addition, the wire position regulation part 44A has such a shape that the opening 41A facing the pair of feeding gears 30 regulates the radial orientation of the wire W. Thereby, even when the height and the orientation of the reinforcing bar binding machine 1A are changed, the wire W that is fed by the second wire guiding part 24 of the wire feeding mechanism 2A can be guided to the downstream side opening 41A by the guide surface 42A of the wire guide 4A and can be guided between the pair of feeding gears 30 by the wire position regulation part 44A. Therefore, the wire W can be suppressed from coming off between the pair of feeding gears 30. In the present example, the two wires W can be suppressed from moving and coming off from the groove portions 32L of the first feeding gear 30L and the groove portions 32R of the second feeding gear 30R along the axial directions of rotations of the first feeding gear 30L and the second feeding gear 30R. For example, as shown in FIG. 8F, even when the reinforcing bar binding machine 1A moves down, a state where the wires W guided by the second wire guiding part 24 of the wire feeding mechanism 2A are guided between the pair of feeding gears 30 by the downstream side opening 41A of the wire guide 4A constituting the wire position regulation part 44A can be maintained. Therefore, when the reinforcing bar binding machine 1A moves up to the binding position, as shown in FIG. 1C, the wires W can be fed by the wire feeding unit 3A. Note that, the pair of feeding members is not limited to the gears having groove portions, and a roller configured to rotatively drive, a configuration where a belt is put on a plurality of rollers aligned in parallel along the feeding direction of the wire W, and the like are also possible. Even with this configuration, it is possible to suppress the wire W from coming off from the feeding members by regulating the position of the wire W along the axial directions of rotations of the feeding members.

<Configuration Example of Binding Facility of Second Embodiment>

Figure 9A:
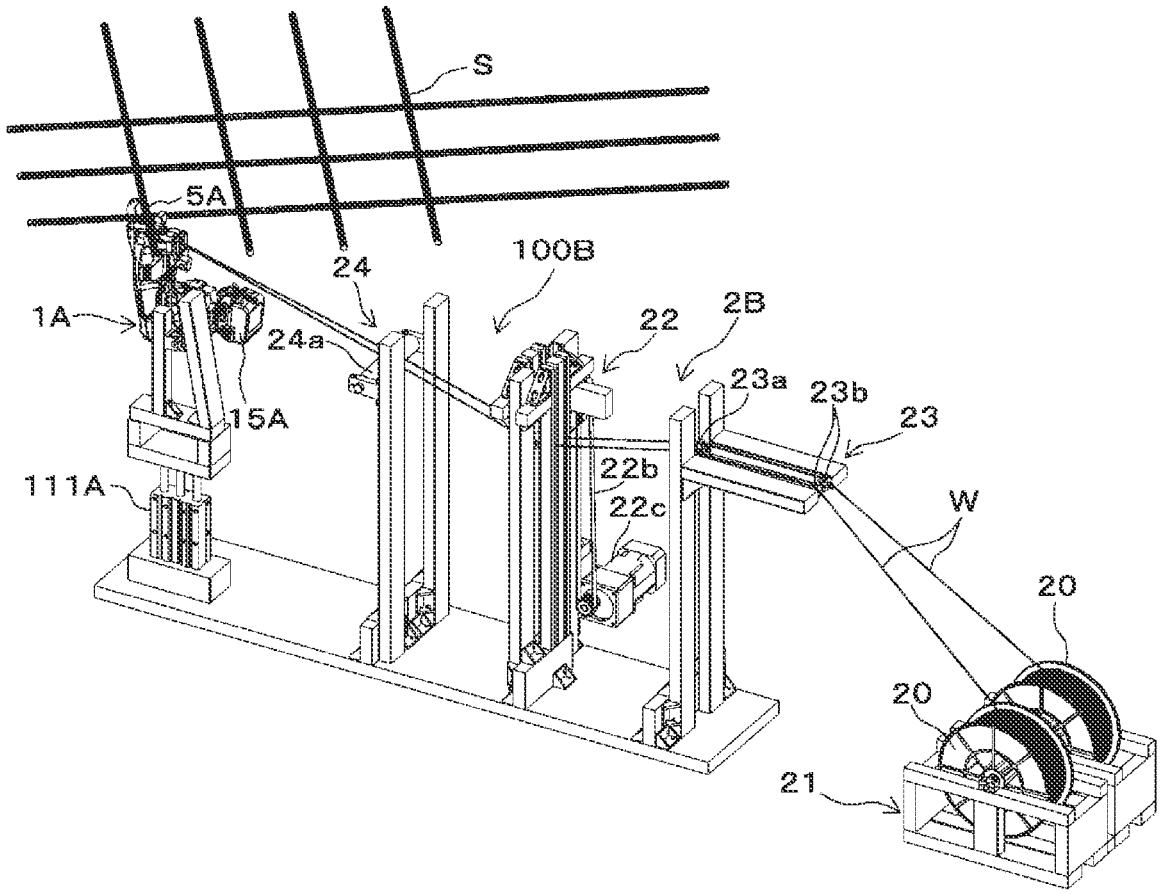
FIG. 9A is a perspective view showing an example of a binding facility according to a second embodiment.
Figure 9B:
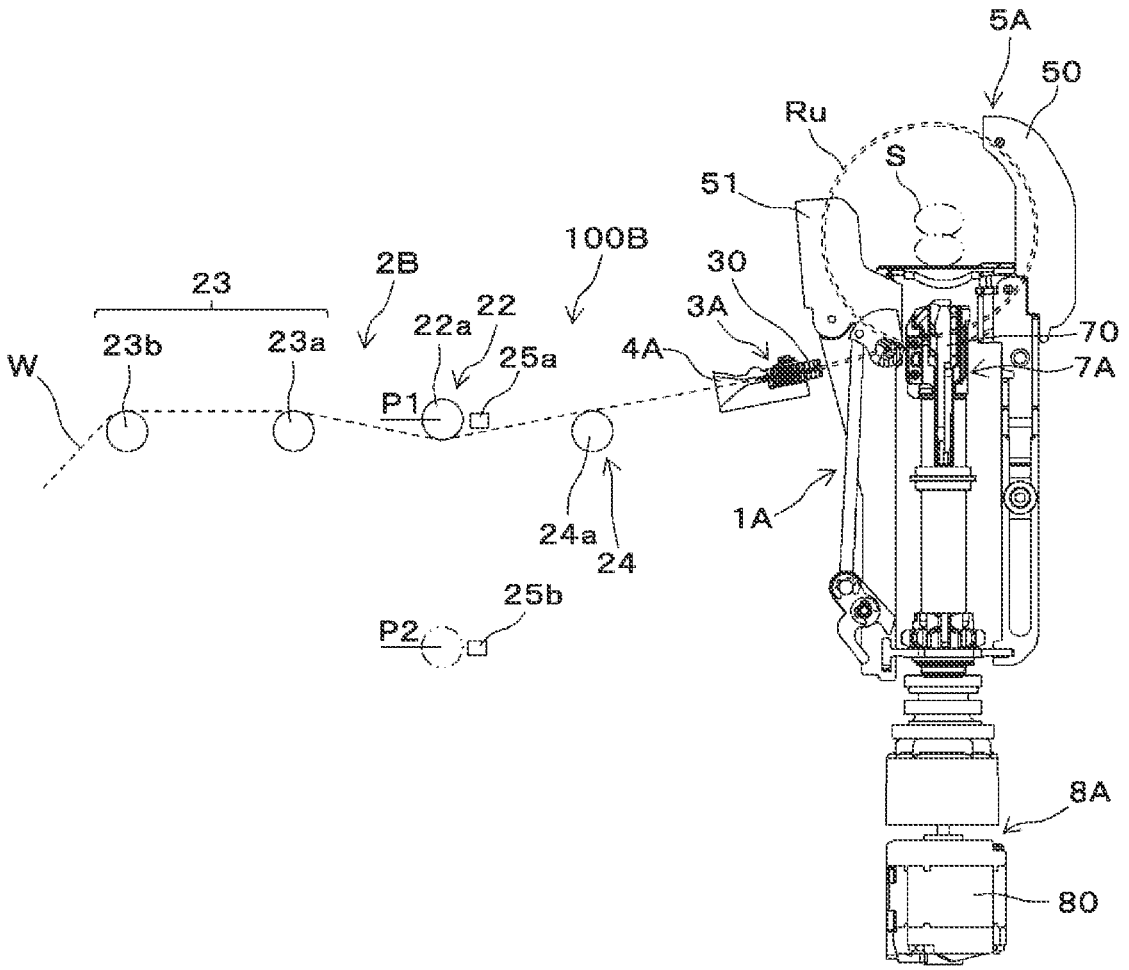
FIG. 9B is a side view of main parts showing the example of the binding facility according to the second embodiment.

FIG. 9A is a perspective view showing an example of a binding facility according to a second embodiment, and FIG. 9B is a side view of main parts showing the example of the binding facility according to the second embodiment.

A binding facility 100B of the second embodiment includes a reinforcing bar binding machine 1A configured to bind reinforcing bars S, which are a binding target, with wires W, and a wire feeding mechanism 2B configured to feed the wires W to the reinforcing bar binding machine 1A. In the binding facility 100B of the second embodiment, the reinforcing bar binding machine 1A may be similar to that of the binding facility 100A of the first embodiment. In addition, in the wire feeding mechanism 2B, the wire pullout mechanism 22 and the second wire guiding part 24 may be similar to those of the binding facility 100A of the first embodiment.

The first wire guiding part 23 has a load applying unit configured to apply a first load in the feeding direction of the wires W. The load applying unit is implemented by a configuration where a predetermined load is applied in the rotation directions of the rollers 23*a* and 23*b*. In the present example, as the load applying unit, a configuration where the roller 23*a* is made not to rotate and the wires W slide along an outer peripheral surface of the roller 23*a* is adopted. On the other hand, the roller 24*a* of the second wire guiding part 24 is caused to rotate by feeding of the wires W. Thereby, the load, which is applied to the wires W that are guided by the first wire guiding part 23, becomes greater than the load, which is applied to the wires W that are guided by the second wire guiding part 24, so that the first load becomes greater than the second load.

<Operation Example of Binding Facility of Second Embodiment>

Figure 10A:
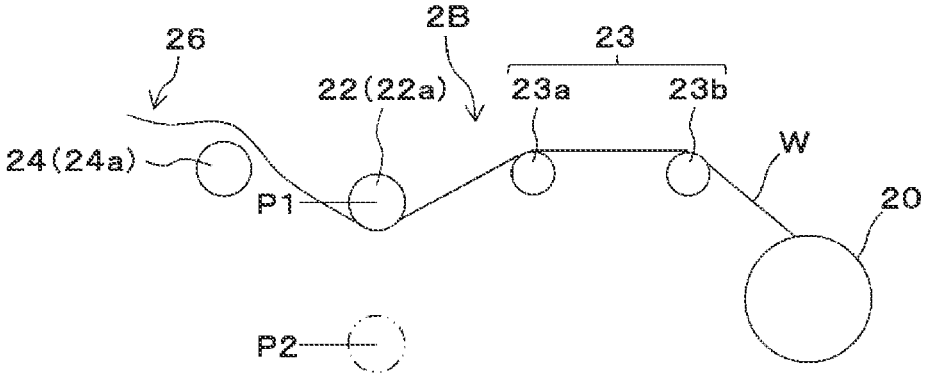
FIG. 10A is an operation illustration view showing an example of the operation of feeding the wires with the wire feeding apparatus.
Figure 10B:
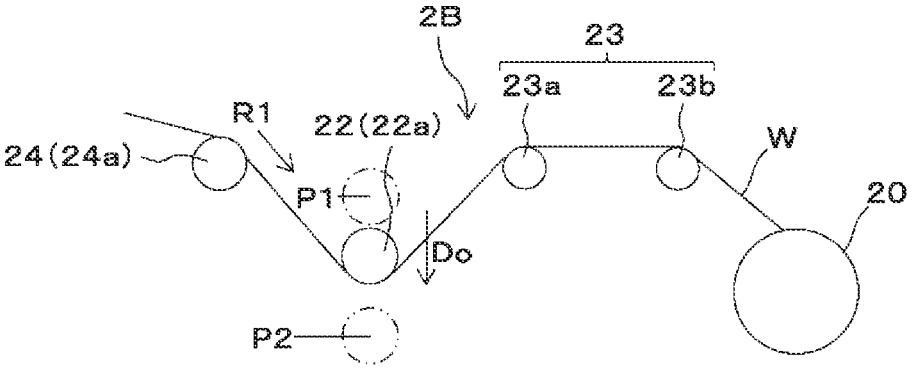
FIG. 10B is an operation illustration view showing the example of the operation of feeding the wires with the wire feeding apparatus.
Figure 10C:
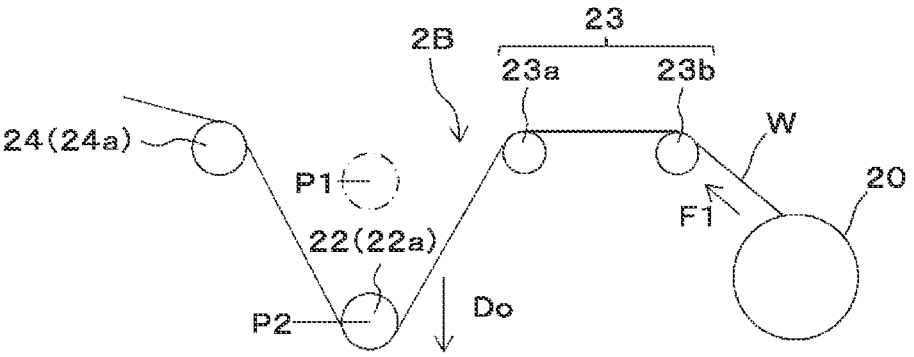
FIG. 10C is an operation illustration view showing the example of the operation of feeding the wires with the wire feeding apparatus.

FIGS. 10A to 10C are operation illustration views showing an example of the operation of feeding the wires by the wire feeding apparatus. Subsequently, the operation of feeding the wires by the wire feeding mechanism 2B is described. Note that, the operation of binding the reinforcing bars S in the reinforcing bar binding machine 1A is similar to the operation described in the flowchart of FIG. 5 and the like. The flow of the operation of feeding the wires by the wire feeding mechanism 2B is also similar to the operation described in the flowchart of FIG. 7.

After the wires W are fed in the reverse direction in step SA4 in the binding operation in the above-described reinforcing bar binding machine 1A until the wires W are fed in the forward direction in step SA3 in a next binding operation, the wire feeding mechanism 2B performs an operation of pulling out predetermined amounts of the wires W from the reels 20.

In step SB1 of FIG. 7, the control unit 110A controls the drive unit 22*b* to rotate the motor 22*c* in the forward direction, thereby moving down the pullout roller 22*a* from the upper limit position P1 in the direction denoted with the arrow Do. In the wire pullout mechanism 22, the pullout roller 22*a* moves down from the upper limit position P1 to the lower limit position P2 along the direction intersecting with the wires W between the roller 23*a* of the first wire guiding part 23 and the roller 24*a* of the second wire guiding part 24.

When the pullout roller 22*a* starts to move down from the upper limit position P1, the wires W between the roller 23*a* of the first wire guiding part 23 and the roller 24*a* of the second wire guiding part 24 are pulled downward, so that the wires W between the reels 20 and the first wire guiding part 23 and the wires W between the reinforcing bar binding machine 1A and the second wire guiding part 24 are pulled between the first wire guiding part 23 and the second wire guiding part 24. Therefore, the wires W between the reinforcing bar binding machine 1A and the second wire guiding part 24 and the wires W between the first wire guiding part 23 and the reels 20 accommodated in the reel accommodation part 21 are fed between the roller 23*a* of the first wire guiding part 23 and the roller 24*a* of the second wire guiding part 24.

As described above, the load, which is applied to the wires W that are guided by the first wire guiding part 23, is set greater than the load, which is applied to the wires W that are guided by the second wire guiding part 24, so that the first load becomes greater than the second load.

In addition, in the operation of winding the wires W on the reinforcing bars S by the reinforcing bar binding machine 1A, the wires W are fed in the reverse direction, so that the wires W are loosened between the reinforcing bar binding machine 1A and the second wire guiding part 24, as shown in FIG. 10A.

Thereby, in the operation of pulling the wires W with the pullout roller 22*a* of the wire pullout mechanism 22, as shown in step SB2 of FIG. 7 and in FIG. 10B, since the first load is greater than the second load, a surplus of the wires W loosened between the reinforcing bar binding machine 1A and the second wire guiding part 24 is first drawn between the roller 23*a* of the first wire guiding part 23 and the roller 24*a* of the second wire guiding part 24, as shown with the arrow R1.

When the surplus of the wires W between the reinforcing bar binding machine 1A and the second wire guiding part 24 is fed to eliminate the loosening of the wires W, the wires W between the reinforcing bar binding machine 1A and the second wire guiding part 24 cannot be fed because the pair of feeding gears 30 of the wire feeding unit 3A is in a stationary state and does not rotate. Thereby, the feeding gears 30 become a load, so that the tension applied to the wires W between the reinforcing bar binding machine 1A and the second wire guiding part 24 increases. As a result, the load by the feeding gears 30 is added to the second load, so that a sum of the second load and the load of the feeding gears becomes greater than the first load.

When the sum of the second load and the load of the feeding gears becomes greater than the first load, as shown in step SB3 of FIG. 7 and with the arrow F1 in FIG. 10C, the wires W are pulled out from the reels 20 accommodated in the reel accommodation part 21 and are fed between the roller 23*a* of the first wire guiding part 23 and the roller 24*a* of the second wire guiding part 24. A moving amount of the pullout roller 22*a* is set so that amounts of the wires W required to eliminate the loosening of the wires W between the reinforcing bar binding machine 1A and the second wire guiding part 24 and to bind the reinforcing bars S by the reinforcing bar binding machine 1A can be pulled out from the reels 20 when the pullout roller 22*a* is moved to the lower limit position.

Figure 10D:
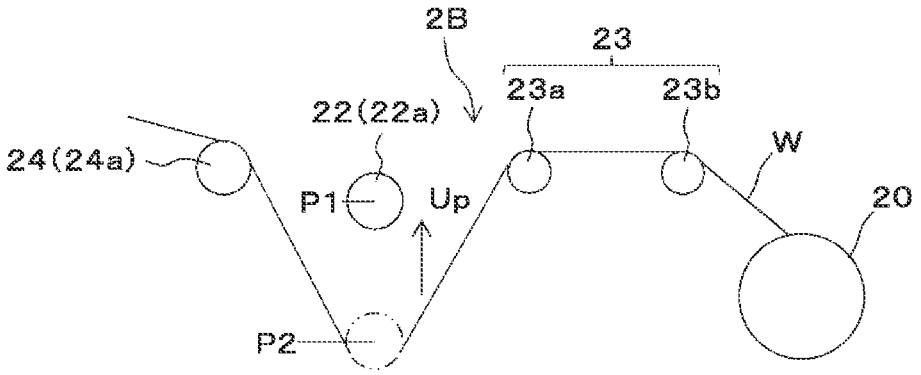
FIG. 10D is an operation illustration view showing the example of the operation of feeding the wires with the wire feeding apparatus.

In step SB4 of FIG. 7, when the lower limit detection sensor 25*b* detects that the pullout roller 22*a* is moved to the lower limit position, the control unit 110A switches the rotation direction of the motor 22*c* from the forward rotation to the reverse rotation, thereby moving up the pullout roller 22*a* in the direction denoted with the arrow Up, as shown in step SB5 of FIG. 7 and in FIG. 10D. In step SB6 of FIG. 7, when the upper limit detection sensor 25*a* detects that the pullout roller 22*a* is moved to the upper limit position, the control unit 110A stops the rotation of the motor 22*c*, in step SB7. Thereby, the amounts of the wires W required to bind the reinforcing bars S by the reinforcing bar binding machine 1A become in a loosened state between the roller 23*a* of the first wire guiding part 23 and the roller 24*a* of the second wire guiding part 24.

Figure 10E:
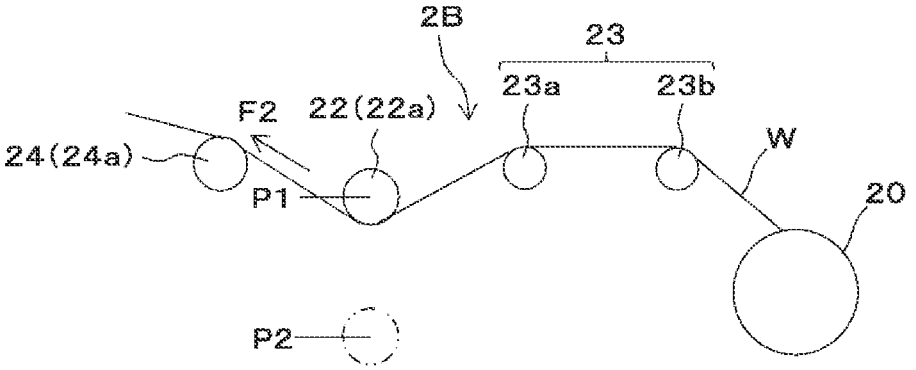
FIG. 10E is an operation illustration view showing the example of the operation of feeding the wires with the wire feeding apparatus.

In a next binding operation that is executed by the reinforcing bar binding machine 1A, the wires W loosened between the roller 23*a* of the first wire guiding part 23 and the roller 24*a* of the second wire guiding part 24 are fed in the direction denoted with the arrow F2 by the operation of feeding the wires W in the forward direction in step SA3, as shown in FIG. 10E.

Thereby, also in the wire feeding mechanism 2B, in the operation of feeding the wires W in the reverse direction by the reinforcing bar binding machine 1A so as to wind the wires W on the reinforcing bars S, the loosening of the wires W occurring between the reinforcing bar binding machine 1A and the second wire guiding part 24 can be eliminated in the operation of pulling out the wires W by the wire pullout mechanism 22. In addition, in the operation of pulling out the wires W by the wire pullout mechanism 22, the amounts of the wires W required to bind the reinforcing bars S by the reinforcing bar binding machine 1A can be pulled out from the reels 20.

<Configuration Example of Binding Facility of Third Embodiment>

Figure 11A:
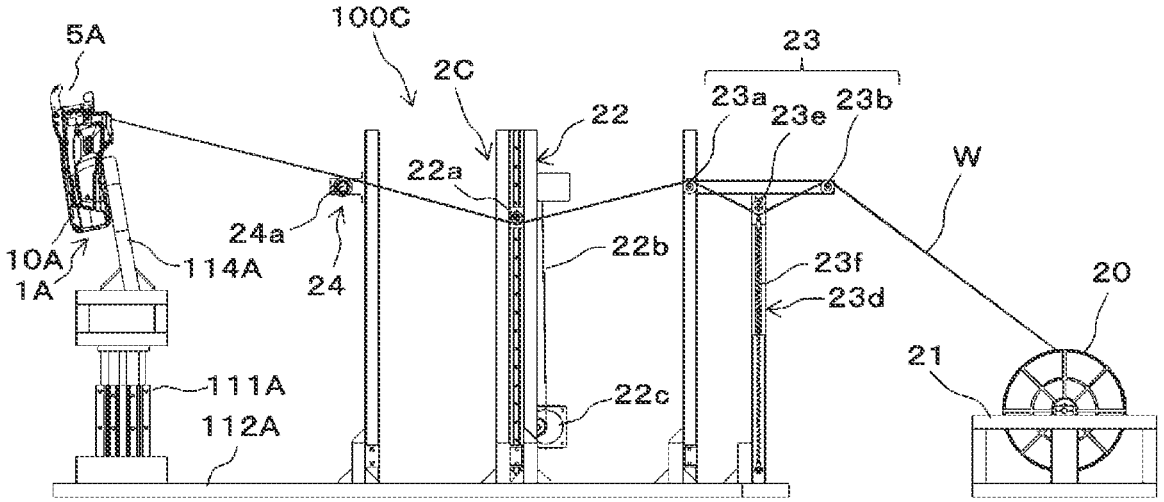
FIG. 11A is a side view showing an example of a binding facility according to a third embodiment.
Figure 11B:
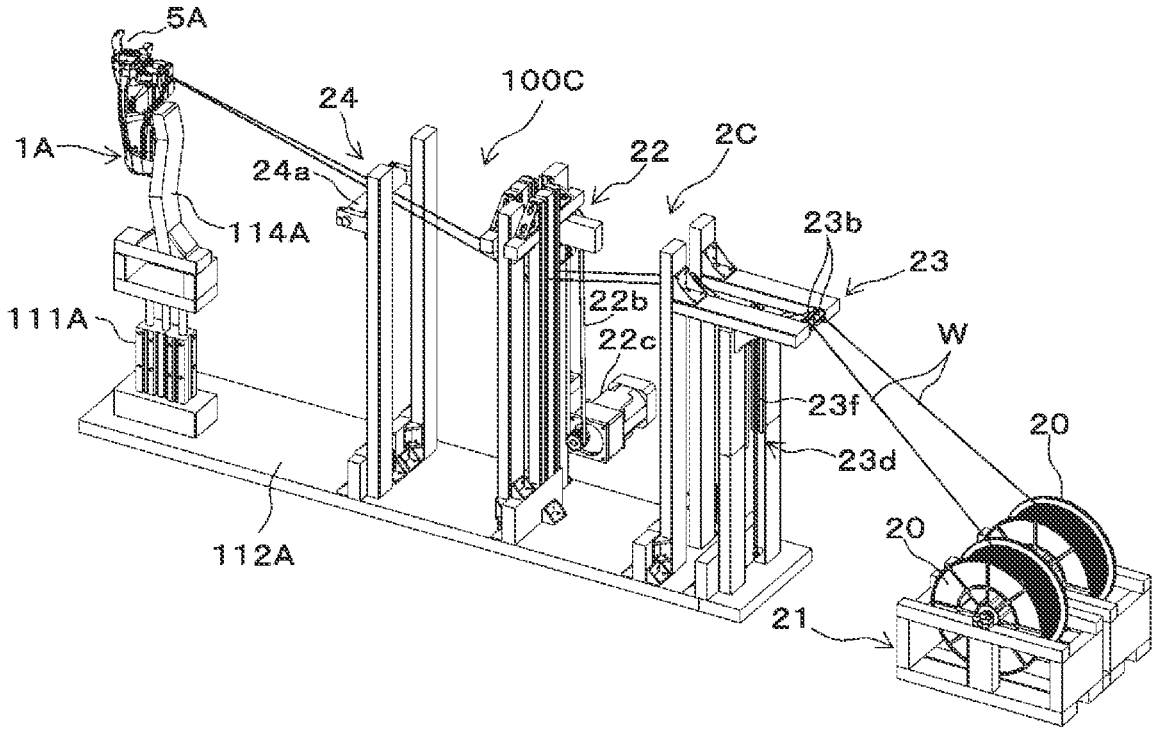
FIG. 11B is a perspective view showing the example of the binding facility according to the third embodiment.
Figure 11C:
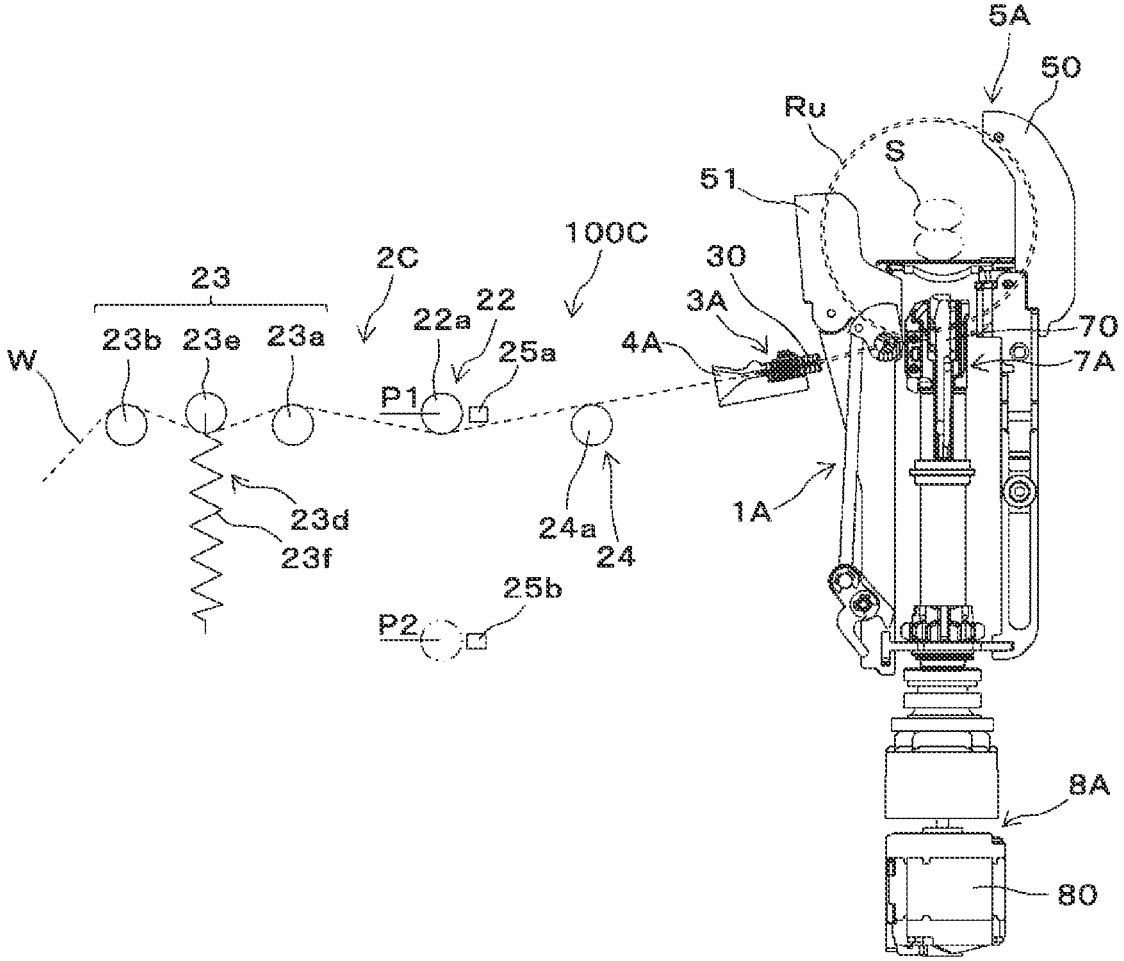
FIG. 11C is a side view of main parts showing the example of the binding facility according to the third embodiment.

FIG. 11A is a side view showing an example of a binding facility according to a third embodiment, FIG. 11B is a perspective view showing the example of the binding facility according to the third embodiment, and FIG. 11C is a side view of main parts showing the example of the binding facility according to the third embodiment.

A binding facility 100C of the third embodiment includes a reinforcing bar binding machine 1A configured to bind reinforcing bars S, which are a binding target, with wires W, and a wire feeding mechanism 2C configured to feed the wires W to the reinforcing bar binding machine 1A. In the binding facility 100C of the third embodiment, the reinforcing bar binding machine 1A may be similar to that of the binding facility 100A of the first embodiment. The wire pullout mechanism 22 and the second wire guiding part 24 of the wire feeding mechanism 2C may also be similar to those of the binding facility 100A of the first embodiment.

The first wire guiding part 23 has rollers 23*a* and 23*c* provided on an upstream side of the wire pullout mechanism 22 with respect to the feeding direction of the wires W that are fed from the reels 20 accommodated in the reel accommodation part 21 to the reinforcing bar binding machine 1A. The first wire guiding part 23 is configured to guide the path, along which the wires W pulled out from the reels 20 accommodated in the reel accommodation part 21 are fed, toward the roller 23*a* by the roller 23*b* and to guide the path toward the second wire guiding part 24 by the roller 23*a*.

The first wire guiding part 23 has a wire loosening absorption mechanism 23*d* configured to absorb loosening of the wires W. The wire loosening absorption mechanism 23*d* has a loosening absorption roller 23*e* provided between the rollers 23*a* and 23*b*, and a spring 23*f* for urging downward the loosening absorption roller 23*e* in a direction intersecting with the wires W between the roller 23*a* and the roller 23*b*.

The loosening absorption roller 23*e* of the first wire guiding part 23 is in contact with the wires W between the roller 23*a* and the roller 23*b* from the upper side that is an opposite side to a side on which the rollers 23*a* and 23*b* are in contact with the wire. The loosening absorption roller 23*e* is urged downward in the direction intersecting with the wires W between the roller 23*a* and the roller 23*b* by the spring 23*f*, so that a position thereof in the height direction is prescribed by a balance between the urging force of the spring 23*f* and the tension applied to the wires W.

<Operation Example of Binding Facility of Third Embodiment>

Figure 12:
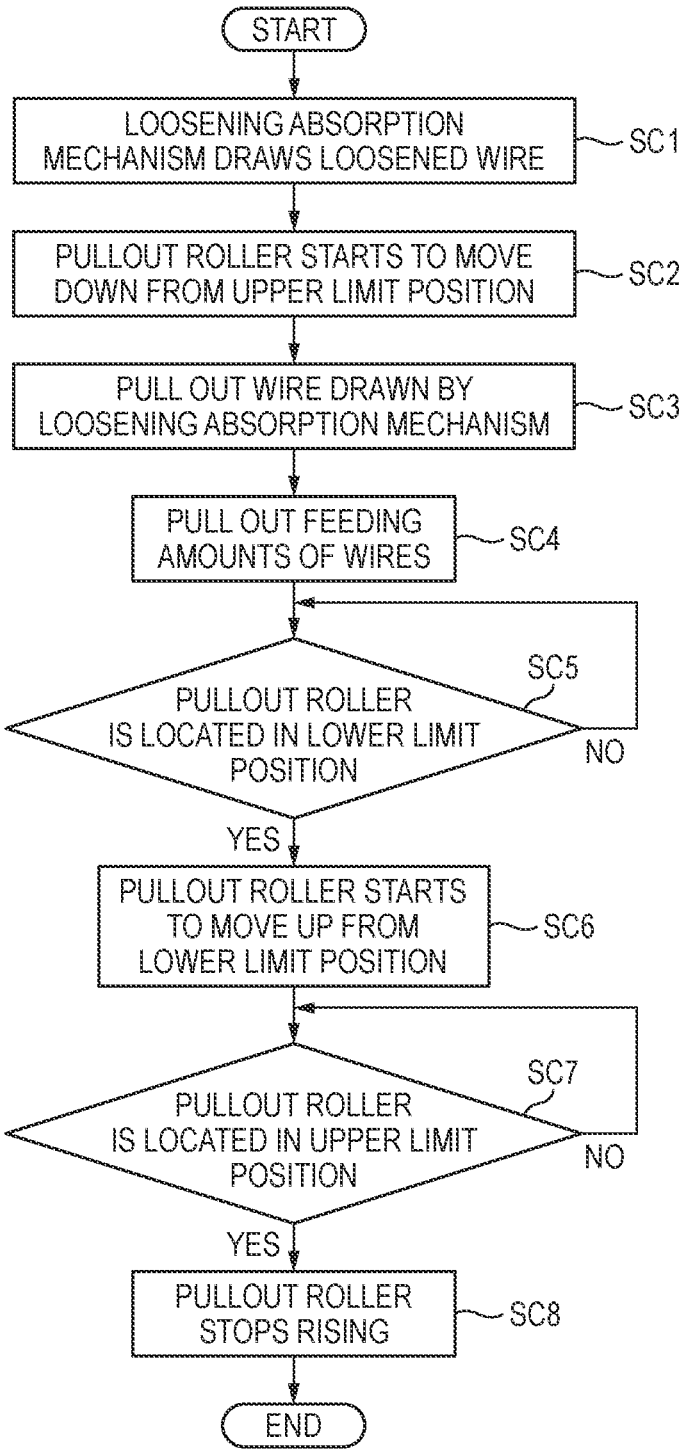
FIG. 12 is a flowchart showing an example of the operation of feeding the wires with the wire feeding apparatus.

FIG. 12 is a flowchart showing an example of the operation of feeding the wires with the wire feeding apparatus, and FIGS. 13A to 13F are operation illustration views showing the example of the operation of feeding the wires with the wire feeding apparatus. Subsequently, the operation of feeding the wires with the wire feeding mechanism 2C is described. Note that, the operation of binding the reinforcing bars S in the reinforcing bar binding machine 1A is similar to the operation described in the flowchart of FIG. 5, and the like.

After the wires W are fed in the reverse direction in step SA4 in the binding operation in the above-described reinforcing bar binding machine 1A until the wires W are fed in the forward direction in step SA3 in a next binding operation, the wire feeding mechanism 2C performs an operation of pulling out predetermined amounts of the wires W from the reels 20.

Figure 13A:
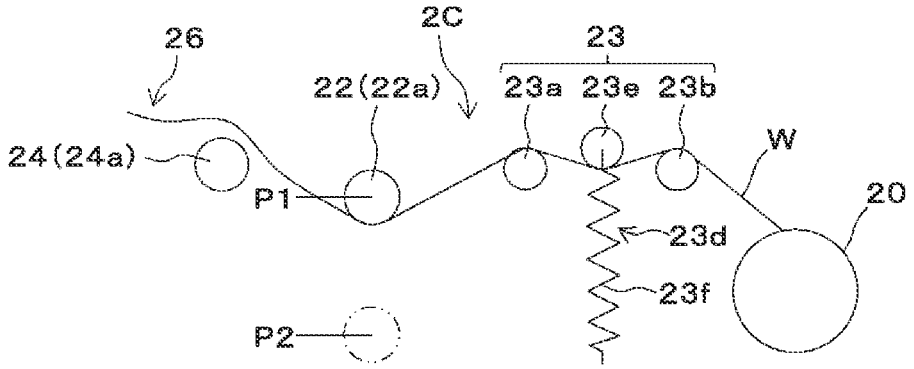
FIG. 13A is an operation illustration view showing an example of the operation of feeding the wires with the wire feeding apparatus.
Figure 13B:
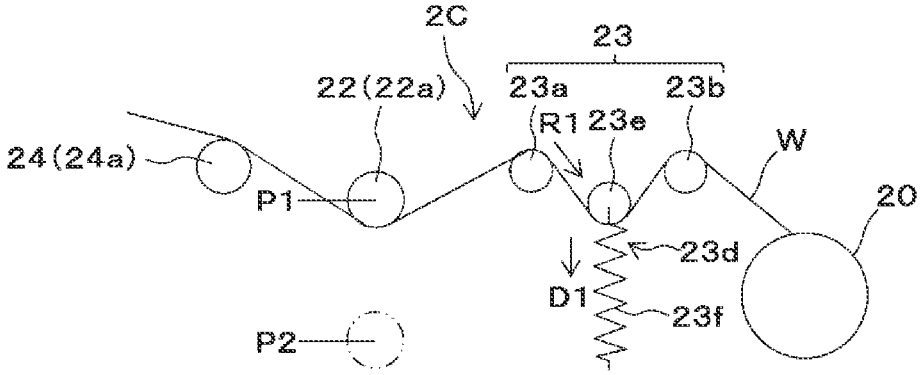
FIG. 13B is an operation illustration view showing the example of the operation of feeding the wires with the wire feeding apparatus.
Figure 13C:
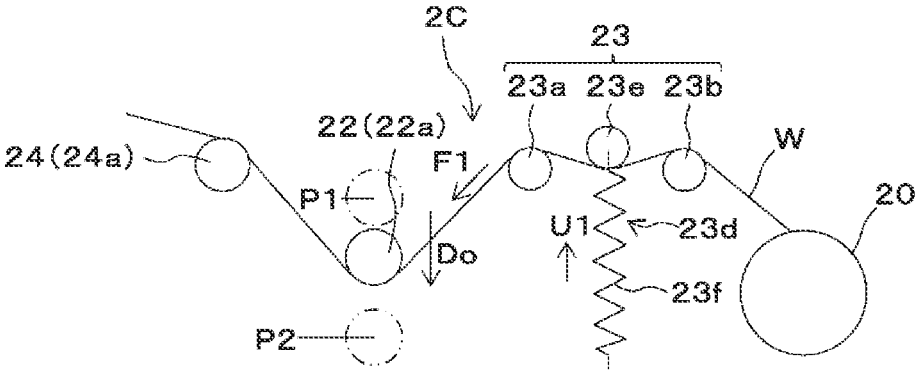
FIG. 13C is an operation illustration view showing the example of the operation of feeding the wires with the wire feeding apparatus.

As described above, in the operation of winding the wires W on the reinforcing bars S by the reinforcing bar binding machine 1A, the wires W are fed in the reverse direction, so that the wires W are loosened between the reinforcing bar binding machine 1A and the second wire guiding part 24, as shown in FIG. 13A.

Thereby, the tension that is applied to the wires W in the wire feeding mechanism 2C is reduced. When the tension that is applied to the wires W are reduced, the urging force of the spring 23*f* becomes greater than the tension applied to the wires W, so that the loosening absorption roller 23*e* moves down in a direction denoted with an arrow D1 along the direction intersecting with the wires W between the roller 23*a* and the roller 23*b*.

When the loosening absorption roller 23*e* moves down, the wires W between the roller 23*a* and the roller 23*b* are pulled downward. Thereby, as shown in step SC1 of FIG. 12 and in FIG. 13B, the surplus of the loosened wires W are drawn between the roller 23*a* and the roller 23*b* of the first wire guiding part 23, as shown with the arrow R1.

In step SC2 of FIG. 12, the control unit 110A controls the drive unit 22*b* to rotate the motor 22*c* in the forward direction, thereby moving down the pullout roller 22*a* from the upper limit position P1 in the direction denoted with the arrow Do. In the wire pullout mechanism 22, the pullout roller 22*a* moves down from the upper limit position P1 to the lower limit position P2 along the direction intersecting with the wires W between the roller 23*a* of the first wire guiding part 23 and the roller 24*a* of the second wire guiding part 24.

When the pullout roller 22*a* starts to move down from the upper limit position P1, the wires W between the roller 23*a* of the first wire guiding part 23 and the roller 24*a* of the second wire guiding part 24 are pulled downward, so that the wires W between the reels 20 and the first wire guiding part 23 and the wires W between the reinforcing bar binding machine 1A and the second wire guiding part 24 are pulled between the first wire guiding part 23 and the second wire guiding part 24.

Thereby, the tension that is applied to the wires W in the wire feeding mechanism 2C is increased. When the tension applied to the wires W are increased, the urging force of the spring 23*f* becomes relatively smaller than the tension that is applied to the wires W, so that the loosening absorption roller 23*e* moves up in a direction denoted with an arrow U1 along the direction intersecting with the wires W between the roller 23*a* and the roller 23*b*. For this reason, as shown in step SC3 of FIG. 12 and in FIG. 13C, the wires W between the roller 23*a* and the roller 23*b* of the first wire guiding part 23 whose loosening has been absorbed by the loosening absorption mechanism 23*d* are first drawn between the roller 23*a* of the first wire guiding part 23 and the roller 24*a* of the second wire guiding part 24, as shown with the arrow F1.

Figure 13D:
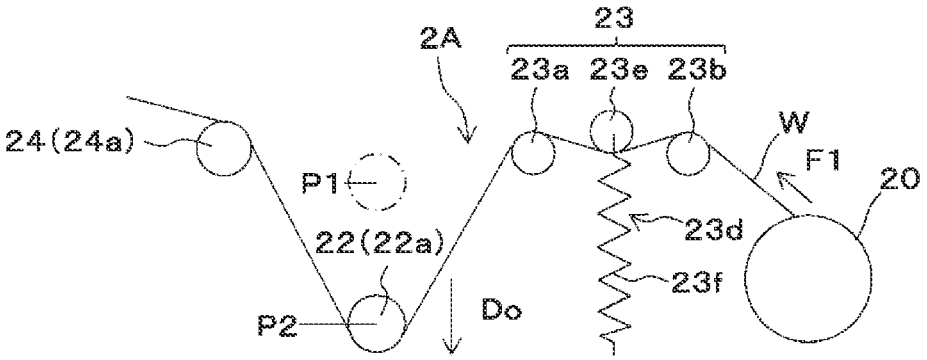
FIG. 13D is an operation illustration view showing the example of the operation of feeding the wires with the wire feeding apparatus.

When the urging force of the spring 23*f* and the tension applied to the wires W are balanced, the wires W are pulled out from the reels 20 accommodated in the reel accommodation part 21 and are fed between the roller 23*a* of the first wire guiding part 23 and the roller 24*a* of the second wire guiding part 24, as shown in step SC4 of FIG. 12 and with the arrow F1 in FIG. 13D. A moving amount of the pullout roller 22*a* is set so that amounts of the wires W required to eliminate the surplus of the wires W on the feeding path 26 of the wires W between the reinforcing bar binding machine 1A and the second wire guiding part 24 whose loosening is absorbed by the wire loosening absorption mechanism 23*d* and to bind the reinforcing bars S by the reinforcing bar binding machine 1A can be pulled out from the reels 20 when the pullout roller 22*a* is moved to the lower limit position P2.

Figure 13E:
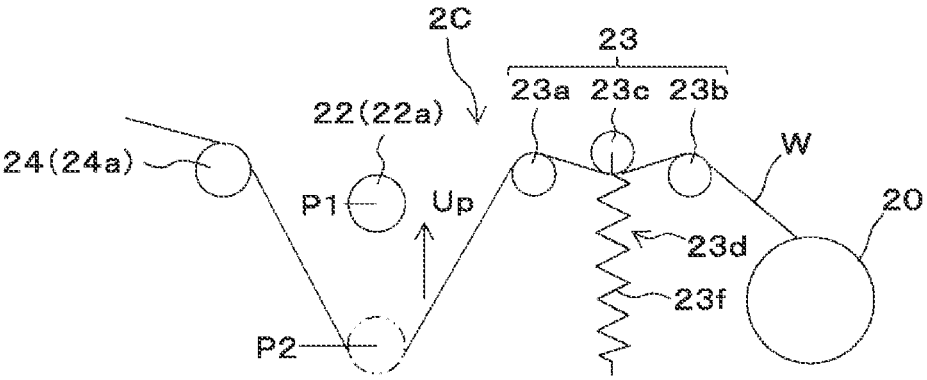
FIG. 13E is an operation illustration view showing the example of the operation of feeding the wires with the wire feeding apparatus.

In step SC5 of FIG. 12, when the lower limit detection sensor 25*b* detects that the pullout roller 22*a* is moved to the lower limit position P2, the control unit 110A switches the rotation direction of the motor 22*c* from the forward rotation to the reverse rotation, thereby moving up the pullout roller 22*a* in a direction denoted with an arrow Up, as shown in step SC6 of FIG. 12 and in FIG. 13E. In step SC7 of FIG. 12, when the upper limit detection sensor 25*a* detects that the pullout roller 22*a* is moved to the upper limit position P1, the control unit 110A stops the rotation of the motor 22*c*, in step SB7. Thereby, the amounts of the wires W required to bind the reinforcing bars S by the reinforcing bar binding machine 1A become in a loosened state between the roller 23*a* of the first wire guiding part 23 and the roller 24*a* of the second wire guiding part 24.

Figure 13F:
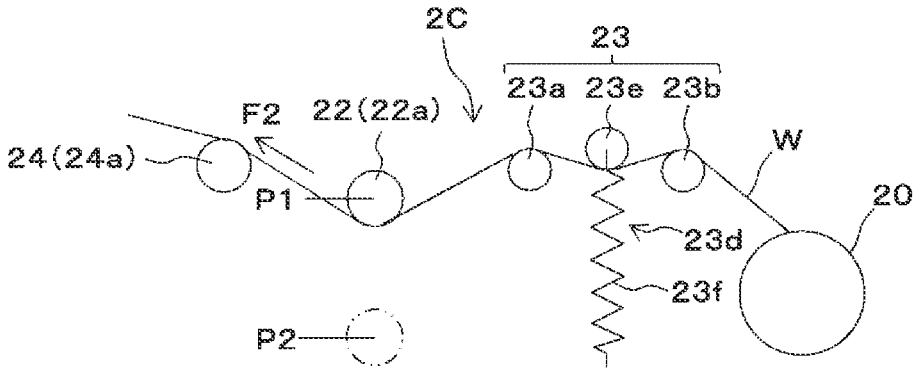
FIG. 13F is an operation illustration view showing the example of the operation of feeding the wires with the wire feeding apparatus.

In a next binding operation that is executed by the reinforcing bar binding machine 1A, the wires W loosened between the roller 23*a* of the first wire guiding part 23 and the roller 24*a* of the second wire guiding part 24 are fed in the direction denoted with the arrow F2 by the operation of feeding the wires W in the forward direction in step SA3, as shown in FIG. 13F.

Thereby, also in the wire feeding mechanism 2C, the first wire guiding part 23 is provided with the wire loosening absorption mechanism 23*d*, so that the loosening of the wires W occurring between the reinforcing bar binding machine 1A and the second wire guiding part 24 in the operation of feeding the wires W in the reverse direction by the reinforcing bar binding machine 1A so as to wind the wires W on the reinforcing bars S can be absorbed and eliminated by the wire loosening absorption mechanism 23*d*. In addition, in the operation of pulling out the wires W by the wire pullout mechanism 22, the amounts of the wires W required to bind the reinforcing bars S by the reinforcing bar binding machine 1A can be pulled out from the reels 20.

<Configuration Example of Binding Facility of Fourth Embodiment>

Figure 14:
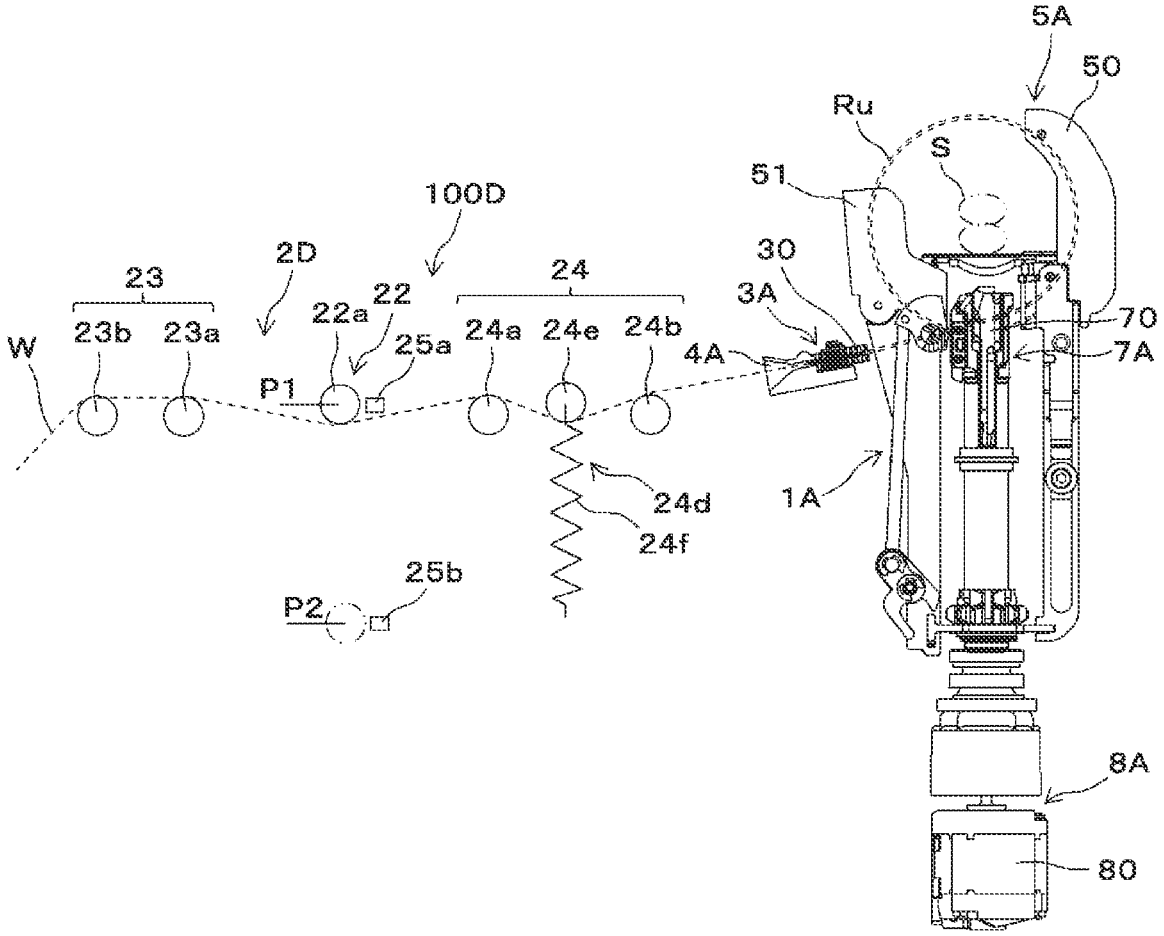
FIG. 14 is a side view of main parts showing an example of a binding facility according to a fourth embodiment.

FIG. 14 is a side view of main parts showing an example of a binding facility according to a fourth embodiment.

A binding facility 100D of the fourth embodiment includes a reinforcing bar binding machine 1A configured to bind reinforcing bars S, which are a binding target, with wires W, and a wire feeding mechanism 2D configured to feed the wires W to the reinforcing bar binding machine 1A. In the binding facility 100D of the fourth embodiment, the reinforcing bar binding machine 1A may be similar to the binding facility 100A of the first embodiment. In addition, the wire pullout mechanism 22 and the first wire guiding part 23 of the wire feeding mechanism 2D may be similar to those of the binding facility 100A of the first embodiment or the binding facility 100B of the second embodiment.

The second wire guiding part 24 has rollers 24*a* and 24*c* provided on a downstream side of the wire pullout mechanism 22 with respect to the feeding direction of the wires W that are fed from the reel 20 accommodated in the reel accommodation part 21 to the reinforcing bar binding machine 1A. The second wire guiding part 24 is configured to guide the feeding path of the wires W that are pulled out by the wire pullout mechanism 22 toward the roller 24*b* by the roller 24*a* and to guide the feeding path toward the reinforcing bar binding machine 1A by the roller 24*c*.

The second wire guiding part 24 has a wire loosening absorption mechanism 24*d* configured to absorb loosening of the wires W. The wire loosening absorption mechanism 24*d* has a loosening absorption roller 24*e* provided between the rollers 24*a* and 24*b*, and a spring 24*f* for urging downward the loosening absorption roller 24*e* in the direction intersecting with the wires W between the roller 24*a* and the roller 24*b*.

The loosening absorption roller 24*e* of the second wire guiding part 24 is in contact with the wires W between the roller 24*a* and the roller 24*b* from the upper side that is an opposite side to a side on which the rollers 24*a* and 24*b* are in contact with the wire. The loosening absorption roller 24*e* is urged downward in the direction intersecting with the wires W between the roller 24*a* and the roller 24*b* by the spring 24*f*, so that a position thereof in the height direction is prescribed by a balance between the urging force of the spring 24*f* and the tension applied to the wires W.

<Operation Example of Binding Facility of Fourth Embodiment>

FIGS. 15A to 15F are operation illustration views showing an example of the operation of feeding the wires with the wire feeding apparatus. Subsequently, the operation of feeding the wires with the wire feeding mechanism 2D is described. Note that, the operation of binding the reinforcing bars S in the reinforcing bar binding machine 1A is similar to the operation described in the flowchart of FIG. 5, and the like. In addition, the flow of the operation of feeding the wire by the wire feeding mechanism 2D is similar to the operation described in the flowchart of FIG. 12.

After the wires W are fed in the reverse direction in step SA4 in the binding operation in the above-described reinforcing bar binding machine 1A until the wires W are fed in the forward direction in step SA3 in a next binding operation, the wire feeding mechanism 2D performs an operation of pulling out predetermined amounts of the wires W from the reels 20.

Figure 15A:
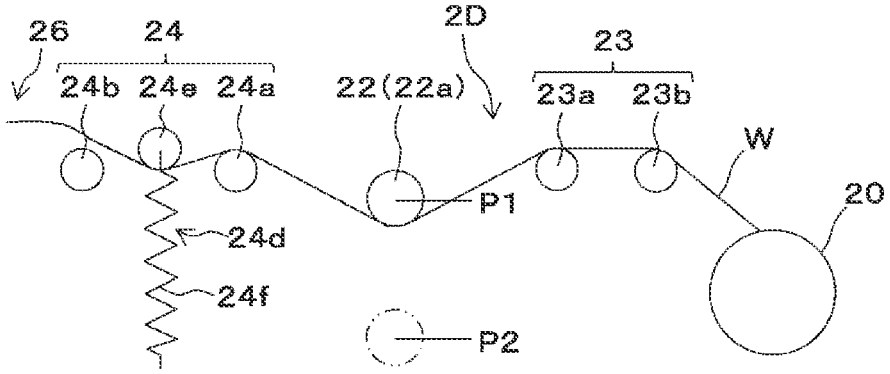
FIG. 15A is an operation illustration view showing an example of the operation of feeding the wires with the wire feeding apparatus.
Figure 15B:
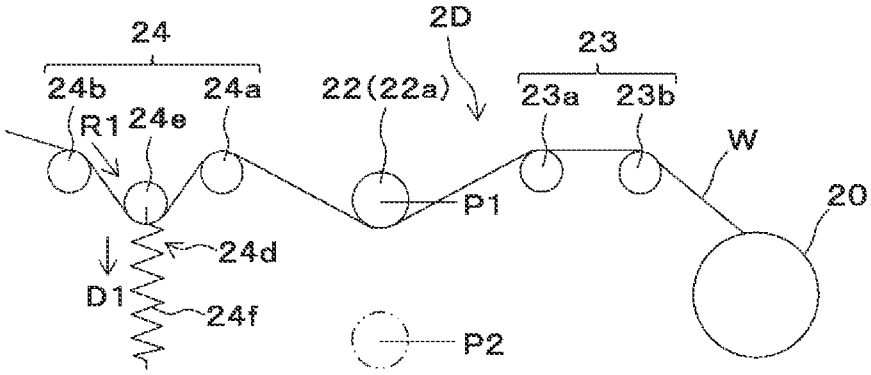
FIG. 15B is an operation illustration view showing an example of the operation of feeding the wires with the wire feeding apparatus.
Figure 15C:
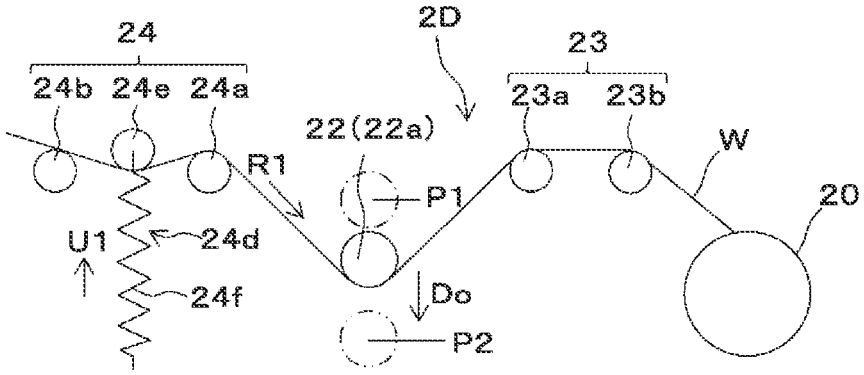
FIG. 15C is an operation illustration view showing an example of the operation of feeding the wires with the wire feeding apparatus.

As described above, in the operation of winding the wires W on the reinforcing bars S by the reinforcing bar binding machine 1A, the wires W are fed in the reverse direction, so that the wires W are loosened between the reinforcing bar binding machine 1A and the second wire guiding part 24, as shown in FIG. 15A.

Thereby, the tension that is applied to the wires W in the wire feeding mechanism 2D is reduced. When the tension applied to the wires W are reduced, the urging force of the spring 23*f* becomes greater than the tension that is applied to the wires W, so that the loosening absorption roller 24*e* moves down in the direction denoted with the arrow D1 along the direction intersecting with the wires W between the roller 24*a* and the roller 24*b*.

When the loosening absorption roller 24*e* moves down, the wires W between the roller 24*a* and the roller 24*b* are pulled downward. Thereby, as shown in step SC1 of FIG. 12 and in FIG. 15B, the surplus of the loosened wires W are drawn between the roller 24*a* and the roller 24*b* of the second wire guiding part 24, as shown with the arrow R1.

In step SC2 of FIG. 12, the control unit 110A controls the drive unit 22*b* to rotate the motor 22*c* in the forward direction, thereby moving down the pullout roller 22*a* from the upper limit position P1 in the direction denoted with the arrow Do. In the wire pullout mechanism 22, the pullout roller 22*a* moves down from the upper limit position P1 to the lower limit position P2 along the direction intersecting with the wires W between the roller 23*a* of the first wire guiding part 23 and the roller 24*a* of the second wire guiding part 24.

When the pullout roller 22*a* starts to move down from the upper limit position P1, the wires W between the roller 23*a* of the first wire guiding part 23 and the roller 24*a* of the second wire guiding part 24 are pulled downward, so that the wires W between the reels 20 and the first wire guiding part 23 and the wires W between the reinforcing bar binding machine 1A and the second wire guiding part 24 are pulled between the first wire guiding part 23 and the second wire guiding part 24.

Thereby, the tension that is applied to the wires W in the wire feeding mechanism 2D is increased. When the tension applied to the wires W are increased, the urging force of the spring 24*f* becomes relatively smaller than the tension that is applied to the wires W, so that the loosening absorption roller 24*e* moves up in the direction denoted with the arrow U1 along the direction intersecting with the wires W between the roller 24*a* and the roller 24*b*. For this reason, as shown in step SC3 of FIG. 12 and in FIG. 15C, the wires W between the roller 24*a* and the roller 24*b* of the second wire guiding part 24 whose loosening has been absorbed by the loosening absorption mechanism 24*d* are first drawn between the roller 23*a* of the first wire guiding part 23 and the roller 24*a* of the second wire guiding part 24, as shown with the arrow R1.

Figure 15D:
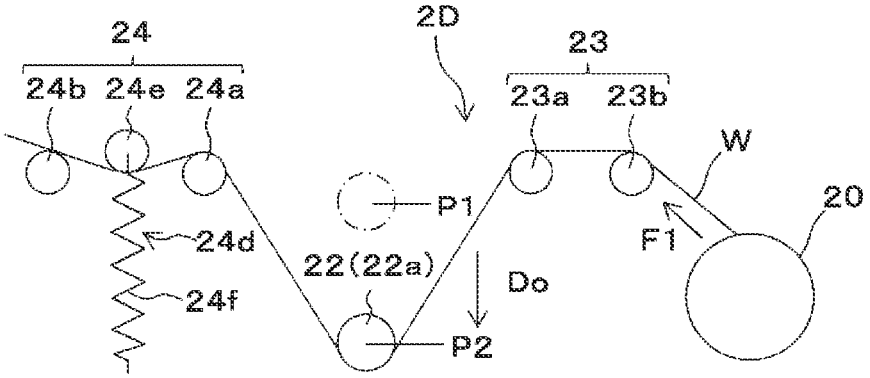
FIG. 15D is an operation illustration view showing the example of the operation of feeding the wires with the wire feeding apparatus.

When the urging force of the spring 24*f* and the tension applied to the wires W are balanced, the wires W are pulled out from the reels 20 accommodated in the reel accommodation part 21 and are fed between the roller 23*a* of the first wire guiding part 23 and the roller 24*a* of the second wire guiding part 24, as shown in step SC4 of FIG. 12 and with the arrow F1 in FIG. 15D. A moving amount of the pullout roller 22*a* is set so that amounts of the wires W required to eliminate the surplus of the wires W on the feeding path 26 of the wires W between the reinforcing bar binding machine 1A and the second wire guiding part 24 whose loosening is absorbed by the wire loosening absorption mechanism 24*d* and to bind the reinforcing bars S by the reinforcing bar binding machine 1A can be pulled out from the reels 20 when the pullout roller 22*a* is moved to the lower limit position P2.

Figure 15E:
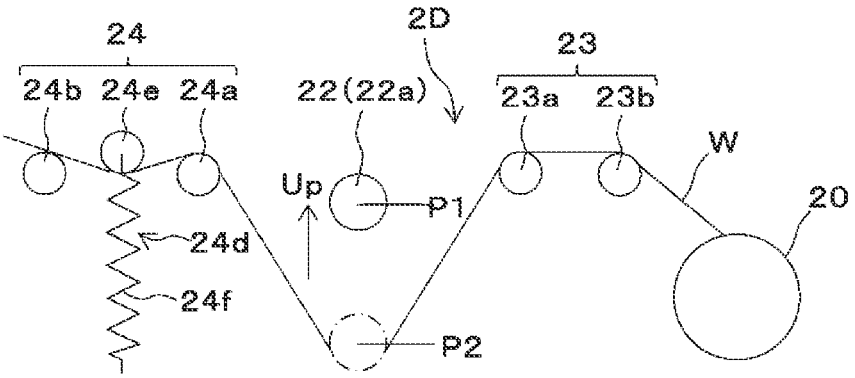
FIG. 15E is an operation illustration view showing the example of the operation of feeding the wires with the wire feeding apparatus.

In step SC5 of FIG. 12, when the lower limit detection sensor 25*b* detects that the pullout roller 22*a* is moved to the lower limit position P2, the control unit 110A switches the rotation direction of the motor 22*c* from the forward rotation to the reverse rotation, thereby moving up the pullout roller 22*a* in the direction denoted with the arrow Up, as shown in step SC6 of FIG. 12 and in FIG. 15E. In step SC7 of FIG. 12, when the upper limit detection sensor 25*a* detects that the pullout roller 22*a* is moved to the upper limit position P1, the control unit 110A stops the rotation of the motor 22*c*, in step SC8. Thereby, the amounts of the wires W required to bind the reinforcing bars S by the reinforcing bar binding machine 1A become in a loosened state between the roller 23*a* of the first wire guiding part 23 and the roller 24*a* of the second wire guiding part 24.

Figure 15F:
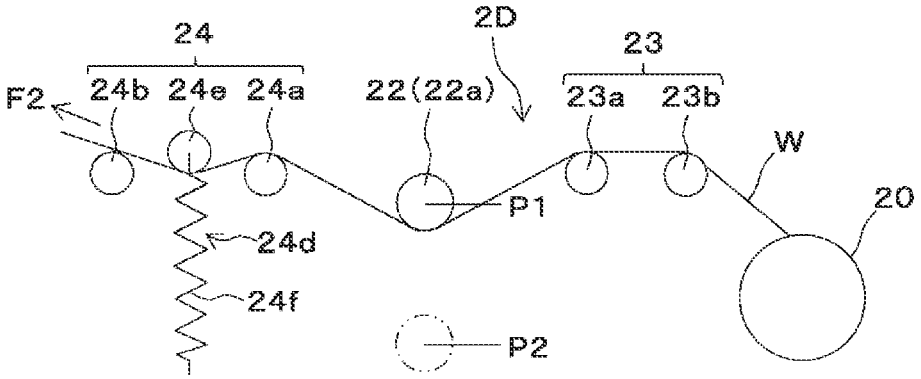
FIG. 15F is an operation illustration view showing the example of the operation of feeding the wires with the wire feeding apparatus.

In a next binding operation that is executed by the reinforcing bar binding machine 1A, the wires W loosened between the roller 23*a* of the first wire guiding part 23 and the roller 24*a* of the second wire guiding part 24 are fed in a direction denoted with the arrow F2 by the operation of feeding the wires W in the forward direction in step SA3, as shown in FIG. 15F.

Thereby, also in the wire feeding mechanism 2D, the second wire guiding part 24 is provided with the wire loosening absorption mechanism 24*d*, so that the loosening of the wires W occurring on the feeding path 26 of the wires W between the reinforcing bar binding machine 1A and the second wire guiding part 24 in the operation of feeding the wires W in the reverse direction by the reinforcing bar binding machine 1A so as to wind the wires W on the reinforcing bars S can be absorbed and eliminated by the wire loosening absorption mechanism 24*d*. In addition, in the operation of pulling out the wires W by the wire pullout mechanism 22, the amounts of the wires W required to bind the reinforcing bars S by the reinforcing bar binding machine 1A can be pulled out from the reels 20.

<Configuration Example of Binding Facility of Fifth Embodiment>

Figure 16:
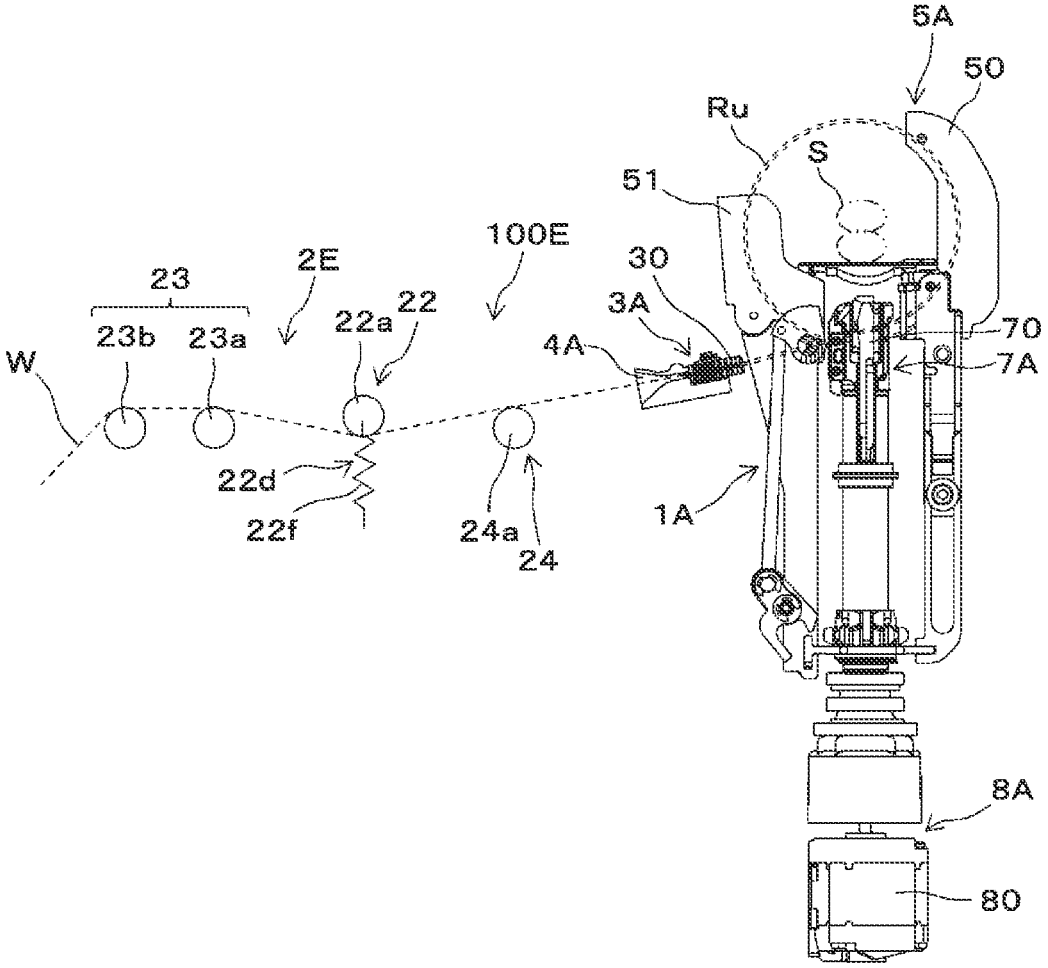
FIG. 16 is a side view of main parts showing an example of a binding facility according to a fifth embodiment.

FIG. 16 is a side view of main parts showing an example of a binding facility according to a fifth embodiment.

A binding facility 100E of the fifth embodiment includes a reinforcing bar binding machine 1A configured to bind reinforcing bars S, which are a binding target, with wires W, and a wire feeding mechanism 2E configured to feed the wires W to the reinforcing bar binding machine 1A. In the binding facility 100E of the fifth embodiment, the reinforcing bar binding machine 1A may be similar to the binding facility 100A of the first embodiment. In addition, the first wire guiding part 23 and the second wire guiding part 24 of the wire feeding mechanism 2E may be similar to those of the binding facility 100A of the first embodiment or the binding facility 100B of the second embodiment.

The wire pullout mechanism 22 has a pullout roller 22*a* configured to pull the wires W between the first wire guiding part 23 and the second wire guiding part 24, and a drive unit 22*b* configured to move a position of the pullout roller 22*a* in a direction intersecting with the wires W between the first wire guiding part 23 and the second wire guiding part 24. In the wire pullout mechanism 22, the pullout roller 22*a* located in the upper limit position P1 is in contact with the wires W between the roller 23*a* of the first wire guiding part 23 and the roller 24*a* of the second wire guiding part 24, from the upper side that is an opposite side to a side on which the rollers 23*a* and 24*a* are in contact with the wire. In the wire pullout mechanism 22, the pullout roller 22*a* is configured to move from the upper limit position to the lower limit position in the direction intersecting with the wires W between the roller 23*a* of the first wire guiding part 23 and the roller 24*a* of the second wire guiding part 24.

The wire pullout mechanism 22 has a wire loosening absorption mechanism 22*d* configured to absorb loosening of the wires W. The wire loosening absorption mechanism 22*d* has the pullout roller 22*a* that constitutes a loosening absorption roller, and a spring 22*f* for urging downward the pullout roller 22*a* along the direction intersecting with the wires W between the roller 23*a* of the first wire guiding part 23 and the roller 24*a* of the second wire guiding part 24.

In the wire pullout mechanism 22, the pullout roller 22*a* is urged downward in the direction intersecting with the wires W between the roller 23*a* and the roller 24*a* by the spring 22*f*, so that a position thereof in the height direction is prescribed by a balance between the urging force of the spring 22*f* and the tension applied to the wires W.

<Operation Example of Binding Facility of Fifth Embodiment>

FIGS. 17A to 17G are operation illustration views showing an example of the operation of feeding the wires with the wire feeding apparatus. Subsequently, the operation of feeding the wires with the wire feeding mechanism 2E is described. Note that, the operation of binding the reinforcing bars S in the reinforcing bar binding machine 1A is similar to the operation described in the flowchart of FIG. 5, and the like. In addition, the flow of the operation of feeding the wire by the wire feeding mechanism 2E is similar to the operation described in the flowchart of FIG. 12.

After the wires W are fed in the reverse direction in step SA4 in the binding operation in the above-described reinforcing bar binding machine 1A until the wires W are fed in the forward direction in step SA3 in a next binding operation, the wire feeding mechanism 2E performs an operation of pulling out predetermined amounts of the wires W from the reels 20.

Figure 17A:
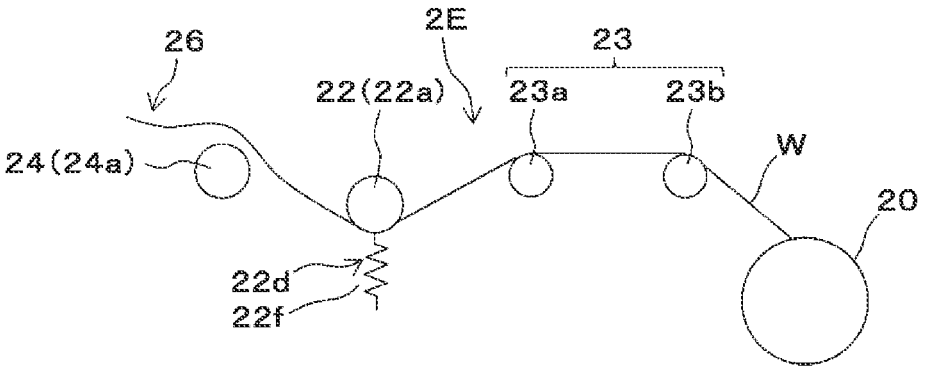
FIG. 17A is an operation illustration view showing an example of the operation of feeding the wires with the wire feeding apparatus.
Figure 17B:
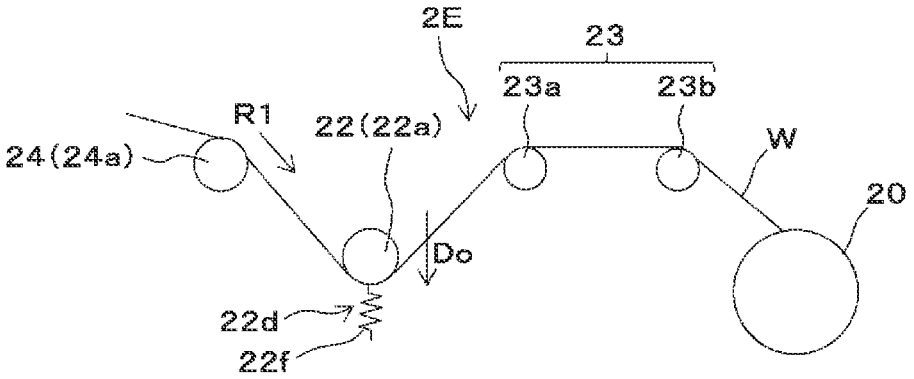
FIG. 17B is an operation illustration view showing the example of the operation of feeding the wires with the wire feeding apparatus.

As described above, in the operation of winding the wires W on the reinforcing bars S by the reinforcing bar binding machine 1A, the wires W are fed in the reverse direction, so that the wires W are loosened between the reinforcing bar binding machine 1A and the second wire guiding part 24, as shown in FIG. 17A.

Thereby, the tension that is applied to the wires W in the wire feeding mechanism 2E is reduced. When the tension applied to the wires W are reduced, the urging force of the spring 22*f* becomes greater than the tension that is applied to the wires W, so that the pullout roller 22*a* moves down in the direction denoted with the arrow Do along the direction intersecting with the wires W between the roller 23*a* of the first wire guiding part 23 and the roller 24*a* of the second wire guiding part 24.

When the pullout roller 22*a* moves down, the wires W between the roller 23*a* and the roller 24*a* are pulled downward. Thereby, as shown in step SC1 of FIG. 12 and in FIG. 17B, the surplus of the loosened wires W are drawn between the roller 23*a* and the roller 24*a*, as shown with the arrow R1.

Figure 17C:
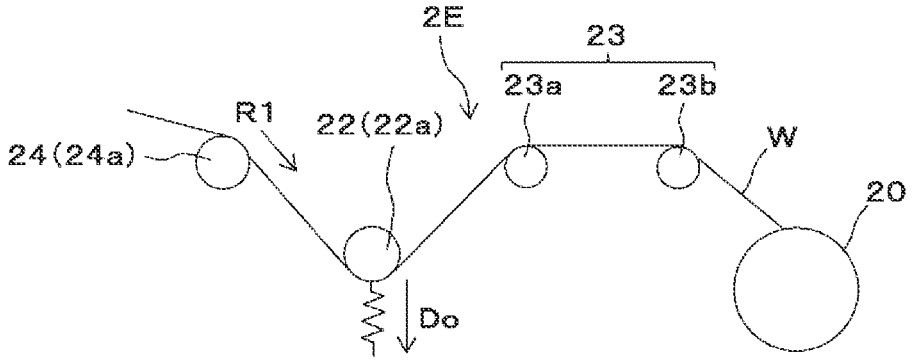
FIG. 17C is an operation illustration view showing the example of the operation of feeding the wires with the wire feeding apparatus.

In step SC2 of FIG. 12, the control unit 110A controls the drive unit 22*b* to rotate the motor 22*c* in the forward direction, thereby moving down the pullout roller 22*a* in the direction denoted with the arrow Do. When the pullout roller 22*a* starts to move down by drive of the drive unit 22*b*, the tension that is applied to the wires W in the wire feeding mechanism 2E increases. When the tension that is applied to the wires W increases, the urging force of the spring 22*f* becomes relatively smaller than the tension that is applied to the wires W, so that the spring 22*f* is extended against the urging force of the spring 22*f*, as shown in FIG. 17C.

Figure 17D:
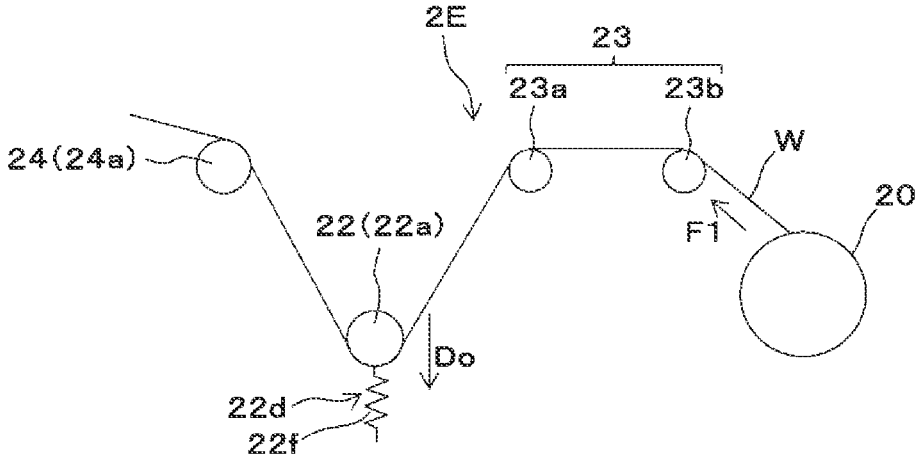
FIG. 17D is an operation illustration view showing the example of the operation of feeding the wires with the wire feeding apparatus.

When the pullout roller 22*a* is further moved down by drive of the drive unit 22*b*, the wires W are pulled out from the reel 20 accommodated in the reel accommodation part 21 and are fed between the roller 23*a* of the first wire guiding part 23 and the roller 24*a* of the second wire guiding part 24, as shown in step SC4 of FIG. 12 and with the arrow F1 in FIG. 17D. A moving amount of the pullout roller 22*a* is set so that amounts of the wires W required to eliminate the surplus of the wires W on the feeding path 26 of the wires W between the reinforcing bar binding machine 1A and the second wire guiding part 24 whose loosening is absorbed by the wire loosening absorption mechanism 22*d* and to bind the reinforcing bars S by the reinforcing bar binding machine 1A can be pulled out from the reel 20 when the pullout roller 22*a* is moved to the lower limit position.

Figure 17E:
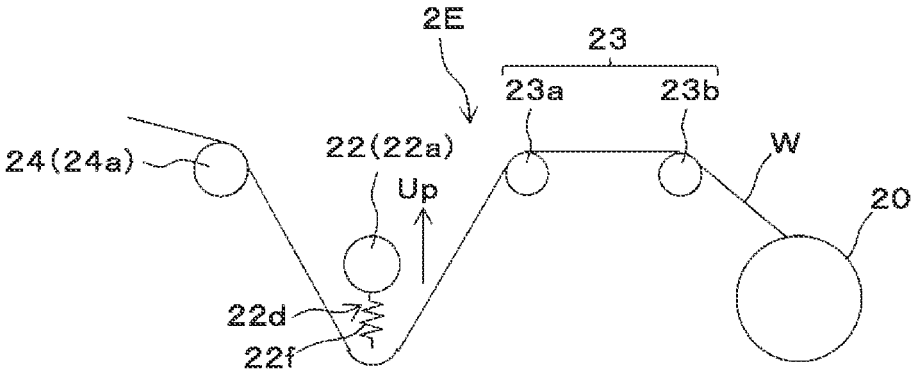
FIG. 17E is an operation illustration view showing the example of the operation of feeding the wires with the wire feeding apparatus.
Figure 17F:
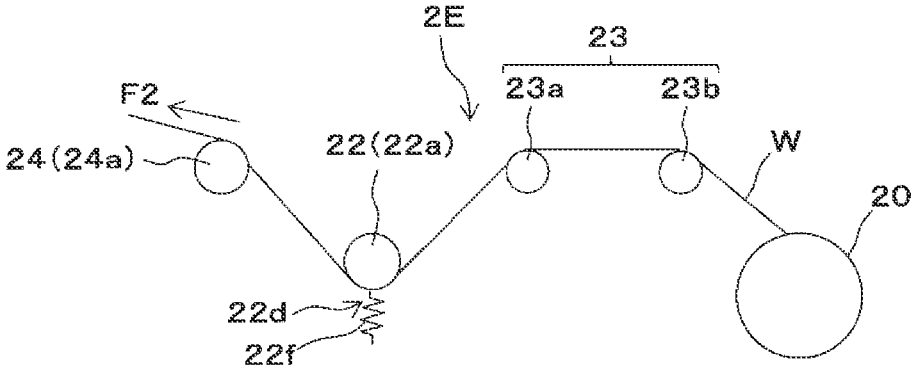
FIG. 17F is an operation illustration view showing the example of the operation of feeding the wires with the wire feeding apparatus.

In step SC5 of FIG. 12, when the control unit 110A detects that the pullout roller 22*a* is moved to the lower limit position, the control unit 110A switches the rotation direction of the motor 22*c* from the forward rotation to the reverse rotation, thereby moving up the pullout roller 22*a* in the direction denoted with the arrow Up, as shown in step SC6 of FIG. 12 and in FIG. 17E. In step SC7 of FIG. 12, when the control unit 110A detects that the pullout roller 22*a* is moved up to the upper limit position, the control unit 110A stops the rotation of the motor 22*c*, in step SC8. Thereby, the amounts of the wires W required to bind the reinforcing bars S by the reinforcing bar binding machine 1A become in a loosened state between the roller 23*a* of the first wire guiding part 23 and the roller 24*a* of the second wire guiding part 24. In addition, since the tension of the wires W are not applied to the pullout roller 22*a*, the pullout roller 22*a* is in a state of being moved down from the upper limit position by a contraction of the spring 22*f* by the urging force of the spring 22*f*.

In a next binding operation that is executed by the reinforcing bar binding machine 1A, the wires W loosened between the roller 23*a* of the first wire guiding part 23 and the roller 24*a* of the second wire guiding part 24 are fed in the direction denoted with the arrow F2 by the operation of feeding the wires Win the forward direction in step SA3, as shown in FIG. 15F.

When the wires W loosened between the roller 23*a* of the first wire guiding part 23 and the roller 24*a* of the second wire guiding part 24 are fed in the direction denoted with the arrow F2, the wires W are contacted to the pullout roller 22*a* that has been moved down by the contraction of the spring 22*f*.

Figure 17G:
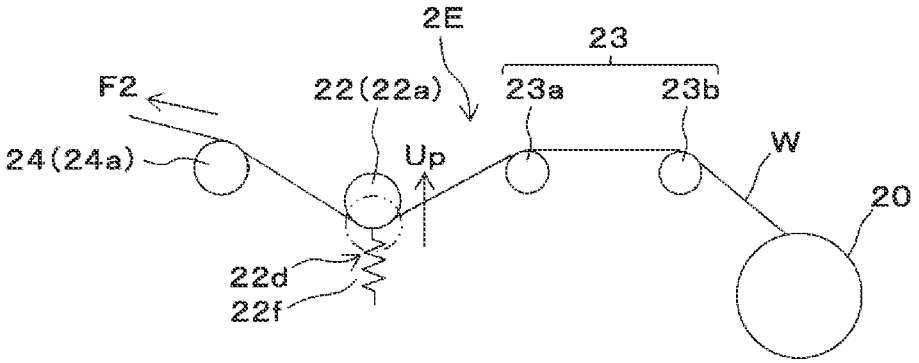
FIG. 17G is an operation illustration view showing the example of the operation of feeding the wires with the wire feeding apparatus.

When the wires W loosened between the roller 23*a* of the first wire guiding part 23 and the roller 24*a* of the second wire guiding part 24 are further fed in the direction denoted with the arrow F2, the tension that is applied to the wires W increases and the urging force of the spring 22*f* becomes relatively smaller than the tension applied to the wires W, so that the spring 22*f* is extended against the urging force and the pullout roller 22*a* is moved up to the upper limit position, as shown in FIG. 17G.

Thereby, also in the wire feeding mechanism 2E, the wire feeding mechanism 22 is provided with the wire loosening absorption mechanism 22*d*, so that the loosening of the wires W occurring between the reinforcing bar binding machine 1A and the second wire guiding part 24 in the operation of feeding the wires W in the reverse direction by the reinforcing bar binding machine 1A so as to wind the wires W on the reinforcing bars S can be absorbed and eliminated by the wire loosening absorption mechanism 22*d*. In addition, in the operation of pulling out the wires W by the wire pullout mechanism 22, the amounts of the wires W required to bind the reinforcing bars S by the reinforcing bar binding machine 1A can be pulled out from the reels 20.

<Configuration Example of Binding Facility of Sixth Embodiment>

Figure 18A:
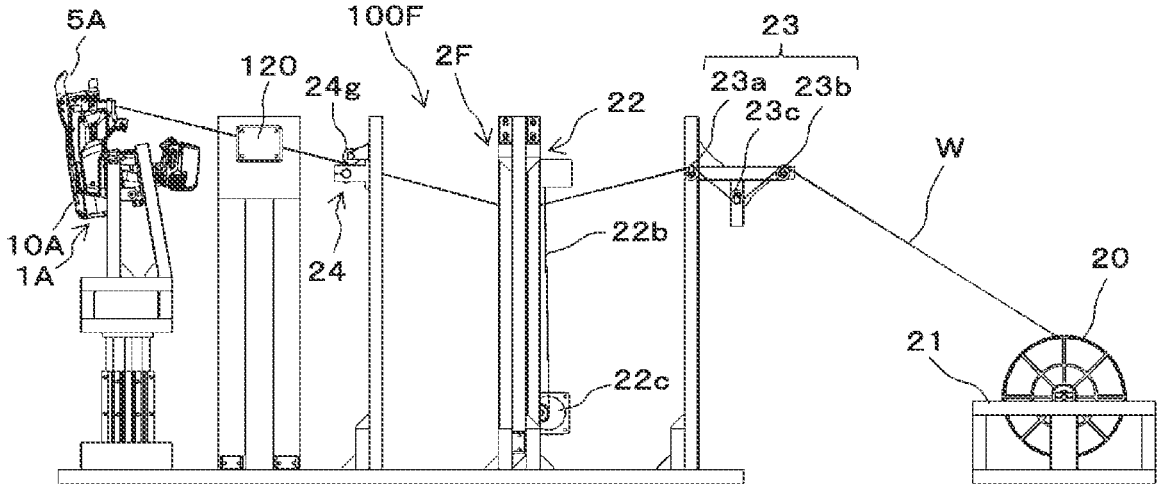
FIG. 18A is a side view showing an example of a binding facility according to a sixth embodiment.
Figure 18B:
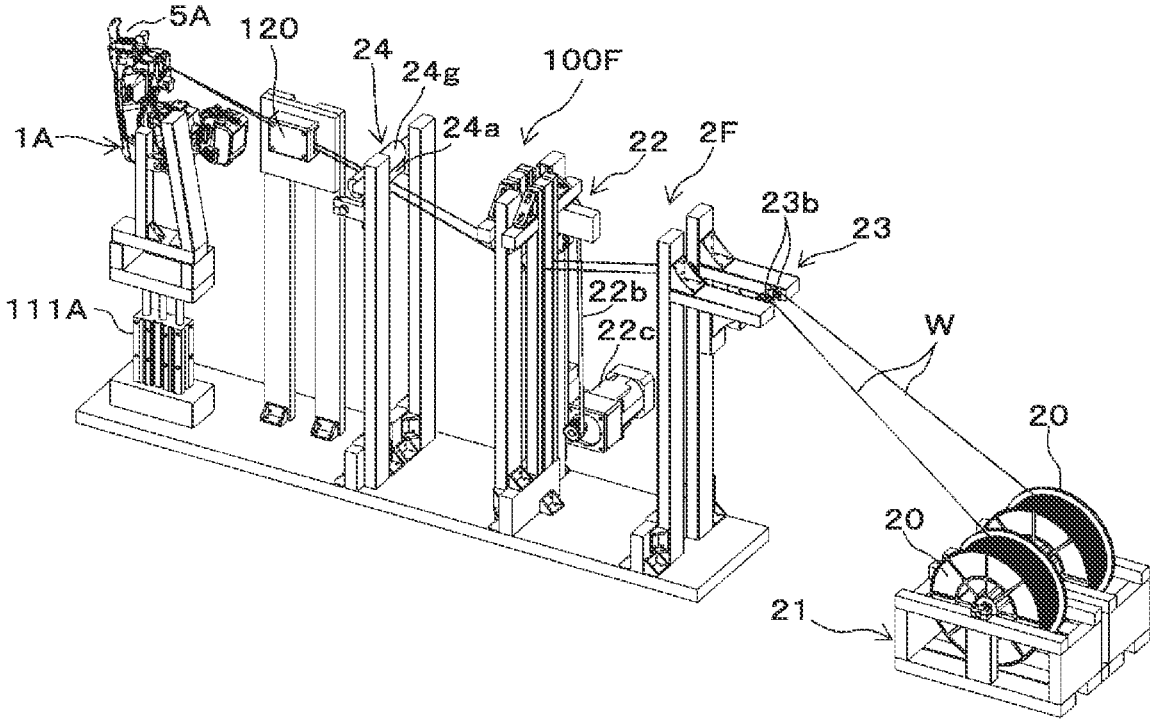
FIG. 18B is a perspective view showing the example of the binding facility according to the sixth embodiment.

FIG. 18A is a side view showing an example of a binding facility according to a sixth embodiment, and FIG. 18B is a perspective view showing the example of the binding facility according to the sixth embodiment.

A binding facility 100F of the sixth embodiment includes a reinforcing bar binding machine 1A configured to bind reinforcing bars S, which are a binding target, with wires W, and a wire feeding mechanism 2F configured to feed the wires W to the reinforcing bar binding machine 1A. In the binding facility 100F of the sixth embodiment, the reinforcing bar binding machine 1A may be similar to that of the binding facility 100A of the first embodiment. In addition, the first wire guiding part 23 of the wire feeding mechanism 2F may be similar to that of the binding facility 100A of the first embodiment.

The second wire guiding part 24 has a wire feeding regulation roller 24*g* configured to regulate feeding of the wires W in a predetermined direction. The wire feeding regulation roller 24*g* is an example of the wire feeding regulation member, and is configured to allow feeding of the wires W in the forward direction from the wire feeding mechanism 2F toward the reinforcing bar binding machine 1A and to regulate feeding of the wires W in the reverse direction from the reinforcing bar binding machine 1A toward the wire feeding mechanism 2F. The wire feeding regulation roller 24*g* has, as an example, a non-rotating member provided to be contactable/separable with respect to the roller 24*a*, and in the operation of feeding the wires W in the forward direction by the reinforcing bar binding machine 1A, the wire feeding regulation roller 24*g* is spaced with respect to the roller 24*a* to allow feeding of the wires W in the forward direction. On the other hand, in the operation of feeding the wires W in the reverse direction by the reinforcing bar binding machine 1A and in the operation of pulling out the wires W from the reels 20 by the wire feeding mechanism 2F, the wires W are sandwiched between the roller 24*a* and the wire feeding regulation roller 24*g* to regulate the feeding of the wires W in the reverse direction. In addition, as another example, the wire feeding regulation roller 24*g* is supported by a support mechanism such as a one-way bearing configured to allow rotation in one direction and to regulate rotation in the other direction, and is caused to rotate by feeding of the wires W in the forward direction, thereby allowing feeding of the wires W in the forward direction. On the other hand, the wire feeding regulation roller 24*g* is not caused to rotate by feeding of the wires W in the reverse direction, thereby regulating feeding of the wires W in the reverse direction.

The wire feeding mechanism 2F has a feeding amount detection sensor 120 configured to detect feeding amounts of the wires W. The feeding amount detection sensor 120 is an example of a feeding amount detection unit, and is configured to detect feeding amounts of the wires W that are fed in the forward direction and in the reverse direction. In a configuration where the wire feeding mechanism 2F feeds the two wires W, the feeding amount detection sensor 120 is configured to detect a feeding amount of each wire W. The feeding amount detection sensor 120 is implemented by a method of using a member caused to rotate by feeding of the wires W and detecting a rotation amount of the member, a method of detecting weights of the wires W returned by the reverse feeding, and the like.

Figure 19:
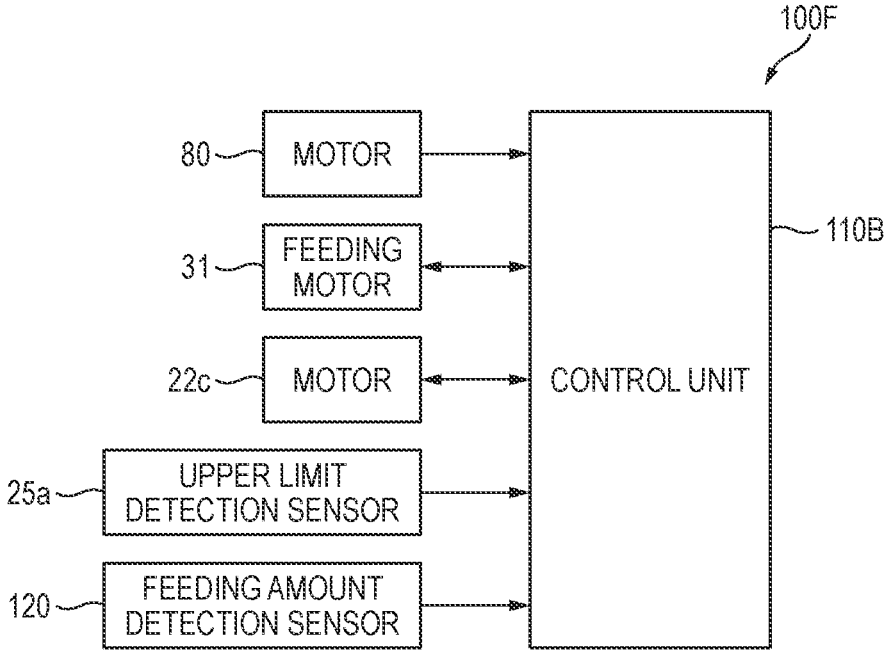
FIG. 19 is a block diagram showing an example of the control function of the binding facility.

FIG. 19 is a block diagram showing an example of the control function of the binding facility. In the binding facility 100F, a control unit 110E is configured to control the motor 80 and the feeding motor 31 of the reinforcing bar binding machine 1A. The control unit 110B is configured to control a position of the sleeve 71 shown in FIG. 1 and the like and to perform an operation of engaging the wires W with the wire engaging body 70, an operation of cutting the wires W with the cutting unit 6A and an operation of twisting the wires W with the wire engaging body 70 by controlling a rotation amount of the motor 80.

In addition, the control unit 110B is configured to control forward and reverse rotations of the feeding motor 31, thereby feeding the wires W in the forward direction to perform an operation of winding the wires W around the reinforcing bars S and feeding the wires W in the reverse direction to perform an operation of winding the wires W on the reinforcing bars S.

Further, the control unit 110B is configured to detect feeding amounts of the wires W reversely fed in the reinforcing bar binding machine 1A by the feeding amount detection sensor 120 and to calculate a moving amount for moving (moving down) the pullout roller 22*a* to a target lowering position in which amounts of the wires W required to bind the reinforcing bars S by the reinforcing bar binding machine 1A are pulled out.

The control unit 110B is configured to control the motor 22*c* of the drive unit 22*b* of the wire feeding mechanism 2F and to control forward rotation and reverse rotation of the motor 22*c*, based on the position of the pullout roller 22*a* detected by the upper limit detection sensor 25*a* and the moving amount for moving down the pullout roller 22*a* to the target lowering position, thereby moving down or up the pullout roller 22*a*.

<Operation Example of Binding Facility of Sixth Embodiment>

Figure 20:
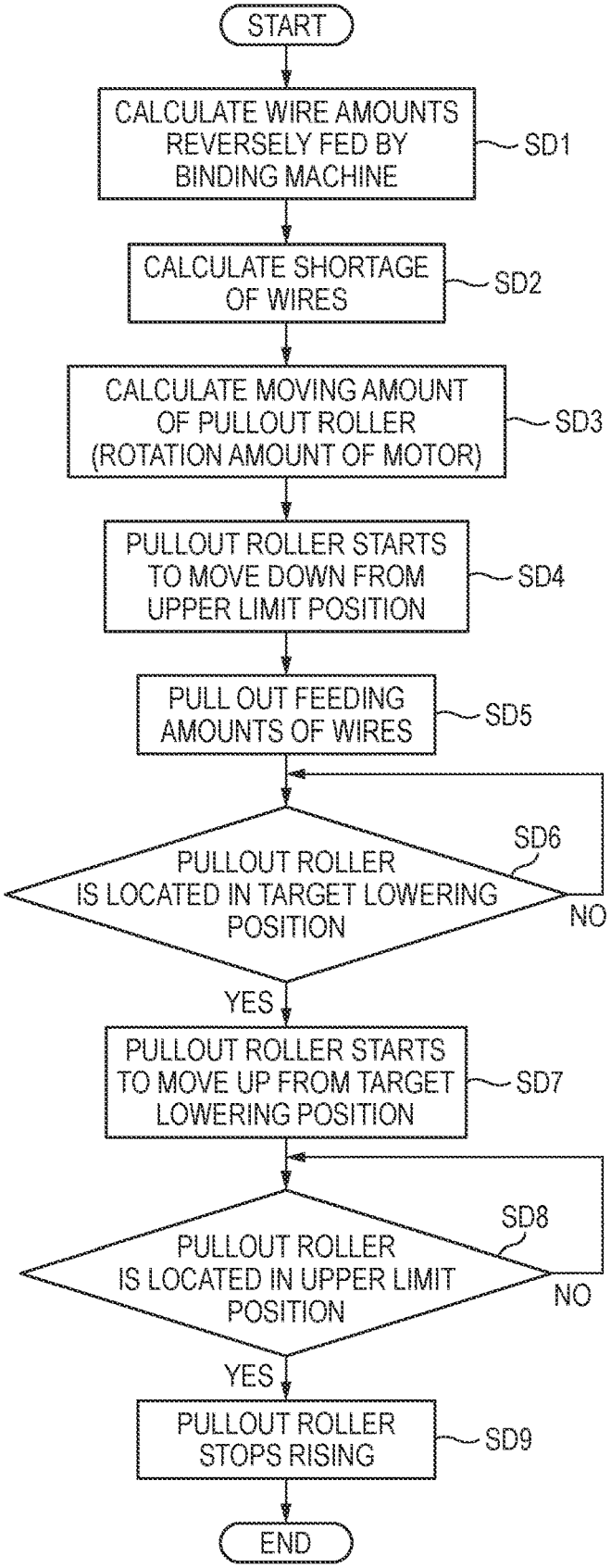
FIG. 20 is a flowchart showing an example of the operation of feeding the wires with the wire feeding apparatus.

FIGS. 18C to 18G are operation illustration views showing an example of the operation of feeding the wires with the wire feeding apparatus, and FIG. 20 is a flowchart showing an example of the operation of feeding the wires with the wire feeding apparatus. Subsequently, the operation of feeding the wires with the wire feeding mechanism 2F is described. Note that, the operation of binding the reinforcing bars S in the reinforcing bar binding machine 1A is similar to the operation described in the flowchart of FIG. 5 and the like.

After the wires W are fed in the reverse direction in step SA4 in the binding operation in the above-described reinforcing bar binding machine 1A until the wires W are fed in the forward direction in step SA3 in a next binding operation, the wire feeding mechanism 2F performs an operation of pulling out predetermined amounts of the wires W from the reels 20.

Figure 18C:
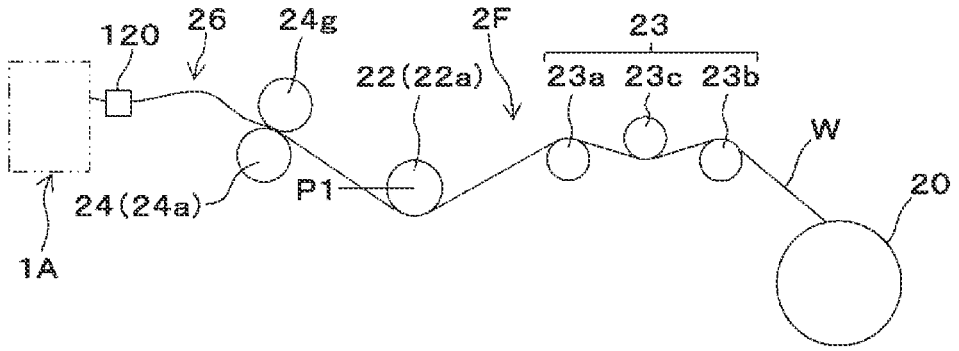
FIG. 18C is an operation illustration view showing an example of the operation of feeding the wires with the wire feeding apparatus.

In the operation of feeding the wires W in the reverse direction so as to wind the wires W on the reinforcing bars S by the reinforcing bar binding machine 1A, the wires W are sandwiched between the roller 24*a* and the wire feeding regulation roller 24*g* to regulate the feeding of the wires W in the reverse direction, as shown in FIG. 18C. In the operation of winding the wires W on the reinforcing bars S by the reinforcing bar binding machine 1A, when the wires W are fed in the reverse direction, the control unit 110B detects the feeding amounts of the wires W reversely fed in the reinforcing bar binding machine 1A by the feeding amount detection sensor 120, in step SD1 of FIG. 20.

In addition, the control unit 110B calculates a shortage of the amounts of the wires W required to bind the reinforcing bars S with the reinforcing bar binding machine 1A, in step SD2. Then, in step SD3, the control unit 110B calculates a moving amount for moving (moving down) the pullout roller 22*a* to a target lowering position P21 in which the amounts of the wires W required to bind the reinforcing bars S with the reinforcing bar binding machine 1A are pulled out, and calculates a rotation amount of the motor 22*c* for moving (moving down) the pullout roller 22*a* to the target lowering position P21. The target lowering position P21 changes according to the feeding amounts of the wires W reversely fed in the reinforcing bar binding machine 1A. Specifically, the amount of the wire W required to bind the reinforcing bars S with the reinforcing bar binding machine 1A is a sum of a feeding amount of the wire W reversely fed in the reinforcing bar binding machine 1A and an amount of the wire W pulled out from the reel 20. For this reason, in a case where the feeding amounts of the wires W reversely fed are small, the target lowering position P21 lowers so as to increase the amounts of the wires W that are pulled out from the reels 20. On the other hand, in a case where the feeding amounts of the wires W reversely fed are large, the target lowering position P21 rises so as to reduce the amounts of the wires W that are pulled out from the reels 20.

Figure 18D:
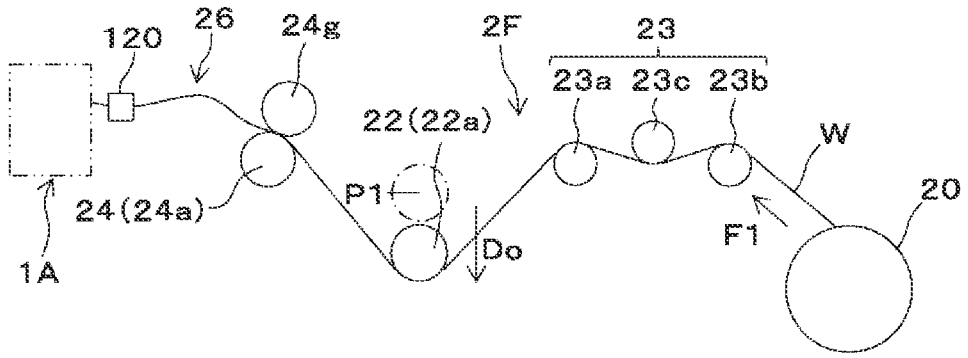
FIG. 18D is an operation illustration view showing the example of the operation of feeding the wires with the wire feeding apparatus.
Figure 18E:
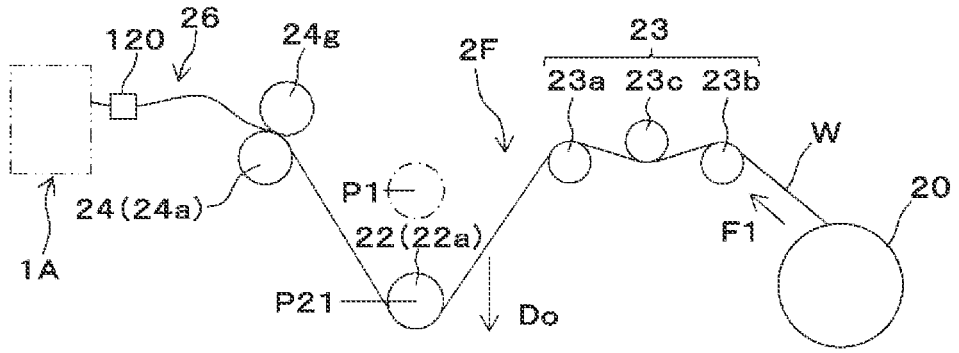
FIG. 18E is an operation illustration view showing the example of the operation of feeding the wires with the wire feeding apparatus.

In order to pull out the wires W from the reels 20 with the wire feeding mechanism 2F, the control unit 110B controls the drive unit 22*b* to rotate the motor 22*c* in the forward rotation, thereby moving down the pullout roller 22*a* from the upper limit position P1 in the direction denoted with the arrow Do, in step SD4 of FIG. 20. In the operation of pulling out the wires W from the reels 20 with the wire feeding mechanism 2F, the wires W are sandwiched between the roller 24*a* and the wire feeding regulation roller 24*g* to regulate the feeding of the wires W in the reverse direction, as shown in FIGS. 18D and 18E. In the wire pullout mechanism 22, the pullout roller 22*a* moves down from the upper limit position P1 along the direction intersecting with the wires W between the roller 23*a* of the first wire guiding part 23 and the roller 24*a* of the second wire guiding part 24.

When the pullout roller 22*a* starts to move down from the upper limit position P1, the wires W between the roller 23*a* of the first wire guiding part 23 and the roller 24*a* of the second wire guiding part 24 are pulled downward. Thereby, a force by which the wires W between the reels 20 and the first wire guiding part 23 and the wires W between the reinforcing bar binding machine 1A and the second wire guiding part 24 are pulled between the first wire guiding part 23 and the second wire guiding part 24 is applied.

In the wire guiding part 24, the wires W are sandwiched between the roller 24*a* and the wire feeding regulation roller 24*g* and the feeding of the wires W in the reverse direction is thus regulated. Thereby, the surplus of the wires W loosened between the reinforcing bar binding machine 1A and the second wire guiding part 24 is not drawn between the roller 23*a* of the first wire guiding part 23 and the roller 24*a* of the second wire guiding part 24 by the operation of pulling the wires W with the pullout roller 22*a* of the wire pullout mechanism 22.

On the other hand, since the wires W between the reinforcing bar binding machine 1A and the second wire guiding part 24 cannot be fed, the wires W between the reels 20 and the first wire guiding part 23 are drawn between the roller 23*a* of the first wire guiding part 23 and the roller 24*a* of the second wire guiding part 24.

Thereby, in step SD5, the wires W are pulled out from the reels 20 accommodated in the reel accommodation part 21 and are fed between the roller 23*a* of the first wire guiding part 23 and the roller 24*a* of the second wire guiding part 24.

When the pullout roller 22*a* is moved down to the target lowering position P21, the wires W are pulled out from the reels 20 so that the feeding amounts of the wires W reversely fed in the reinforcing bar binding machine 1A, i.e., the sum of the surplus of the wires W loosened on the feeding path 26 of the wires W between the reinforcing bar binding machine 1A and the second wire guiding part 24 and the amounts of the wires W pulled out from the reels 20 becomes an amount required to bind the reinforcing bars S with the reinforcing bar binding machine 1A.

Figure 18F:
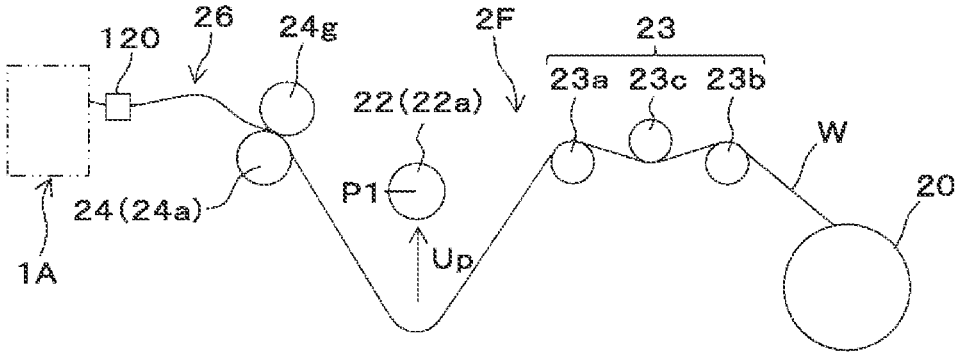
FIG. 18F is an operation illustration view showing the example of the operation of feeding the wires with the wire feeding apparatus.

In step SD6 of FIG. 20, when the control unit 110B detects that the pullout roller 22*a* is moved to the target lowering position P21, as shown in FIG. 18E, from the rotation amount of the motor 22*c* or the like, the control unit 110B switches the rotation direction of the motor 22*c* from the forward rotation to the reverse rotation, and moves up the pullout roller 22*a*, in step SD7. In step SD8, when the upper limit detection sensor 25*a* detects that the pullout roller 22*a* is moved to the upper limit position P1, as shown in FIG. 18F, the control unit 110B stops the rotation of the motor 22*c*, in step SD9. Thereby, the amounts of the wires W required to bind the reinforcing bars S with the reinforcing bar binding machine 1A become in a loosened state on the feeding path 26 of the wires W between the reinforcing bar binding machine 1A and the second wire guiding part 24 and between the roller 23*a* of the first wire guiding part 23 and the roller 24*a* of the second wire guiding part 24.

Figure 18G:
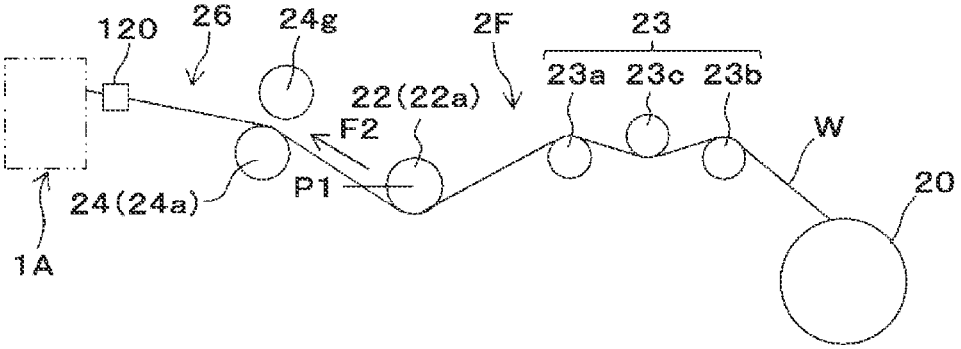
FIG. 18G is an operation illustration view showing the example of the operation of feeding the wires with the wire feeding apparatus.

In a next binding operation that is executed in the reinforcing bar binding machine 1A, in the operation of feeding the wires W in the forward direction by the reinforcing bar binding machine 1A, the wire feeding regulation roller 24*g* is spaced with respect to the roller 24*a* to allow the feeding of the wires Win the forward direction, as shown in FIG. 18G. Therefore, the wires W loosened on the feeding path 26 of the wires W between the reinforcing bar binding machine 1A and the second wire guiding part 24 and the wires W loosened between the roller 23*a* of the first wire guiding part 23 and the roller 24*a* of the second wire guiding part 24 are fed in the direction denoted with the arrow F2 by the operation of feeding the wires Win the forward direction in step SA3 of FIG. 3.

Thereby, in the wire feeding mechanism 2F, the feeding amount detection sensor 120 detects the feeding amounts of the wires W and the pullout roller 22*a* is moved (moved down) to the target lowering position P21 in which the amounts of the wires W required to bind the reinforcing bars S with the reinforcing bar binding machine 1A are pulled out, so that the loosening of the wires W occurring on the feeding path 26 of the wires W between the reinforcing bar binding machine 1A and the second wire guiding part 24 in the operation of feeding the wires W in the reverse direction by the reinforcing bar binding machine 1A so as to wind the wires W on the reinforcing bars S can be eliminated. In addition, in the operation of pulling out the wires W by the wire pullout mechanism 22, the amounts of the wires W required to bind the reinforcing bars S by the reinforcing bar binding machine 1A can be pulled out from the reel 20 according to the surplus due to the loosening of the wires W occurring on the feeding path 26 of the wires W between the reinforcing bar binding machine 1A and the second wire guiding part 24.

Note that, the configuration of pulling out the wires W from the reel 20 may have a configuration where a gear and a roller configured to rotate with sandwiching the rotation-controllable wires W are provided on the feeding path of the wires W and a configuration for driving the reel 20.

<Modified Embodiments of Binding Facility>

In a case where the reinforcing bar binding machine 1A has such a form that an operator holds and uses with a hand, the reinforcing bar binding machine 1A includes a main body 10A and a handle part, and a battery 15A is detachably mounted to the handle part, as shown in FIG. 1A and the like. On the other hand, as shown in FIG. 11A and the like, a configuration where the main body 10A is not provided with the battery and electric power is supplied from an outside is also possible. In addition, as shown in FIG. 11A and the like, a configuration where the reinforcing bar binding machine 1A is attached to a tip end part of a robot hand 114A configured to be displaceable in the upper and lower direction, in the right and left direction and in the rotation direction and the robot hand 114A is attached to an elevation mechanism 111A is also possible.

Figure 21:
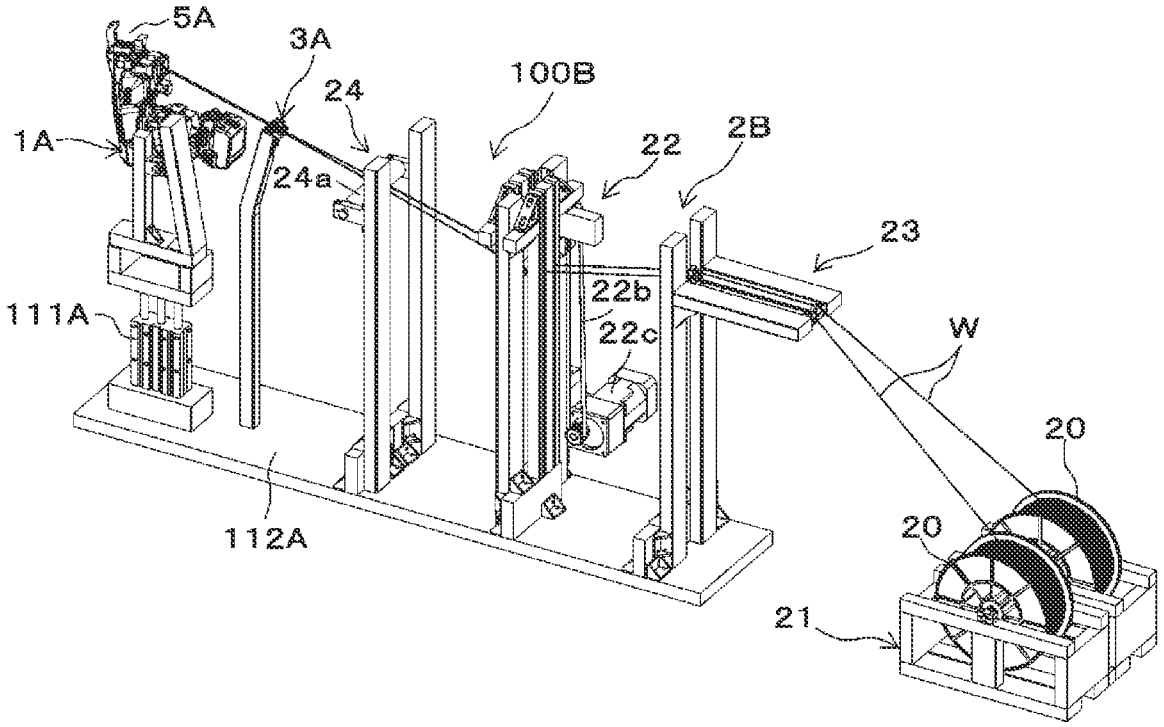
FIG. 21 is a perspective view showing a modified embodiment of the binding facility of each embodiment.

FIG. 21 is a perspective view showing a modified embodiment of the binding facility of each embodiment. FIG. 21 shows, as an example, a modified embodiment of the binding facility 100B of the second embodiment, with respect to the wire feeding unit. In the binding facility of each embodiment, the reinforcing bar binding machine 1A is provided with the wire feeding unit 3A. However, a configuration where the wire feeding unit 3A configured as shown in FIG. 3A is provided outside the reinforcing bar binding machine 1A is also possible.

Figure 22A:
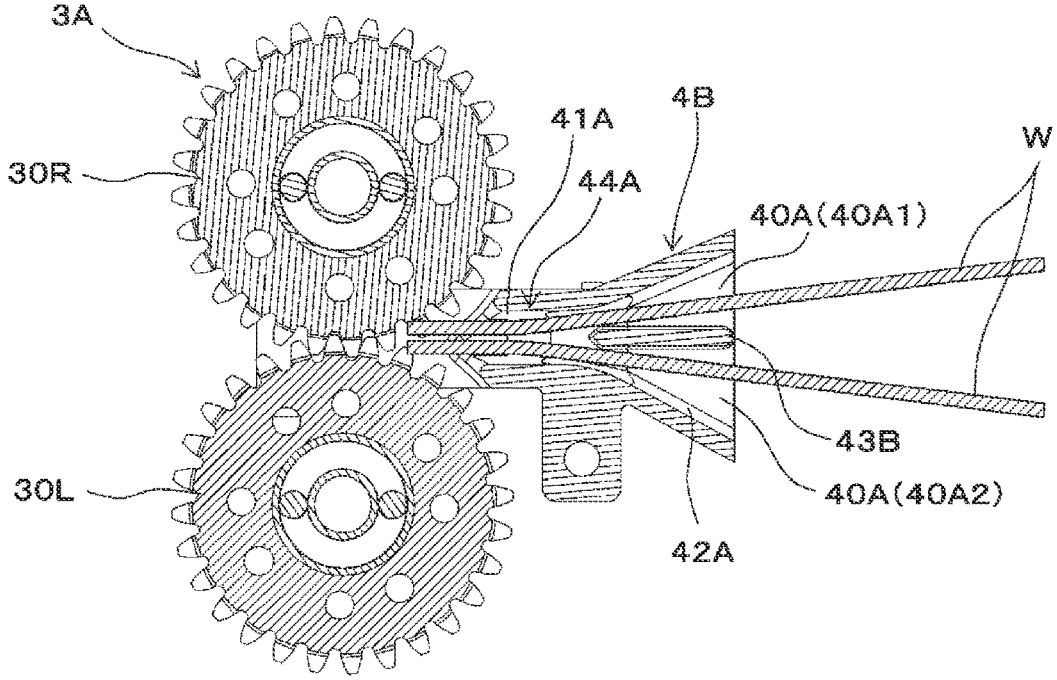
FIG. 22A is a plan sectional view showing a modified embodiment of the wire feeding unit and the wire guide.
Figure 22B:
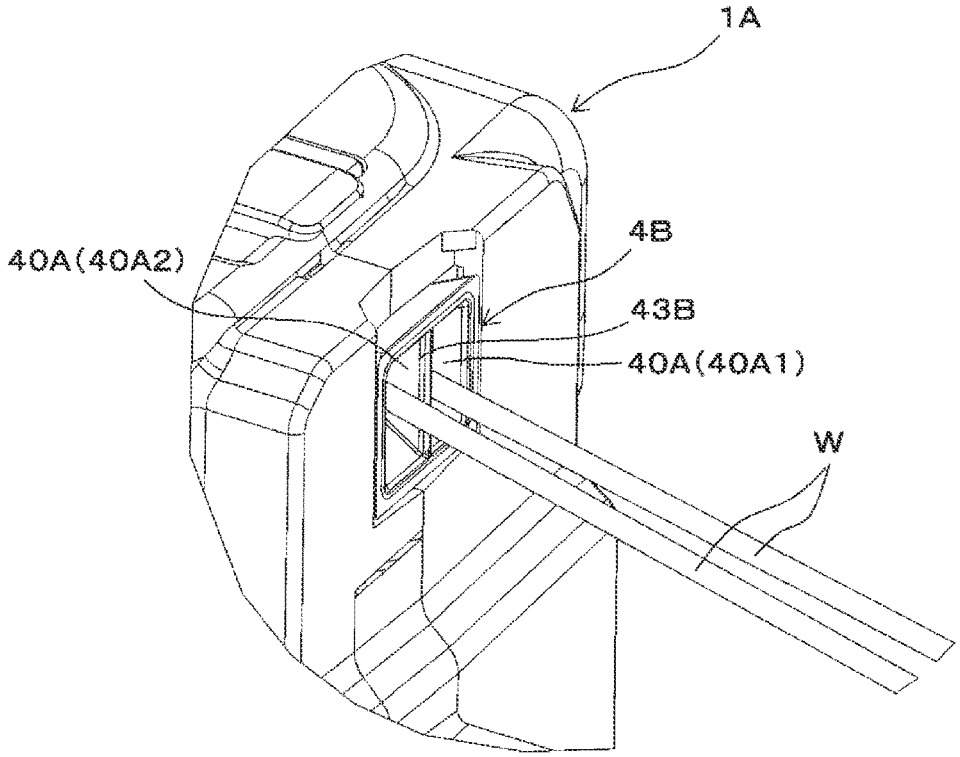
FIG. 22B is a perspective view showing an example of the wire guide.

FIG. 22A is a plan sectional view showing a modified embodiment of the wire feeding unit and the wire guide, and FIG. 22B is a perspective view showing an example of the wire guide. Subsequently, as a modified embodiment of the binding facility of each embodiment, a wire guide 4B of a modified embodiment configured to guide the wire W to the wire feeding unit 3A is described.

The wire guide 4B is configured so that the upstream side opening 40A with respect to the feeding direction of the wires W that are fed in the forward direction has a larger opening area, as compared to the downstream side opening 41A. In the present example, the wire guide 4B is constituted by a tapered opening where an opening area of the upstream side opening 40A, which is an introduction side for the wire W that is fed from the wire feeding mechanism 2A, is largest and the opening area is reduced from the introduction side, and the guide surface 42A configured to guide the wires W are constituted by a tapered inclined surface.

The upstream side opening 40A of the wire guide 4B has a quadrangular, circular or the like shape. The wire guide 4B has a partition part 43B configured to partition the upstream side opening 40A. The wire guide 4B has a configuration of binding the reinforcing bars S with the two wires W, and one wire W passes through one opening 40A1 partitioned by the partition part 43B and the other wire W passes through the other opening 40A2.

In addition, the wire guide 4B has the wire position regulation part 44A that is constituted by the downstream side opening facing the pair of feeding gears 30 (the first feeding gear 30L and the second feeding gear 30R) of the wire feeding unit 3A with respect to the feeding direction of the wires W that are fed in the forward direction. The wire position regulation part 44A has such a shape that the opening 41A facing the pair of feeding gears 30 regulates radial orientation of the wires W. The wire guide 4B has an elliptical shape, a rectangular shape or the like where a length in the length direction of the downstream side opening 41A along the facing direction of the first feeding gear 30L and the second feeding gear 30R is about equal to or greater than a length of a diameter of two wires and a length in the width direction orthogonal to the length direction is about equal to or greater than a length of a diameter of one wire. The downstream side opening 41A of the wire guide 4B is not partitioned by the partition part. Thereby, the radial orientation of the two wires W passing through the wire guide 4B is guided to the orientation along the facing direction of the first feeding gear 30L and the second feeding gear 30R by the downstream side opening 41A of the wire guide 4B. In addition, the positions of the wires W along the axial directions of rotations of the first feeding gear 30L and the second feeding gear 30R are regulated by the downstream side opening 41A of the wire guide 4B, which constitutes the wire position regulation part 44A. Thereby, the two wires W passing through the wire guide 4B are suppressed from moving and coming off from the groove portions 32L of the first feeding gear 30L and the groove portions 32R of the second feeding gear 30R along the axial directions of rotations of the first feeding gear 30L and the second feeding gear 30R.

Figure 23A:
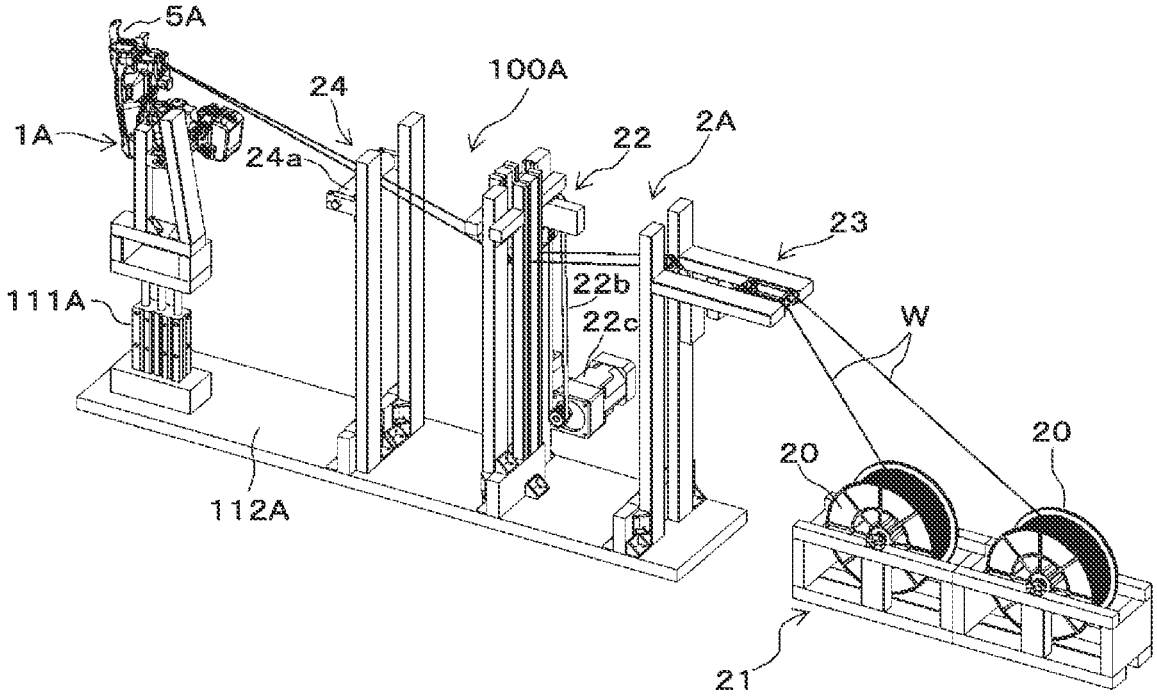
FIG. 23A is a perspective view showing another modified embodiment of the binding facility of each embodiment.
Figure 23B:
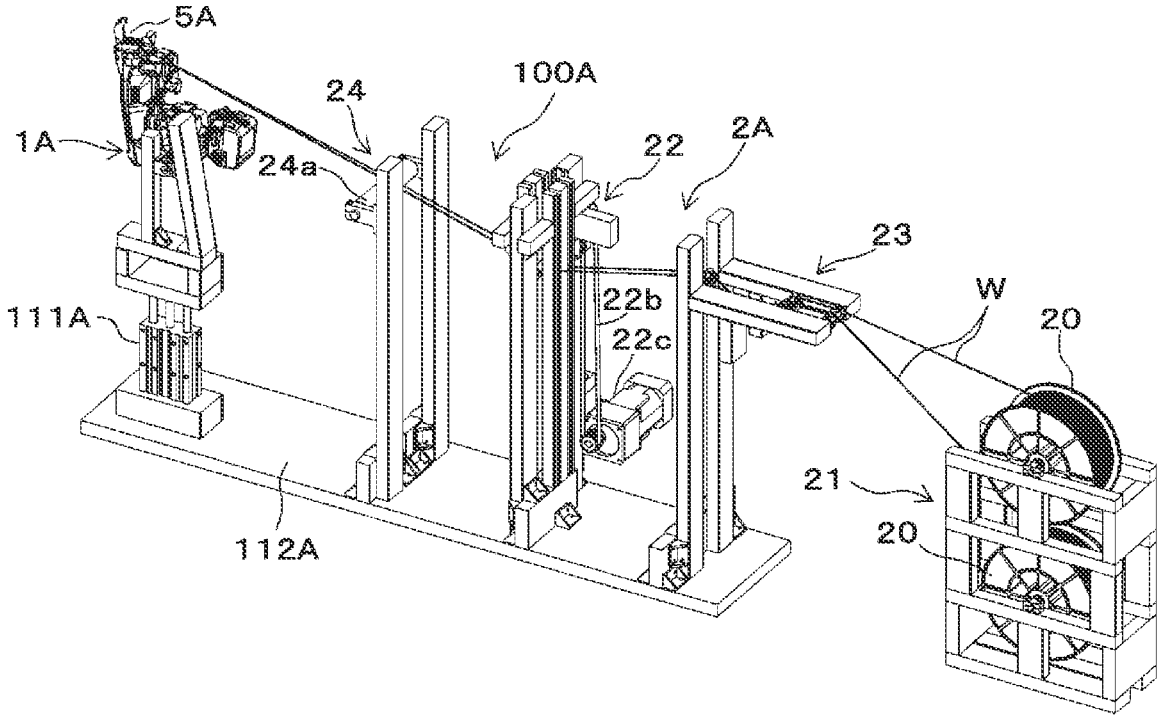
FIG. 23B is a perspective view showing another modified embodiment of the binding facility of each embodiment.
Figure 23C:
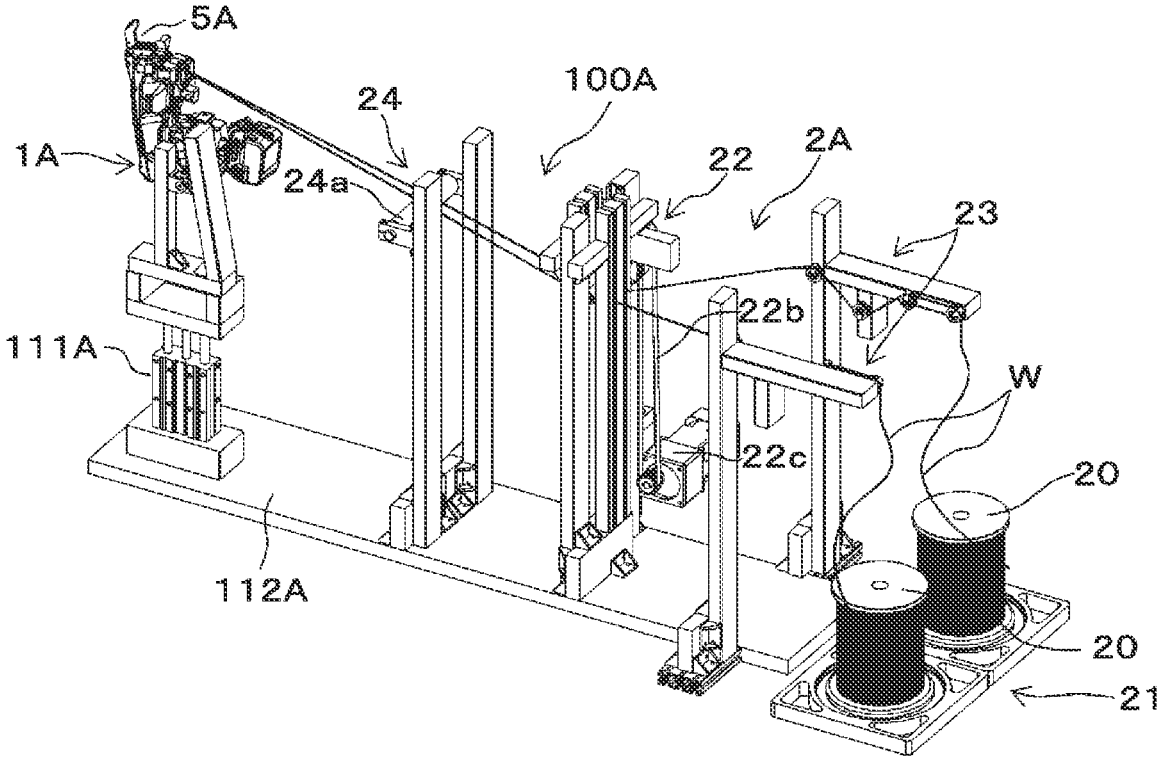
FIG. 23C is a perspective view showing another modified embodiment of the binding facility of each embodiment.

FIGS. 23A to 23C are perspective views showing other modified embodiments of the binding facility of each embodiment. FIGS. 23A to 23C show, as an example, modified embodiments of the binding facility 100A of the first embodiment, with respect to the reel accommodation part.

In FIG. 23A, in order to bind the reinforcing bars S with the two wires W in the reinforcing bar binding machine 1A, the reel accommodation part 21 is configured so that the two reels 20 are accommodated aligned in the front and rear direction in a state where the shafts of rotation are horizontally oriented with respect to the vertical direction. In addition, in FIG. 23B, the two reels 20 are accommodated aligned in the upper and lower direction in the state where the shafts of rotation are horizontally oriented with respect to the vertical direction. Further, in FIG. 23C, the two reels 20 are accommodated aligned in the right and left direction in a state where the shafts are vertically oriented along the vertical direction. Note that, as shown in FIG. 23C, in the case of the configuration where the shafts are vertically oriented along the vertical direction, the reel 20 may not have the rotatable configuration.

Figure 24:
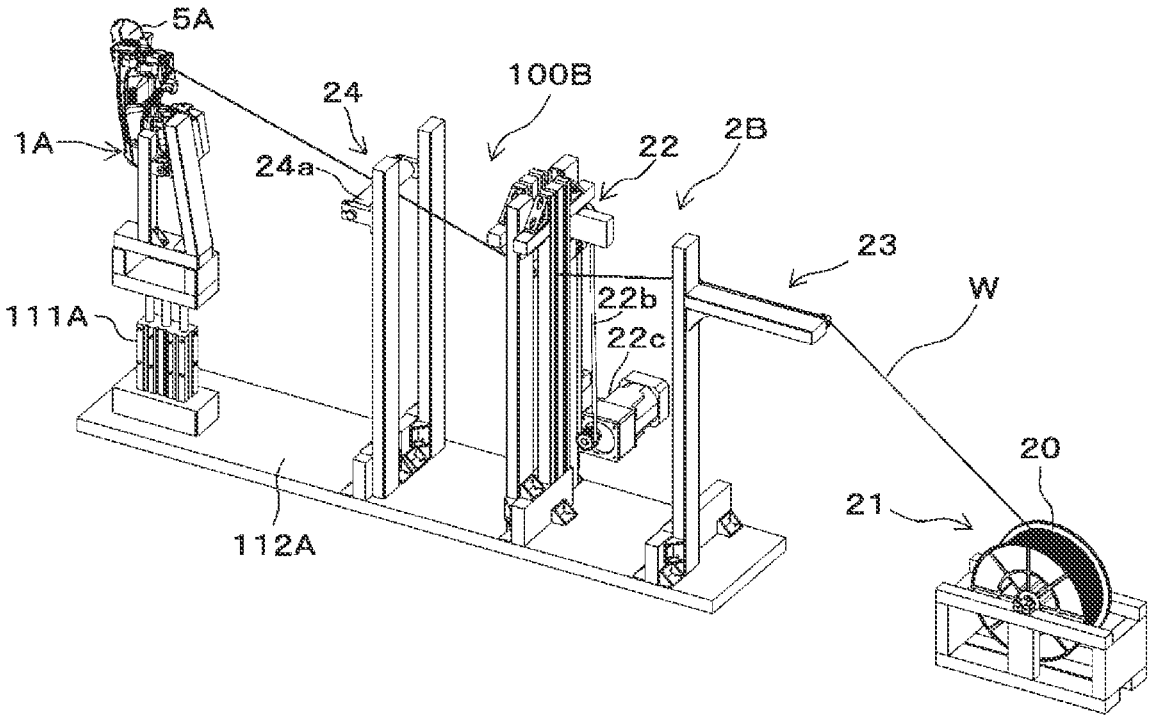
FIG. 24 is a perspective view showing further another modified embodiment of the binding facility of each embodiment.

FIG. 24 is a perspective view showing another modified embodiment of the binding facility of each embodiment. FIG. 24 shows a modified embodiment of the binding facility 100B of the second embodiment, as an example. In the binding facility of each embodiment, the reinforcing bar binding machine 1A is configured to bind the reinforcing bars S with the two wires S that are fed aligned in parallel. However, the reinforcing bar binding machine 1A may also be configured to bind the reinforcing bars S with one wire W. In this case, the wire feeding mechanism 2B has a configuration where the reel accommodation part 21 is configured to accommodate one reel 20, the wire pullout mechanism 22 is configured to pull out one wire W and the first wire guiding part 23 and the second wire guiding part 24 are configured to guide one wire W.

<Modified Embodiments of Wire Feeding Mechanism>

The wire feeding mechanism 2A may have the guide parts each configured to regulate the position of each wire W along the direction in which the two wires W are aligned in parallel, at any one place, at a plurality of places or at all places among the first wire guiding part 23, the vicinity of the first wire guiding part 23, the second wire guiding part 24, the vicinity of the second wire guiding part 24 and the vicinity of the reinforcing bar binding machine 1A.

Figure 25A:
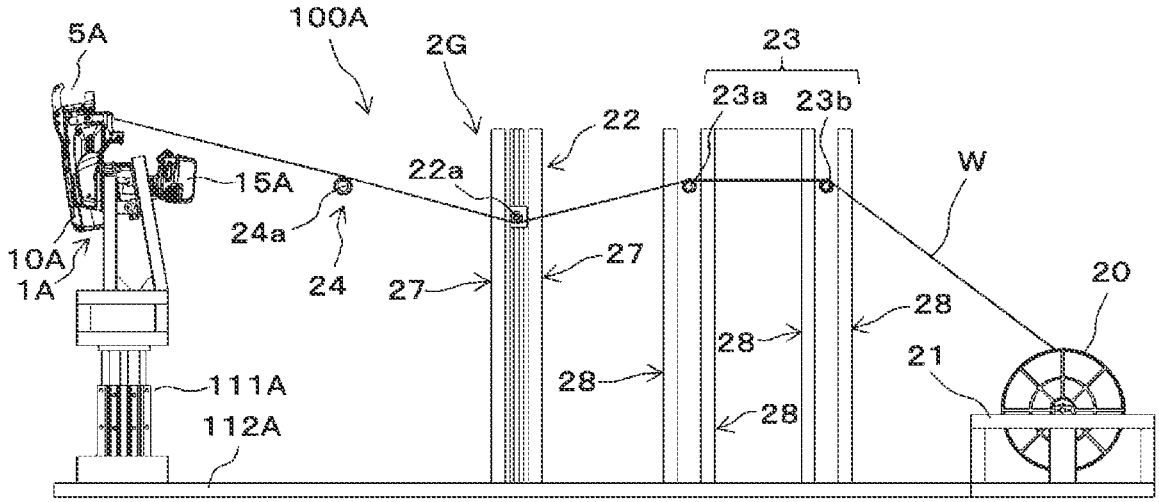
FIG. 25A is a side view of a binding facility showing a modified embodiment of the wire feeding mechanism.
Figure 25B:
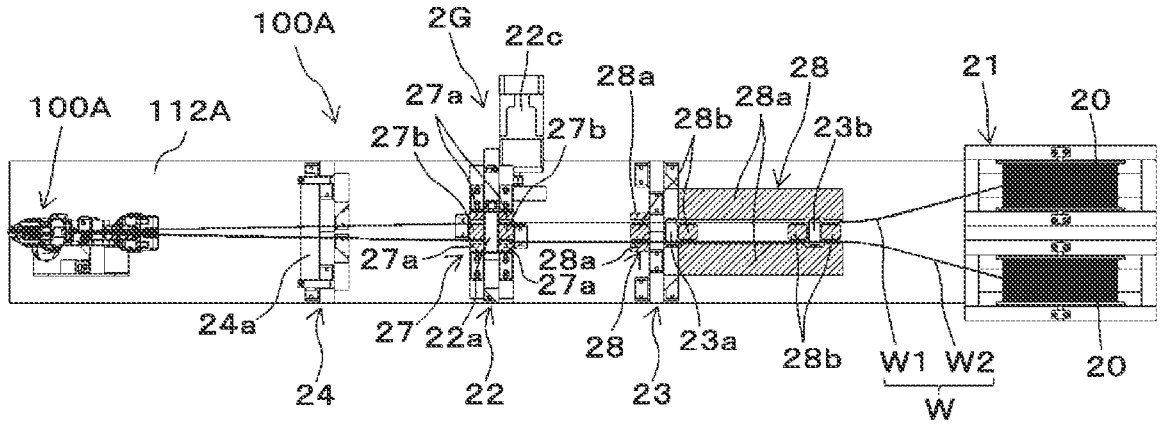
FIG. 25B is a top view of the binding facility showing the modified embodiment of the wire feeding mechanism.
Figure 25C:
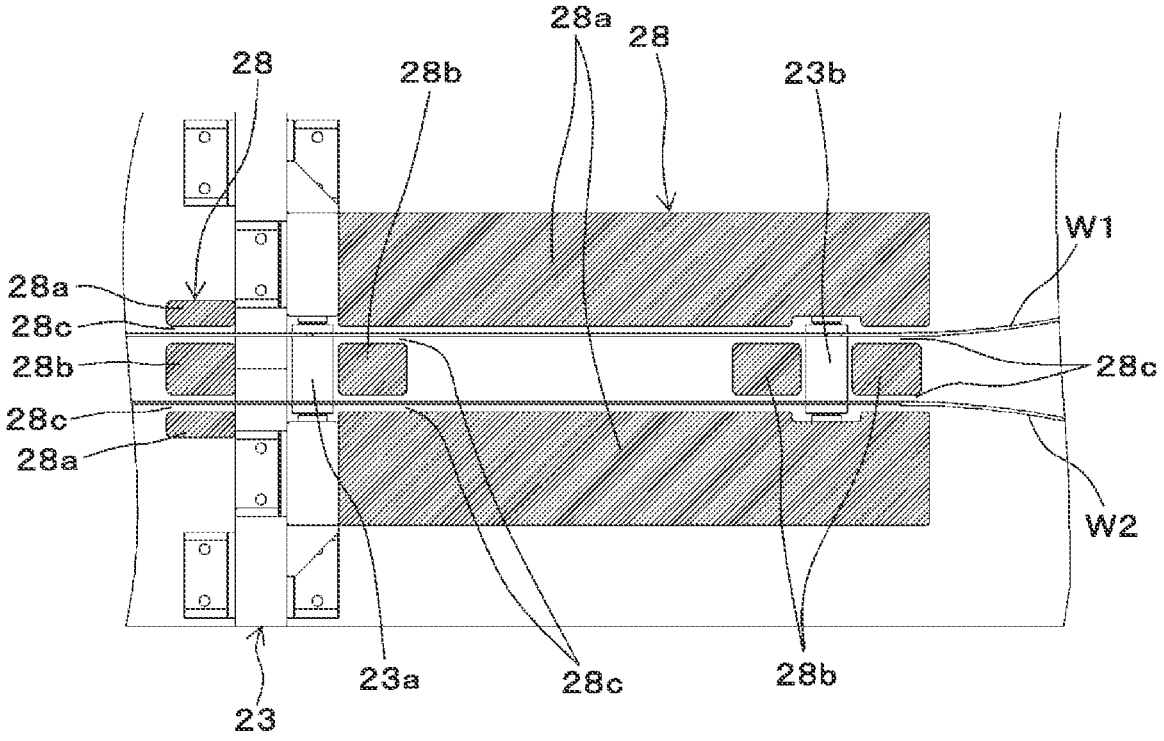
FIG. 25C is a top view of main parts of the binding facility showing the modified embodiment of the wire feeding mechanism.

FIG. 25A is a side view of a binding facility showing a modified embodiment of the wire feeding mechanism, FIG. 25B is a top view of the binding facility showing the modified embodiment of the wire feeding mechanism, and FIG. 25C is a top view of main parts of the binding facility showing the modified embodiment of the wire feeding mechanism. FIG. 25C shows the first wire guiding part 23.

A wire feeding mechanism 23G of the modified embodiment includes the guide parts 27 each configured to regulate the position of each wire W along the direction, in which the two wires W are aligned in parallel, and provided to the wire feeding mechanism 22, and other guide parts 28 each configured to regulate the position of each wire W along the direction, in which the two wires W are aligned in parallel, and provided to the first wire guiding part 23.

The guide parts 28 are respectively provided on the wire pullout mechanism 22-side and the roller 23*b*-side of the roller 23*a* and on the reel accommodation part 21-side and the roller 23*a*-side of the roller 23*b* in the first wire guiding part 23. Specifically, the guide parts 28 are provided before and after the roller 23*a* and before and after the roller 23*b* of the first wire guiding part 23 along the feeding direction of the wires W.

The guide parts 28 each have first guide portions 28*a* each provided on an outer side of each wire W with respect to the direction in which the two wires W (W1, W2) are aligned in parallel, and a second guide portion 28*b* provided between the two wires W.

The first guide portion 28*a* extends from the base part 112A along the moving direction of the pullout roller 22*a*, and the second guide portion 28*b* extends from the base part 112A along the moving direction of the pullout roller 22*a*.

The guide part 28 has one first guide portion 28*a* that is provided on one side of the second guide portion 28*b* along the direction, in which the two wires W are aligned in parallel, and faces the second guide portion with a gap extending along the moving direction of the pullout roller 22*a* and enabling at least one wire W to pass therethrough. The guide part 28 is formed with a guiding portion 28*c* by the gap between the one first guide portion 28*a* and the second guide portion 28*b*.

In addition, the guide part 28 has the other first guide portion 28*a* that is provided on the other side of the second guide portion 28*b* along the direction, in which the two wires W are aligned in parallel, and faces the second guide portion with a gap extending along the moving direction of the pullout roller 22*a* and enabling at least one wire W to pass therethrough. The guide part 28 is formed with a guiding portion 28*c* by the gap between the other first guide portion 28*a* and the second guide portion 28*b*.

Thereby, the guide parts 28 are configured to suppress each wire W from moving in the direction, in which the two wires W are aligned in parallel, within a moving range of the pullout roller 22*a* from the upper limit position to the lower limit position, between the wire pullout mechanism 22 and the first wire guiding part 23. In addition, the guide parts 28 are configured to suppress each wire W from moving in the direction, in which the two wires W are aligned in parallel, between the roller 23*a* and the roller 23*b* of the first wire guiding part 23 and between the roller 23*b* and the reel accommodation part 21.

Therefore, also in the first wire guiding part 23, the two wires W are each suppressed from moving in the direction in which the wires are aligned in parallel. Therefore, one wire is suppressed from being entangled due to being twisted or the like. In addition, the two wires W are suppressed from moving toward each other and being entangled due to being twisted or the like. Further, the two wires W are suppressed from moving away from each other and being entangled between the adjacent binding facilities 100A.

Note that, the guide part 28 may also be configured by a member configured to support the roller 23*a* and the like of the first wire guiding part 23, for example. The first wire guiding part 23 may have two members configured to support the roller 23*a* and the like each provided on each outer side along the direction, in which the two wires W are aligned in parallel, in a form of extending along the moving direction of the pullout roller 22*a*, and the guide part 28 may be constituted by the two members.

Figure 26A:
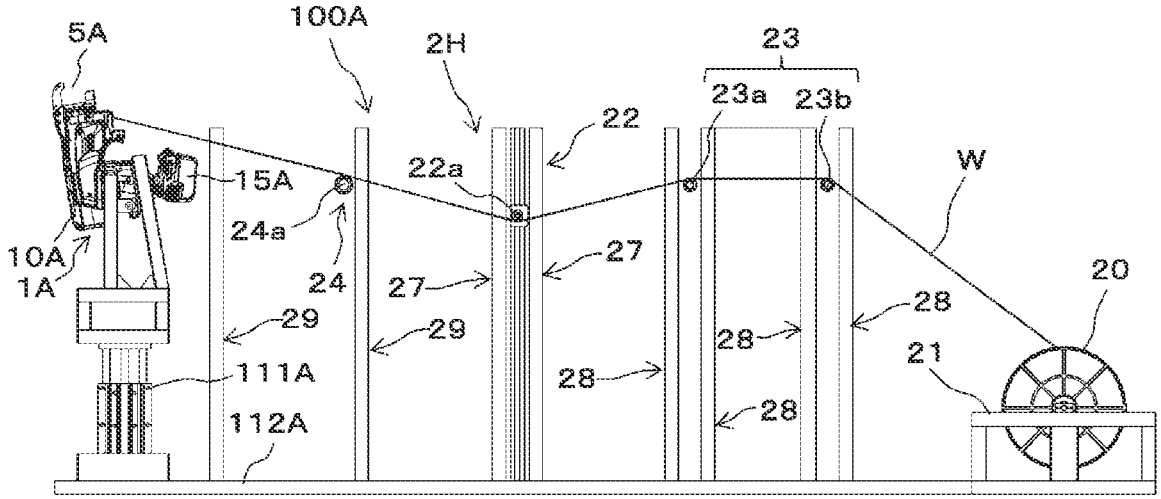
FIG. 26A is a side view of a binding facility showing another modified embodiment of the wire feeding mechanism.
Figure 26B:
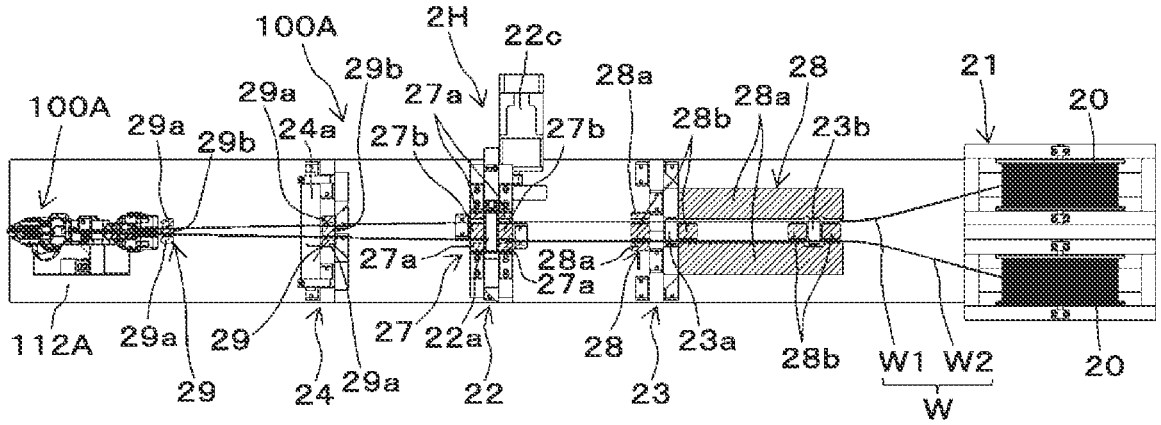
FIG. 26B is a top view of the binding facility showing another modified embodiment of the wire feeding mechanism.
Figure 26C:
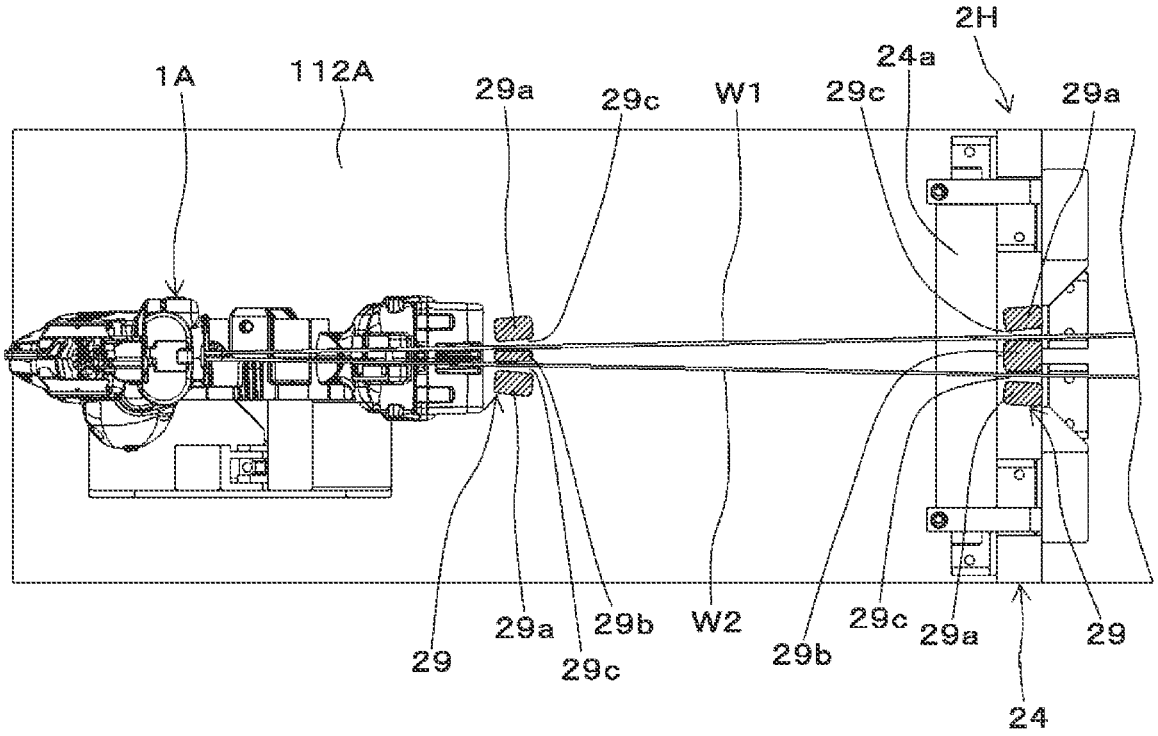
FIG. 26C is a top view of main parts of the binding facility showing another modified embodiment of the wire feeding mechanism.

FIG. 26A is a side view of a binding facility showing another modified embodiment of the wire feeding mechanism, FIG. 26B is a top view of the binding facility showing another modified embodiment of the wire feeding mechanism, and FIG. 26C is a top view of main parts of the binding facility showing another modified embodiment of the wire feeding mechanism. FIG. 26C shows the second wire guiding part 24.

A wire feeding mechanism 2H of another modified embodiment includes the above-described guide parts 27 each configured to regulate the position of each wire W along the direction, in which the two wires W are aligned in parallel, and provided to the wire feeding mechanism 22, and the above-described other guide parts 28 each configured to regulate the position of each wire W along the direction, in which the two wires W are aligned in parallel, and provided to the first wire guiding part 23. In addition, the wire feeding mechanism 2H includes further other guide parts 29 each configured to regulate the position of each wire W along the direction, in which the two wires W are aligned in parallel, and provided to the second wire guiding part 24.

The guide parts 29 are respectively provided on the wire pullout mechanism 22-side of the roller 24*a* of the second wire guiding part 24 and near the reinforcing bar binding machine 1A between the second wire guiding part 24 and the reinforcing bar binding machine 1A. That is, the guide parts 29 are provided before and after the roller 24*a* of the second wire guiding part 24 along the feeding direction of the wires W.

The guide parts 29 each have first guide portions 29*a* each provided on an outer side of each wire W with respect to the direction in which the two wires W (W1, W2) are aligned in parallel, and a second guide portion 29*b* provided between the two wires W.

The first guide portion 29*a* extends from the base part 112A along the moving direction of the pullout roller 22*a*, and the second guide portion 29*b* extends from the base part 112A along the moving direction of the pullout roller 22*a*.

The guide part 29 has one first guide portion 29*a* that is provided on one side of the second guide portion 29*b* along the direction, in which the two wires W are aligned in parallel, and faces the second guide portion with a gap extending along the moving direction of the pullout roller 22*a* and enabling at least one wire W to pass therethrough. The guide part 29 is formed with a guiding portion 29*c* by the gap between the one first guide portion 29*a* and the second guide portion 29*b*.

In addition, the guide part 29 has the other first guide portion 29*a* that is provided on the other side of the second guide portion 29*b* along the direction, in which the two wires W are aligned in parallel, and faces the second guide portion with a gap extending along the moving direction of the pullout roller 22*a* and enabling at least one wire W to pass therethrough. The guide part 29 is formed with a guiding portion 29*c* by the gap between the other first guide portion 29*a* and the second guide portion 29*b*.

Thereby, the guide parts 29 are configured to suppress each wire W from moving in the direction, in which the two wires W are aligned in parallel, within the moving range of the pullout roller 22*a* from the upper limit position to the lower limit position, between the wire pullout mechanism 22 and the second wire guiding part 24. In addition, the guide parts 29 are configured to suppress each wire W from moving in the direction, in which the two wires W are aligned in parallel, between the second wire guiding part 24 and the reinforcing bar binding machine 1A.

Therefore, also in the second wire guiding part 24, the two wires W are each suppressed from moving in the direction in which the wires are aligned in parallel. Therefore, one wire is suppressed from being entangled due to being twisted or the like. In addition, the two wires W are suppressed from moving toward each other and being entangled due to being twisted or the like. Further, the two wires W are suppressed from moving away from each other and being entangled between the adjacent binding facilities 100A.

Note that, the guide part 29 may also be configured by a member configured to support the roller 24*a* and the like of the second wire guiding part 24, for example. The second wire guiding part 24 may have two members configured to support the roller 24*a* and the like each provided on each outer side along the direction, in which the two wires W are aligned in parallel, in a form of extending along the moving direction of the pullout roller 22*a*, and the guide part 29 may be constituted by the two members.

Figure 27A:
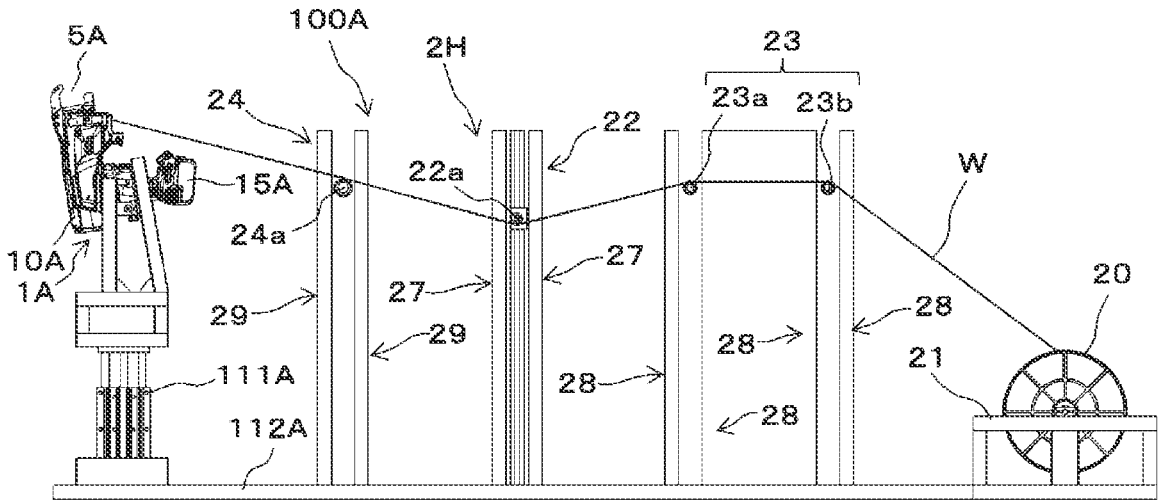
FIG. 27A is a side view of a binding facility showing another modified embodiment of the wire feeding mechanism.
Figure 27B:
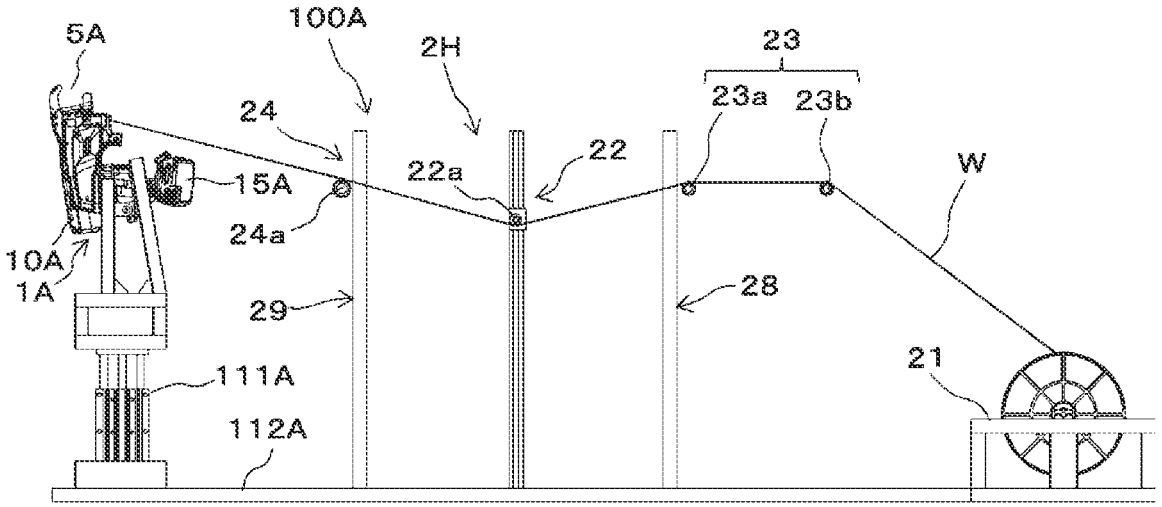
FIG. 27B is a side view of a binding facility showing another modified embodiment of the wire feeding mechanism.
Figure 27C:
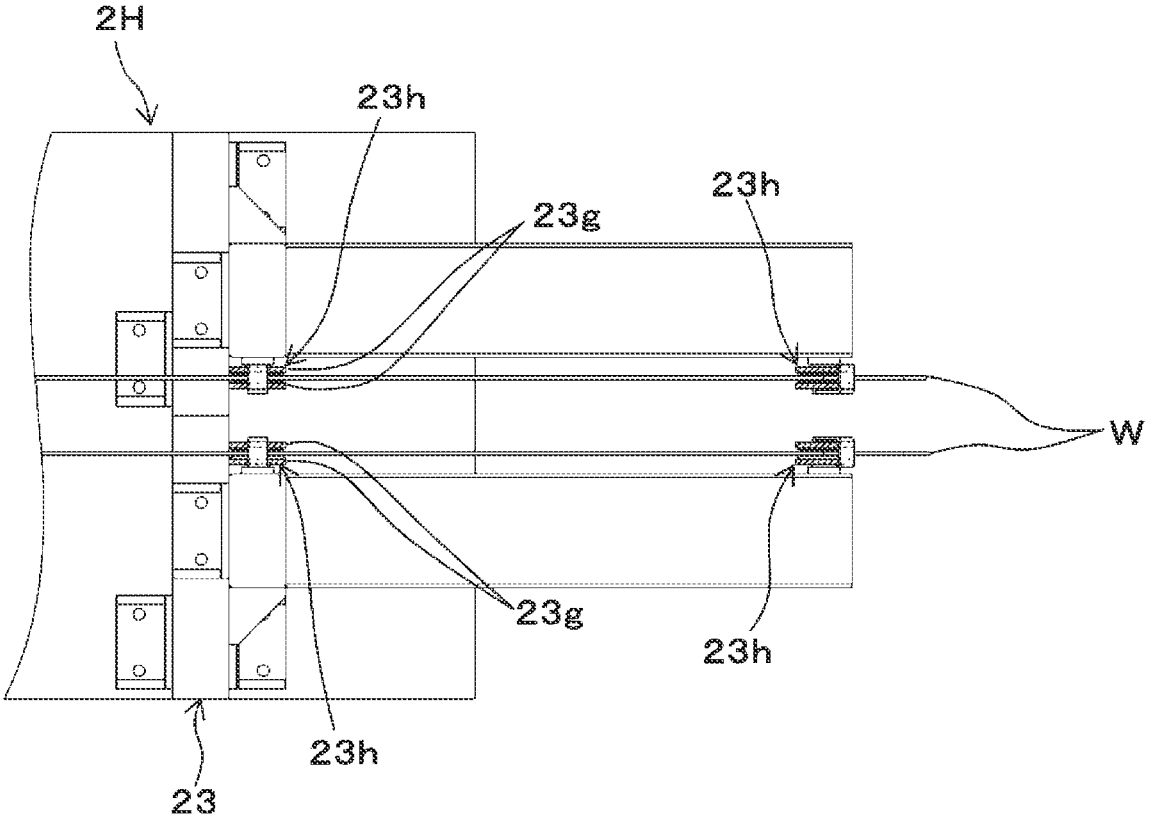
FIG. 27C is a top view of main parts of a binding facility showing another modified embodiment of the wire feeding mechanism.

FIGS. 27A and 27B are side views of binding facilities showing other modified embodiments of the wire feeding mechanism, and FIG. 27C is a top view of main parts of the binding facility showing another modified embodiment of the wire feeding mechanism. FIG. 27C shows the first wire guiding part 23.

As shown in FIG. 27A, the wire feeding mechanism 2H may have a configuration where the guide part 29 between the second wire guiding part 24 and the reinforcing bar binding machine 1A is provided near the second wire guiding part 24. In addition, as shown in FIG. 27B, the wire feeding mechanism 2H may have a configuration where, as the guide part between the wire pullout mechanism 22 and the first wire guiding part 23 and the guide part between the wire pullout mechanism 22 and the second wire guiding part 24, the guide part 27 near the wire pullout mechanism 22 is not provided, the guide part 28 is provided near the first wire guiding part 23 between the wire pullout mechanism 22 and the first wire guiding part 23 and the guide part 29 is provided near the second wire guiding part 24 between the wire pullout mechanism 22 and the second wire guiding part 24. In addition, the guide part 27 near the wire pullout mechanism 22 may not be provided, and the guide part may be provided near the first wire guiding part 23 and/or near the second wire guiding part 24.

In the wire feeding mechanism 2H and the like, the first wire guiding part 23 is configured to guide the wires W by the columnar rollers. Instead of this, as shown in FIG. 27C, the wire W may also be guided by a pulley 23*h* having flange portions 23*g* provided on both axial sides and protruding in a circumferential direction. The pulleys 23*h* can suppress each of the two wires W from moving in the direction in which the wires are aligned in parallel by the flange portions 23*g*.

Figure 28A:
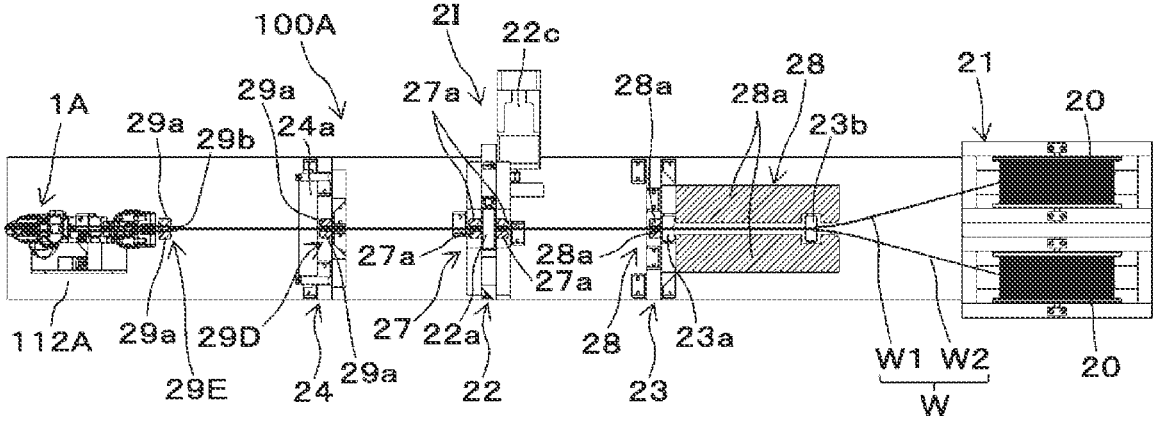
FIG. 28A is a top view of a binding facility showing further another modified embodiment of the wire feeding mechanism.
Figure 28B:
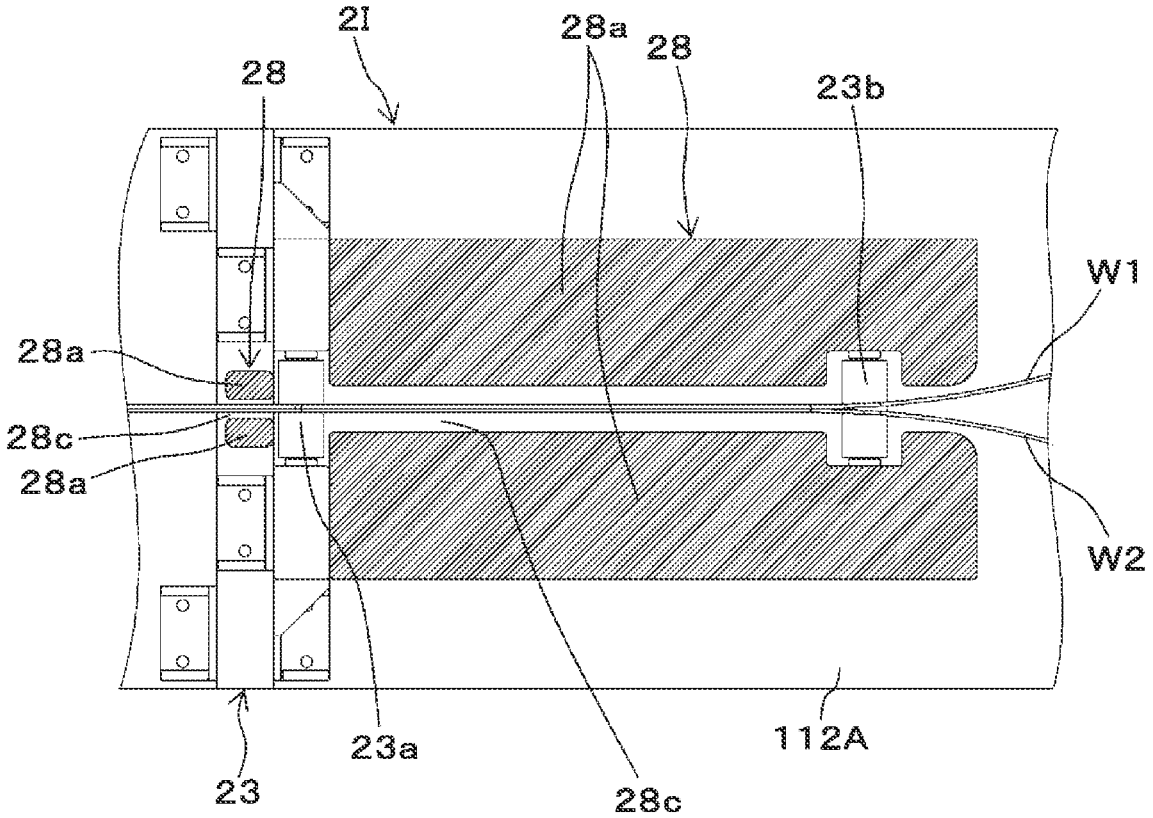
FIG. 28B is a top view of main parts of the binding facility showing further another modified embodiment of the wire feeding mechanism.
Figure 28C:
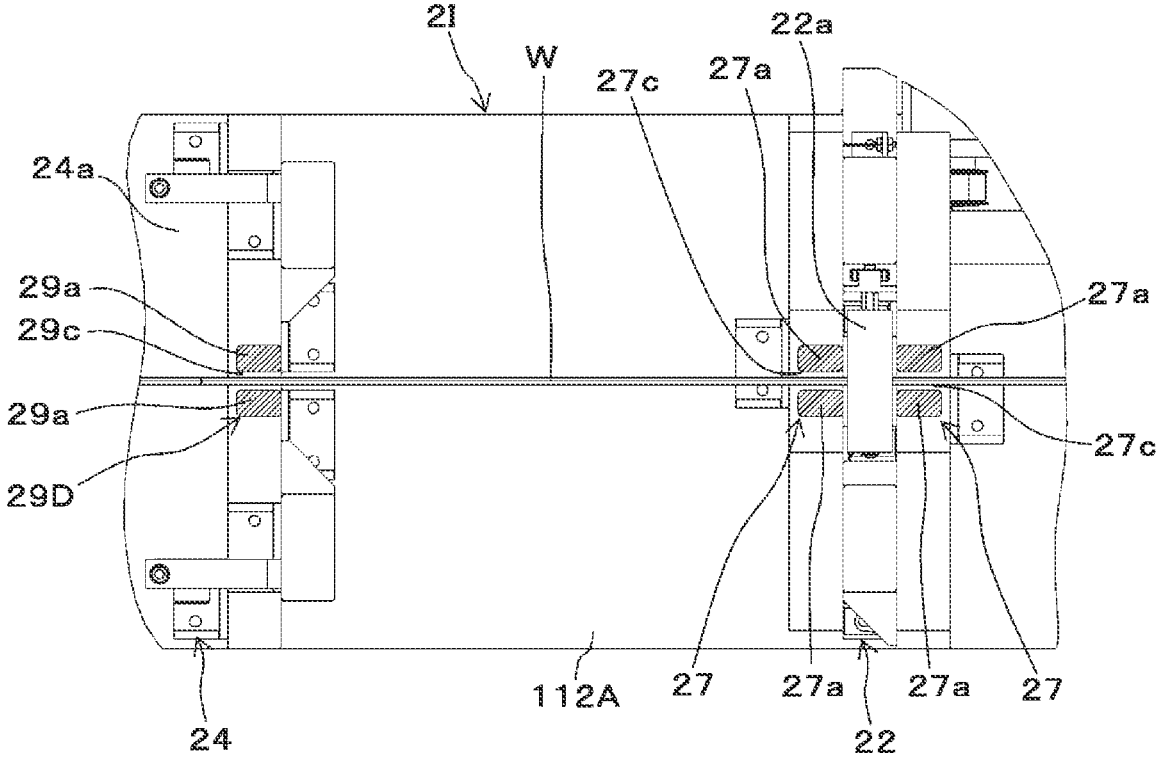
FIG. 28C is a top view of main parts of a binding facility showing further another modified embodiment of the wire feeding mechanism.
Figure 28D:
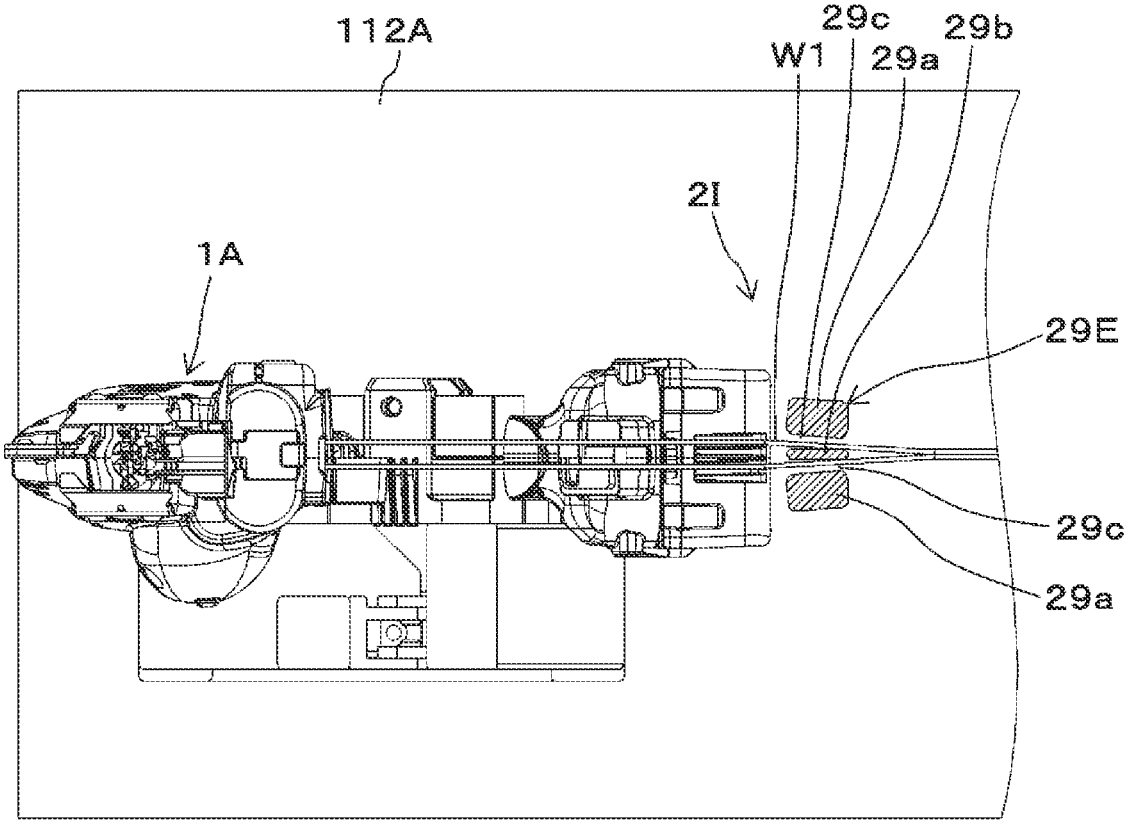
FIG. 28D is a top view of main parts of the binding facility showing further another modified embodiment of the wire feeding mechanism.

FIG. 28A is a top view of a binding facility showing another modified embodiment of the wire feeding mechanism, and FIGS. 28B to 28D are top views of main parts of the binding facility showing another modified embodiment of the wire feeding mechanism. FIG. 28B shows the first wire guiding part 23, FIG. 28C shows the wire pullout mechanism 22 and the second wire guiding part 24, and FIG. 28D shows the vicinity of the reinforcing bar binding machine 1A.

A wire feeding mechanism 2I of another modified embodiment is configured to integrate the feeding paths of the two wires W pulled out from the two reels 20 accommodated in the reel accommodation part 21 into a same path in the first wire guiding part 23 and to divide the path into separate paths between the second wire guiding part 24 and the reinforcing bar binding machine 1A.

The wire feeding mechanism 2I includes the guide parts 27 each configured to regulate the position of each wire W along the direction, in which the two wires W are aligned in parallel, and provided to the wire feeding mechanism 22, other guide parts 28 provided to the first wire guiding part 23 and further other guide parts 29D and 29E provided to the second wire guiding part 24.

The guide parts 28 are respectively provided on the wire pullout mechanism 22-side and the roller 23*b*-side of the roller 23*a* and on the reel accommodation part 21-side and the roller 23*a*-side of the roller 23*b* in the first wire guiding part 23. Specifically, the guide parts 28 are provided before and after the roller 23*a* and before and after the roller 23*b* of the first wire guiding part 23 along the feeding direction of the wires W.

The guide parts 28 each have first guide portions 28*a* each provided on an outer side of each wire W with respect to the direction in which the two wires W (W1, W2) are aligned in parallel. The first guide portion 28*a* extends from the base part 112A along the moving direction of the pullout roller 22*a*.

The guide part 28 has a pair of the first guide portions 28*a* that is provided to face each other with a gap extending along the moving direction of the pullout roller 22*a* and enabling at least two wires W to pass therethrough. The guide part 28 is formed with a guiding part 28*c* by the gap between the pair of first guide portions 28*a*. Note that, the guide part 28 may have a configuration where the first guide portion 28*a* between the roller 23*a* and the roller 23 and the first guide portion 28*a* on the reel accommodation part 21-side with respect to the roller 23*b* are integrated.

Thereby, the guide parts 28 are configured to suppress each wire W from moving in the direction, in which the two wires W are aligned in parallel, between the wire pullout mechanism 22 and the first wire guiding part 23, within the moving range of the pullout roller 22*a* from the upper limit position to the lower limit position. In addition, the guide parts 28 are configured to suppress each wire W from moving in the direction, in which the two wires W are aligned in parallel, between the roller 23*a* and the roller 23*b* of the first wire guiding part 23 and between the roller 23*b* and the reel accommodation part 21.

The guide parts 27 are respectively provided on the first wire guiding part 23-side and the second wire guiding part 24-side of the pullout roller 22*a* of the wire pullout mechanism 22. That is, the guide parts 27 are provided before and after the pullout roller 22*a* of the wire feeding mechanism 22 along the feeding direction of the wires W.

The guide parts 27 each have first guide portions 27*a* each provided on an outer side of each wire W with respect to the direction in which the two wires W (W1, W2) are aligned in parallel. The first guide portion 27*a* extends from the base part 112A along the moving direction of the pullout roller 22*a*.

The guide part 27 has a pair of the first guide portions 27*a* that is provided to face each other with a gap extending along the moving direction of the pullout roller 22*a* and enabling at least two wires W to pass therethrough. The guide part 27 is formed with a guiding part 27*c* by the gap between the pair of first guide portions 27*a*.

Thereby, the guide parts 27 are configured to suppress each wire W from moving in the direction, in which the two wires W are aligned in parallel, between the wire pullout mechanism 22 and the first wire guiding part 23 and between the wire pullout mechanism 22 and the second wire guiding part 24, within the moving range of the pullout roller 22*a* from the upper limit position to the lower limit position.

The guide part 29D is provided on the wire pullout mechanism 22-side of the roller 24*a* of the second wire guiding part 24.

The guide part 29D has first guide portions 29*a* each provided on an outer side of each wire W with respect to the direction in which the two wires W (W1, W2) are aligned in parallel. The first guide portion 29*a* extends from the base part 112A along the moving direction of the pullout roller 22*a*.

The guide part 29D has a pair of the first guide portions 29*a* that is provided to face each other with a gap extending along the moving direction of the pullout roller 22*a* and enabling at least two wires W to pass therethrough. The guide part 29D is formed with a guiding portion 29*c* by the gap between the pair of first guide portions 29*a*.

Thereby, the guide part 29D is configured to suppress each wire W from moving in the direction, in which the two wires W are aligned in parallel, within the moving range of the pullout roller 22*a* from the upper limit position to the lower limit position, between the wire pullout mechanism 22 and the second wire guiding part 24.

The guide part 29E is provided near the reinforcing bar binding machine 1A between the second wire guiding part 24 and the reinforcing bar binding machine 1A.

The guide part 29E has first guide portions 29*a* each provided on an outer side of each wire W with respect to the direction in which the two wires W (W1, W2) are aligned in parallel, and a second guide portion 29*b* provided between the two wires W.

The first guide portion 29*a* extends from the base part 112A along the moving direction of the pullout roller 22*a*, and the second guide portion 29*b* extends from the base part 112A along the moving direction of the pullout roller 22*a*.

The guide part 29E has one first guide portion 29*a* that is provided on one side of the second guide portion 29*b* along the direction, in which the two wires W are aligned in parallel, and faces the second guide portion with a gap extending along the moving direction of the pullout roller 22*a* and enabling at least one wire W to pass therethrough. The guide part 29 is formed with a guiding portion 29*c* by the gap between the one first guide portion 29*a* and the second guide portion 29*b*.

In addition, the guide part 29E has the other first guide portion 29*a* that is provided on the other side of the second guide portion 29*b* along the direction, in which the two wires W are aligned in parallel, and faces the second guide portion with a gap extending along the moving direction of the pullout roller 22*a* and enabling at least one wire W to pass therethrough. The guide part 29 is formed with a guiding portion 29*c* by the gap between the other first guide portion 29*a* and the second guide portion 29*b*.

Thereby, the guide part 29E is configured to divide the feeding path of the two wires W and to suppress the two wires W from moving in the direction in which the two wires W are aligned in parallel, between the second wire guiding part 24 and the reinforcing bar binding machine 1A. Note that, a configuration where the guide part 29E is provided near the second wire guiding part 24 between the second wire guiding part 24 and the reinforcing bar binding machine 1A is also possible.

<Configuration Example of Binding Facility of Seventh Embodiment>

Figure 29A:
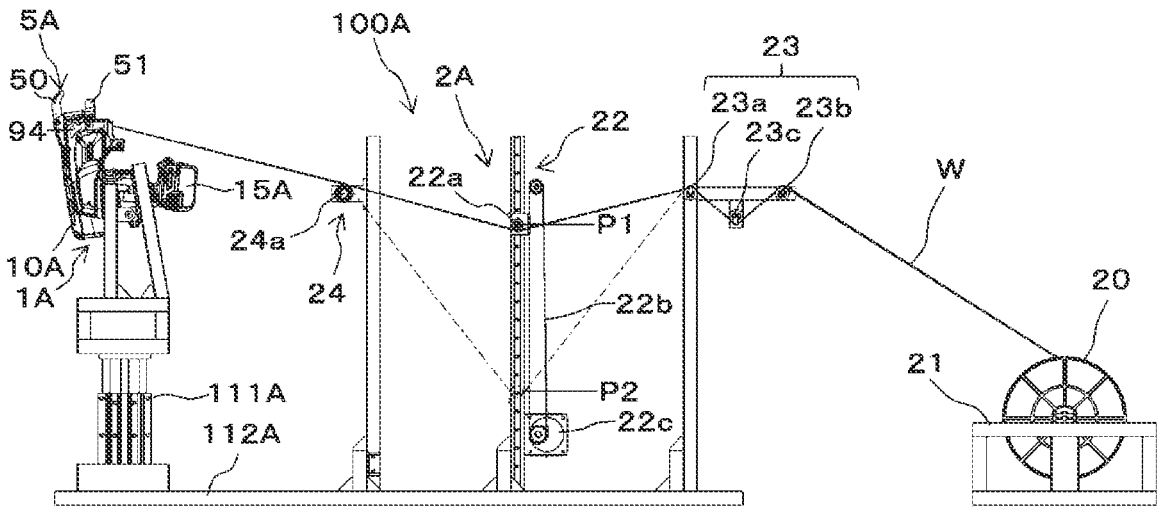
FIG. 29A is a side view showing an example of a binding facility according to the seventh embodiment.
Figure 29B:
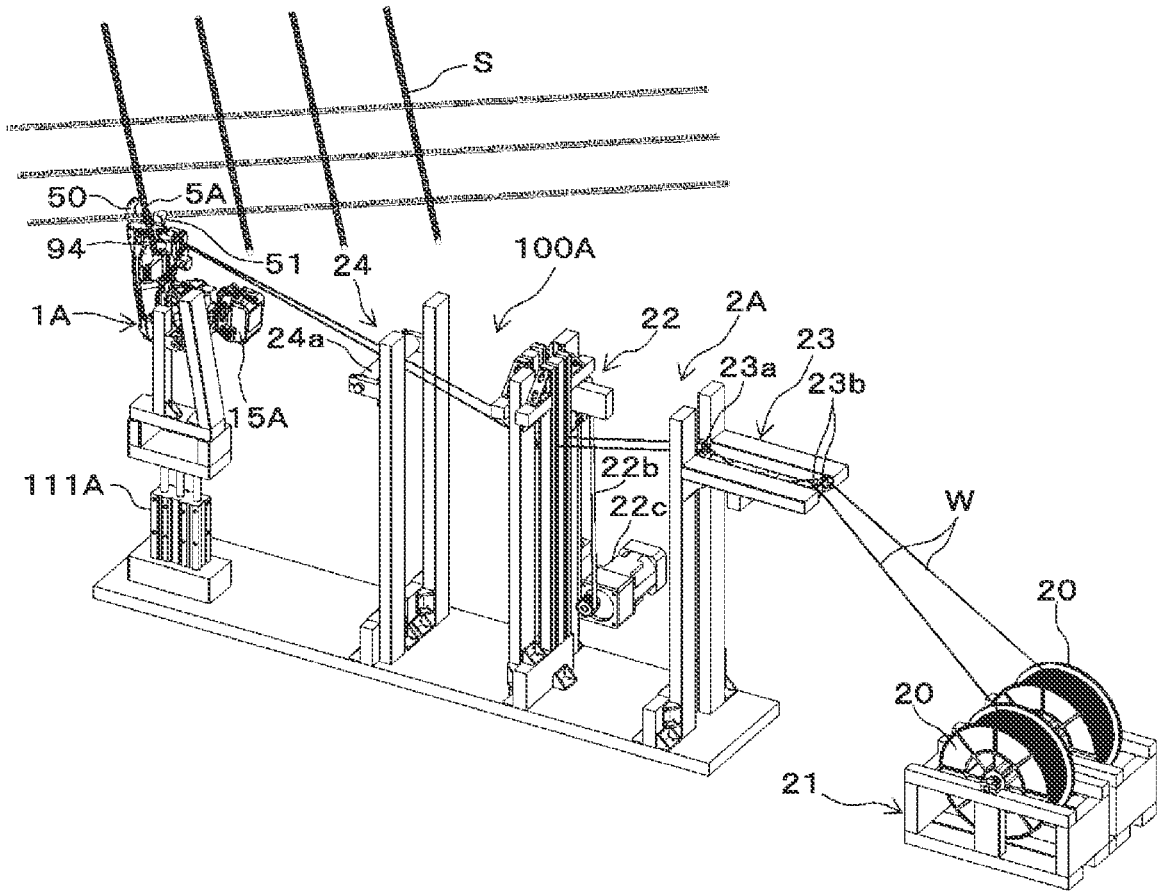
FIG. 29B is a perspective view showing the example of the binding facility according to the seventh embodiment.

FIG. 29A is a side view showing an example of a binding facility according to the seventh embodiment, and FIG. 29B is a perspective view showing the example of the binding facility according to the seventh embodiment.

A binding facility 100A of the seventh embodiment includes a reinforcing bar binding machine 1A configured to bind reinforcing bars S, which are a binding target, with a wire W, a reel accommodation part 21 in which the wire W is accommodated so as to be able to be pulled out, and a wire feeding mechanism 2A configured to pull out the wire W accommodated in the reel accommodation part 21. The reinforcing bar binding machine 1A is attached to an elevation mechanism 111A and supported on a base part 112A so as to be able to move (move up and down) in an upper and lower direction, which is a direction intersecting with an arrangement surface SF of the reinforcing bars S.

The reel accommodation part 21 is an example of the accommodation part, and a reel 20 on which the wire W is wound to be able to be pulled out is rotatably and detachably accommodated therein. For the wire W, a wire made of a plastically deformable metal wire, a wire having a metal wire covered with a resin, a twisted wire or the like is used. The reel 20 is configured so that one wire W is wound on a hub part (not shown) and can be pulled out from the reel 20.

In the present example, in order to bind the reinforcing bars S with two wires W in the reinforcing bar binding machine 1A, the reel accommodation part 21 is configured so that the two reels 20 are accommodated side by side along an axial direction in a state where shafts of rotation are horizontally oriented with respect to a vertical direction.

The wire feeding mechanism 2A includes a wire pullout mechanism 22 configured to feed the wires W between the reinforcing bar binding machine 1A and the reels 20, a first wire guiding part 23 configured to guide the wires W between the reels 20 and the wire pullout mechanism 22, and a second wire guiding part 24 configured to guide the wires W between the reinforcing bar binding machine 1A and the wire pullout mechanism 22.

The wire pullout mechanism 22 has a pullout roller 22*a* configured to pull the wires W between the first wire guiding part 23 and the second wire guiding part 24, and a drive unit 22*b* configured to move a position of the pullout roller 22*a* in a direction intersecting with the wires W between the first wire guiding part 23 and the second wire guiding part 24. In response to the drive unit 22*b* being driven by the motor 22*c*, the pullout roller 22*a* is configured to move between an upper limit position P1 as a first position that is a standby position and a lower limit position P2 as a second position in which the pullout roller pulls the wires W.

The pullout roller 22*a* is in contact with the wires W from the upper side between the first wire guiding part 23 and the second wire guiding part 24 and is moved from the upper limit position P1 to the lower limit position P2, so that the wire pullout mechanism 22 applies a force by which the wires W between the reels 20 and the first wire guiding part 23 and the wires W between the reinforcing bar binding machine 1A and the second wire guiding part 24 are pulled between the first wire guiding part 23 and the second wire guiding part 24.

The first wire guiding part 23 has rollers 23*a*, 23*b* and 23*c* on an upstream side of the wire pullout mechanism 22 with respect to a feeding direction of the wires W that are fed from the reels 20 accommodated in the reel accommodation part 21 to the reinforcing bar binding machine 1A. The first wire guiding part 23 is configured to guide a path, along which the wires W pulled out from the reels 20 accommodated in the reel accommodation part 21 are fed, toward the roller 23*a* by the roller 23*b* and to guide the path toward the second wire guiding part 24 by the roller 23*a*.

The second wire guiding part 24 has a roller 24*a* on a downstream side of the wire pullout mechanism 22. The second wire guiding part 24 is configured to guide the path, along which the wires W are fed, toward the reinforcing bar binding machine 1A by the roller 24*a*.

The rollers 23*a* and 23*b* of the first wire guiding part 23 are provided at substantially the same heights in the vertical direction, and are in contact with the wires W from the lower side. In addition, the roller 24*a* of the second wire guiding part 24 is provided at substantially the same height as the rollers 23*a* and 23*b* of the first wire guiding in the vertical direction, and is in contact with the wires W from the lower side.

In addition, the roller 23*c* of the first wire guiding part 23 is provided on a further lower side than the rollers 23*a* and 23*b* with respect to the vertical direction between the roller 23*a* and the roller 23*b*. The roller 23*c* is in contact with the wires W from the upper side and is configured to bend the feeding path of the wires W along the rollers 23*a* and 23*b*.

Thereby, a contact angle (length) between the rollers 23*a* and 23*b* and roller 23*c* and the wires W in the first wire guiding part 23 increases with respect to a contact angle (length) between the roller 24*a* and the wires W in the second wire guiding part 24.

The rollers 23*a*, 23*b* and 23*c* of the first wire guiding part 23 and the roller 24*a* of the second wire guiding part 24 are caused to rotate by feeding of the wires W, so that a load applied to the wires W becomes greater on a side on which the contact angle (length) between the roller and the wire is longer.

Therefore, the load, which is applied to the wires W that are guided by the first wire guiding part 23, becomes greater than the load, which is applied to the wires W that are guided by the second wire guiding part 24, so that a first load becomes greater than a second load.

In the wire pullout mechanism 22, the pullout roller 22*a* located in the upper limit position P1 is in contact with the wires W between the roller 23*a* of the first wire guiding part 23 and the roller 24*a* of the second wire guiding part 24, from the upper side that is an opposite side to a side on which the rollers 23*a* and 24*a* are in contact with the wires. In the wire pullout mechanism 22, the pullout roller 22*a* is configured to move from the upper limit position P1 to the lower limit position P2 in the direction intersecting with the wires W between the roller 23*a* of the first wire guiding part 23 and the roller 24*a* of the second wire guiding part 24.

Thereby, the wires W between the roller 23*a* of the first wire guiding part 23 and the roller 24*a* of the second wire guiding part 24 are pulled downward by the pullout roller 22*a*. Then, the wires W between the reinforcing bar binding machine 1A and the second wire guiding part 24 and the wires W between the first wire guiding part 23 and the reels 20 accommodated in the reel accommodation part 21 are fed between the roller 23*a* of the first wire guiding part 23 and the roller 24*a* of the second wire guiding part 24.

At this time, it is switched whether the wires W on the first wire guiding part 23-side are fed or the wires W on the second wire guiding part 24-side are fed, depending on the magnitudes of the load applied to the wires W that are guided by the first wire guiding part 23 and the load applied to the wires W that are guided by the second wire guiding part 24.

<Configuration Example of Reinforcing Bar Binding Machine of Seventh Embodiment>

Figure 30A:
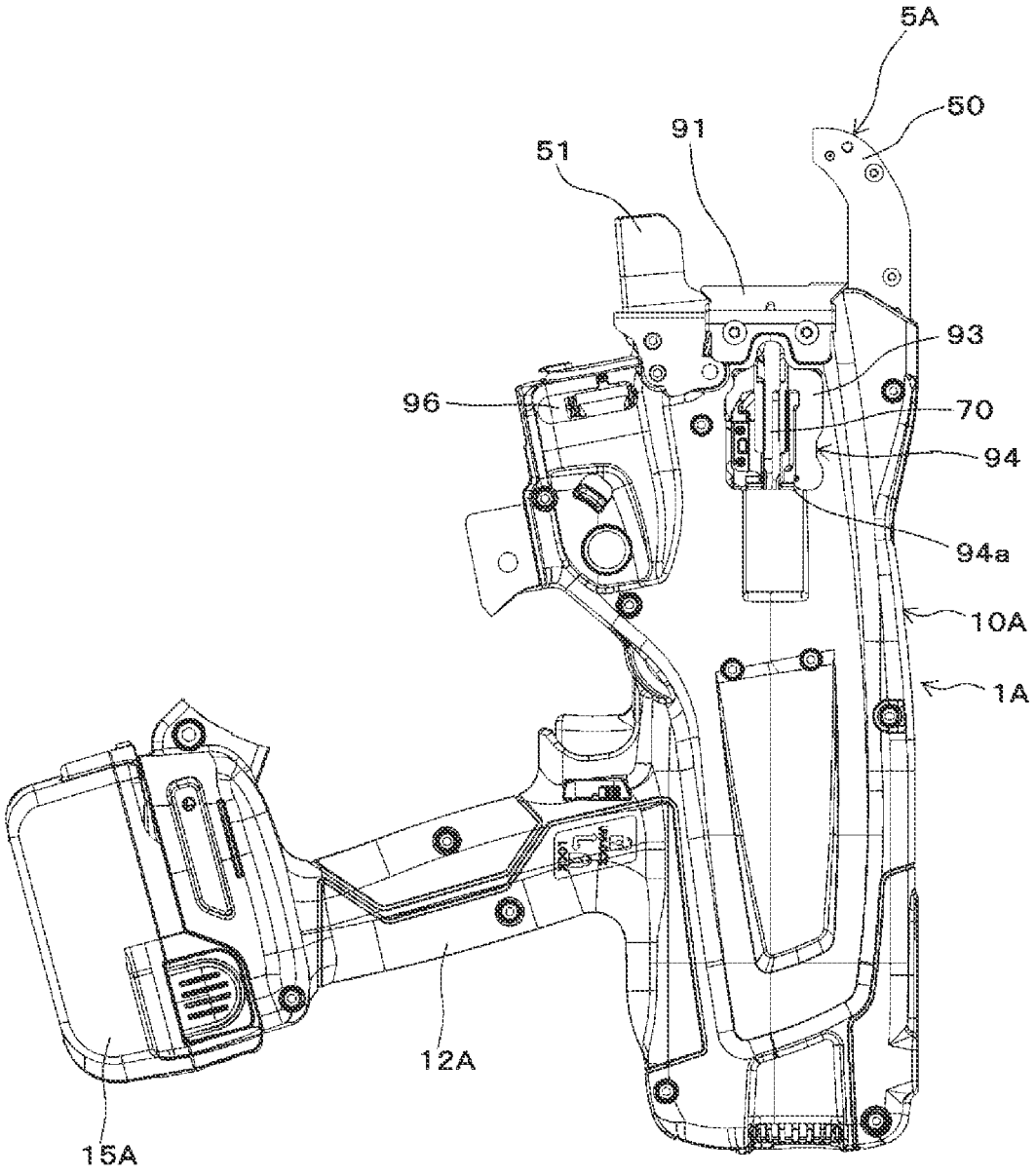
FIG. 30A is a side view showing an example of a reinforcing bar binding machine according to the seventh embodiment.
Figure 30B:
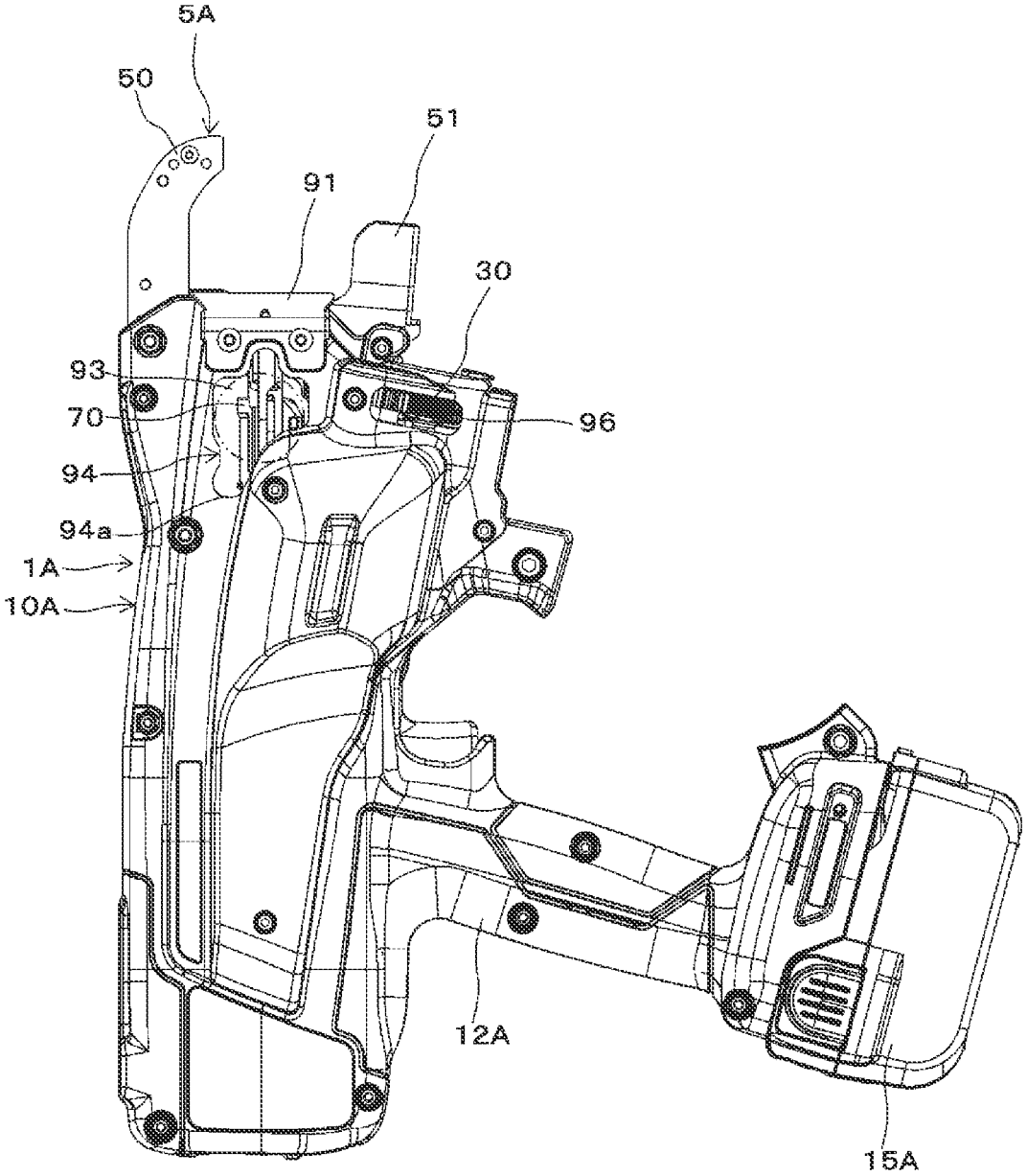
FIG. 30B is a side view showing the example of the reinforcing bar binding machine according to the seventh embodiment.
Figure 30C:
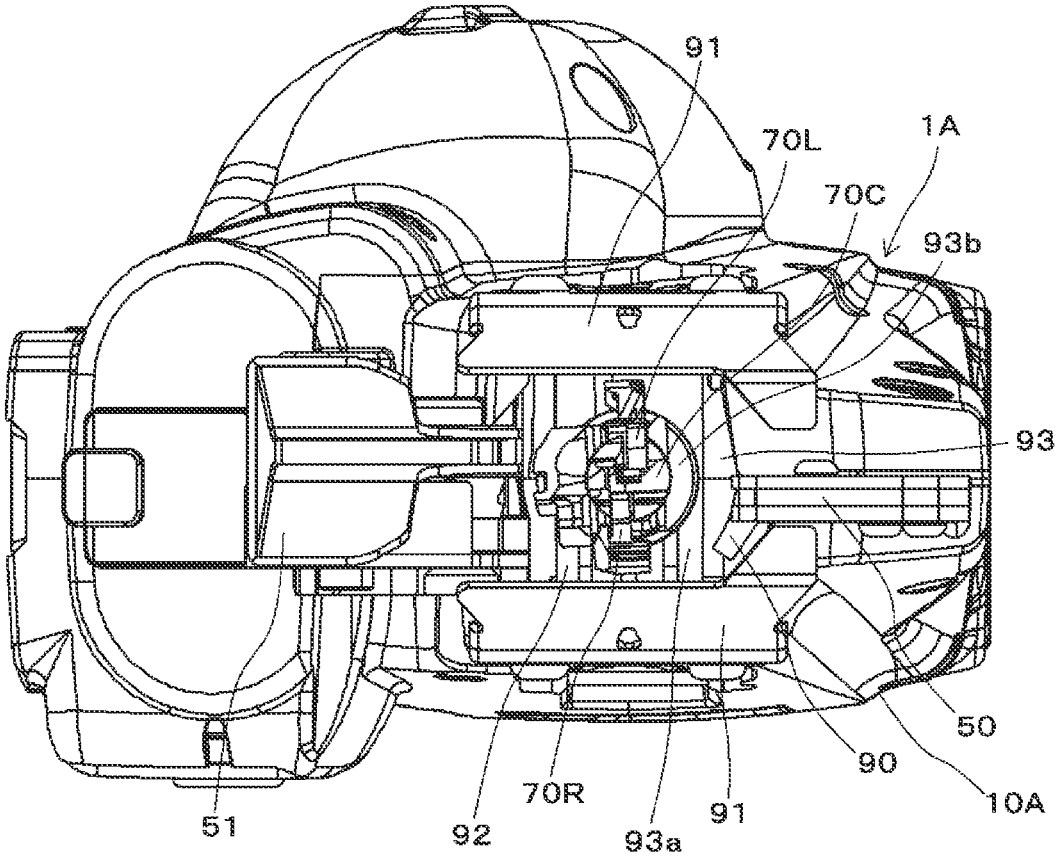
FIG. 30C is a top view of main parts showing the example of the reinforcing bar binding machine according to the seventh embodiment.
Figure 31A:
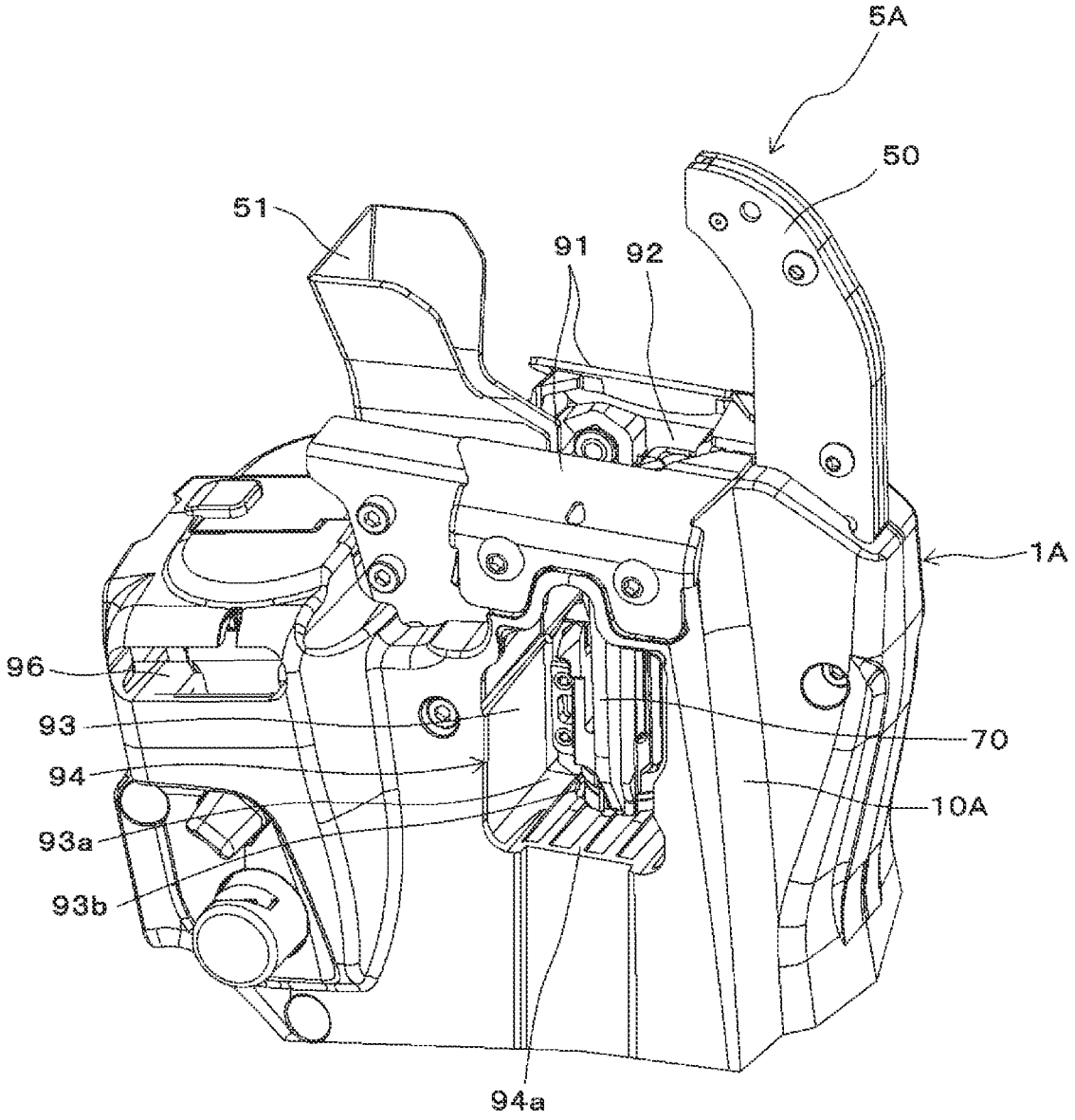
FIG. 31A is a perspective view of main parts showing the example of the reinforcing bar binding machine according to the seventh embodiment.
Figure 31B:
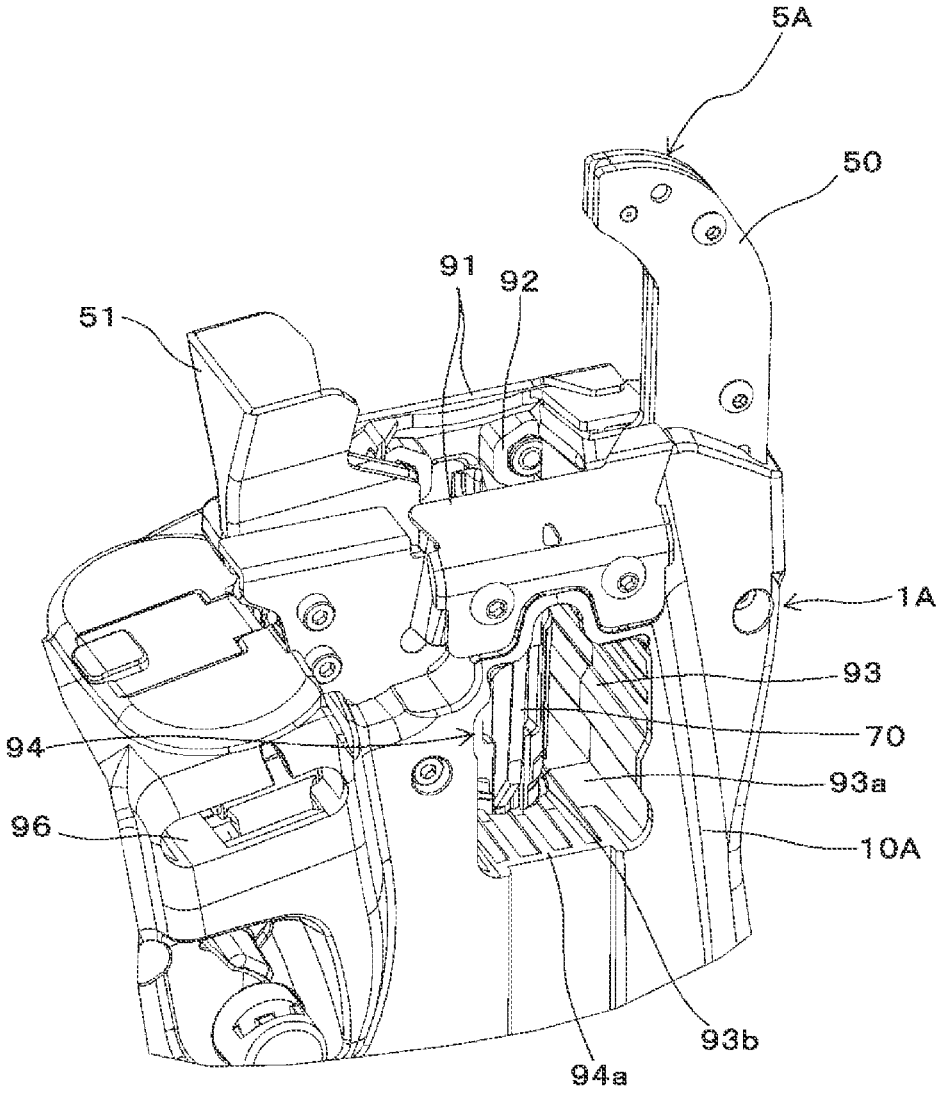
FIG. 31B is a perspective view of main parts showing the example of the reinforcing bar binding machine according to the seventh embodiment.
Figure 31C:
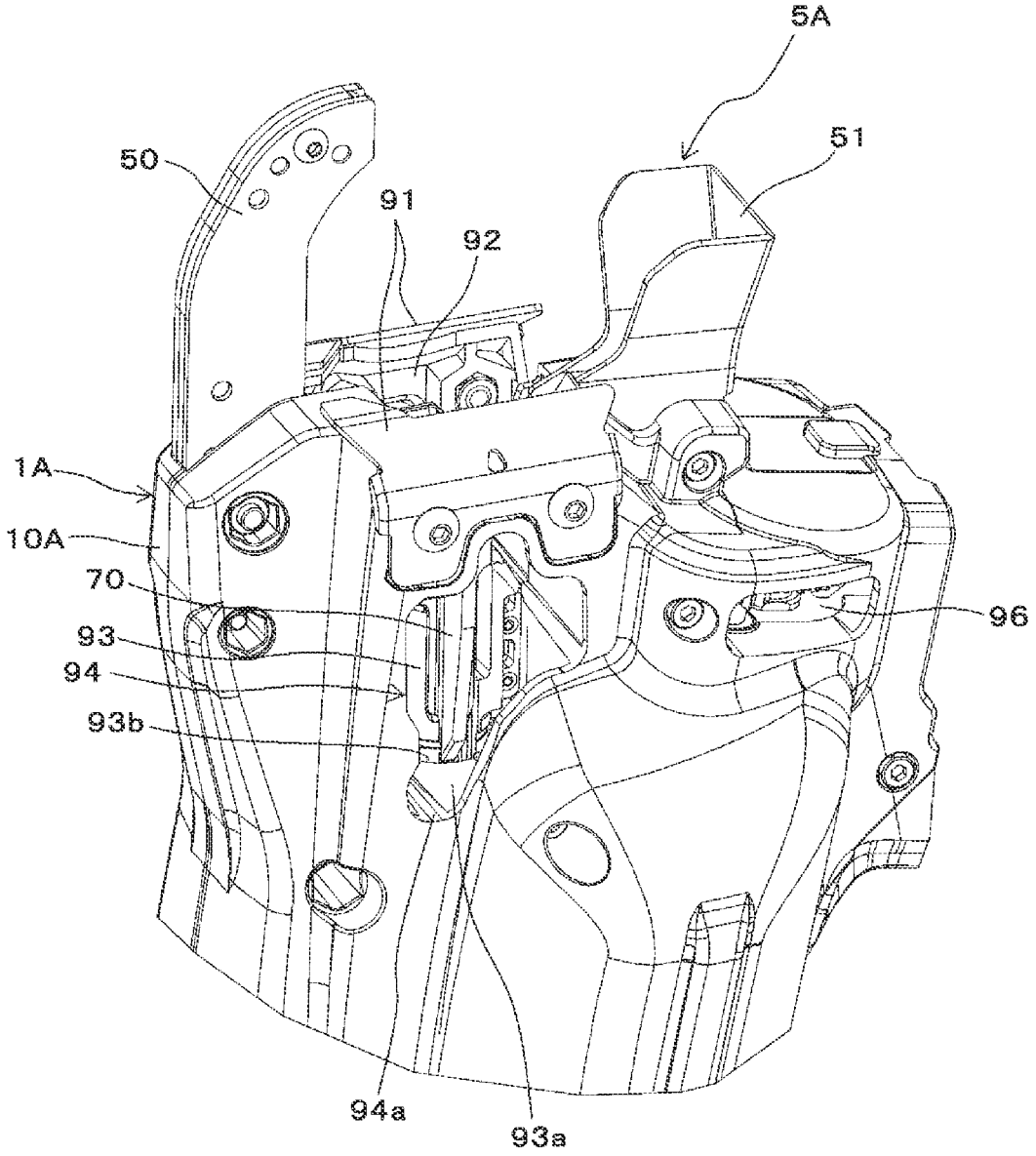
FIG. 31C is a perspective view of main parts showing the example of the reinforcing bar binding machine according to the seventh embodiment.
Figure 31D:
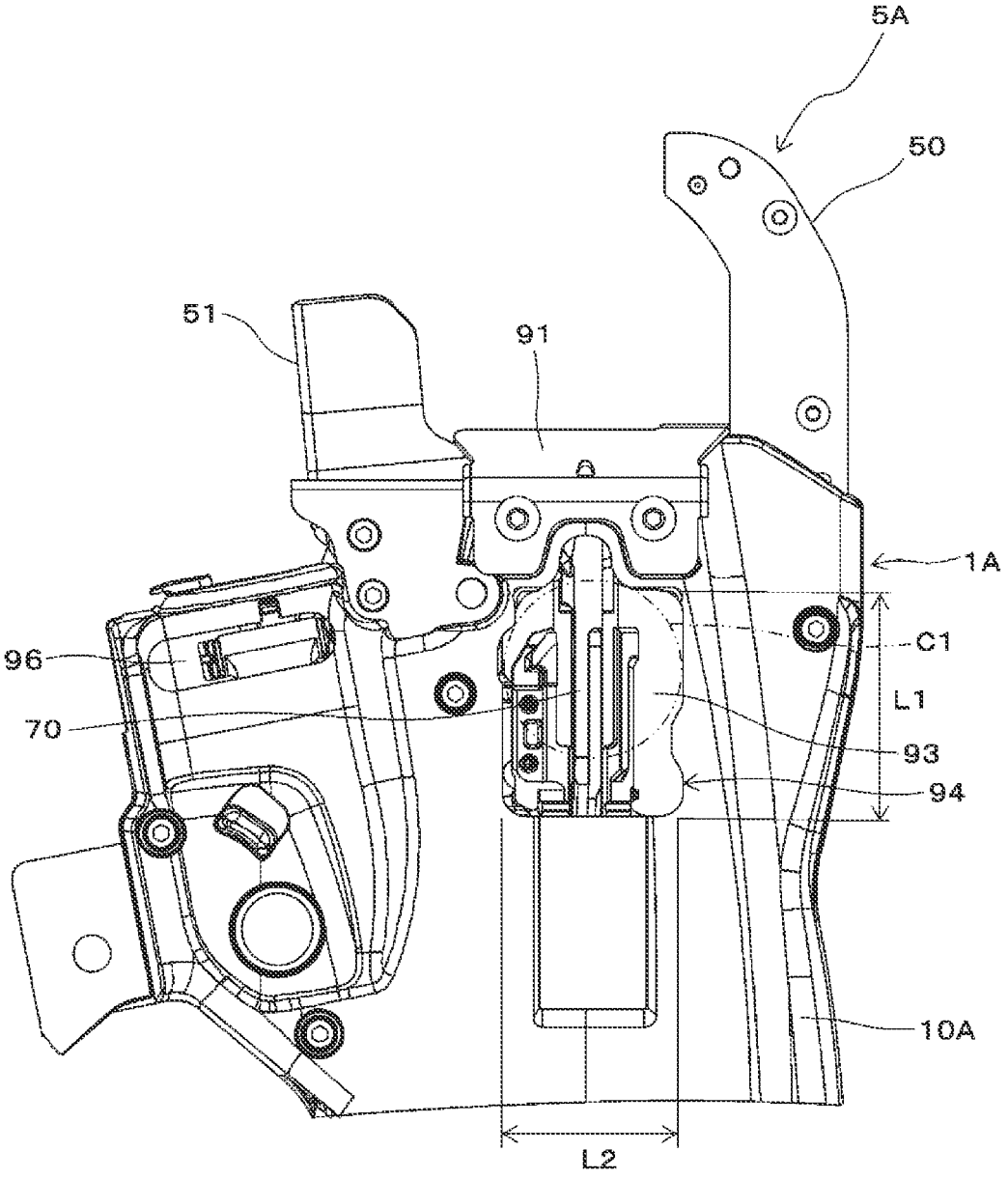
FIG. 31D is a side view of main parts showing the example of the reinforcing bar binding machine according to the seventh embodiment.
Figure 31E:
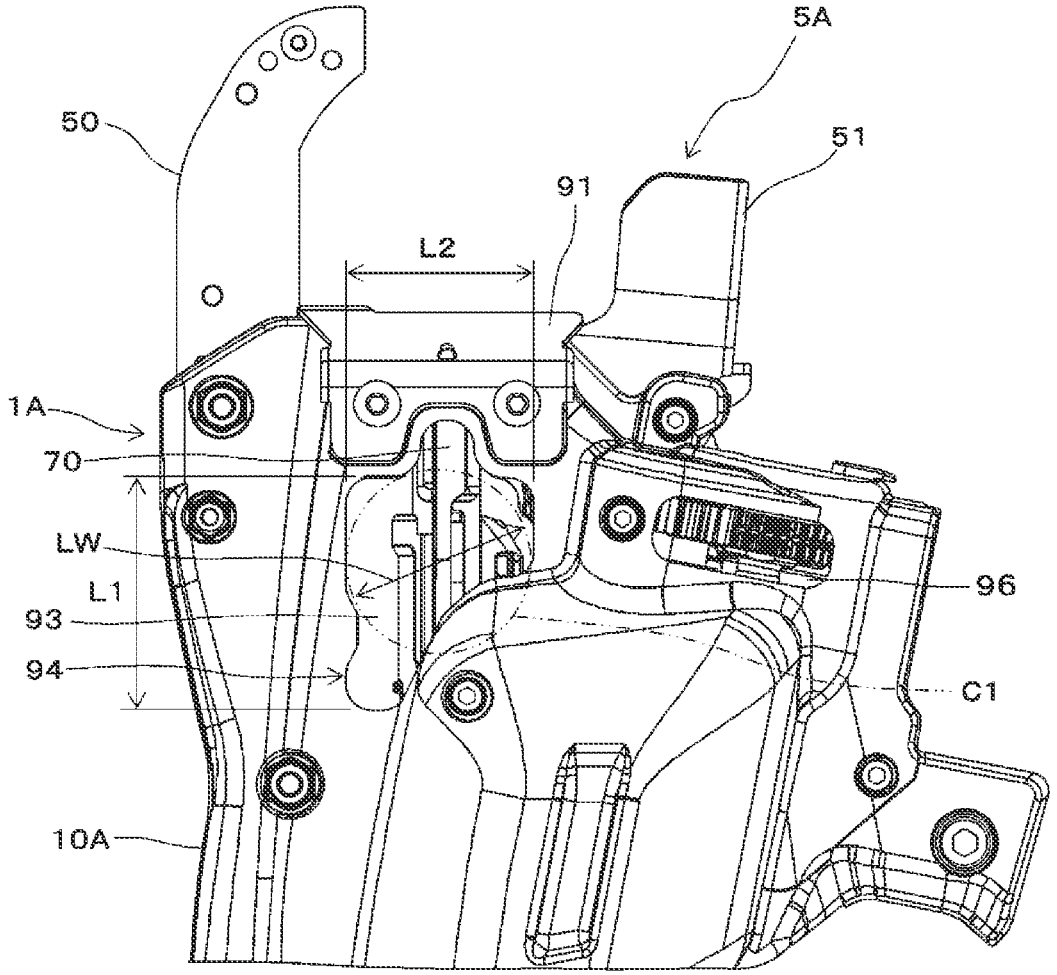
FIG. 31E is a side view of main parts showing the example of the reinforcing bar binding machine according to the seventh embodiment.
Figure 32A:
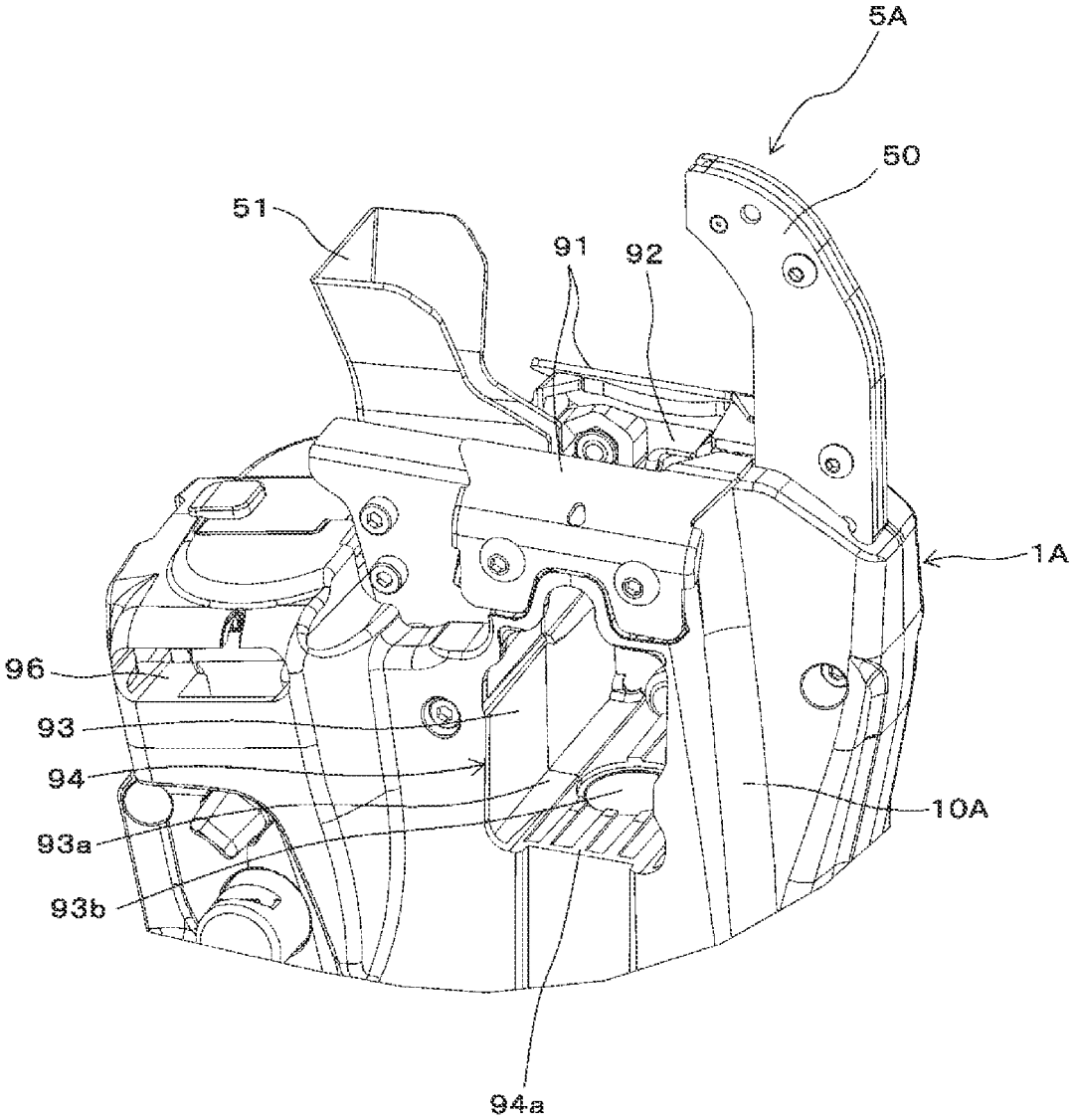
FIG. 32A is a perspective view of main parts showing the example of the reinforcing bar binding machine according to the seventh embodiment.
Figure 32B:
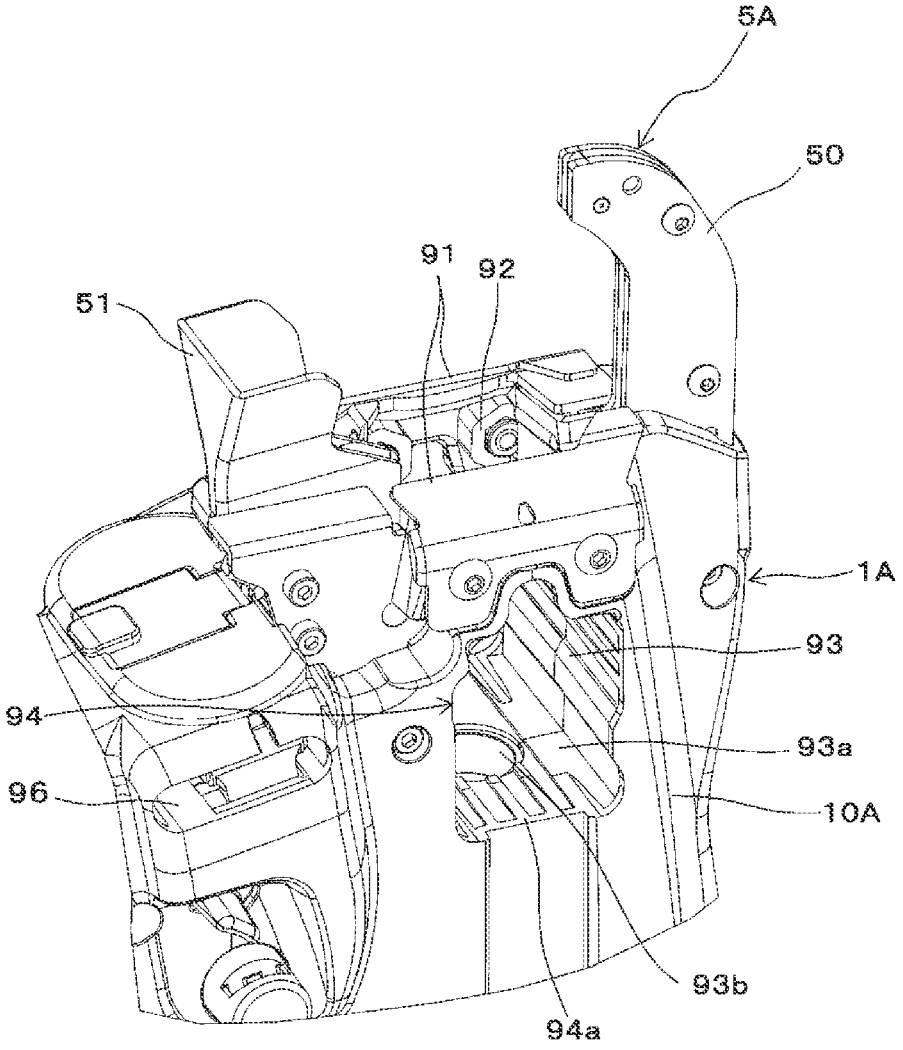
FIG. 32B is a perspective view of main parts showing the example of the reinforcing bar binding machine according to the seventh embodiment.
Figure 32C:
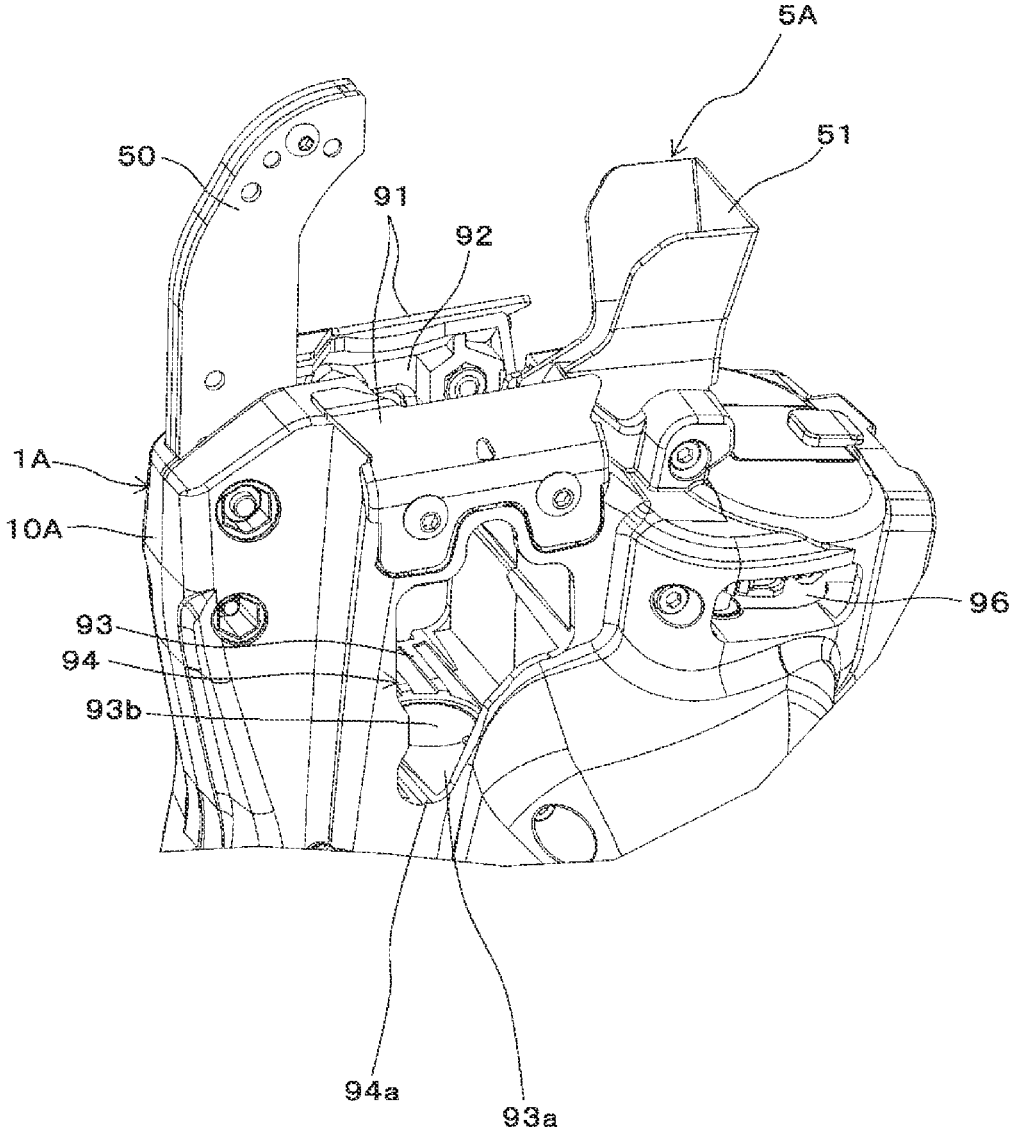
FIG. 32C is a perspective view of main parts showing the example of the reinforcing bar binding machine according to the seventh embodiment.
Figure 33:
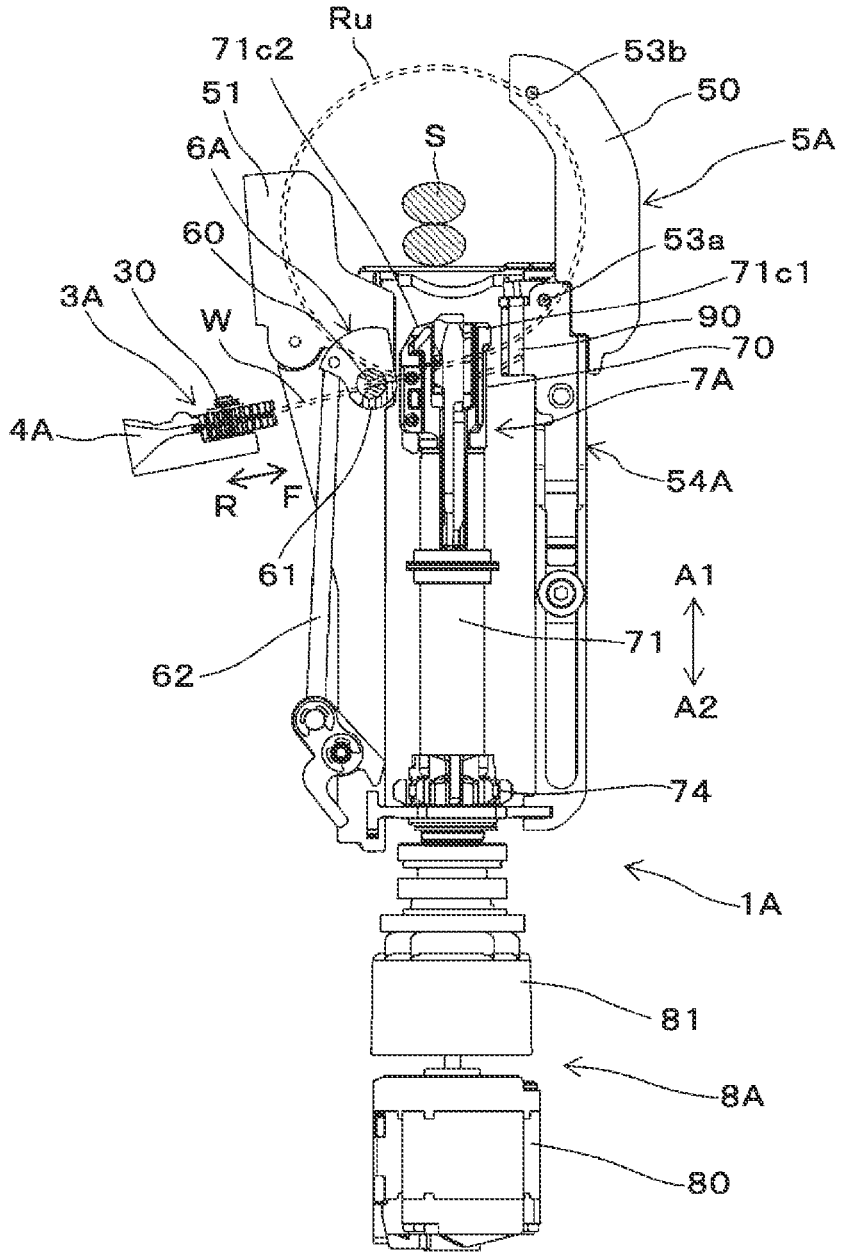
FIG. 33 is a side view of main parts showing an example of an internal configuration of the reinforcing bar binding machine according to the seventh embodiment.

FIGS. 30A and 30B are side views showing an example of the reinforcing bar binding machine according to the seventh embodiment, and FIG. 30C is a top view of main parts showing the example of the reinforcing bar binding machine according to the seventh embodiment. In addition, FIGS. 31A to 31C are perspective views of main parts showing the example of the reinforcing bar binding machine according to the seventh embodiment, FIGS. 31D and 31E are side views of main parts showing the example of the reinforcing bar binding machine according to the seventh embodiment, and FIGS. 32A to 32C are perspective views of main parts showing the example of the reinforcing bar binding machine according to the seventh embodiment. Note that, in FIGS. 32A to 32C, some components of FIGS. 31A to 31C are omitted. In addition, FIG. 33 is a side view of main parts showing an example of an internal configuration of the reinforcing bar binding machine according to the seventh embodiment.

The reinforcing bar binding machine 1A is an example of the binding mechanism, and is configured to feed the wire W in a forward direction denoted with an arrow F, to wind the wire around two intersecting reinforcing bars S, to feed the wire W wound around the reinforcing bars S in a reverse direction denoted with an arrow R, to wind the wire on the reinforcing bars S, and to twist the wire W, thereby binding the reinforcing bars S with the wire W.

In order to implement the above functions, the reinforcing bar binding machine 1A includes a wire feeding unit 3A configured to feed the wire W in the forward direction and the reverse direction, and a wire guide 4A configured to guide the wire W that is fed by the wire feeding unit 3A. The reinforcing bar binding machine 1A also includes a curl forming unit 5A configured to form a path along which the wire W fed by the wire feeding unit 3A is to be wound around the reinforcing bars S, and a cutting unit 6A configured to cut the wire W wound on the reinforcing bars S. The reinforcing bar binding machine 1A also includes a binding unit 7A configured to twist the wire W wound on the reinforcing bars S, and a drive unit 8A configured to drive the binding unit 7A.

As described above, the reinforcing bar binding machine 1A that is applied to the binding facility 100A is configured to move in the upper and lower direction that is a direction intersecting with the placement surface of the reinforcing bars S, so that the reinforcing bars S are caused to move into and out of the curl forming unit 5A. To this end, the reinforcing bar binding machine 1A is attached to the elevation mechanism 111A in an upward orientation in which the curl forming unit 5A is located at an end portion (upper part) on an upper side of a main body 10A. In the below, a side of the reinforcing bar binding machine 1A on which the curl forming unit 5A is provided is referred to as 'upper side'.

The wire feeding unit 3A is provided inside the main body 10A and has a pair of feeding gears 30 configured to sandwich and feed one wire or a plurality of wires W aligned in parallel. In the wire feeding unit 3A, the pair of feeding gears 30 is urged toward each other and a rotating operation of a feeding motor (not shown) is transmitted to rotate the feeding gears 30. Thereby, the wire feeding unit 3A is configured to feed the wire W sandwiched between the pair of feeding gears 30 along an extension direction of the wire W. In a configuration where a plurality of, for example, two wires W are fed, the two wires W are fed aligned in parallel.

The reinforcing bar binding machine 1A has a discharge part 96 through which foreign matters in the wire feeding unit 3A in the main body 10A are discharged to an outside of the main body 10A. The discharge part 96 is constituted by providing at least one side, in the present example, both sides of the main body 10A with an opening formed to communicate with a space in which the pair of feeding gears 30 and the like are put.

The wire guide 4A is provided in the main body 10A in a predetermined position on an upstream side of the wire feeding unit 3A with respect to a feeding direction of feeding the wire W in the forward direction. In a configuration where the two wires W are fed, the wire guide 4A is configured to regulate a radial orientation of the two wires W, to align the two introduced wires W in parallel and to guide the same between the pair of feeding gears 30.

A downstream side opening of the wire guide 4A with respect to the feeding direction of the wire W that is fed in the forward direction has a shape of regulating the radial orientation of the wire W. On the other hand, an upstream side opening with respect to the feeding direction of the wire W that is fed in the forward direction has a larger opening area, as compared to the downstream side opening. For example, the wire guide 4A is constituted by a tapered opening whose opening area is largest on an introduction side for the wire W, which is fed from the wire feeding mechanism 2A shown in FIGS. 29A to 29B, and is reduced from the introduction side. Thereby, even when a height and an orientation of the reinforcing bar binding machine 1A are changed, the wire W that is fed by the wire feeding mechanism 2A can be guided between the pair of feeding gears 30.

The curl forming unit 5A includes a curl guide 50 configured to curl the wire W that is fed by the wire feeding unit 30, and an induction guide 51 configured to guide the wire W curled by the curl guide 50 to the binding unit 7A. The curl forming unit 5A is provided in a state of the curl guide 50 and the induction guide 51 being exposed at an upper part of the main body 10A.

In the reinforcing bar binding machine 1A, the feeding path of the wire W that is fed by the wire feeding unit 3A is regulated by the curl forming unit 5A, so that a locus of the wire W becomes a loop Ru as shown with a broken line in FIG. 33 and the wire W is thus wound around the reinforcing bars S.

The curl forming unit 5A has guide members 53*a* and 53*b* configured to guide the wire W that is fed in the forward direction, and to curl the wire W. The guide member 53*a* is provided on a side of the curl guide 50 on which the wire W fed by the wire feeding unit 3A is introduced, and is arranged on a radially inner side of the loop Ru that is formed by the wire W. The guide member 53*b* is provided on a side of the curl guide 50 on which the wire W fed by the wire feeding unit 3A is discharged, and is arranged on a radially outer side of the loop Ru that is formed by the wire W.

The curl forming unit 5A includes a guide member moving mechanism 54A configured to retreat the guide member 53*a*. The guide member moving mechanism 54A is configured to retreat the guide member 53*a* in conjunction with an operation of the binding unit 7A after the wire W is wound on the reinforcing bars S.

The cutting unit 6A is provided in the main body 10A and includes a fixed blade part 60, a movable blade part 61 configured to cut the wire W by cooperating with the fixed blade part 60, and a transmission mechanism 62 configured to transmit an operation of the binding unit 7A to the movable blade part 61. The cutting unit 6A is configured to cut the wire W by a rotating operation of the movable blade part 61 about the fixed blade part 60 as a fulcrum shaft. The transmission mechanism 62 is configured to transmit an operation of the binding unit 7A to the movable blade part 61 via a movable member 83 and to rotate the movable blade part 61 in conjunction with the operation of the binding unit 7A, thereby cutting the wire W.

The binding unit 7A is provided in the main body 10A and includes a wire engaging body 70 to which the wire W is engaged. A detailed configuration of the binding unit 7A will be described later. The drive unit 8A is provided in the main body 10A and includes a motor 80, and a decelerator 81 configured to perform deceleration and amplification of torque.

In a case where the reinforcing bar binding machine 1A having such a form that an operator holds and uses with a hand is applied to the binding facility 100A, the reinforcing bar binding machine 1A includes a handle part 12A provided to the main body 10A, and a battery 15A is detachably attached to the handle part 12A.

The reinforcing bar binding machine 1A includes a feeding regulation part 90 against which a tip end of the wire W is butted, on the feeding path of the wire W that passes through the curl forming unit 5A and is wound around the reinforcing bars S and engaged by the wire engaging body 70.

The reinforcing bar binding machine 1A also includes butting parts 91 against which the reinforcing bars S are butted, on the upper part of the main body 10A. The butting parts 91 are provided in a pair on left and right sides between the curl guide 50 and the induction guide 51.

The reinforcing bar binding machine 1A also has an opening 92 on the upper part of the main body 10A. The opening 92 is provided between a path through which the wire W passing through the wire engaging body 70 and fed to the curl guide 50 passes and a path through which the wire W passing through the induction guide 51 and fed to the wire engaging body 70 passes, between the pair of left and right butting parts 91.

In an operation of feeding the wire W in the forward direction, the wire W that passes through the wire engaging body 70 and is fed to the curl guide 50 and the wire W that passes through the induction guide 51 and is fed to the wire engaging body 70 passes through the opening 92, in an operation of feeding the wire W in the reverse direction, the wire W that is wound on the reinforcing bars S introduced between the curl guide 50 and the induction guide 51 passes through the opening 92, and in an operation of separating the reinforcing bar binding machine 1A from the reinforcing bars S after binding, the wire W after binding passes through the opening 92. In addition, in an operation of pulling out the reinforcing bars S between the curl guide 50 and the induction guide 51, the wire W binding the reinforcing bars S passes through the opening 92.

The reinforcing bar binding machine 1A includes a wire engaging body exposing part 93 in the main body 10A on an inner side of the opening 92. The wire engaging body exposing part 93 is constituted by an upper inner space of the main body 10A partitioned by a wall portion 93*a* and is formed to communicate with the opening 92.

From a hole portion 93*b* formed in a bottom surface, which constitutes the wall portion 93*a* of the wire engaging body exposing part 93, a part of the wire engaging body 70 is exposed into the main body 10A. The wire engaging body exposing part 93 constitutes the path along which the wire W engaged by the wire engaging body 70 is fed, and also constitutes a space necessary in the operation of twisting the wire W engaged by the wire engaging body 70.

The reinforcing bar binding machine 1A has a discharge part 94 through which foreign matters in the wire engaging body exposing part 93 are discharged to an outside of the main body 10A. The discharge part 94 is an example of a discharge unit, and is configured by providing at least one side, in the present example, both sides of the main body 10A with an opening configured to communicate with the wire engaging body exposing part 93.

The discharge part 94 has a discharge guiding portion 94*a* provided on at least a bottom surface, which is one surface located on a lower side, of the wall portion 93*a* constituting the wire engaging body exposing part 93. In the reinforcing bar binding machine 1A that is used in the binding facility 100A, the bottom surface of the wall portion 93*a* that constitutes the wire engaging body exposing part 93 is a surface located on a lower side in an aspect where the reinforcing bar binding machine 1A is used upward oriented. The discharge guiding portion 94*a* is constituted by connecting, on the same plane, the bottom surface constituting the wall portion 93*a* and at least a part of a side of the opening constituting the discharge part 94. Note that, the discharge guiding portion 94*a* may also be constituted by an inclined surface inclined in a descending direction from the hole portion 93*b* toward the discharge part 94. In addition, the discharge guiding portion 94*a* is constituted by connecting, on the same plane, the wall portion 93*a* and at least a part of a side of the discharge part 94, also for the wall portion 93*a* other than the bottom surface.

Figure 34A:
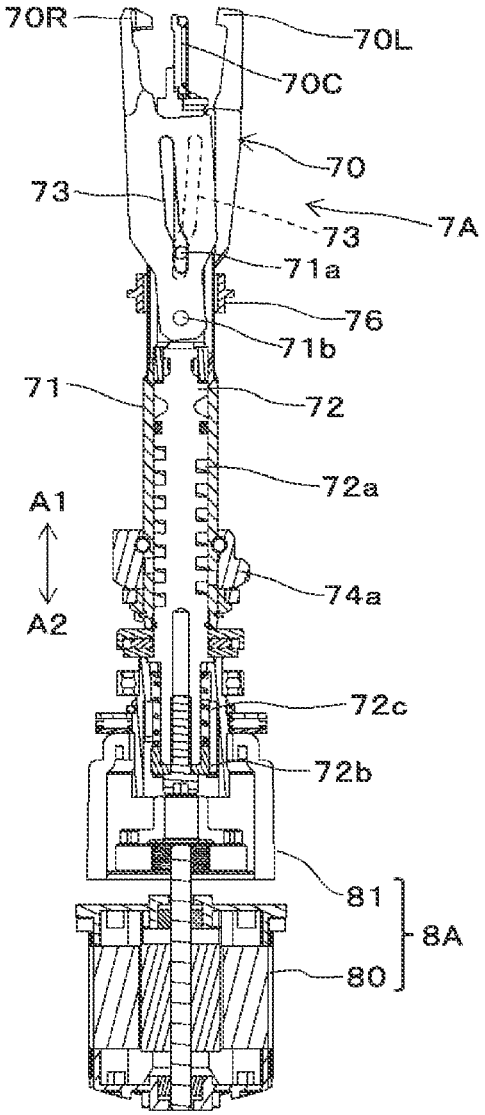
FIG. 34A is a sectional plan view showing an example of a binding unit.
Figure 34B:
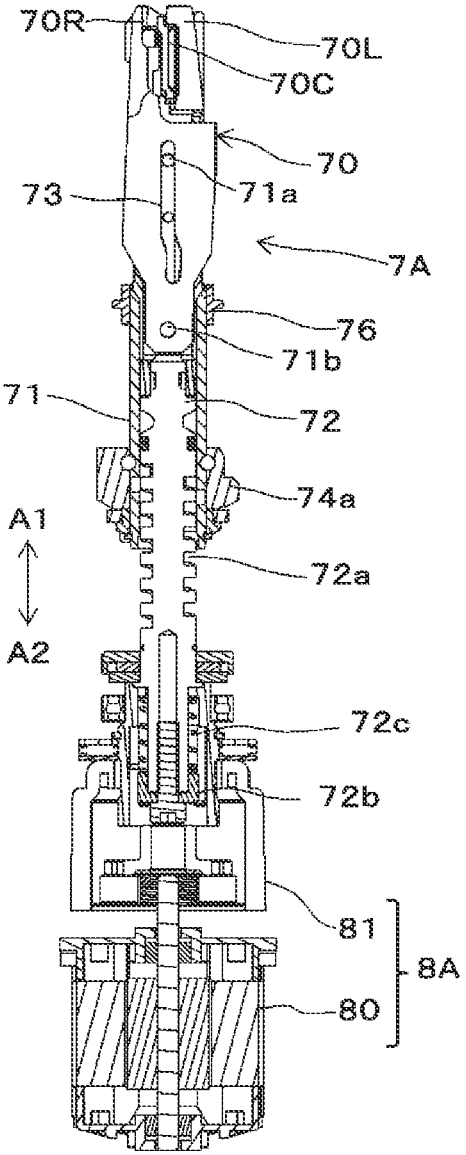
FIG. 34B is a sectional plan view showing the example of the binding unit.

FIGS. 34A and 34B are sectional plan views showing an example of the binding unit. Subsequently, a configuration of the binding unit is described with reference to each drawing.

The binding unit 7A includes the wire engaging body 70 to which the wire W is engaged, and a rotary shaft 72 for actuating the wire engaging body 70. The binding unit 7A and the drive unit 8A are configured so that the rotary shaft 72 and the motor 80 are connected via the decelerator 81 and the rotary shaft 72 is driven via the decelerator 81 by the motor 80.

The wire engaging body 70 has a center hook 70C connected to the rotary shaft 72, a first side hook 70R and a second side hook 70L configured to open and close with respect to the center hook 70C, and a sleeve 71 configured to actuate the first side hook 70R and the second side hook 70L and to form the wire W into a desired shape.

The center hook 70C is connected to a tip end of the rotary shaft 72, which is one end portion along an axial direction of the rotary shaft 72, via a configuration that can rotate with respect to the rotary shaft 72 and move integrally with the rotary shaft 72 in the axial direction.

The wire engaging body 70 is configured to open/close in directions in which the tip end-side of the first side hook 70R contacts and separates with respect to the center hook 70C by a rotating operation about a shaft 71*b* as a fulcrum. The wire engaging body 70 is also configured to open/close in directions in which the tip end-side of the second side hook 70L contacts and separates with respect to the center hook 70C.

The sleeve 71 has a convex portion (not shown) protruding from an inner peripheral surface of a space in which the rotary shaft 72 is inserted, and the convex portion enters a groove portion of a feeding screw 72*a* formed along the axial direction on an outer periphery of the rotary shaft 72. When the rotary shaft 72 rotates, the sleeve 71 moves in the upper and lower direction, which is a direction along the axial direction of the rotary shaft 72, according to a rotation direction of the rotary shaft 72 by an action of the convex portion (not shown) and the feeding screw 72*a* of the rotary shaft 72. The sleeve 71 is also configured to rotate integrally with the rotary shaft 72.

The sleeve 71 has an opening/closing pin 71*a* configured to open/close the first side hook 70R and the second side hook 70L.

The opening/closing pin 71*a* is inserted into opening/closing guide holes 73 formed in the first side hook 70R and the second side hook 70L. The opening/closing guide hole 73 has a shape of extending in a moving direction of the sleeve 71 and converting a linear motion of the opening/closing pin 71*a* configured to move in conjunction with the sleeve 71 into an opening/closing operation by rotation of the first side hook 70R and the second side hook 70L about the shaft 71*b* as a fulcrum.

The wire engaging body 70 is configured so that, when the sleeve 71 is moved in a downward direction denoted with an arrow A2, the first side hook 70R and the second side hook 70L move away from the center hook 70C by the rotating operations about the shaft 71*b* as a fulcrum, due to a locus of the opening/closing pin 71*a* and the shape of the opening/closing guide holes 73.

Thereby, the first side hook 70R and the second side hook 70L are opened with respect to the center hook 70C, so that a feeding path through which the wire W is to pass is formed between the first side hook 70R and the center hook 70C and between the second side hook 70L and the center hook 70C.

In a state where the first side hook 70R and the second side hook 70L are opened with respect to the center hook 70C, the wire W that is fed by the wire feeding unit 3A passes between the center hook 70C and the first side hook 70R. The wire W passing between the center hook 70C and the first side hook 70R is guided to the curl forming unit 5A. Then, the wire W curled by the curl forming unit 5A and guided to the binding unit 7A passes between the center hook 70C and the second side hook 70L.

The wire engaging body 70 is configured so that, when the sleeve 71 is moved in an upward direction denoted with an arrow A1, the first side hook 70R and the second side hook 70L move toward the center hook 70C by the rotating operations about the shaft 71*b* as a fulcrum, due to the locus of the opening/closing pin 71*a* and the shape of the opening/closing guide holes 73. Thereby, the first side hook 70R and the second side hook 70L are closed with respect to the center hook 70C.

When the first side hook 70R is closed with respect to the center hook 70C, the wire W sandwiched between the first side hook 70R and the center hook 70C is engaged in such an aspect that the wire can move between the first side hook 70R and the center hook 70C. Also, when the second side hook 70L is closed with respect to the center hook 70C, the wire W sandwiched between the second side hook 70L and the center hook 70C is engaged in such an aspect that the wire cannot come off between the second side hook 70L and the center hook 70C.

The sleeve 71 has a bending portion 71*c*1 configured to press and bend a tip end-side (one end portion) of the wire W in a predetermined direction to form the wire W into a predetermined shape, and a bending portion 71*c*2 configured to press and bend a terminal end-side (the other end portion) of the wire W cut by the cutting unit 6A in a predetermined direction to form the wire W into a predetermined shape.

The sleeve 71 is moved in the upward direction denoted with the arrow A1, so that the tip end-side of the wire W engaged by the center hook 70C and the second side hook 70L is pressed and bent toward the reinforcing bars S by the bending portion 71*c*1. Also, the sleeve 71 is moved in the upward direction denoted with the arrow A1, so that the terminal end-side of the wire W engaged by the center hook 70C and the first side hook 70R and cut by the cutting unit 6A is pressed and bent toward the reinforcing bars S by the bending portion 71*c*2.

The binding unit 7A includes a rotation regulation part 74 configured to regulate rotations of the wire engaging body 70 and the sleeve 71 interlocking with the rotating operation of the rotary shaft 72. In the binding unit 7A, the rotation regulation part 74 is configured to regulate rotation of the sleeve 71 interlocking with rotation of the rotary shaft 72, according to a position of the sleeve 71 along an axial position of the rotary shaft 72, so that the sleeve 71 is moved in the upper and lower direction by the rotating operation of the rotary shaft 72. Also, when the rotation regulation on the sleeve 71 by the rotation regulation part 74 is released, the sleeve 71 is rotated in conjunction with the rotation of the rotary shaft 72.

As shown in FIGS. 30A, 30B and 31A to 31C, the center hook 70C, the first side hook 70R, the second side hook 70L, and the tip end-side of the sleeve 71 of the wire engaging body 70 are exposed to the wire engaging body exposing part 93 from the hole portion 93*b* provided in the bottom surface that constitutes the wall portion 93*a* of the wire engaging body exposing part 93.

Thereby, the wire engaging body exposing part 93 constitutes a path through which the wire W passing through the cutting unit 6A and fed between the center hook 70C and the first side hook 70R, the wire W passing between the center hook 70C and the first side hook 70R and fed to the curl forming unit 5A, the wire W curled by the curl forming unit 5A and fed between the center hook 70C and the second side hook 70L and the wire W passing between the center hook 70C and the second side hook 70L and butting against the feeding regulation part 90 pass.

<Operation Example of Binding Facility of Seventh Embodiment>

Figure 35A:
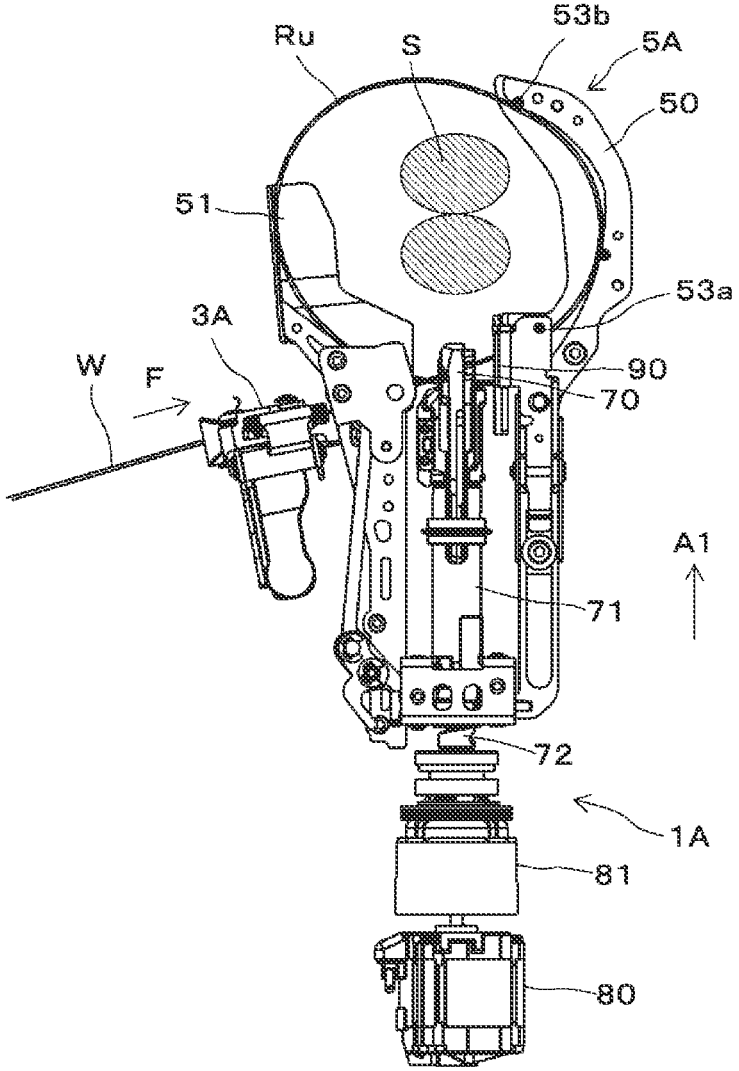
FIG. 35A is an operation illustration view showing an example of an operation of binding reinforcing bars with the reinforcing bar binding machine in the binding facility.
Figure 35B:
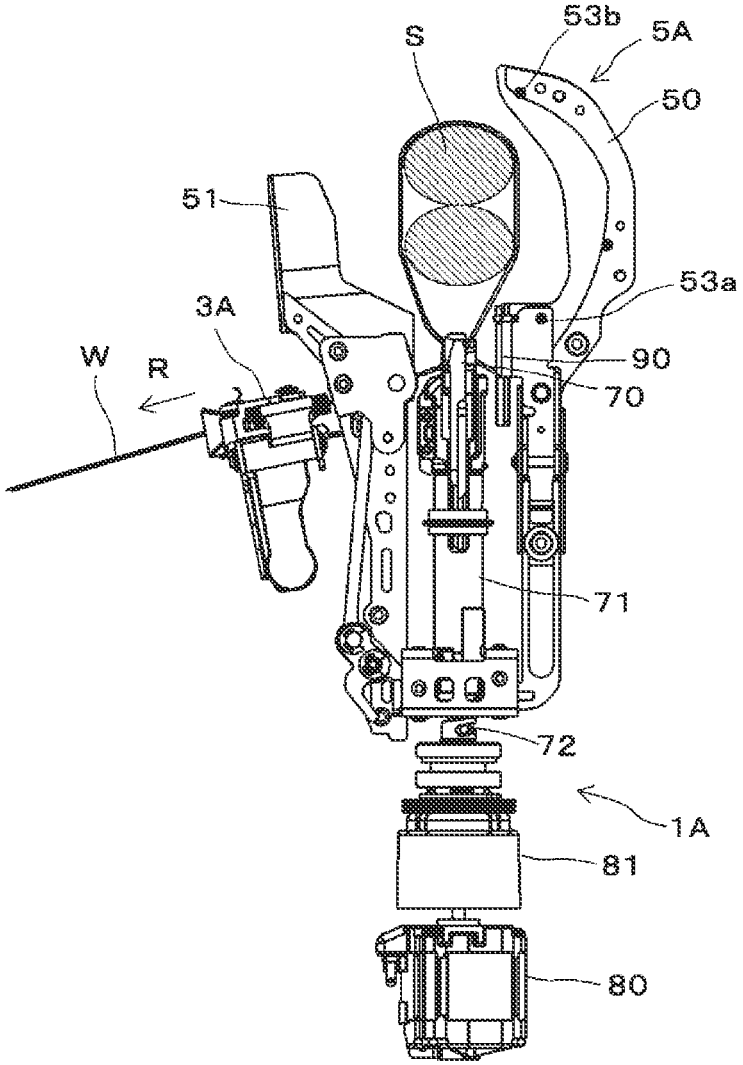
FIG. 35B is an operation illustration view showing the example of the operation of binding reinforcing bars with the reinforcing bar binding machine in the binding facility.

FIGS. 35A and 35B are operation illustration views showing an example of the operation of binding reinforcing bars with the reinforcing bar binding machine in the binding facility. Subsequently, the operation of binding the reinforcing bars S with the wires W by the reinforcing bar binding machine 1A in the binding facility 100A is described with reference to each drawing.

The binding facility 100A moves the reinforcing bars S so that a binding target place at which the reinforcing bars S intersect becomes a position facing the curl forming unit 5A of the reinforcing bar binding machine 1A, and moves the reinforcing bar binding machine 1A so that the binding target place of the reinforcing bars S enters between the curl guide 50 and the induction guide 51 of the curl forming unit 5A.

The reinforcing bar binding machine 1A drives the feeding motor (not shown) in the forward rotation direction to feed the wires W in the forward direction denoted with an arrow F by the wire feeding unit 3A. In the wire feeding unit 3A, the two wires W are fed aligned in parallel in an axial direction of the loop Ru formed by the wires W.

The wires W that are fed in the forward direction pass between the center hook 70C and the first side hook 70R, and are fed to the curl guide 50 of the curl forming unit 5A. The wires W pass through the curl guide 50 and are thus curled to be wound around the reinforcing bars S by the guide members 53*a* and 53*b*.

The wires W curled by the curl guide 50 are guided to the induction guide 51 and are further fed in the forward direction by the wire feeding unit 3A, so that the wires are guided between the center hook 70C and the second side hook 70L by the induction guide 51. Then, the wires W are fed until the tip ends are butted against the feeding regulation part 90. The feeding path of the wires W that are fed by the wire feeding unit 3A is regulated by the curl forming unit 5A, so that a locus of the wires W becomes a loop Ru as shown with a broken line in FIG. 35A and the wires W are thus wound around the reinforcing bars S. When the wires W are fed to a position in which the tip ends thereof are butted against the feeding regulation part 90, the drive of the feeding motor (not shown) is stopped.

After stopping the feeding of the wires W in the forward direction, the motor 80 is driven in the forward rotation direction. In an operation area where the rotation regulation part 74 regulates the rotation of the sleeve 71 interlocking with the rotation of the rotary shaft 72, the rotation operation of the rotary shaft 72 is converted into linear movement, so that the sleeve 71 is moved in the upward direction denoted with the arrow A1.

When the sleeve 71 is moved in the upward direction, the opening/closing pin 71*a* passes through the opening/closing guide holes 73. Thereby, as shown in FIG. 34B, the first side hook 70R is moved toward the center hook 70C by the rotating operation about the shaft 71*b* as a fulcrum. When the first side hook 70R is closed with respect to the center hook 70C, the wires W sandwiched between the first side hook 70R and the center hook 70C are engaged in such an aspect that the wires can move between the first side hook 70R and the center hook 70C.

In addition, the second side hook 70L is moved toward the center hook 70C by the rotating operation about the shaft 71*b* as a fulcrum. When the second side hook 70L is closed with respect to the center hook 70C, the wires W sandwiched between the second side hook 70L and the center hook 70C are engaged in such an aspect that the wires cannot come off between the second side hook 70L and the center hook 70C.

After moving the sleeve 71 to an end point position of the operation area where the wires W are engaged by the closing operation of the first side hook 70R and the second side hook 70L, the rotation of the motor 80 is temporarily stopped, and the feeding motor (not shown) is driven in the reverse rotation direction. Thereby, the pair of feeding gears 30 is reversely rotated. Therefore, the wires W sandwiched between the pair of feeding gears 30 are fed in the reverse direction denoted with the arrow R.

The wires W wound around the reinforcing bars S and engaged by the wire engaging body 70 are engaged in such an aspect that portions on the tip ends-side sandwiched between the second side hook 70L and the center hook 70C cannot come off between the second side hook 70L and the center hook 70C. Also, the wires W engaged by the wire engaging body 70 are engaged in such an aspect that portions sandwiched between the first side hook 70R and the center hook 70C can move between the first side hook 70R and the center hook 70C in a circumferential direction of the loop Ru along the feeding path of the wires W.

Thereby, the wires W wound around the reinforcing bars S are wound on the reinforcing bars S by the operation of feeding the wires W in the reverse direction denoted with the arrow R, as shown in FIG. 35B. In the operation of feeding the wires W in the reverse direction by the reinforcing bar binding machine 1A, the wires W are not fed in the reverse direction in the wire feeding mechanism 2A. For this reason, in the operation of feeding the wires W in the reverse direction by the reinforcing bar binding machine 1A, the wires W are loosened between the reinforcing bar binding machine 1A and the second wire guiding part 24.

When the wires W are pulled back to a position in which the wires W are wound on the reinforcing bars S, the drive of the feeding motor (not shown) in the reverse rotation direction is stopped and the motor 80 is then driven in the forward rotation direction, so that the sleeve 71 is moved in the upward direction denoted with the arrow A1. The operation of moving the sleeve 71 in the upward direction is transmitted to the cutting unit 6A, so that the movable blade part 61 is rotated and the wires W engaged by the first side hook 70R and the center hook 70C are cut by the operation of the fixed blade part 60 and the movable blade part 61.

When the wires W are cut, the bending portions 71*c*1 and 71*c*2 are moved in a direction of contacting the reinforcing bars S. Thereby, the tip ends-side of the wires W engaged by the center hook 70C and the second side hook 70L are pressed toward the reinforcing bars S and bent toward the reinforcing bars S in the engaging position as a fulcrum by the bending portion 71*c*1. The sleeve 71 is further moved in the upward direction, so that the wires W engaged between the second side hook 70L and the center hook 70C are maintained sandwiched by the bending portion 71*c*1.

Also, the terminal ends-side of the wires W engaged by the center hook 70C and the first side hook 70R and cut by the cutting unit 6A are pressed toward the reinforcing bars S and bent toward the reinforcing bars S in the engaging position as a fulcrum by the bending portion 71*c*2. The sleeve 71 is further moved in the upward direction, so that the wires W engaged between the first side hook 70R and the center hook 70C are maintained sandwiched by the bending portion 71*c*2.

After the tip ends-side and the terminal ends-side of the wires W are bent toward the reinforcing bars S, the motor 80 is further driven in the forward rotation direction, so that the sleeve 71 is further moved in the upward direction. When the sleeve 71 is moved to a predetermined position and reaches the operation area where the wires W engaged by the wire engaging body 70 are twisted, the rotation regulation on the sleeve 71 by the rotation regulation part 74 is released, and the sleeve 71 is rotated in conjunction with the rotation of the rotary shaft 72

Thereby, the motor 80 is further driven in the forward rotation direction, so that the wire engaging body 70 is rotated in conjunction with the rotary shaft 72, thereby twisting the wires W to bind the reinforcing bars S with the wires W. When it is detected that a load applied to the motor 80 becomes a predetermined value, for example, a maximum value, the rotation of the motor 80 in the forward direction is stopped at a predetermined timing.

After stopping the rotation of the motor 80 in the forward direction, the motor 80 is reversely rotated to move the sleeve 71 in the downward direction to a position in which the first side hook 70R is opened with respect to the center hook 70C and the second side hook 70L is opened with respect to the center hook 70C, and to return the wire engaging body 70 to the standby position. When the wires W binding the reinforcing bars S come off from the wire engaging body 70, the reinforcing bar binding machine 1A is moved to the standby position.

After the wires W are fed in the reverse direction and wound on the reinforcing bars S in the binding operation in the above-described reinforcing bar binding machine 1A until the wires W are fed in the forward direction in a next binding operation, the wire feeding mechanism 2A performs an operation of pulling out predetermined amounts of the wires W from the reels 20.

The wire feeding mechanism 2A rotates the motor 22*c* in the forward direction to move down the pullout roller 22*a* from the upper limit position P1. In the wire pullout mechanism 22, the pullout roller 22*a* moves down from the upper limit position P1 to the lower limit position P2 along the direction intersecting with the wires W between the roller 23*a* of the first wire guiding part 23 and the roller 24*a* of the second wire guiding part 24.

When the pullout roller 22*a* starts to move down from the upper limit position P1, the wires W between the roller 23*a* of the first wire guiding part 23 and the roller 24*a* of the second wire guiding part 24 are pulled downward, so that the wires W between the reels 20 and the first wire guiding part 23 and the wires W between the reinforcing bar binding machine 1A and the second wire guiding part 24 are pulled between the first wire guiding part 23 and the second wire guiding part 24. Therefore, the wires W between the reinforcing bar binding machine 1A and the second wire guiding part 24 and the wires W between the first wire guiding part 23 and the reels 20 accommodated in the reel accommodation part 21 are fed between the roller 23*a* of the first wire guiding part 23 and the roller 24*a* of the second wire guiding part 24.

As described above, the load, which is applied to the wires W that are guided by the first wire guiding part 23, is set greater than the load, which is applied to the wires W that are guided by the second wire guiding part 24, so that the first load becomes greater than the second load.

In addition, in the reinforcing bar binding machine 1A, in the operation of binding the reinforcing bars S with the wires W, the wires W are fed in the reverse direction, so that the wires W are wound on the reinforcing bars S. In the operation of feeding the wires W in the reverse direction by the reinforcing bar binding machine 1A, the wires W are not fed in the reverse direction in the wire feeding mechanism 2A. For this reason, in the operation of feeding the wires W in the reverse direction by the reinforcing bar binding machine 1A, the wires W are loosened between the reinforcing bar binding machine 1A and the second wire guiding part 24.

Thereby, in the operation of pulling the wires W with the pullout roller 22*a* of the wire pullout mechanism 22, a surplus of the wires W loosened on the feeding path 26 of the wires W between the reinforcing bar binding machine 1A and the second wire guiding part 24 is first drawn between the roller 23*a* of the first wire guiding part 23 and the roller 24*a* of the second wire guiding part 24.

When the surplus of the wires W between the reinforcing bar binding machine 1A and the second wire guiding part 24 is fed to eliminate the loosening of the wires W, since the pair of feeding gears 30 of the wire feeding unit 3A is in the stationary state and does not rotate, the wires W cannot be fed on the feeding path 26 of the wires W between the reinforcing bar binding machine 1A and the second wire guiding part 24. Thereby, the feeding gears 30 become a load, so that the tension applied to the wires W between the reinforcing bar binding machine 1A and the second wire guiding part 24 increases. As a result, the load by the feeding gears 30 is added to the second load, so that a sum of the second load and the load of the feeding gears becomes greater than the first load.

When the sum of the second load and the load of the feeding gears becomes greater than the first load, the wires W are pulled out from the reels 20 accommodated in the reel accommodation part 21 and are fed between the roller 23*a* of the first wire guiding part 23 and the roller 24*a* of the second wire guiding part 24. A moving amount of the pullout roller 22*a* is set so that amounts of the wires W required to eliminate the loosening of the wires W on the feeding path 26 of the wires W between the reinforcing bar binding machine 1A and the second wire guiding part 24 and to bind the reinforcing bars S by the reinforcing bar binding machine 1A can be pulled out from the reels 20 when the pullout roller 22*a* is moved to the lower limit position.

When the pullout roller 22*a* is moved to the lower limit position P2, the wire feeding mechanism 2A switches the rotation direction of the motor 22*c* from the forward rotation to the reverse rotation, thereby moving up the pullout roller 22*a*. When the pullout roller 22*a* is moved to the upper limit position P1, the rotation of the motor 22*c* is stopped. Thereby, the amounts of the wires W required to bind the reinforcing bars S by the reinforcing bar binding machine 1A become in a loosened state between the roller 23*a* of the first wire guiding part 23 and the roller 24*a* of the second wire guiding part 24.

In a next binding operation that is executed by the reinforcing bar binding machine 1A, the wires W loosened between the roller 23*a* of the first wire guiding part 23 and the roller 24*a* of the second wire guiding part 24 are fed toward the reinforcing bar binding machine 1A by the operation of feeding the wires W in the forward direction with the wire feeding unit 3A.

In this way, it is switched whether the wires W on the first wire guiding part 23-side are fed or the wires W on the second wire guiding part 24-side are fed, depending on the magnitudes of the load applied to the wires W that are guided by the first wire guiding part 23 and the load applied to the wires W that are guided by the second wire guiding part 24.

Thereby, the loosening of the wires W occurring on the feeding path 26 of the wires W between the reinforcing bar binding machine 1A and the second wire guiding part 24 in the operation of feeding the wires W in the reverse direction by the reinforcing bar binding machine 1A so as to wind the wires W on the reinforcing bars S can be eliminated by the operation of pulling out the wires W with the wire pullout mechanism 22. In addition, in the operation of pulling out the wires W with the wire pullout mechanism 22, the amounts of the wires W required to bind the reinforcing bars S by the reinforcing bar binding machine 1A can be pulled out from the reels 20.

As described above, in the binding facility 100A, the reinforcing bar binding machine 1A has such a form that the curl forming unit 5A is oriented upward, and the opening 92 of the wire engaging body exposing part 93 faces upward. For this reason, in the binding facility 100A, when the reinforcing bars S are butted against the butting parts 91 in the operation of putting the reinforcing bars S into the curl forming unit 5A of the reinforcing bar binding machine 1A, the reinforcing bars S and the butting part 91 are rubbed, so that the foreign matters attached to the reinforcing bars S may be dropped and introduced into the wire engaging body exposing part 93 from the opening 92.

In addition, when the wires W pass between the center hook 70C and the first side hook 70R and between the center hook 70C and the second side hook 70L, which constitute the wire engaging body 70, the foreign matters such as shavings generated as a result of the wires W rubbing against the wire engaging body 70 are dropped onto the bottom surface constituting the wall portion 93*a* inside the wire engaging body exposing part 93. Further, in the operation of cutting the wires W by the cutting unit 6A, scrapes of the wires W may be dropped onto the bottom surface constituting the wall portion 93*a* inside the wire engaging body exposing part 93.

Therefore, the reinforcing bar binding machine 1A has the discharge part 94 through which the foreign matters in the wire engaging body exposing part 93 are discharged to an outside of the main body 10A. The discharge part 94 is constituted by providing both sides of the main body 10A with the openings configured to communicate with the wire engaging body exposing part 93.

In addition, the discharge part 94 has the discharge guiding portion 94*a*, which is flush with the bottom surface of the wall portion 93*a* constituting the wire engaging body exposing part 93, so that a convex portion hindering discharge of the foreign matters is not provided between the side of the discharge part 94 and the bottom surface of the wire engaging body exposing part 93.

Thereby, the foreign matters in the wire engaging body exposing part 93 can be discharged from the discharge part 94 to the outside of the main body 10A. In addition, the discharge part 94 is provided with the discharge guiding portion 94*a*, so that the foreign matters can be suppressed from being accumulated on the portion of the side of the opening constituting the discharge part 94.

Further, the discharge guiding portion 94*a* is constituted by connecting, on the same plane, the wall portion 93*a* and at least a part of the side of the discharge part 94, not only for the bottom surface of the wall portion 93*a* constituting the wire engaging body exposing part 93 but also for the wall portion 93*a* other than the bottom surface. Therefore, the foreign matters can be suppressed from being accumulated on the portion of each side of the opening constituting the discharge part 94.

In the reinforcing bar binding machine 1A, in the operation of binding the reinforcing bars S, the wires W may be carelessly cut in the operation of twisting the wires W wound on the reinforcing bars S by rotating the wire engaging body 70. The carelessly cut wires W are referred to as wire pieces. A length of the wire piece is about 10 mm to 15 mm. The wire pieces cut in the operation of rotating the wire engaging body 70 may be dropped into the wire engaging exposing part 93 when the first side hook 70R and the second side hook 70L are opened with respect to the center hook 70C.

Therefore, a width of the opening of the discharge part 94 is made greater than a radial dimension of the wire engaging body 70. Specifically, when a length of the wire piece is denoted as LW, the opening constituting the discharge part 94 has a shape where portions whose lengths in one direction and in another direction orthogonal to the one direction are equal to or greater than a diameter of a virtual circle C1 having a diameter of LW, in the present example, a diameter of 10 mm or greater are provided at at least a part between the facing sides, and has a shape including diametrical portions of the virtual circle C1 having a diameter of 10 mm in two arbitrary directions.

For example, a length L1 of the opening, which constitutes the discharge part 94, in a direction along the axial direction of the rotary shaft 72 and a length L2 in a direction orthogonal to the axial direction of the rotary shaft 72 are preferably equal to or greater than the length LW of the wire piece, i.e., 10 mm or greater and 50 mm or smaller, respectively. Due to a relationship between the discharge ability of the wire pieces and the configuration of the reinforcing bar binding machine 1A, the dimensions are more preferably 13 mm or greater and 15 mm or smaller. Note that, the opening constituting the discharge part 94 is not necessarily substantially quadrangular, as shown in FIG. 31D and the like, and may have such a shape that a portion is inwardly convex, as shown in FIG. 31E and the like. Also in this case, when there is a place where the length L1 in the direction along the axial direction of the rotary shaft 72 and the length L2 in the direction orthogonal to the axial direction of the rotary shaft 72 are each equal to or greater than the length LW of the wire piece, in the present example, equal to or greater than 10 mm, the wire piece can be discharged from the discharge part 94, irrespective of the direction of the wire piece. Thereby, the discharge part 94 can be constituted by the opening having an area necessary and sufficient for discharge of the foreign matters.

Note that, the reinforcing bar binding machine 1A vibrates in the operation of moving the reinforcing bars S in and out of the curl forming unit 5A, in the operation of binding the reinforcing bars S, and the like. The vibration of the reinforcing bar binding machine 1A promotes the discharge of the foreign matters in the wire engaging body exposing part 93 from the discharge part 94 to the outside.

Therefore, as the discharge unit, a mode for discharging the foreign matters may be set, and at a predetermined timing when the binding operation is not executed, the reinforcing bar binding machine 1A may be caused to vibrate by moving up and down the reinforcing bar binding machine 1A by the elevation mechanism 111A, for example, thereby promoting the discharge of the foreign matters in the wire engaging body exposing part 93 from the discharge part 94 to the outside.

In addition, as a separate discharge unit, a mode for discharging the foreign matters may be set, and the bottom surface of the wall portion 93*a* constituting the wire engaging body exposing part 93 may be inclined in a descending direction from the hole portion 93*b* toward the discharge part 94, thereby promoting the discharge of the foreign matters in the wire engaging body exposing part 93 from the discharge part 94 to the outside.

Further, the reinforcing bar binding machine 1A has the discharge part 96 through which the foreign matters in the wire feeding unit 3A in the main body 10A are discharged to the outside of the main body 10A. The wire feeding unit 3A is configured to sandwich the wires W by the pair of feeding gears 30, and the foreign matters such as shavings generated as a result of the wires W rubbing against the feeding gears 30 are dropped into a space of the wire feeding unit 3A, in which the feeding gears 30 and the like are put. Therefore, the discharge part 96 is constituted by providing the opening formed to communicate with the space in which the feeding gears 30 and the like are put, so that the foreign matters in the wire feeding unit 3A can be discharged from the discharge part 96 to the outside of the main body 10A.

<Modified Embodiment of Reinforcing Bar Binding Machine>

Figure 36A:
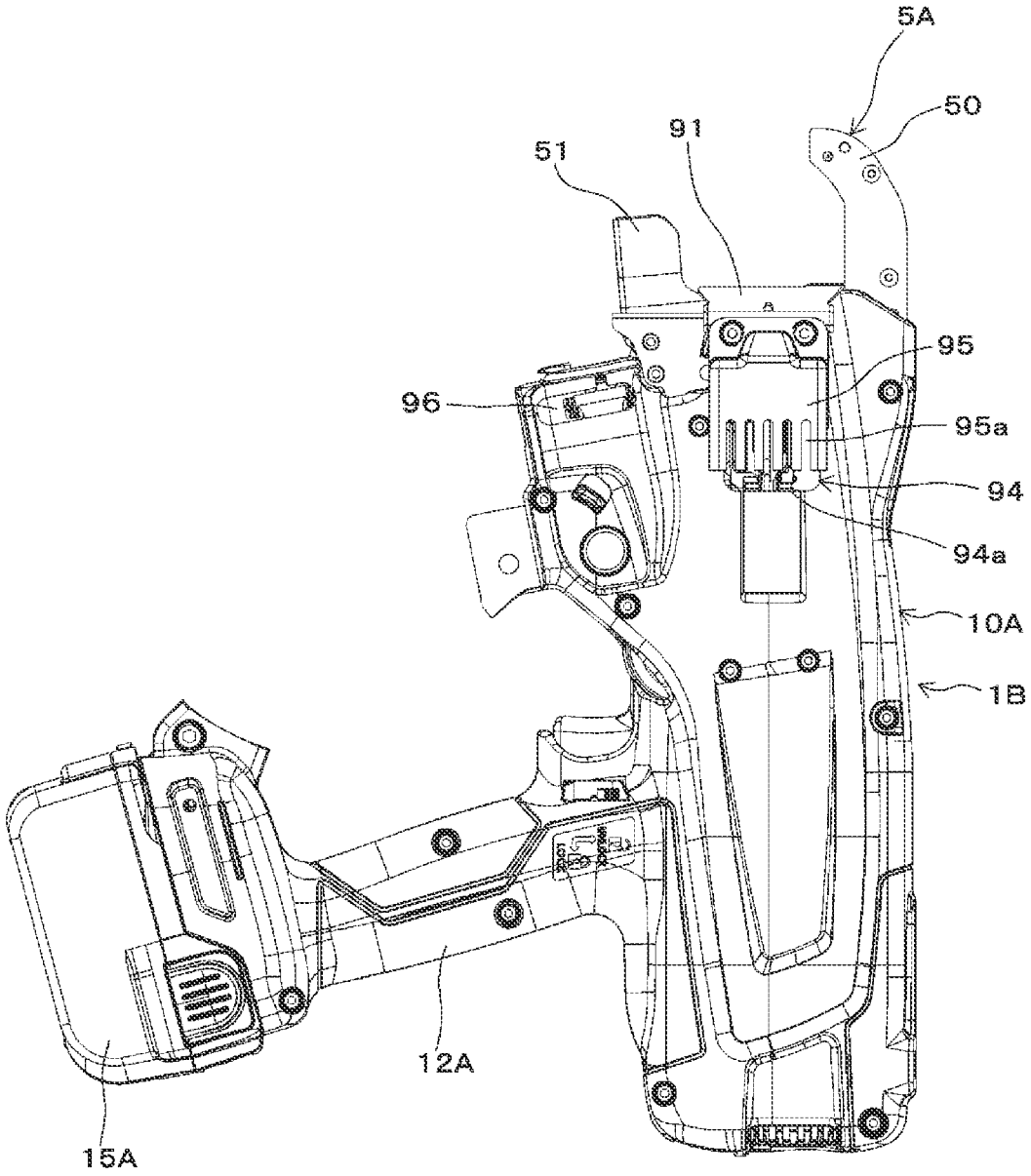
FIG. 36A is a side view showing a modified embodiment of the reinforcing bar binding machine.
Figure 36B:
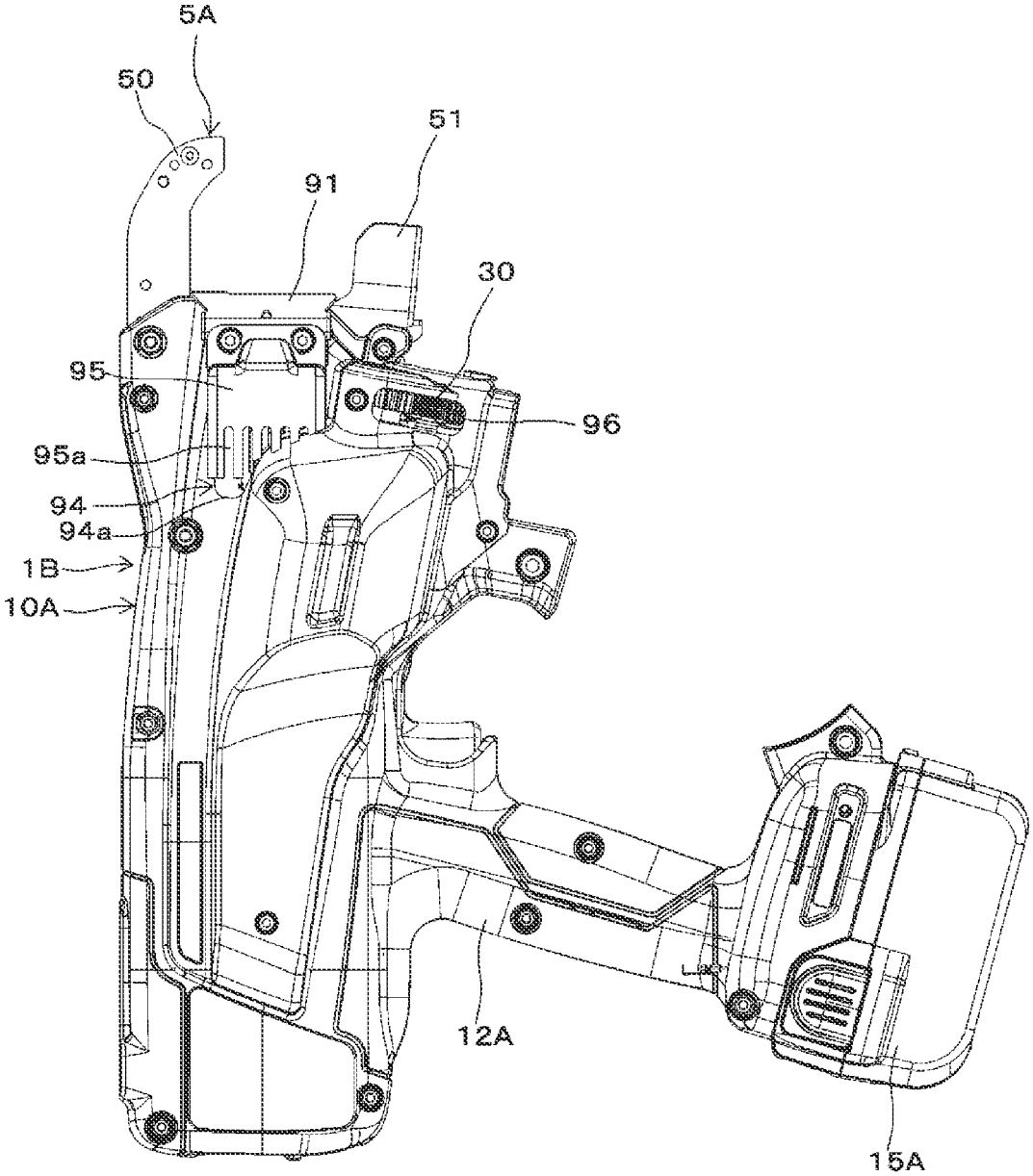
FIG. 36B is a side view showing the modified embodiment of the reinforcing bar binding machine.

FIGS. 36A and 36B are side views showing a modified embodiment of the reinforcing bar binding machine. A reinforcing bar binding machine 1B of the modified embodiment that is applied to the binding facility 100A shown in FIGS. 29A and 29B includes a cover part 95 that is detachably attached to the discharge part 94. The cover part 95 has a shape of covering the entire opening constituting the discharge part 94 or a shape of covering a part of the opening constituting the discharge part 94 and exposing a remaining part or is provided with a slit-shaped opening portion 95*a* and has a shape of covering a part of the opening constituting the discharge part 94 and exposing a remaining part.

The reinforcing bar binding machine 1B has a configuration where the discharge parts 94 are provided on both sides of the main body 10A, and the cover part 95 is attached to the discharge part 94 on any one side, so that a discharge direction of the foreign matters can be selected. In addition, in a case where the cover part 95 is provided with the slit-shaped opening portion 95*a* and has a shape of covering a part of the opening constituting the discharge part 94 and exposing a remaining part, an opening area of the discharge part 94 can be adjusted by attaching the cover part 95 to the discharge part 94.

<Another Configuration Example of Reinforcing Bar Binding Machine>

Figure 37A:
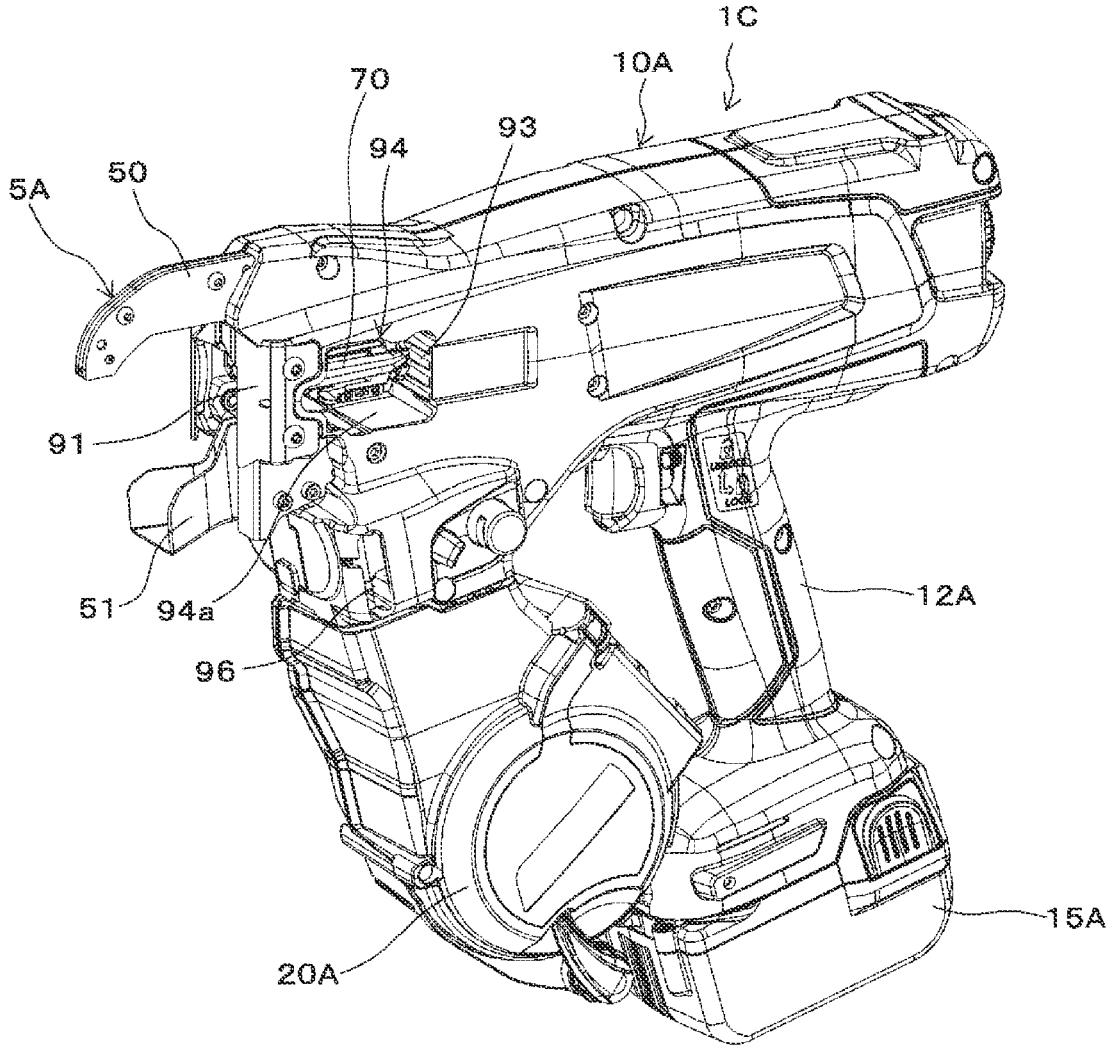
FIG. 37A is a side view showing another example of the reinforcing bar binding machine.
Figure 37B:
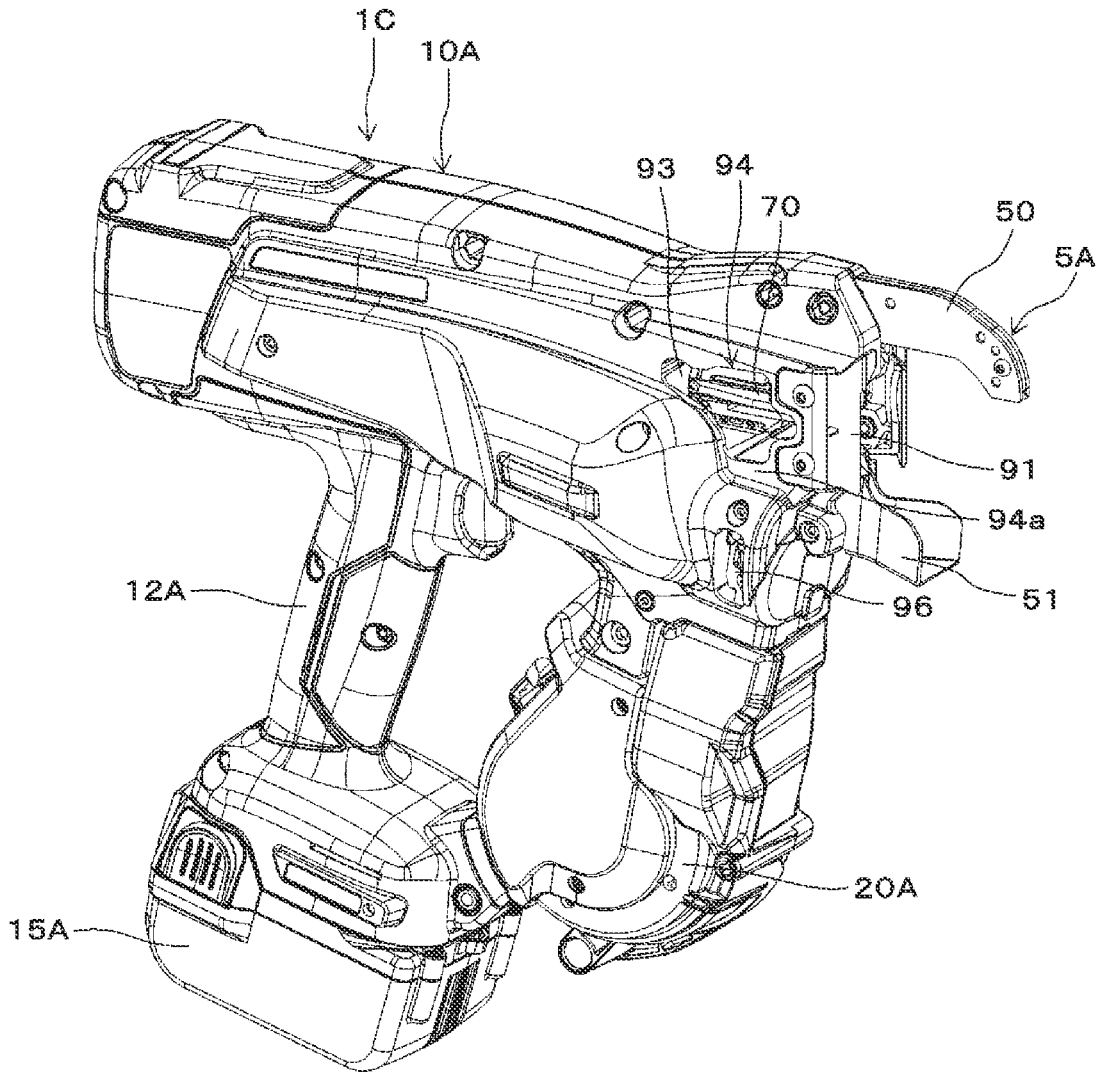
FIG. 37B is a side view showing another example of the reinforcing bar binding machine.

FIGS. 37A and 37B are side views showing another example of the reinforcing bar binding machine. A reinforcing bar binding machine 1C according to another example is used in such an aspect that an operator holds with a hand, and has a magazine 20A in which the wire W is accommodated. The other configurations are similar to the above-described reinforcing bar binding machine 1A.

The magazine 20A is an example of the accommodation part, and a reel (not shown) on which an elongated wire W is wound to be able to be reeled out is rotatably and detachably accommodated therein. The reel is configured so that one or more wires W are wound on a hub part (not shown), and one wire W or a plurality of wires W can be pulled out from the reel at the same time.

The reinforcing bar binding machine 1C that is used in an aspect that an operator holds with a hand is used in a horizontally oriented form where the handle part 12A is located on a lower side of the main body 10A and the curl forming unit 5A is located on an end portion (front part) on a front side of the main body 10A, in many cases. In the below, a side of the reinforcing bar binding machine 1C on which the curl forming unit 5A is provided is referred to as 'front side'. The curl forming unit 5A is provided in a state of the curl guide 50 and the induction guide 51 being exposed at the front part of the main body 10A. The reinforcing bar binding machine 1C also includes butting parts 91 against which the reinforcing bars S are butted, on the front part of the main body 10A. The reinforcing bar binding machine 1C also has an opening 92 on the front part of the main body 10A.

The discharge part 94 has a discharge guiding portion 94*a* provided on at least a bottom surface, which is one surface located on a lower side, of the wall portion 93*a* constituting the wire engaging body exposing part 93. In the reinforcing bar binding machine 1C that is held and used with a hand, the bottom surface of the wall portion 93*a* that constitutes the wire engaging body exposing part 93 is a surface located on a lower side in an aspect where the reinforcing bar binding machine 1C is used horizontally oriented. The discharge guiding portion 94*a* is constituted by connecting, on the same plane, the bottom surface constituting the wall portion 93*a* and at least a part of a side of the opening constituting the discharge part 94. Note that, the discharge guiding portion 94*a* may also be constituted by an inclined surface inclined in a descending direction from the hole portion 93*b* toward the discharge part 94. In addition, the discharge guiding portion 94*a* is constituted by connecting, on the same plane, the wall portion 93*a* and at least a part of a side of the discharge part 94, also for the wall portion 93*a* other than the bottom surface.

Also in the reinforcing bar binding machine 1C that the operator holds and uses with a hand, the foreign matters in the wire engaging body exposing part 93 can be discharged from the discharge part 94 to the outside of the main body 10A. In addition, the discharge part 94 is provided with the discharge guiding portion 94*a*, so that the foreign matters can be suppressed from being accumulated on the portion of the side of the opening constituting the discharge part 94.

Further, the discharge guiding portion 94*a* is constituted by connecting, on the same plane, the wall portion 93*a* and at least a part of the side of the discharge part 94, not only for the bottom surface of the wall portion 93*a* constituting the wire engaging body exposing part 93 but also for the wall portion 93*a* other than the bottom surface. Therefore, the foreign matters can be suppressed from being accumulated on the portion of each side of the opening constituting the discharge part 94.

Also in the reinforcing bar binding machine 1C that the operator holds and uses with a hand, the cover part 95 that is detachably attached to the discharge part 94 may also be provided, as described in FIGS. 36A and 36B.

Additional Notes

This application discloses at least the following inventions (1) to (34).

(1) A binding facility comprising: a binding mechanism configured to bind a binding target with a plurality of wires; a reel accommodation part in which a plurality of reels each having one wire wound thereon are accommodated; and a wire feeding mechanism configured to feed each wire from the plurality of reels accommodated in the reel accommodation part to the binding mechanism.

In the above invention, in the binding facility, the plurality of wires are fed to the binding mechanism and the binding target is bound with the plurality of wires.

Thus, in the binding facility, the plurality of wires are fed to the binding mechanism and the binding target can be bound with the plurality of wires.

(2) The binding facility according to (1), wherein the reel accommodation part is configured so that the plurality of reels are accommodated aligned in a state where shafts thereof are horizontally oriented with respect to a vertical direction.

(3) The binding facility according to (1), wherein the reel accommodation part is configured so that the plurality of reels are accommodated aligned in a state where shafts thereof are vertically oriented with respect to a vertical direction.

(4) A binding facility comprising: a binding mechanism configured to bind a binding target with a wire; a wire pullback mechanism configured to feed the wire fed in a first direction and wound around the binding target by the binding mechanism in a second direction opposite to the first direction to wind the wire on the binding target; a reel accommodation part in which a reel having the wire wound thereon is accommodated; and a wire feeding mechanism configured to feed the wire from the reel accommodated in the reel accommodation part to the binding mechanism, wherein the wire feeding mechanism includes a wire pullout mechanism configured to pull out the wire from the reel, and wherein the wire pullout mechanism is provided between the wire pullback mechanism and the reel.

In the above invention, in the binding facility, the wire is fed to the binding mechanism and is wound on the binding target, so that the binding target is bound with the wire.

Thus, in the binding facility, the wire is fed to the binding mechanism and is wound on the binding target, so that the binding target can be bound with the wire.

(5) The binding facility according to (4), wherein the wire feeding mechanism includes a load applying unit configured to apply a load in a feeding direction of the wire, the load applying unit provided on at least one of an upstream side and a downstream side of the wire pullout mechanism with respect to the first direction, and wherein the load applying unit makes a load, which is applied to the wire on the upstream side of the wire pullout mechanism, greater than a load, which is applied to the wire on the downstream side of the wire pullout mechanism.

(6) The binding facility according to (5), wherein the wire feeding mechanism is configured so that, when the wire is fed in the second direction on the downstream side of the wire pullout mechanism and the load applied to the wire on the downstream side of the wire pullout mechanism becomes greater than the load applied to the wire on the upstream side of the wire pullout mechanism, the wire is fed in the first direction on the upstream side of the wire pullout mechanism.

(7) The binding facility according to any one of (1) to (6), wherein the wire feeding mechanism includes a guide part configured to regulate a position of each wire along a direction in which the plurality of wires are aligned in parallel.

(8) The binding facility according to (7), wherein the guide part is provided between the plurality of wires aligned in parallel.

(9) The binding facility according to (7) or (8), wherein the guide part is provided on an outer side along the direction in which the plurality of wires are aligned in parallel, with respect to the wire on the outermost side of the plurality of wires aligned in parallel.

(10) The binding facility according to any one of (4) to (6), wherein the wire feeding mechanism includes a guide part configured to regulate a position of each wire along a direction, in which a plurality of wires are aligned in parallel, and provided to the wire pullout mechanism.

(11) The binding facility according to any one of (4) to (6), wherein the wire feeding mechanism includes a guide part configured to regulate a position of each wire along a direction, in which a plurality of wires are aligned in parallel, and provided between the wire pullout mechanism and the reel and/or between the wire pullout mechanism and the wire pullback mechanism.

(12) The binding facility according to (11), wherein the guide part includes a first guide portion configured to regulate moving of the plurality of wires away from each other along the direction in which the wires are aligned in parallel and a second guide portion configured to regulate moving of the plurality of wires toward each other along the direction in which the wires are aligned in parallel, at least between the wire pullout mechanism and the wire pullback mechanism.

(13) A wire feeding mechanism comprising: a wire pullout mechanism configured to pull out a wire from a reel on which the wire is wound, wherein the wire pullout mechanism is configured to pull out the wire from the reel, according to a surplus of the wire on a feeding path of the wire pulled out from the reel.

In the above invention, the wire is pulled out from the reel, according to the surplus of the wire occurring on the feeding path of the wire pulled out from the reel.

Thus, the wire can be pulled out from the reel, according to the surplus of the wire occurring on the feeding path of the wire pulled out from the reel.

(14) The wire feeding mechanism according to (13), wherein when a load applied to the wire on a downstream side of the wire pullout mechanism with respect to a feeding direction of the wire pulled out from the reel becomes greater than a load applied to the wire on an upstream side of the wire pullout mechanism, the wire is pulled out from the reel according to the surplus of the wire.

(15) The wire feeding mechanism according to (13), further comprising a feeding amount detection unit configured to detect a feeding amount of the wire on the feeding path of the wire pulled out from the reel, wherein the wire pullout mechanism is configured to pull out the wire corresponding to the surplus of the wire from the reel, according to a feeding amount of the wire detected by the feeding amount detection unit.

(16) A binding facility comprising: a binding mechanism configured to bind a binding target with a wire; a reel accommodation part in which a reel having the wire wound thereon is accommodated; and a wire feeding mechanism configured to feed the wire from the reel accommodated in the reel accommodation part to the binding mechanism, wherein the binding mechanism includes a wire feeding unit configured to feed the wire in a first direction to wind the wire around the binding target, to feed the wire wound around the binding target in a second direction opposite to the first direction, and to wind the wire on the binding target, and a wire guide configured to guide the wire, which is fed to the wire feeding unit, and to suppress the wire from coming off from the wire feeding unit.

In the above invention, the wire guide configured to guide the wire that is fed to the wire feeding unit is configured to suppress the wire from coming off from the wire feeding unit.

Thus, even when the binding mechanism moves with respect to the wire feeding mechanism, it is possible to suppress the wire from coming off from the wire feeding unit and to guide the wire to the wire feeding unit.

(17) The binding facility according to (16), wherein the wire feeding unit includes a pair of feeding members configured to feed the wire by a rotating operation, and wherein the wire guide includes a wire position regulation part configured to regulate a position of the wire along axial directions of rotations of the feeding members.

(18) The binding facility according to (17), wherein the wire guide is configured so that an upstream side opening to which the wire fed from the wire feeding mechanism is introduced has an opening area larger than that of a downstream side opening, with respect to a feeding direction of the wire that is fed from the wire feeding mechanism to the wire feeding unit.

(19) The binding facility according to (18), wherein the wire position regulation part is constituted by the downstream side opening.

(20) The binding facility according to any one of (16) to (19), wherein the binding mechanism is movable with respect to the reel accommodation part.

(21) The binding facility according to any one of (16) to (20), wherein the wire guide is configured so that an opening area on an introduction side for the wire that is fed from the wire feeding mechanism is largest and the opening area is reduced from the introduction side.

(22) The binding facility according to any one of (16) to (21), wherein the binding mechanism is configured to bind the binding target with a plurality of wires, wherein the wire feeding unit is configured to feed the plurality of wires aligned in parallel in a radial direction, and wherein the wire guide is configured so that a downstream side opening with respect to a feeding direction of the plurality of wires that are fed from the wire feeding mechanism regulates a radial orientation of the plurality of wires.

(23) A binding facility comprising: a binding machine configured to bind a binding target with a wire; an accommodation part in which the wire is accommodated to be able to be pulled out; and a wire feeding mechanism configured to pull out the wire accommodated in the accommodation part, wherein the binding machine includes a main body, a wire feeding unit provided in the main body and configured to feed the wire pulled out from the accommodation part, a curl forming unit exposed on an upper part of the main body and configured to constitute a path along which the wire fed by the wire feeding unit is wound around the binding target, a binding unit provided in the main body, including a wire engaging body configured to engage the wire wound around the binding target, and configured to twist the wire wound on the binding target by rotating the wire engaging body, a wire engaging body exposing part configured to communicate with an opening provided on the upper part of the main body and configured to expose a part of the wire engaging body in the main body, and a discharge unit configured to discharge foreign matters in the wire engaging body exposing part to an outside of the main body.

In the above invention, the foreign matters introduced into the wire engaging body exposing part from the opening of the binding machine and the foreign matters generated in the wire engaging body exposing part can be discharged to an outside of the main body.

(24) The binding facility according to (23), wherein the discharge unit includes an opening provided to the main body and formed to communicate with the wire engaging body exposing part.

(25) The binding facility according to (24), wherein the discharge unit includes a discharge guiding portion having, on the same plane, the opening formed to communicate with the wire engaging body exposing part and at least a part of a wall portion constituting the wire engaging body exposing part.

(26) The binding facility according to (24) or (25), wherein a cover part configured to cover a part or all of the opening formed to communicate with the wire engaging body exposing part is detachably attached to the discharge unit.

(27) The binding facility according to any one of (24) to (26), wherein the discharge unit has such a shape that the opening provided to the main body and formed to communicate with the wire engaging body exposing part includes diametrical portions of a virtual circle having a diameter of 10 mm or greater in two directions.

(28) The binding facility according to any one of (24) to (27), wherein the opening of the discharge unit provided to the main body and formed to communicate with the wire engaging body exposing part has a length in a direction along an axial direction of a rotary shaft of the wire engaging body and a length in a direction orthogonal to the axial direction of the rotary shaft, which are equal to or greater than 10 mm and equal to or smaller than 50 mm, respectively.

(29) A binding machine comprising: a main body; a wire feeding unit provided in the main body and configured to feed a wire pulled out from an accommodation part; a curl forming unit exposed on a front part of the main body and configured to constitute a path along which the wire fed by the wire feeding unit is wound around a binding target; a binding unit provided in the main body, including a wire engaging body configured to engage the wire wound around the binding target, and configured to twist the wire wound on the binding target by rotating the wire engaging body; a wire engaging body exposing part configured to communicate with an opening provided on the front part of the main body and configured to expose a part of the wire engaging body in the main body; and a discharge unit configured to discharge foreign matters in the wire engaging body exposing part to an outside of the main body.

In the above invention, the foreign matters introduced into the wire engaging body exposing part from the opening of the binding machine and the foreign matters generated in the wire engaging body exposing part can be discharged to an outside of the main body.

(30) The binding machine according to (29), wherein the discharge unit includes an opening provided to the main body and formed to communicate with the wire engaging body exposing part.

(31) The binding machine according to (30), wherein the discharge unit includes a discharge guiding portion having, on the same plane, the opening formed to communicate with the wire engaging body exposing part and at least a part of a wall portion constituting the wire engaging body exposing part.

(32) The binding machine according to (30) or (31), wherein a cover part configured to cover a part or all of the opening formed to communicate with the wire engaging body exposing part is detachably attached to the discharge unit.

(33) The binding machine according to any one of (30) to (32), wherein the discharge unit has such a shape that the opening provided to the main body and formed to communicate with the wire engaging body exposing part includes diametrical portions of a virtual circle having a diameter of 10 mm in two directions.

(34) The binding machine according to any one of (30) to (33), wherein the opening of the discharge unit provided to the main body and formed to communicate with the wire engaging body exposing part has a length in a direction along an axial direction of a rotary shaft of the wire engaging body and a length in a direction orthogonal to the axial direction of the rotary shaft, which are equal to or greater than 10 mm and equal to or smaller than 50 mm, respectively.

What is claimed is:

1. A binding facility comprising:

a binding mechanism configured to bind a binding target with a plurality of wires, the binding mechanism including:

a wire feeding part which includes a pair of feeding gears configured to sandwich and simultaneously feed the plurality of wires and which is configured to feed the plurality of wires in a forward direction and a reverse direction, a wire guide configured to guide the plurality of wires that are fed to the wire feeding part, a curl forming part configured to form a path along which the plurality of wires fed by the wire feeding part is to be wound around the binding target, a cutting part configured to cut the plurality of wires wound on the binding target, a binding part configured to twist the plurality of wires wound on the binding target, and a feeding motor configured to drive the feeding gears;

a reel accommodation part in which a plurality of reels, each having one wire wound thereon, are accommodated; and a wire feeding mechanism spaced from the binding mechanism and the reel accommodation part, the wire feeding mechanism is configured to feed each wire from the plurality of reels accommodated in the reel accommodation part to the binding mechanism, wherein the wire feeding mechanism includes a wire pullout mechanism configured to feed the wires and provided between the binding mechanism and the reel accommodation part, and wherein the wire pullout mechanism has a pullout roller configured to pull the wires fed to the binding mechanism, and a drive part configured to move the pullout roller.

2. The binding facility according to claim 1, wherein the reel accommodation part is configured so that the plurality of reels are accommodated in a state where shafts thereof are horizontally oriented with respect to a vertical direction.

3. The binding facility according to claim 1, wherein the reel accommodation part is configured so that the plurality of reels are accommodated in horizontal direction with respect to a vertical direction in a state where shafts thereof are vertically oriented with respect to the vertical direction.

4. The binding facility according to claim 1, wherein the wire feeding mechanism includes a guide part configured to regulate a position of each wire along a direction in which the plurality of wires are aligned in parallel.

5. The binding facility according to claim 4, wherein the guide part is provided between the plurality of wires aligned in parallel.

6. The binding facility according to claim 4, wherein the guide part is provided on an outer side along the direction in which the plurality of wires are aligned in parallel, with respect to the wire on the outermost side of the plurality of wires aligned in parallel.

7. The binding facility according to claim 1, wherein the binding mechanism includes the wire feeding part, the wire feeding part configured to sandwich and simultaneously feed the plurality of wires from the plurality of reels.

* * * * *